US010525487B2

(12) United States Patent
Helmsderfer et al.

(10) Patent No.: US 10,525,487 B2
(45) Date of Patent: Jan. 7, 2020

(54) GARDEN WATERING DEVICE

(71) Applicants: John A. Helmsderfer, Cincinnati, OH (US); Nathan Maggard, Cincinnati, OH (US); Andrew Ahr, Cincinnati, OH (US); Nicholas Jeffers, Marysville, OH (US); Yani Deros, Phoenix, AZ (US); Craig Ovans, Chandler, AZ (US)

(72) Inventors: John A. Helmsderfer, Cincinnati, OH (US); Nathan Maggard, Cincinnati, OH (US); Andrew Ahr, Cincinnati, OH (US); Nicholas Jeffers, Marysville, OH (US); Yani Deros, Phoenix, AZ (US); Craig Ovans, Chandler, AZ (US)

(73) Assignee: Partners In Innovation Limited, LLC, Cincinnati, OH (US)

( * ) Notice: Subject to any disclaimer, the term of this patent is extended or adjusted under 35 U.S.C. 154(b) by 0 days.

(21) Appl. No.: 15/670,598

(22) Filed: Aug. 7, 2017

(65) Prior Publication Data

US 2017/0333919 A1 Nov. 23, 2017

Related U.S. Application Data

(63) Continuation of application No. 13/526,361, filed on Jun. 18, 2012, now Pat. No. 9,724,708, which is a
(Continued)

(51) Int. Cl.
*B05B 1/00* (2006.01)
*B05B 1/02* (2006.01)
(Continued)

(52) U.S. Cl.
CPC ..... *B05B 1/02* (2013.01); *B05B 1/14* (2013.01); *B05B 1/16* (2013.01); *B05B 1/1654* (2013.01);
(Continued)

(58) Field of Classification Search
CPC ..... B05B 1/645; B05B 1/1654; B05B 3/044
(Continued)

(56) References Cited

U.S. PATENT DOCUMENTS 924,519 A 6/1909 Wooding
941,109 A 11/1909 Sutherland
(Continued)

FOREIGN PATENT DOCUMENTS

EP 0826427 A2 3/1998
WO 2011075660 A1 6/2011

OTHER PUBLICATIONS

Eighteen-page International Search Report and Written Opinion dated Feb. 14, 2011 for PCT/US2010/061063.
(Continued)

*Primary Examiner* — Viet Le
(74) *Attorney, Agent, or Firm* — Wood Herron & Evans LLP

(57) ABSTRACT

A garden watering device is configured for use in handheld and ground-based operation. The garden watering device includes a device body having a water inlet and a handle. The garden watering device also includes at least one water distribution member adapted to spray in multiple patterns. In one example, the at least one water distribution member includes an elongate tube with a series of discharge outlets and a multi-pattern head with at least one flow outlet. The garden watering device also includes a flow route selector that routes water to either the elongate tube or the multi-pattern head.

12 Claims, 89 Drawing Sheets

Related U.S. Application Data continuation of application No. PCT/US2010/061063, filed on Dec. 17, 2010, and a continuation-in-part of application No. 13/184,325, filed on Jul. 15, 2011, now Pat. No. 8,910,887.

(60) Provisional application No. 61/498,411, filed on Jun. 17, 2011, provisional application No. 61/287,524, filed on Dec. 17, 2009, provisional application No. 61/287,537, filed on Dec. 17, 2009, provisional application No. 61/287,519, filed on Dec. 17, 2009, provisional application No. 61/364,660, filed on Jul. 15, 2010.

(51) Int. Cl.

| | |
|---|---|
| ***B05B 15/625*** | (2018.01) |
| ***B05B 15/658*** | (2018.01) |
| ***B05B 15/652*** | (2018.01) |
| ***B05B 1/16*** | (2006.01) |
| ***B05B 1/14*** | (2006.01) |
| ***B05B 1/18*** | (2006.01) |
| ***B05B 3/04*** | (2006.01) |

(52) U.S. Cl.
CPC ..... *B05B 1/18* (2013.01); *B05B 3/0422* (2013.01); *B05B 15/625* (2018.02); *B05B 15/652* (2018.02); *B05B 15/658* (2018.02); *B05B 3/04* (2013.01)

(58) Field of Classification Search
USPC ..... 239/242, 394, 392, 393, 397, 436, 444, 239/438, 446
See application file for complete search history.

(56) References Cited

U.S. PATENT DOCUMENTS 1,007,657 A * 10/1911 Freund ..... B05B 15/625 248/83
1,026,742 A * 5/1912 French ..... B05B 1/1636 239/446
1,031,176 A 7/1912 Gilpin
1,058,189 A * 4/1913 McBoyle ..... B05B 15/622 239/275
1,078,817 A * 11/1913 Austin ..... B05B 15/622 248/85
1,168,219 A * 1/1916 Miller ..... B05B 1/18 239/436
1,410,434 A * 3/1922 Werstler ..... B05B 3/044 239/243
1,517,664 A * 12/1924 Bergquist ..... B05B 1/1672 239/242
1,566,232 A 12/1925 Schreiter
1,612,326 A * 12/1926 Taylor ..... B05B 1/1636 137/874
1,696,385 A * 12/1928 Coles ..... B05B 3/044 239/236
1,764,758 A * 6/1930 Slining ..... B05B 3/044 239/242
1,942,271 A * 1/1934 Barrington ..... B05B 3/044 239/242
2,053,931 A 9/1936 Work
2,620,232 A * 12/1952 King ..... B05B 3/16 239/229
2,770,826 A 11/1956 Curfman
2,943,796 A * 7/1960 Smith ..... B05B 3/044 239/237
2,969,922 A * 1/1961 Butler ..... B05B 3/044 239/237
3,115,305 A * 12/1963 Rinkewich ..... B05B 3/044 239/242
3,332,624 A 7/1967 Rinkcwich
3,354,730 A 11/1967 Thompson
3,630,450 A 12/1971 Stephany et al.
3,941,109 A 3/1976 Schmid
4,130,135 A 12/1978 Moore
4,347,981 A * 9/1982 Hayes ..... B05B 1/1654 239/394
4,421,276 A * 12/1983 Rodgers ..... B05B 15/60 239/273
4,708,291 A 11/1987 Grundy
4,903,897 A * 2/1990 Hayes ..... B05B 1/1654 239/394
5,160,093 A * 11/1992 Battaglia ..... B05B 1/1609 239/444
5,174,501 A 12/1992 Hadar
5,305,956 A 4/1994 Wang
5,337,957 A 8/1994 Olson
D355,476 S 2/1995 Schon
5,462,227 A * 10/1995 Ping ..... B05B 3/0413 239/227
5,947,388 A 9/1999 Woodruff
D421,639 S 3/2000 Clivio
D426,867 S 6/2000 Wang
6,123,272 A 9/2000 Havican et al.
6,264,121 B1 7/2001 McClary
6,334,577 B1 * 1/2002 Chih ..... A62C 31/02 239/242
6,390,391 B1 5/2002 Ulin
6,398,185 B1 6/2002 Wang
6,491,062 B1 12/2002 Croft
6,554,209 B2 * 4/2003 Djordjevic ..... B05B 9/01 239/276
6,568,603 B2 * 5/2003 Chao ..... B05B 1/1627 239/242
6,619,570 B1 9/2003 Ericksen et al.
6,663,022 B1 * 12/2003 Baker ..... B05B 12/002 239/288
6,708,722 B1 3/2004 Goodenough
6,712,294 B1 3/2004 Wang
7,014,128 B2 3/2006 Leung
7,028,984 B2 4/2006 Wang
7,140,561 B2 11/2006 Heren et al.
D536,062 S 1/2007 Hester
7,252,246 B2 8/2007 Heren et al.
7,448,558 B2 11/2008 Wang
D607,971 S 1/2010 Barnard et al.
D608,412 S 1/2010 Barnard et al.
D608,413 S 1/2010 Barnard et al.
7,708,210 B2 5/2010 Griffen
7,779,852 B2 8/2010 Burlage et al.
7,866,333 B2 1/2011 Boe et al.
7,866,576 B1 1/2011 Farley
D668,320 S 10/2012 Weihreter
D689,591 S 9/2013 Ovans et al.
D689,592 S 9/2013 Ovans et al.
D700,275 S 2/2014 Ovans et al.
8,910,887 B2 * 12/2014 Helmsderfer ..... B05B 1/02 239/289
9,597,699 B2 3/2017 Helmsderfer et al.
9,724,708 B2 8/2017 Helmsderfer et al.
9,764,338 B2 * 9/2017 Wang ..... B05B 15/68
9,968,950 B2 * 5/2018 Davie ..... A01M 7/005
2004/0124281 A1 * 7/2004 Leung ..... B05B 3/044 239/548
2004/0222320 A1 * 11/2004 Wu ..... B05B 1/3013 239/526
2005/0082381 A1 * 4/2005 Wang ..... B05B 3/0436 239/3
2006/0157583 A1 * 7/2006 Huang ..... B05B 3/044 239/242
2006/0214023 A1 * 9/2006 Collins ..... B05B 1/1636 239/242
2006/0249595 A1 * 11/2006 Lipscomb ..... B05B 1/16 239/242
2007/0290071 A1 * 12/2007 Wang ..... B05B 1/1654 239/275
2008/0111001 A1 5/2008 Elmer et al.
2009/0293189 A1 12/2009 Somerville
2012/0036091 A1 2/2012 Cook

(56) References Cited

U.S. PATENT DOCUMENTS

| | | | | |
|---|---|---|---|---|
| 2012/0126027 | A1 | 5/2012 | Helmsderfer et al. | |
| 2012/0223153 | A1* | 9/2012 | Helmsderfer | B05B 1/1654 239/1 |
| 2012/0321445 | A1* | 12/2012 | Zhou | E03C 1/0408 415/122.1 |
| 2013/0037624 | A1* | 2/2013 | Helmsderfer | B05B 1/02 239/66 |

OTHER PUBLICATIONS

U.S. Patent and Trademark Office, Office Action in U.S. Appl. No. 13/526,361, dated Mar. 17, 2016.

* cited by examiner

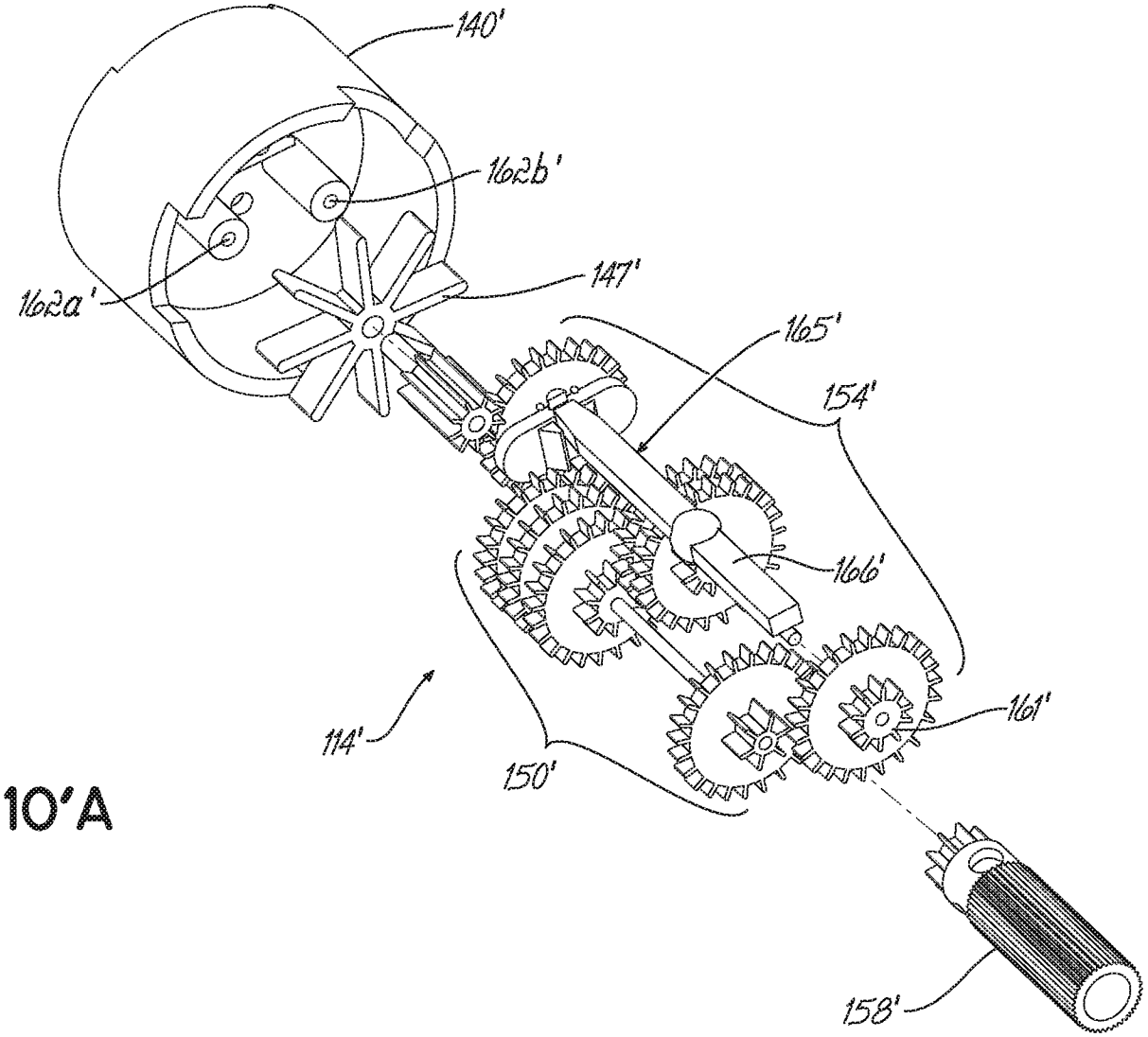
FIG. 10'A

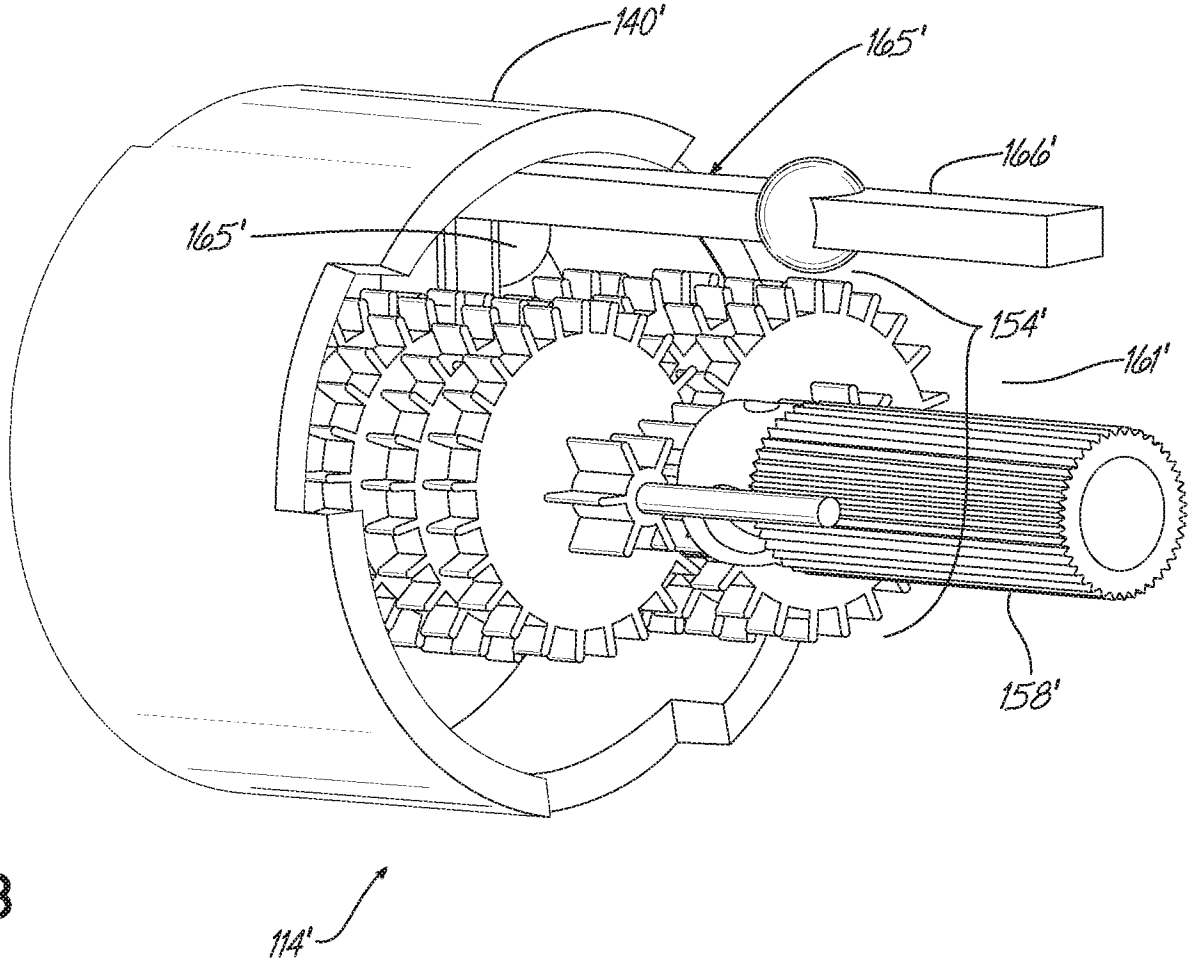
FIG. 10'B

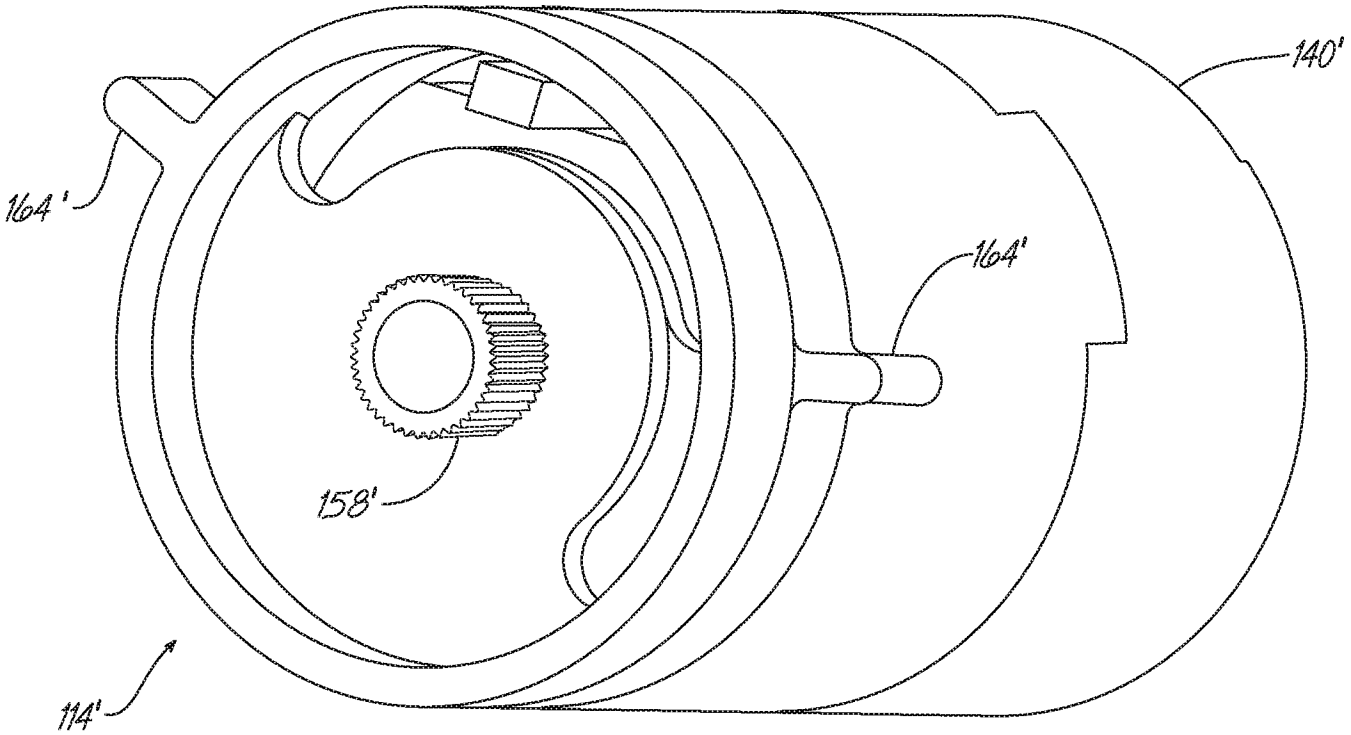
FIG. 10'C

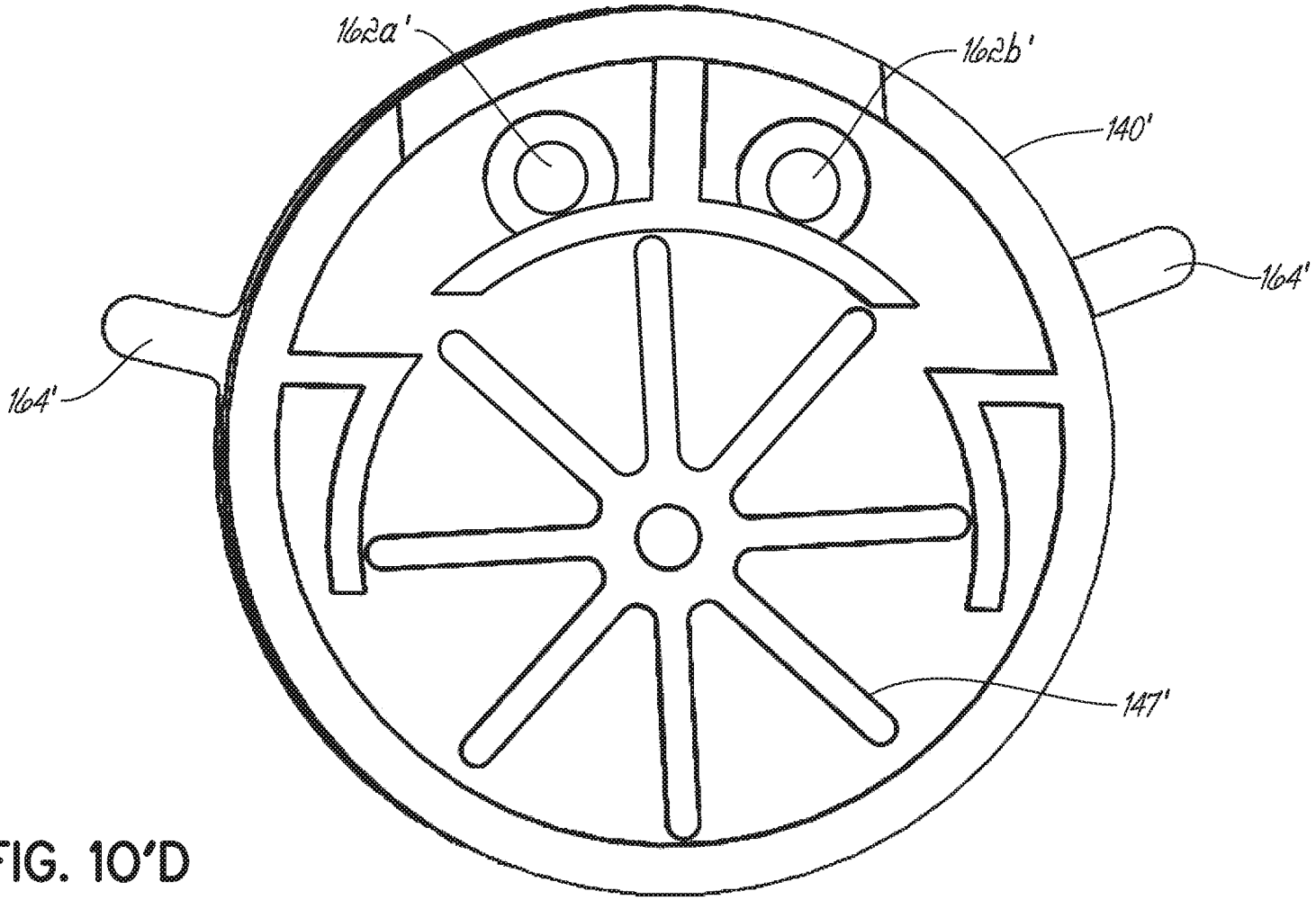
FIG. 10'D

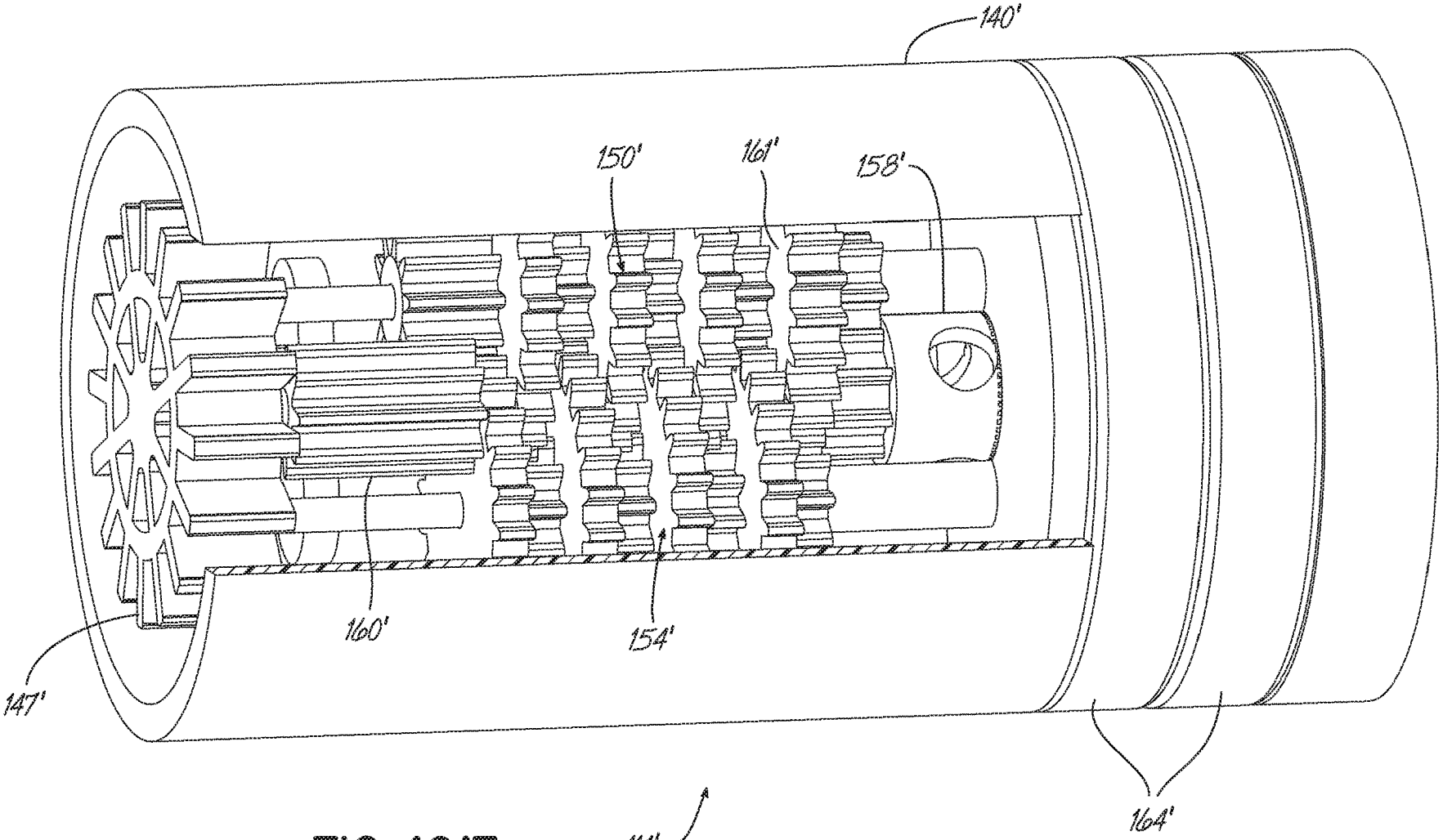
FIG. 10'E 400
402
404
430
431
432
433
434
435
X

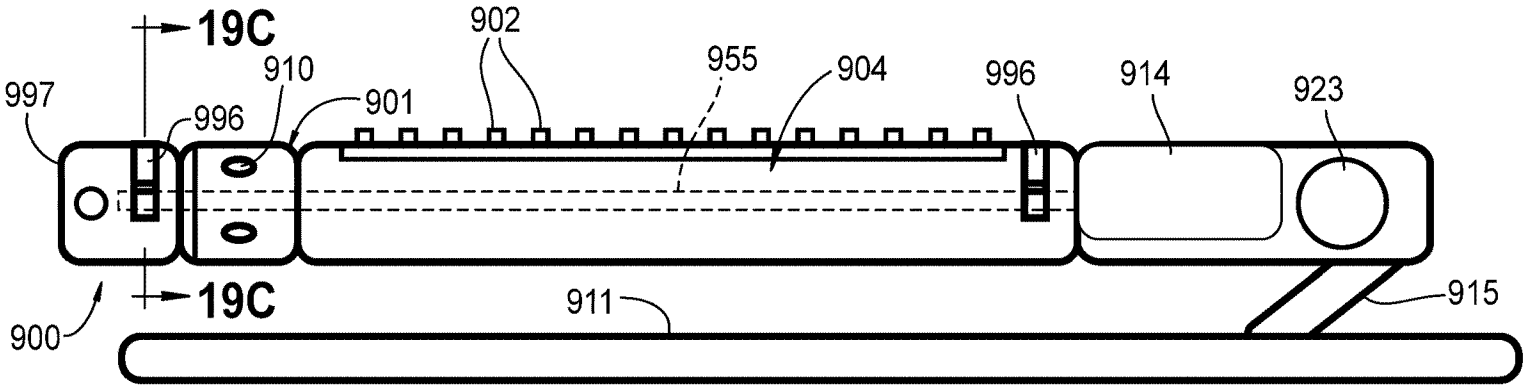
FIGURE 19B
FIGURE 19A
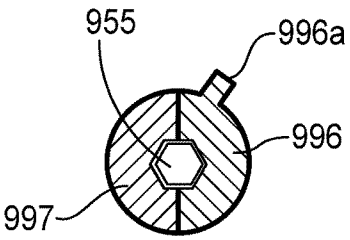
FIGURE 19C

GARDEN WATERING DEVICE

RELATED APPLICATIONS

This application is a continuation of U.S. patent application Ser. No. 13/526,361, entitled "GARDEN WATERING DEVICE", filed Jun. 18, 2012.

U.S. patent application Ser. No. 13/526,361 is a Non-Provisional application, and claims priority of U.S. Provisional Application No. 61/498,411, which was filed on Jun. 17, 2011, and which is incorporated herein by reference in its entirety.

U.S. patent application Ser. No. 13/526,361 is also a continuation-in-part of International Application No. PCT/US2010/061063, which was filed Dec. 17, 2010 and claimed priority of U.S. Provisional Patent Application No. 61/287,537 filed Dec. 17, 2009, U.S. Provisional Patent Application No. 61/287,519 filed Dec. 17, 2009, U.S. Provisional Patent Application No. 61/287,524 filed Dec. 17, 2009, and U.S. Provisional Patent Application No. 61/364,680 filed Jul. 15, 2010

U.S. patent application Ser. No. 13/526,361 is also a continuation-in-part of U.S. application Ser. No. 13/184,325, which was filed Jul. 15, 2011 and issued as U.S. patent application Ser. No. 13/526,361.

All of the application(s) and patent(s) noted herein and above are incorporated by reference in their entireties.

FIELD OF THE INVENTION

The present invention relates to garden watering devices and, more particularly, to a water distributing multi-pattern sprinkler that can function as both a ground-based sprinkler or a handheld sprinkler and washing device.

BACKGROUND OF THE INVENTION

For people who live on properties with the need to maintain large outdoor living spaces, automobiles, and pets, there is a need to create a device capable of watering plants that can serve a multitude of functions. For example, there is a need for a device that can serve as a lawn watering device as well as a spray device for washing automobiles, pets, and other outdoor surfaces. In particular, there is a need for a device that serves as both a handheld watering device and a ground based lawn sprinkler, thus eliminating the need to own multiple watering devices that each serves a particular function. One could instead own a single device capable of serving multiple functions.

Having a single device capable of serving multiple watering functions would be advantageous for multiple reasons. First, it is inconvenient to have to shut off the water supply when changing devices for different watering tasks. In most cases, the water shut off (the hose bib) is adjacent to the dwelling or building. The operator must therefore walk back to the hose bib and shut off the water supply in order to exchange devices. If the residual water pressure has not been discharged, the hose may spray on the operator as the device is disconnected. Furthermore, these separate devices for different watering tasks must be retrieved and stored upon each device exchange performed by the operator. Another point of difficulty for the operator may be experienced by individuals that have physical limitations with respect to their ability to twist or grab small objects such as a hose fitting. Connecting the hose can be especially difficult when the fitting is wet or the strength of the connection has been increased by the pressure of water running through the line.

There have been devices that have been created to address some of these problems. For example, U.S. Pat. No. 5,160,093 to Battaglia describes a multi-purpose handheld watering device featuring two sprayer heads, one of which is oriented in a forward direction when the device is to be used in handheld operation, and the other oriented upwardly for when the device is operated as a ground based lawn sprinkler. The device also features a pivoting spike which may be folded into the sprinkler body or pointed outward, providing the device with a means of support for when the device is used as a ground based lawn sprinkler.

However, these devices suffer from several drawbacks. Some conventional devices are only capable of watering a small to medium area of the lawn. They are also only capable of watering the lawn in a fixed pattern. This means that should the device be placed at the edge of a lawn, there would be no means of limiting the flow of water to only the lawn area, and it would unnecessarily spill over to other areas or provide inadequate coverage over the desired lawn area. A further drawback in some of the prior devices is the required use of a spike inserted into the ground to support the device when it is to be used in ground based operation. This prevents the device from properly being used for ground based operation if the device is to be used on hard surfaces, such as rocky areas or areas with dense tree roots. Moreover, the inclusion of a spike on the prior devices could damage an automobile or injure a pet if these devices were used for washing purposes other than lawn watering.

While individuals of all ages enjoy gardening, a significant percentage of active gardeners are at an age where the physical requirements to use a particular tool is a consideration. It is generally understood in the art that the combination of an oscillating elongated sprinkler with a hand-held wand sprinkler is not practicable, because a device incorporating the benefits of these components in an unaltered form would result in an overall length and diameter that is excessive for a handheld sprinkler.

Additionally, such devices would exceed the standard dimensions for oscillating sprinkler products found on store shelves. Shelf spacing, planograms and other merchandising designs take the standard oscillating sprinkler length dimension into account. Therefore, the length of a combination hand-held wand and ground-based oscillating sprinkler, according to the knowledge of the prior art, exceeds commercial practicability.

Thus, it would be desirable to provide a garden watering device that addresses these and other concerns by incorporating hand-held and ground-based sprinkler functionality in a single device that is appropriate for multiple gardening tasks and is still manageable for a typical gardener.

SUMMARY OF THE INVENTION

Various embodiments of the present invention provide the consumer the benefits of different types of watering products in a length and at a weight that can be comfortably managed by a typical gardener.

According to the present invention, a garden watering device is provided that is capable of performing multiple functions. In one embodiment, the garden watering device includes a device body, a water inlet, and at least one multi-pattern water distribution head. The device body includes a support structure having at least two legs configured to support the multi-pattern water distribution head on the ground in a ground-based operation. The device body also includes a handle disposed between the water inlet and the multi-pattern water distribution head and configured to support the multi-pattern water distribution head in a handheld operation. The handle is integrated with at least one of the legs of the support structure.

In another embodiment, the garden watering device includes a device body, a first water distribution member, a second water distribution member, and a flow selector. The device body includes a water inlet. The first water distribution member is an elongate tube capable of oscillation. The second water distribution member is a fixed or movable multi-pattern head. The flow selector directs flow selectively into the elongate tube, the multi-pattern head, or neither. In this regard, the garden watering device may be configured for ground-based watering an area of varying sizes in a lawn, and may also be configured for handheld watering or washing operations.

The garden watering device may further include a telescoping member coupled to the device body. The telescoping member allows the multi-pattern head to be extended outwardly from the device body for additional watering tasks. The garden watering device may alternatively include a device body having a first body member and a second body member coupled to the first body member at an articulating hinge joint. The second body member may rotate with respect to the first body member between a folded position and an unfolded position for various watering tasks. For example, the elongate tube may be reoriented for ground-based operation such that the elongate tube sprays water in a direction substantially parallel to the ground surface instead of substantially normal to the ground surface.

The second water distribution member may extend integrally from a free end of the elongate tube opposite the handle. In this regard, the second water distribution member may be rotatable about the longitudinal axis of the elongate tube. Alternatively, the second water distribution member may be spaced from the elongate tube. In this regard, the second water distribution member may include two fixed multi-pattern heads directed in opposing directions. The second water distribution member may also include one pivotal multi-pattern head configured to be selectively locked in various positions or be free-floating with respect to the device body during handheld operation. In another embodiment, the garden watering device includes a device body and a multi-pattern turret-type water distribution head. The device body includes a water inlet, a U-shaped body member, and a handle disposed between the water inlet and the U-shaped body member. The water distribution head is rotatably coupled to the device body at the U-shaped body member by at least one hollow axle. In this regard, the U-shaped body member partially surrounds an outer periphery of the water distribution head. The axle is configured to deliver water from the U-shaped body member to the water distribution head, and the axle permits the water distribution head to rotate 360 degrees with respect to the U-shaped body member.

The garden watering device may also include an articulating joint coupled to the hollow axle and the U-shaped body member. The articulating joint maintains the angular position of the water distribution head with respect to the U-shaped body member. The articulating joint may also be disengaged so that the water distribution head is free-floating with respect to the U-shaped body member. The articulating joint may be configured to automatically disengage when the water distribution head engages an undulating contour of a surface to be washed or watered.

The water distribution head may include a dial having a plurality of flow outlets corresponding to a variety of water discharge patterns. The garden watering device may also include a valve control at the handle for selectively opening and closing water flow through the device body. The device body may further include a support structure extending from the handle such that the garden watering device may be supported on any ground surface by the support structure and the U-shaped body member. The water distribution head may also include auxiliary devices including a scraper and a squeegee for use in the handheld operation.

In yet another embodiment, the garden watering device includes a pistol-type device body, a water distribution head coupled to the body member, and a water inlet. The water distribution head includes a rotatable dial having a plurality of flow outlets. The device body includes a handle disposed between the water inlet and the water distribution head, and a support structure configured to support the garden watering device in ground-based operation. More particularly, the support structure includes at least one pivoting leg rotatable between a first position flush against the handle and a second position extending away from the handle. Alternatively, the support structure includes a stabilization bar which pivots from a first position adjacent the device body to a second position extending away from the device body. The support structure and handle are configured to support the water distribution head in a ground-based operation such that the water distribution head is directed upward and generally perpendicular to the ground.

The handle of the garden watering device may also include a trigger which may be depressed to deliver water flow from the handle to the water distribution head. The garden watering device may include a locking collar coupled for rotation with the handle. The locking collar moves from a locked position where the locking collar forces the trigger to stay depressed (i.e., for ground-based operation) and an unlocked position where the locking collar does not affect the operation of the trigger.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

FIGS. 10'A-10'E show an alternate embodiment of a gear box in accordance with an embodiment of the present invention.

FIG. 19A is a side view of another embodiment of a garden watering device in a first position.

FIG. 19B is a side view of the garden watering device of FIG. 19A in a second position.

FIG. 19C is a front cross-sectional view of a portion of the garden watering device of FIG. 19A.

DETAILED DESCRIPTION

Figure 1:
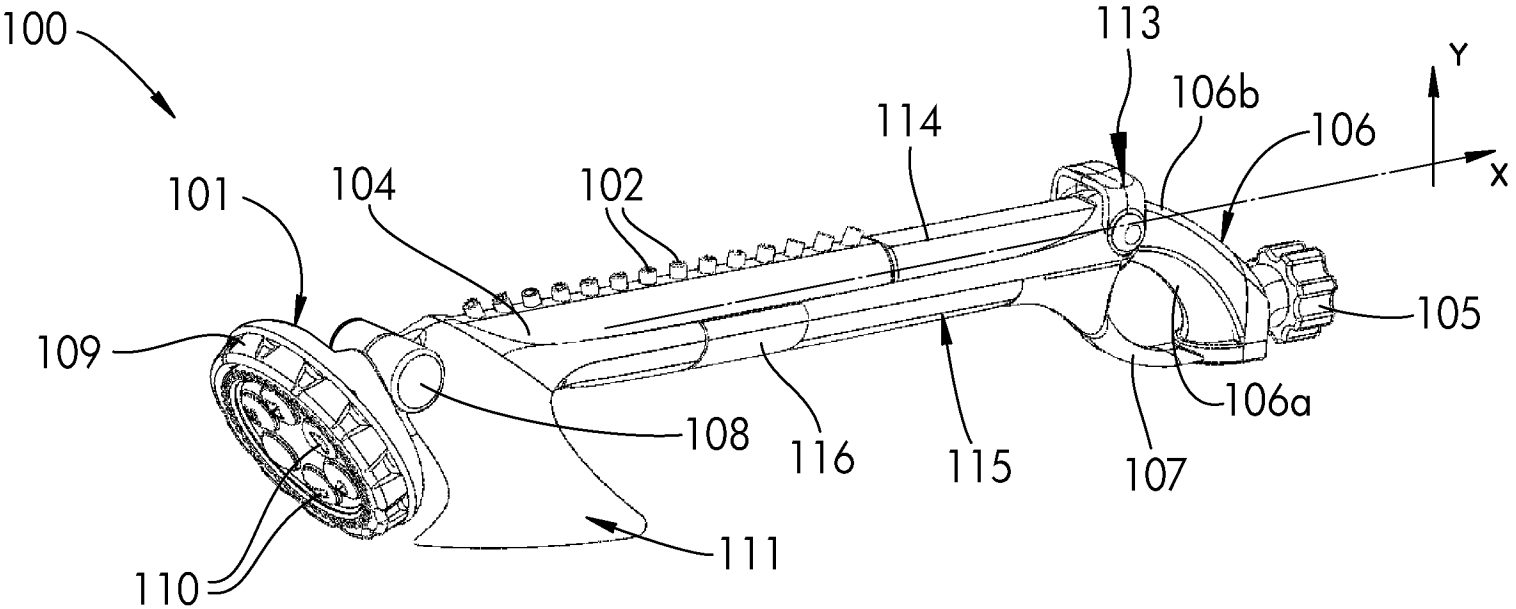
FIG. 1 is a perspective view of a garden watering device in accordance with one embodiment of the invention.
Figure 2:
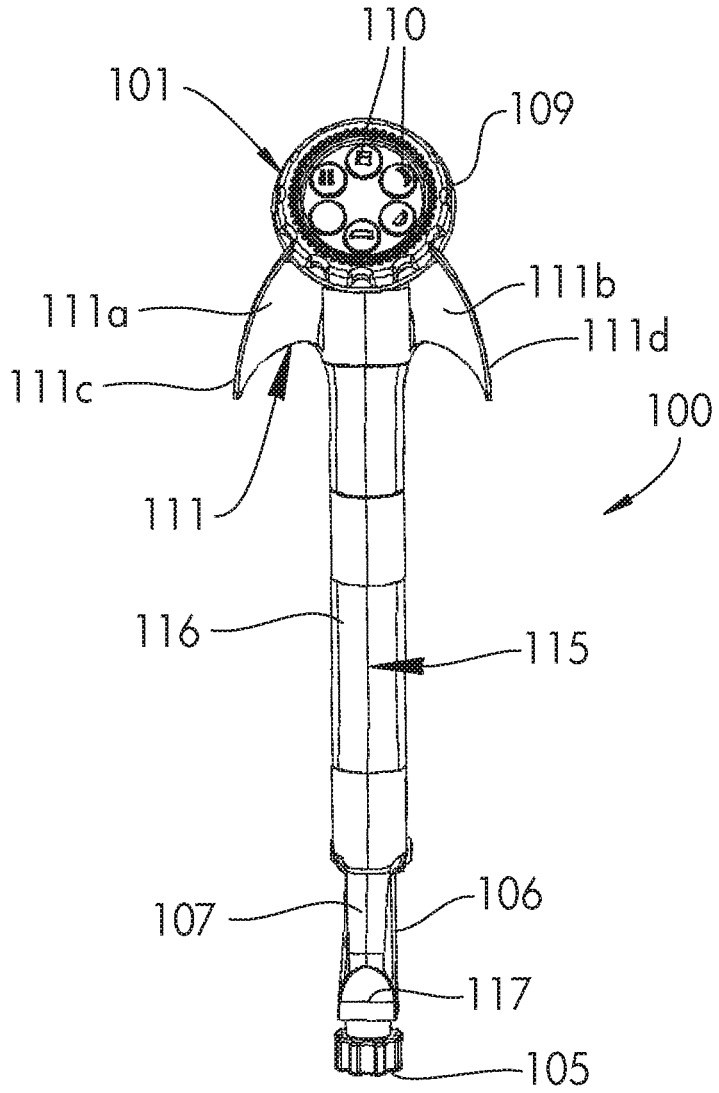
FIG. 2 is a bottom view of the garden watering device of FIG. 1.

One embodiment of a garden watering device 100 is shown in FIGS. 1-11. The garden watering device 100 includes a device body 115, a first water distribution member 104, and a second water distribution member 101. The first water distribution member 104 is an elongate tube configured to oscillate. The second water distribution member 101 is a turret-style multi-pattern head. The garden watering device 100 further includes a flow route selector 113 that selectively directs water to each of the elongate tube 104 and the multi-pattern head 101. The elongate tube 104 may be operatively coupled to an oscillation device 114 configured to rotate the elongate tube 104 to provide water flow over a large area in a ground-based operation of the garden watering device 100. The multi-pattern head 101 is capable of being aimed upwardly to provide water flow over a small to medium area of land in a ground-based operation of the garden watering device 100. Alternatively, the pivoting turret head 101 may be aimed downwardly to provide a directed stream of water in a handheld operation of the garden watering device 100. To this end, an operator can use the garden watering device 100 for many kinds of watering applications.

It will be understood that in this specification, directional terms such as "upwardly" and "downwardly" are provided for explanatory purposes only and generally refer to directions encountered during ground-based and handheld operation of this and other embodiments disclosed herein. FIG. 1 further illustrates another directional notation used herein. The elongate tube 104 extends along a longitudinal axis X that defines an axial direction of the garden watering device

100. The longitudinal axis X is generally parallel to the plane of the ground in a ground-based operation. The elongate tube 104 includes flow outlets 102 which direct water to flow in a direction substantially normal to the ground along a normal axis Y. Water flow along the normal axis Y is generally referred to as water flow in the normal direction of the garden watering device 100.

As shown in FIGS. 1-5B, the device body 115 includes a handle 106 and a water inlet coupling 105 which allows attachment of a garden hose to the garden watering device 100. The flow route selector 113 includes a lever 113*a* at the top of the handle 106 coupled to a valve 113*b* (not shown in FIGS. 1-5B) for controlling the flow of water from the water inlet coupling 105 through the garden watering device 100. The operation of the flow route selector 113 is provided in further detail below with reference to FIGS. 8A-9C. The device body 115 further includes a central body portion 116 extending from the handle 106 to the multi-pattern head 101. Central body portion 116 has the form of a cradle, but could also take the form of other structure for supporting the connection between oscillating bar 104 and gearbox 114, such as a support leg like the support leg 211 shown in FIG. 12B. In such a configuration, the otherwise cantilevered load at the connection between oscillating tube 104 and gearbox 114 is supported by the central body portion 116 at the end of oscillating tube 104 opposite the gearbox 114, such as between the oscillating tube 104 and the multi-pattern head 101. In addition, the central body portion 116 provides alignment support for the oscillating tube 104 and the gearbox 114. Moreover, central body portion 116 connects other elements of device 100, such as handle 106 and spray head 101, to serve as a basis for connecting these various components into a unitary device. The central body portion 116 connects the oscillation device 114 and the elongate tube 104.

Figure 3:
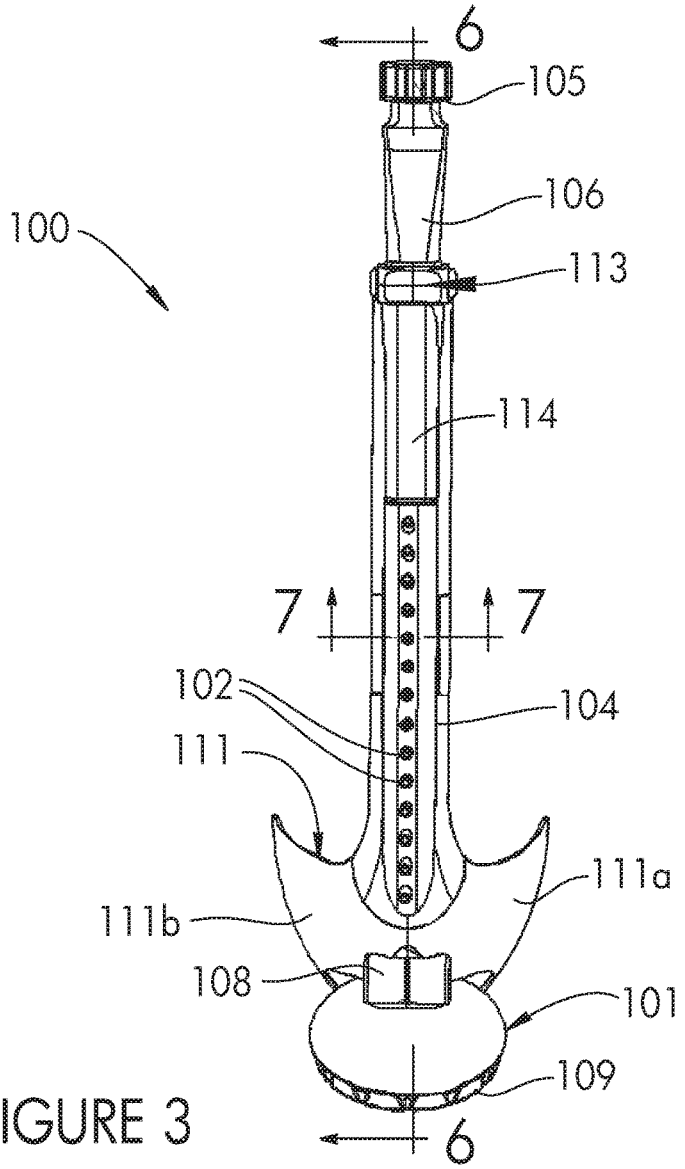
FIG. 3 is a top view of the garden watering device of FIG. 1.
Figure 4:
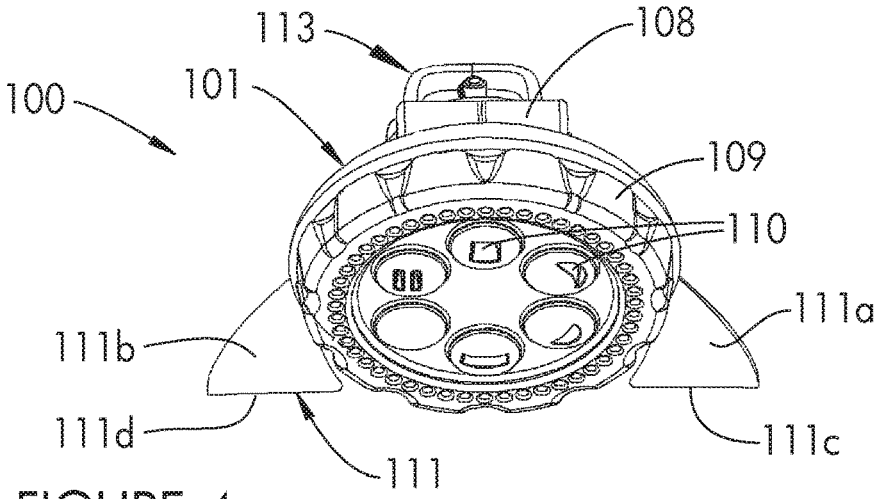
FIG. 4 is a front view of the garden watering device of FIG. 1.

At one end of the central body portion 116, the device body 115 includes a support leg 107 spaced from the handle 106 in a similar manner as a trigger guard in other sprinkler systems. The support leg 107 and the handle 106 are integral or partially integrated to form a generally planar bottom surface 117 defined by the generally tripedal arrangement of support leg 107 and the handle 106 shown most clearly in FIG. 2. In this regard, the handle 106 may include a trigger portion 106*a* facing towards the support leg 107 and a grip portion 106*b* facing outwardly and configured to be gripped by a user when moving the device 100 or during handheld operation. The support leg 107 is configured to contact the ground, while the trigger portion 106*a* and the grip portion 106*b* are spaced from the ground in a ground-based operation. At the opposite end of the central body portion 116 from the support leg 107 and the handle 106, the device body 115 includes a support structure 111 having a pair of support structure legs 111*a*, 111*b* that flare outwardly adjacent to the multi-position head 101 as shown in FIGS. 3 and 4. The pair of support structure legs 111*a*, 111*b* defines respective bottom ends 111*c*, 111*d* that are generally flat and in the same plane as the bottom surface 117 of the support leg 107 and handle 106. Consequently, the bottom surface 117 and bottom ends 111*c*, 111*d* collectively provide support for the garden watering device 100 to hold the device body 115 above the ground in a ground-based operation.

The spray head 101 in the embodiment shown is configured to nest generally between the support legs 111*a*, 111*b*. Such a nesting arrangement reduces the overall dimension of the device 100 and protects the spray head 101, which are advantages for packaging, shipping, and for storage. In addition, the pair of support legs 111*a*, 111*b* could be consolidated into a unitary support structure that would otherwise provide stability for the device such that when device 100 is placed on the ground, discharge outlets 102 in elongate tube 104 are pointed in an upward position.

The elongate tube 104 is oriented generally horizontally and parallel to the ground surface along the longitudinal axis X. The handle 106 extends coextensively with the elongate tube 104 and at least partially along the longitudinal axis X. The garden watering device 100 can therefore be supported on any type of surface without the use of a spike driven into the ground.

Figure 5A:
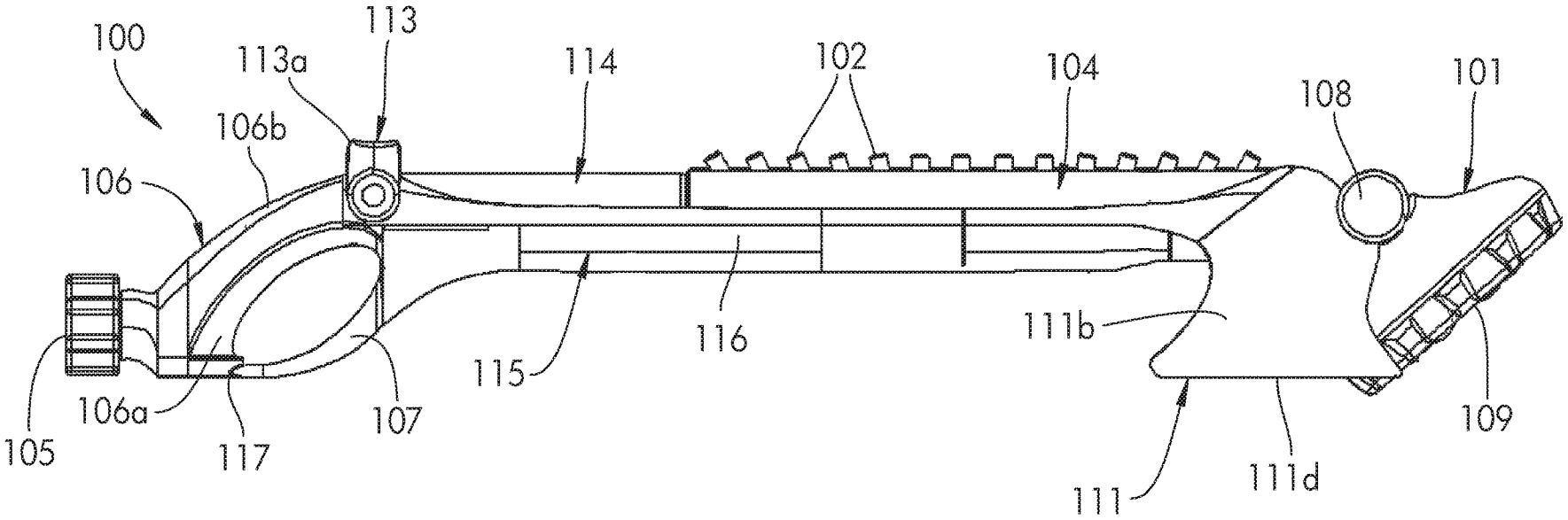
FIG. 5A is a side view of the garden watering device of FIG. 1 with the turret head pivoted downward.
Figure 5B:
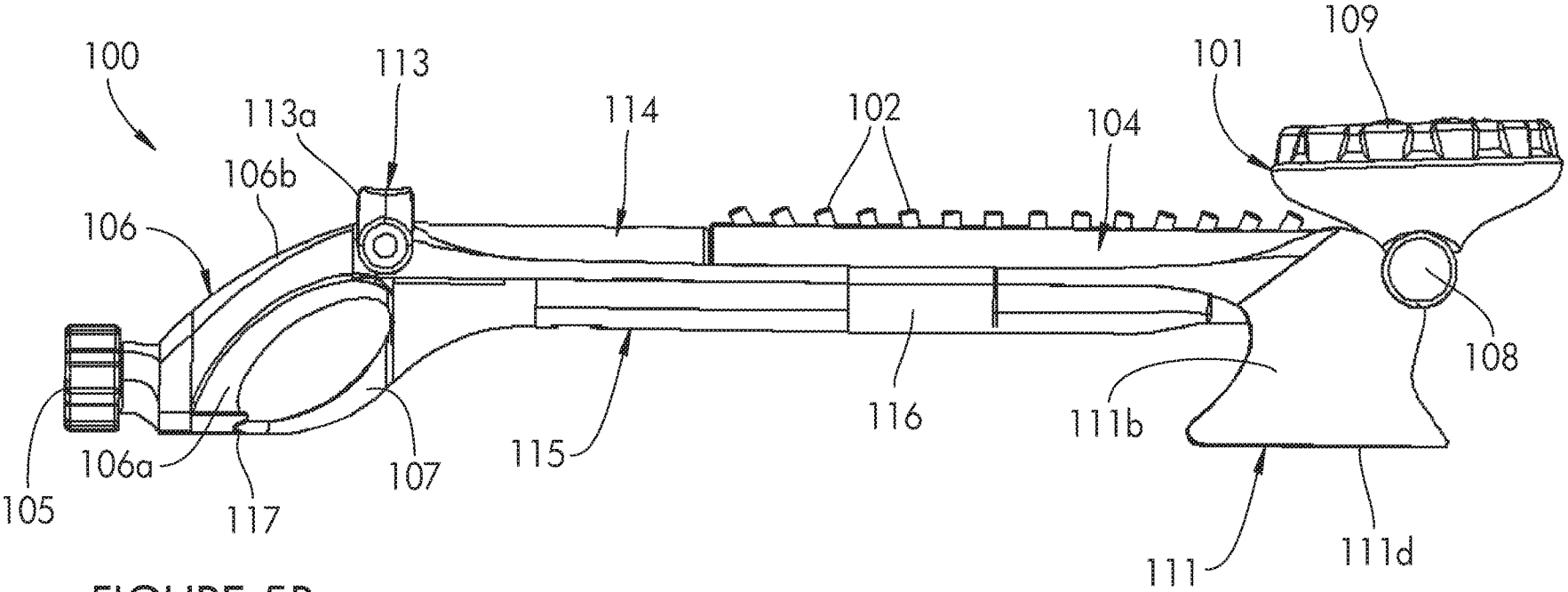
FIG. 5B is a side view of the garden watering device of FIG. 1 with the turret head pivoted upward.

The multi-pattern head 101 is coupled to the device body 115 at an articulating joint 108. The articulating joint 108 is discussed in further detail below, but the articulating joint 108 acts as a pivot axis for the multi-pattern head 101 as shown in FIGS. 5A and 5B. The multi-pattern head 101 further includes a dial 109 containing a plurality of flow orifices 110 shown most clearly in FIGS. 2 and 4. Each of the plurality of flow orifices 110 has a different shape corresponding to different types of output flow from the multi-pattern head 101. The dial 109 may be rotated to align one of the flow orifices 110 with the water flow in the multi-pattern head 101, thereby setting the type of output flow delivered by the multi-pattern head 101. The flow orifices 110 may be used in one or both of the handheld operation or the ground-based operation. For example, one of the flow orifices 110 may provide flow only along one side of the multi-pattern head 101, which allows a user to place the garden watering device 100 at the edge of a lawn and keep the water flow contained to only the lawn. The multi-pattern head 101 may be rotated to the downward direction for handheld watering or washing operations as shown in FIG. 5A, and may alternatively be rotated to the upward direction for ground-based lawn watering as shown in FIG. 5B. In each position, the multi-pattern head 101 is located relative to the support structure 111 to ensure that water flow passes by the support structure 111 rather than into the support structure 111.

Figure 6:
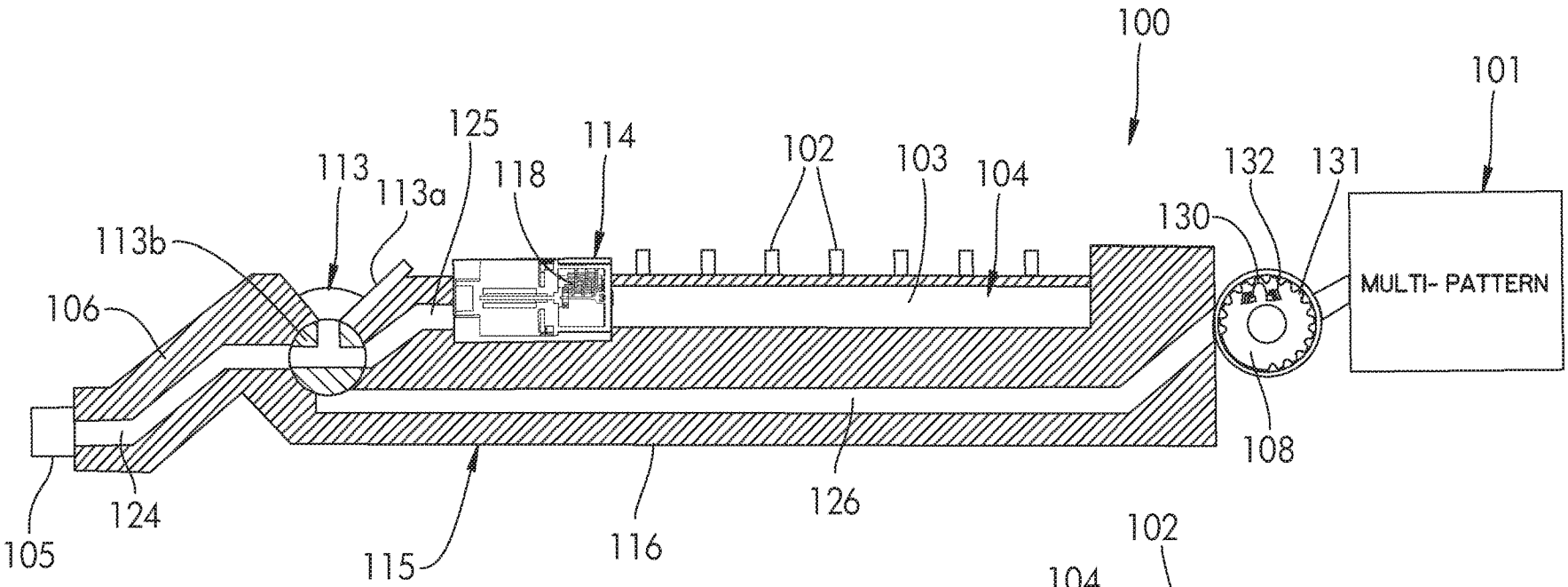
FIG. 6 is a partial cross sectional side view of the garden watering device of FIG. 1 as taken along line 6-6 in FIG. 3.
Figure 7:
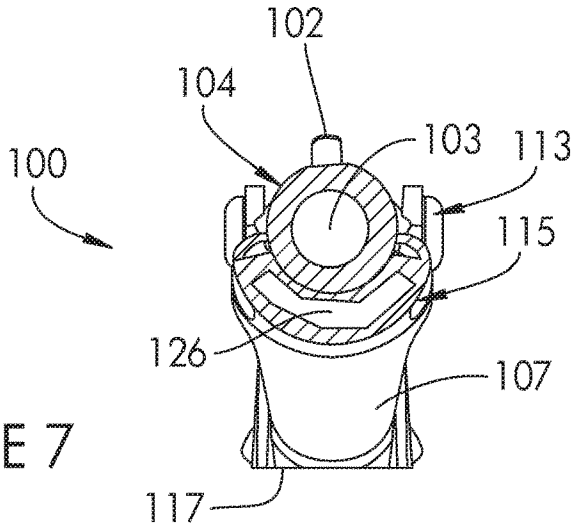
FIG. 7 is a cross sectional side view of the garden watering device of FIG. 1 as taken along line 7-7 in FIG. 3.

FIGS. 6 and 7 illustrate partial cross-sections of the garden watering device 100. The handle 106 includes a primary channel 124 in fluid communication with the water inlet coupling 105 and the valve 113*b* of the flow route selector 113. Depending on the orientation of the valve 113*b*, water from the primary channel 124 may flow into an upper channel 125 or a lower channel 126 in the device body 115. The upper channel 125 is in fluid communication with the elongate tube 104. The water passes through the oscillation device 114 between the upper channel 125 and the elongate tube 104. The oscillation device 114 is further described with reference to FIGS. 10A-10E below. The oscillation device 114 may alternatively be the oscillating gear box disclosed in U.S. Pat. No. 4,708,291 to Grundy, which is incorporated by reference herein, or another known oscillating gear box or device. In any event, as water flows through the oscillation device 114, the water flow actuates rotation of a gear train 118 held within the oscillation device 114, which in turn leads to oscillatory movement of the elongate tube 104 about the longitudinal axis X. Water exiting the oscillation device 114 then enters a tube flow passage 103 as shown in FIG. 7. The water then exits the garden watering device 100 in a spray through a generally linear series of discharge outlets 102 in the elongate tube 104. It will be appreciated that the discharge outlets 102 may be offset or spaced slightly from adjacent discharge outlets 102 in angular orientation within the scope of the generally linear series of discharge outlets 102.

Alternatively, water from the primary channel 124 may be directed by the valve 113*b* of the flow route selector 113 to flow through the lower channel 126 disposed in the device body 115 to the articulating joint 108. The articulating joint 108 may be a water joint disclosed in U.S. Pat. No. 6,712,294 to Wang, which is incorporated by reference herein. The articulating joint 108 enables the multi-pattern head 101 to retain a position until the user chooses to rotate the multi-pattern head 101. As shown in FIG. 6, the interior of the articulating joint 108 includes a plurality on inwardly-directed gear teeth 131 and a spring-loaded member 130 mounted on a bracket 132 which is configured to remain stationary. The gear teeth 131 may rotate with the movement of the multi-pattern head 101 such that the spring-loaded member 130 engages one of the gaps between the gear teeth 131. The spring-loaded member 130 will remain in this gap until a user rotates the multi-pattern head 101 manually to overcome the spring force holding the spring-loaded member 130 between the gear teeth 131. Alternatively, the spring-loaded member 130 and the gear teeth 131 of the articulating joint 108 may be disengaged such that the multi-pattern head 101 is free flowing in a handheld operation. Water flowing through the articulating joint 108 then passes into the multi-pattern head 101 where the water flows out of the garden watering device 100 through one of the flow orifices 110 described above.

Figure 8A:
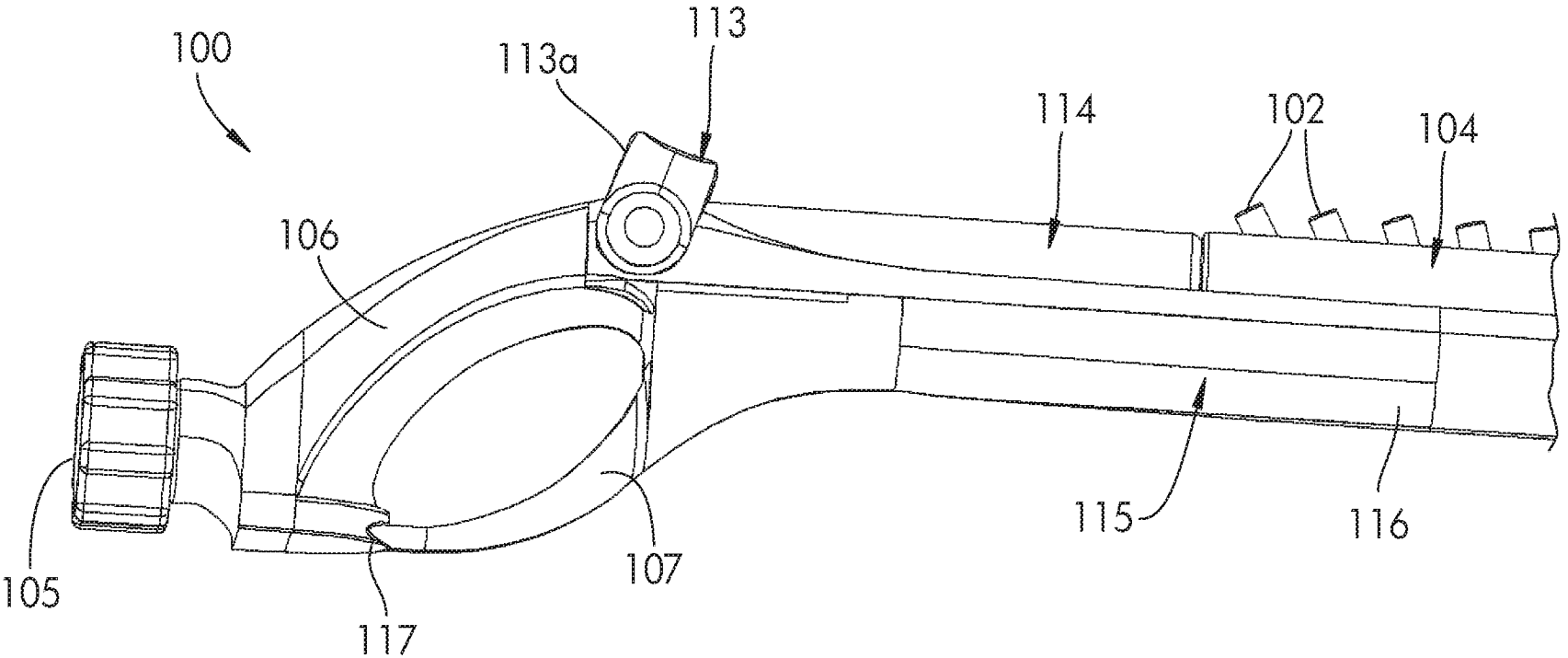
FIG. 8A is a side view of the handle of the garden watering device of FIG. 1 with the flow route selector in a first position.
Figure 8B:
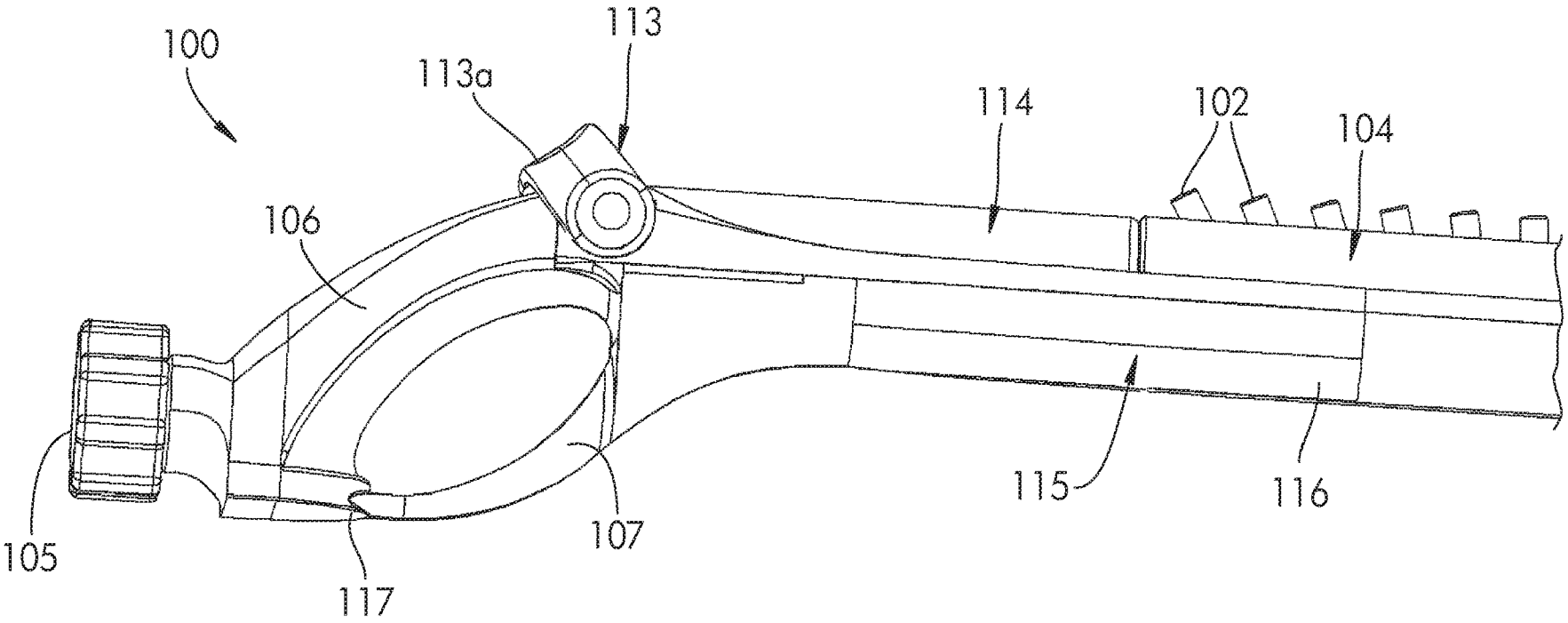
FIG. 8B is a side view of the handle of the garden watering device of FIG. 1 with the flow route selector in a second position.
Figure 8C:
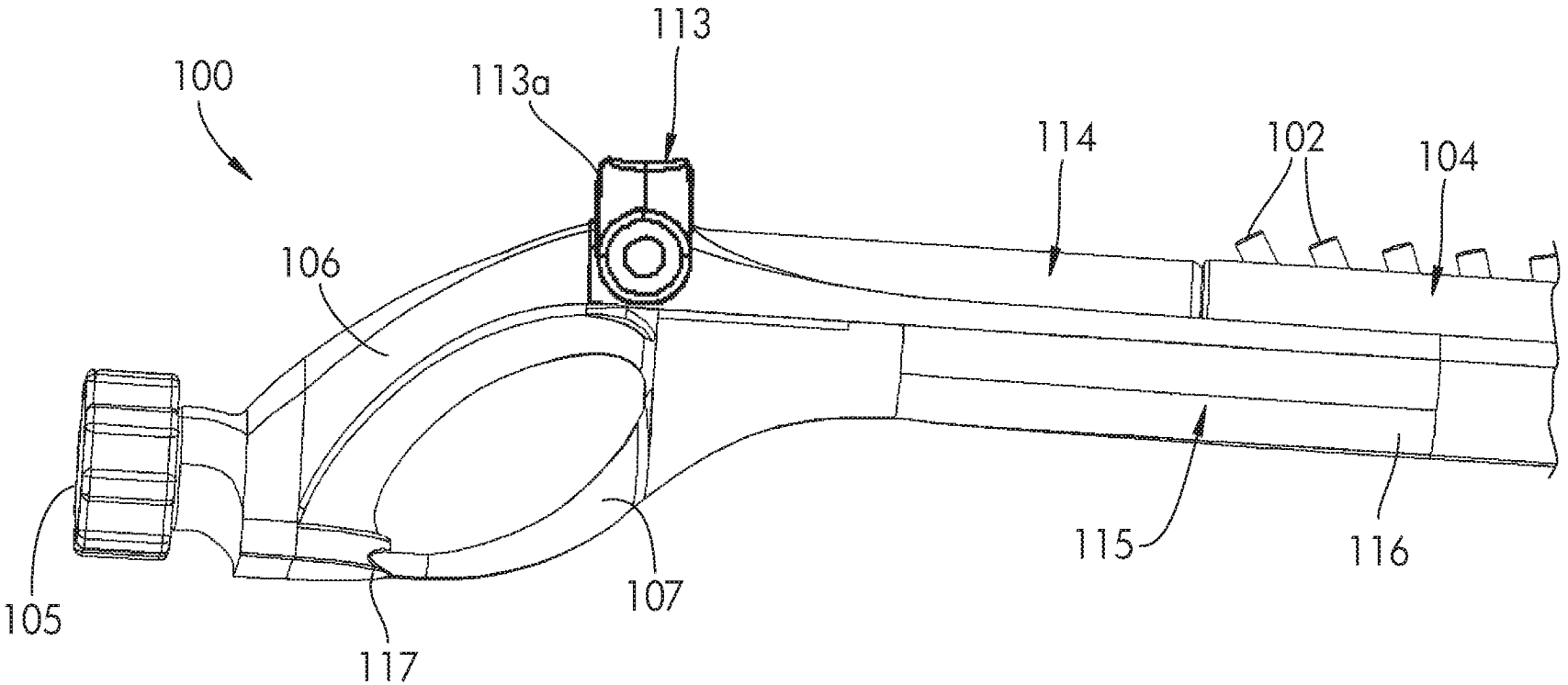
FIG. 8C is a side view of the handle of the garden watering device of FIG. 1 with the flow route selector in a third position.
Figure 9A:
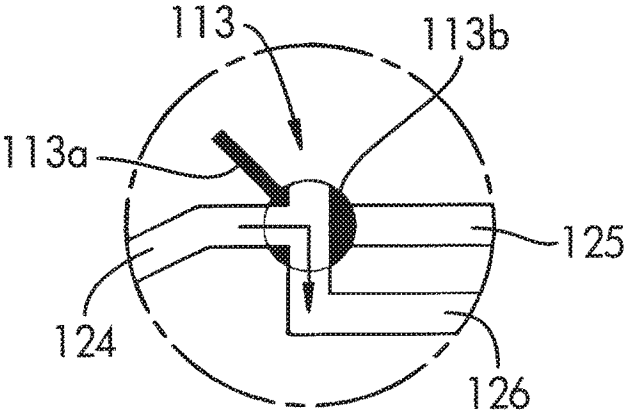
FIG. 9A is a schematic view of the valve of the flow route selector in the first position corresponding to FIG. 8A.
Figure 9B:
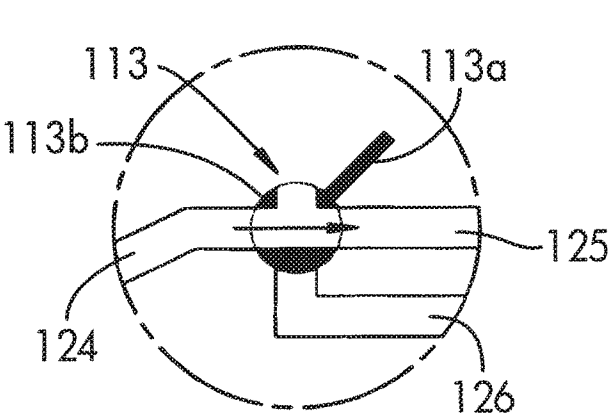
FIG. 9B is a schematic view of the valve of the flow route selector in the second position corresponding to FIG. 8B.
Figure 9C:
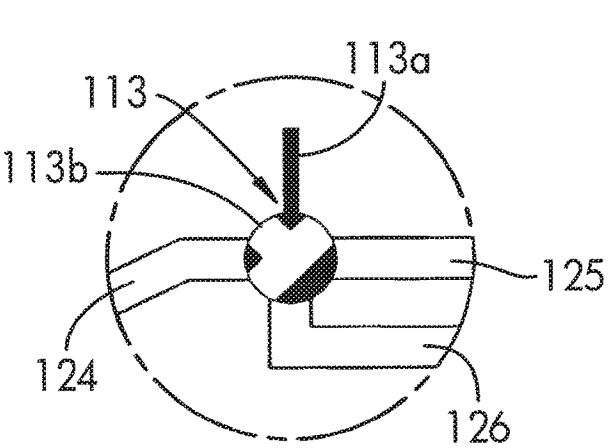
FIG. 9C is a schematic view of the valve of the flow route selector in the third position corresponding to FIG. 8C.

The operation of the flow route selector 113 is schematically illustrated in FIGS. 8A-8C and 9A-9C. FIGS. 8A-8C show the various positions of the lever 113*a*, while FIGS. 9A-9C show the corresponding position of the valve 113*b*. When the lever 113*a* is rotated back to a first position shown in FIG. 8A, the valve 113*b*, shown as a three-way valve in FIGS. 9A-9C, allows flow from the primary channel 124 into the upper channel 125 and the elongate tube 104 as shown in FIG. 9A. When the lever 113*a* is rotated forward to a second position shown in FIG. 8B, the valve 113*b* permits flow from the primary channel 124 into the lower channel 126 and the multi-pattern head 101 as shown in FIG. 9B. The lever 113*a* may also be rotated to a third position intermediate the first and second positions as shown in FIG. 8C. In the third position, the valve 113*b* turns so that water flow is blocked at the flow route selector 113 and is not delivered to either of the upper channel 125 or lower channel 126. Thus, the flow route selector 113 not only allows a user to switch flow between the elongate tube 104 and the multi-position head 101, but also acts as a trigger or on/off control for water flow through the garden watering device 100.

The amount of water to both the upper channel 125 and the lower channel 126 may be metered by flow route selector 113, thereby controlling the amount of water conveyed to the elongate tube 104 and multi-pattern head 101, respectively. Techniques for metering the water with flow route selector 113, such as progressively increasing the flow outlet size in the valve as it is turned in its respective directions, are known to those skilled in the art. In such a case the flow outlet's size in the flow route selector 113 would taper out from the third position in each direction towards the first and second positions. From the third position to the first the size of the flow outlet would increase until reaching the first position. From the third position to the second the size of the flow outlet would increase until reaching the first second.

Figure 9D:
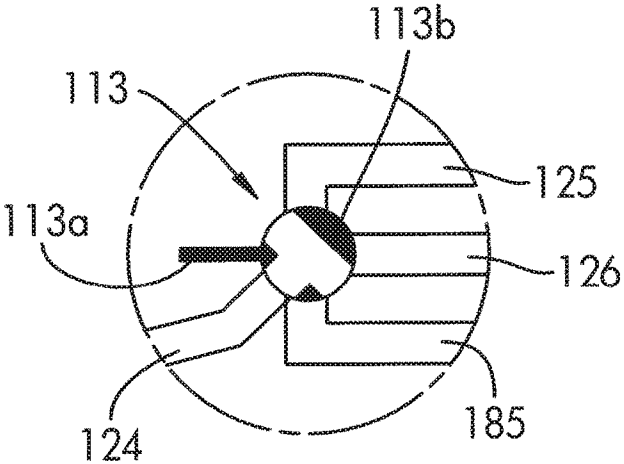
FIG. 9D is a schematic view of another embodiment of the flow route selector.

It will be understood that the flow route selector 113 may be configured to move to a fourth position or more positions in alternative embodiments wherein the valve 113*b* includes more than three inlets/outlets. For example, FIG. 9D illustrates another flow route selector 113 configured for use with the garden watering device 100 of this embodiment or other embodiments further described below. The flow route selector 113 includes a four-way valve 113*b* that directs flow into one of the upper channel 125, the lower channel 126, or a third channel 185 extending to various water distribution members. Therefore, the flow route selector 113 is configured to deliver flow to any water distribution member incorporated with the garden watering device 100. In addition to what is shown, the flow route selector 113 could also take any useful form for routing water, non-limiting examples of which include barrel valves, ball valves, gate valves, poppet valves, radial valves, other non-valve based devices, or the like.

FIGS. 10A-10E show an exemplary oscillation device 114 configured to rotate the elongate tube 104 of the garden watering device 100. The oscillation device 114 includes a housing 140 with an inlet end 141 and an outlet end 142. The oscillation device 114 also includes a fluid connector 143 extending from the inlet end 141 and configured to be coupled to the device body 115. Also shown in FIG. 10A, a final gear drive adapter 144 extends from the outlet end 142. The final gear drive adapter 144 includes an interlocking driver surface 145 and a plurality of through apertures 146 for outgoing water exiting the oscillation device 114.

Figure 10A:
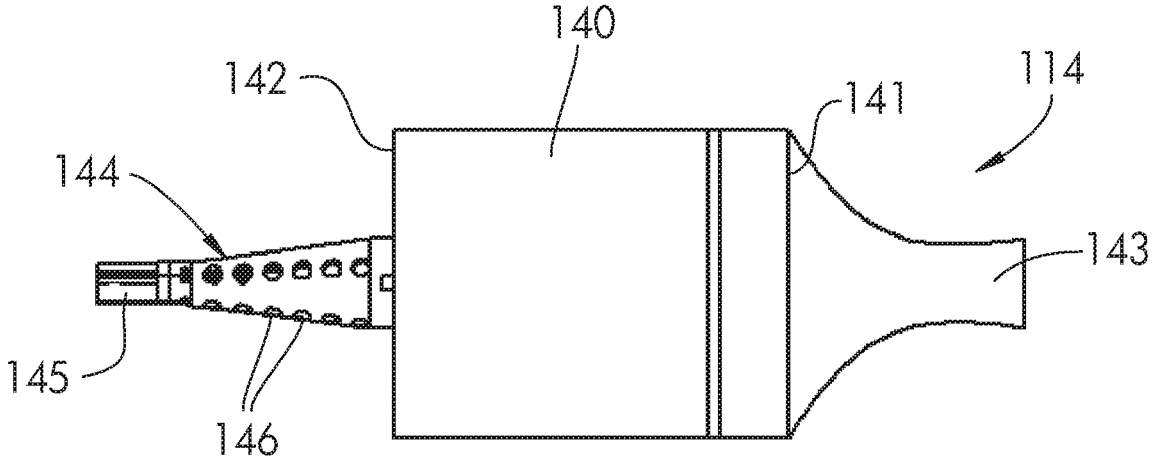
FIG. 10A is a side view of the oscillation device of the garden watering device of FIG. 1.
Figure 10C:
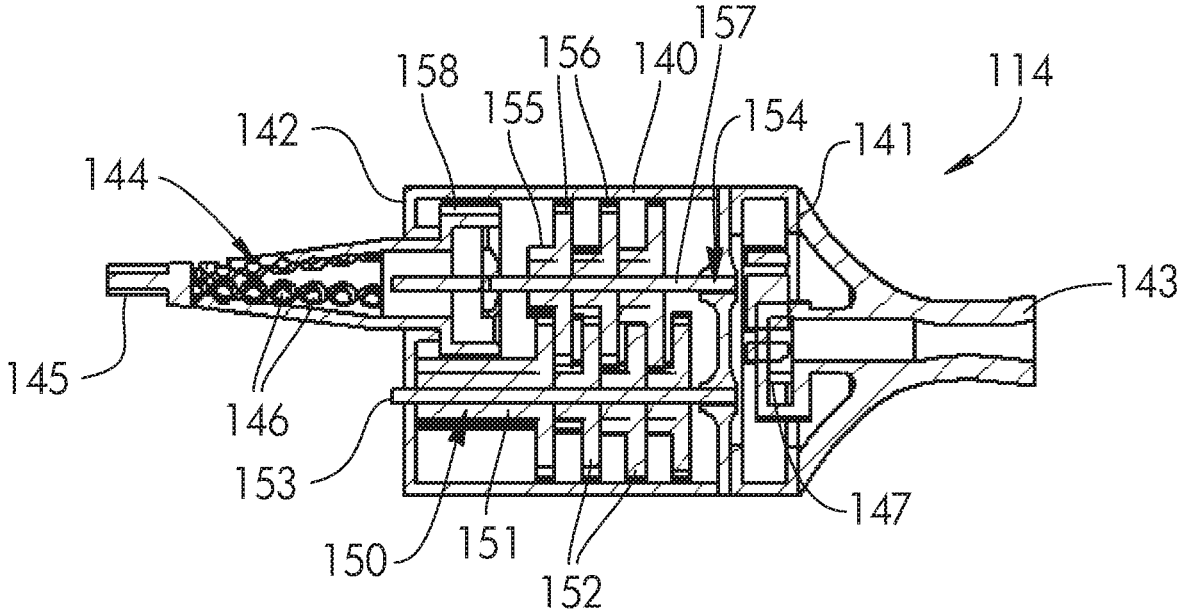
FIG. 10C is a cross-sectional side view of the oscillation device of the garden watering device of FIG. 1.
Figure 10B:
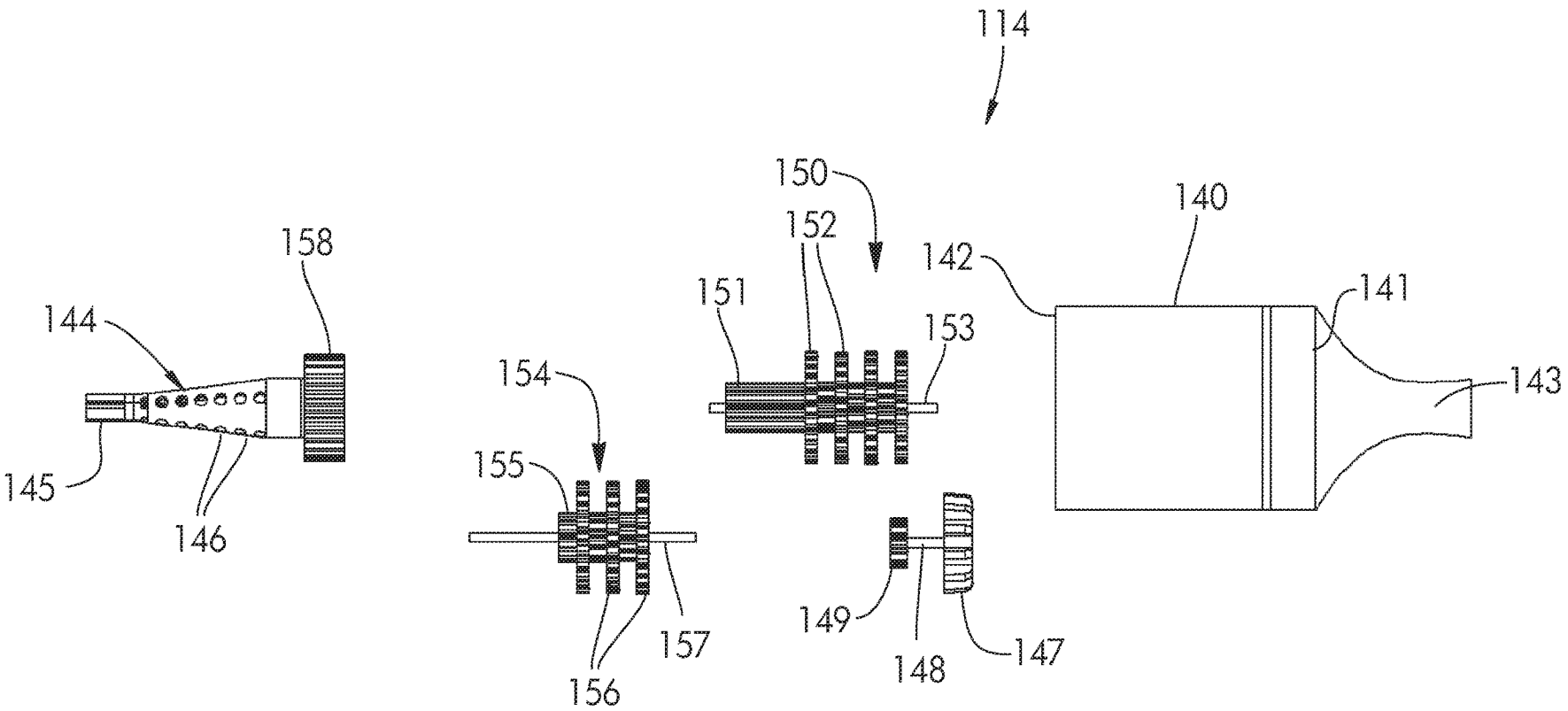
FIG. 10B is an exploded view of the oscillation device of the garden watering device of FIG. 1.

FIGS. 10B and 10C further illustrate internal components of the oscillation device 114. The oscillation device 114 further includes a paddlewheel 147 coupled to a propulsion shaft 148 leading to a propulsion gear 149. The oscillation device 114 also includes a first gear stack 150 having an elongate first inner gear 151 and a plurality of spaced first outer gears 152 rigidly coupled for collective rotation on a first gear shaft 153. A second gear stack 154 is positioned within the housing 140 and includes an elongate second inner gear 155 and a plurality of spaced second outer gears 156 rigidly coupled for collective rotation on a second gear shaft 157. The final gear drive adapter 144 also includes an outlet gear 158 disposed within the housing 140 as shown in FIG. 10C. The first gear stack 150 and second gear stack 154 are engaged such that the second outer gears 156 are disposed between adjacent first outer gears 152, thereby enabling gear meshing between the elongate first inner gear 151 and the second outer gears 156, as well as gear meshing between the elongate second inner gear 155 and the first outer gears 152. The propulsion gear 149 is engaged with one of the first outer gears 152, and the outlet gear 158 is engaged with the elongate first inner gear 151 as shown in FIG. 10C.

In operation, water flows from the flow route selector 113 and the upper channel 125 into the fluid connector 143 and then the housing 140 of the oscillation device 114. The motion of the water flowing past the paddlewheel 147 causes the paddlewheel 147 and the propulsion gear 149 to rotate. The propulsion gear 149 then meshes with the first outer gears 152 and forces the first gear stack 150 and the second gear stack 154 to each rotate in opposing directions. The elongate first inner gear 151 then actuates the outlet gear 158 and the final gear drive adapter 144 to rotate. The gear drive adapter 144 may be engaged with a corresponding receptacle 159 in the elongate tube 104 to thereby rotate the elongate tube 104 through full oscillations of 360 degrees or partial oscillations, as well understood in the sprinkler art. At the same time, the water flowing through the housing 140 passes through the through apertures 146 into the flow passage 103 formed in the elongate tube 104.

Figure 10D:
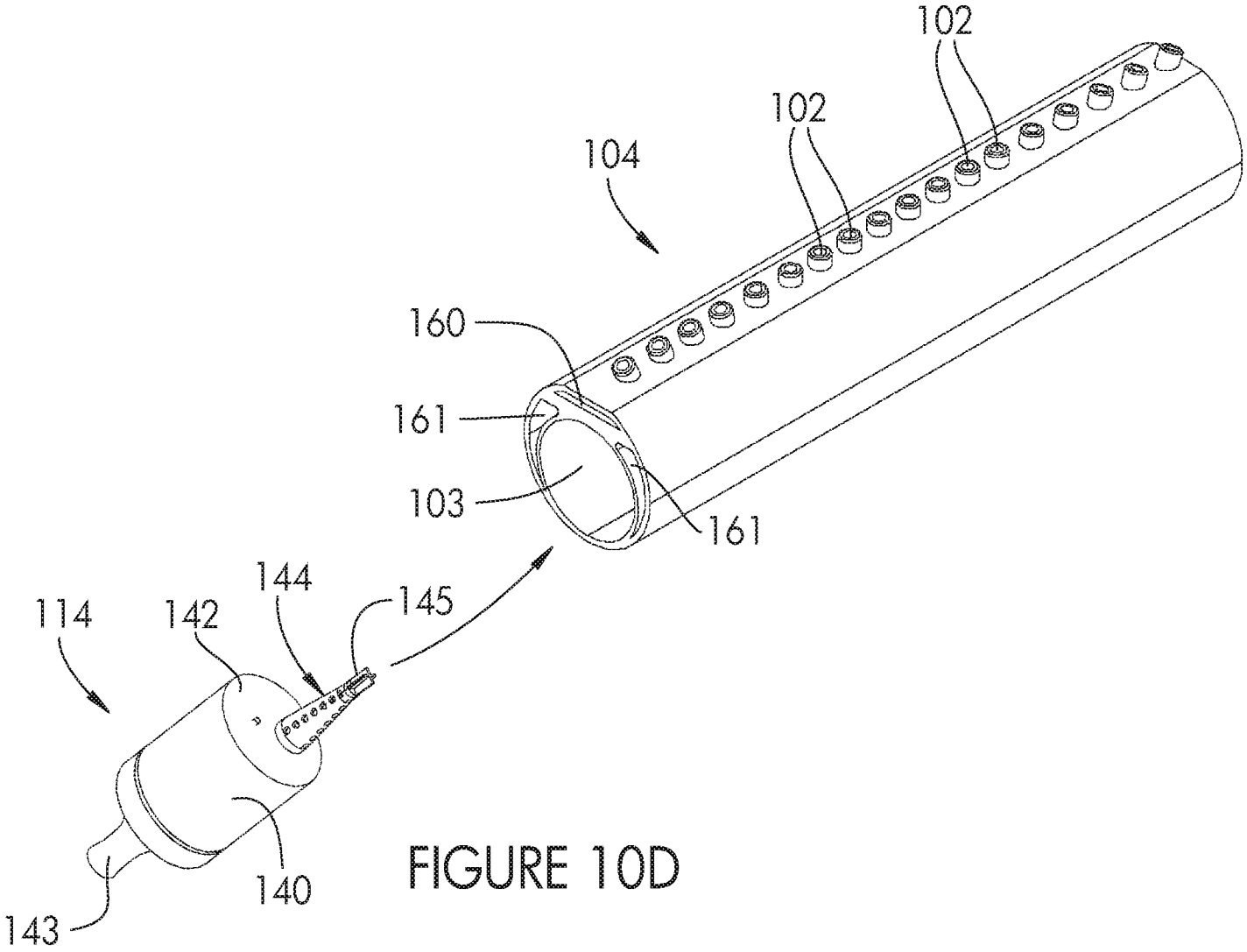
FIG. 10D is a perspective view of the oscillation device and the elongate tube of the garden watering device of FIG. 1.
Figure 10E:
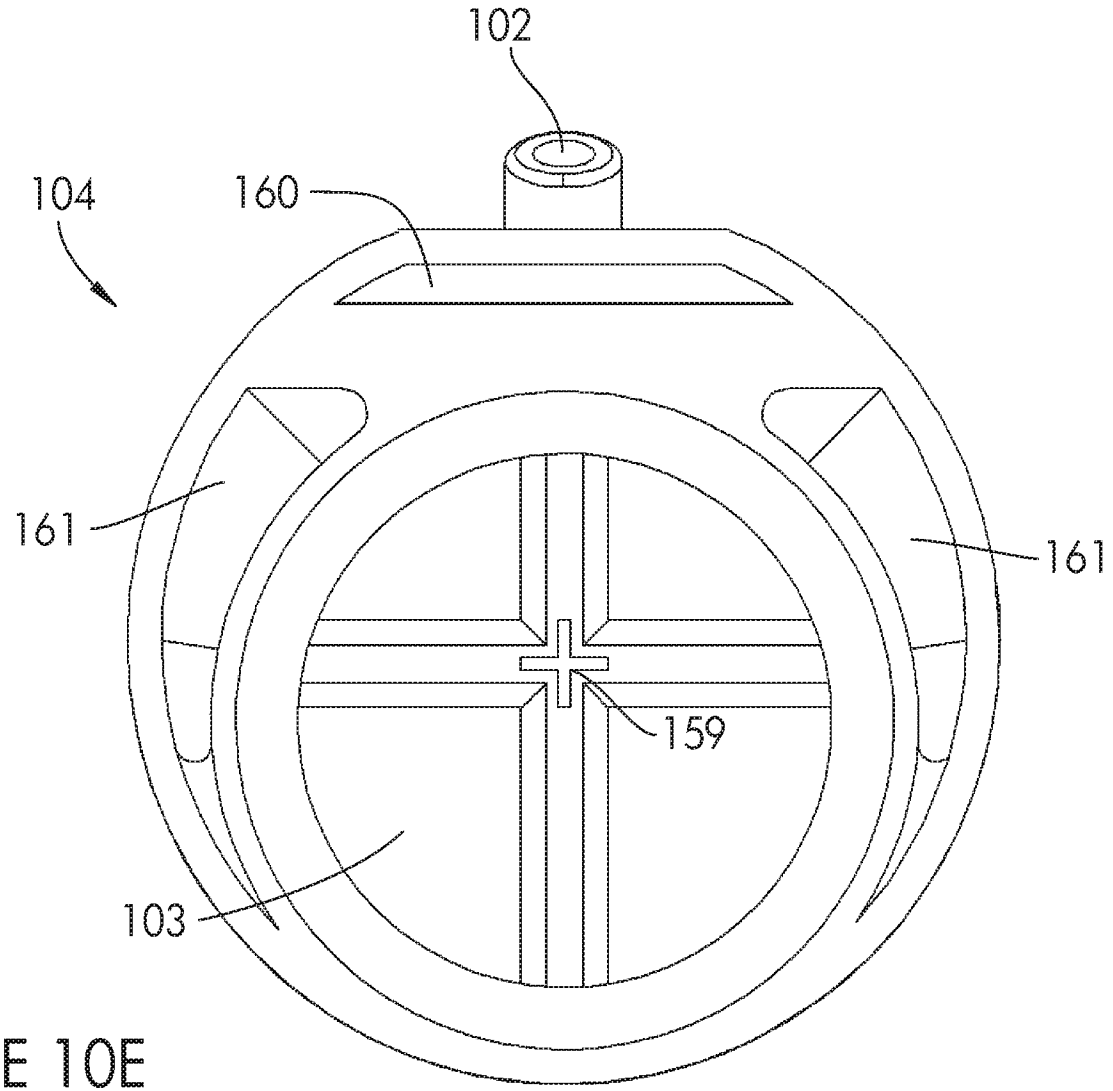
FIG. 10E is a front view of the elongate tube of the garden watering device of FIG. 1.
Figure 10F:
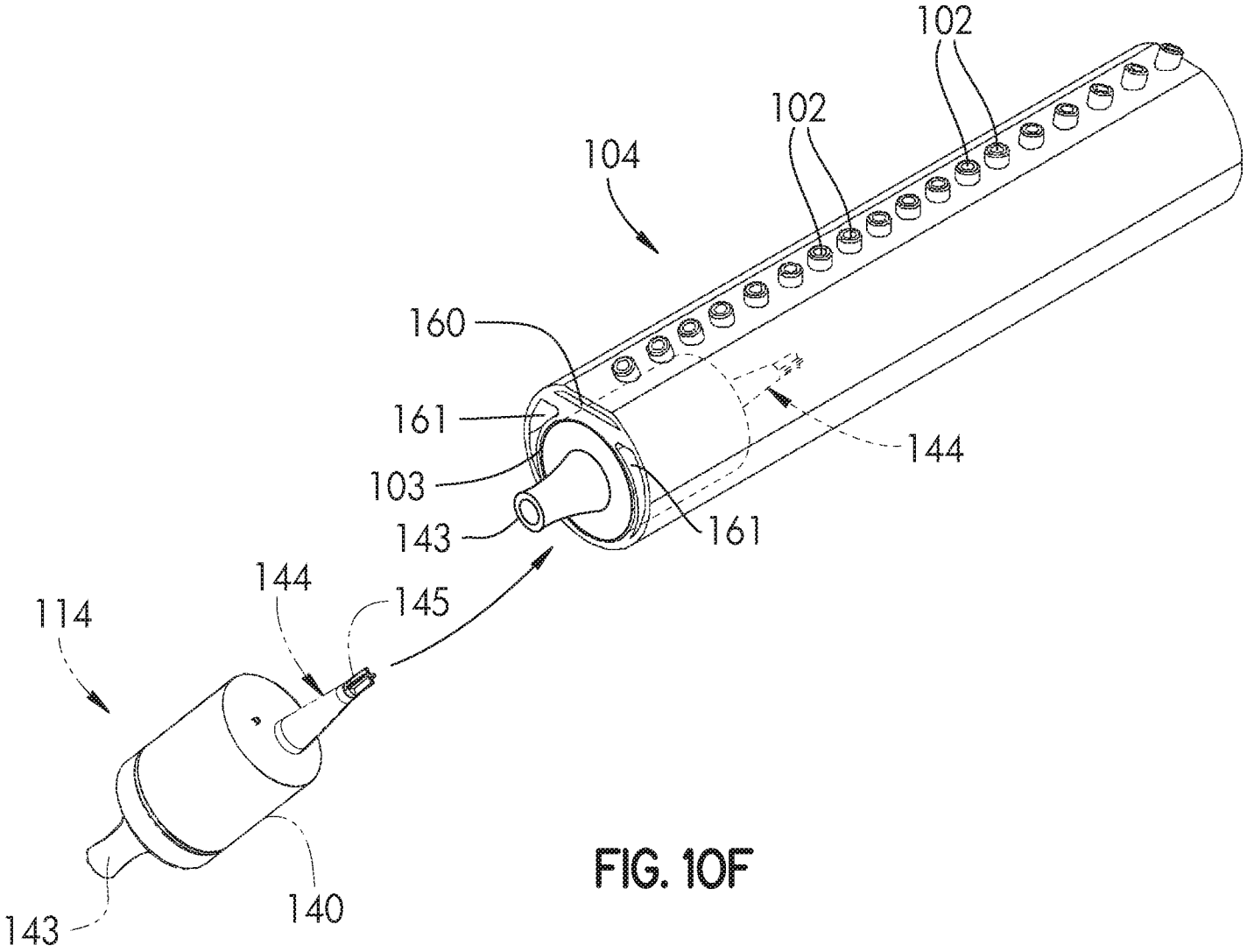
FIG. 10F is a perspective view of the oscillation device assembled within the elongate tube of the garden watering device of FIG. 1.

FIGS. 10D-F further illustrate the engagement of the elongate tube 104 and the oscillation device 114. The flow passage 103 corresponds in size and shape with the housing 140 of the oscillation device 114 so that the oscillation device 114 may be slid into the flow passage 103. Once positioned in the flow passage 103, the gear drive adapter 144 engages with the receptacle 159 extending into the flow passage 103 as shown most clearly in FIG. 10E. After water exits the oscillation device 114 into the flow passage 103, the water may then be directed into an upper lumen 160 leading to the discharge outlets 102. The elongate tube 104 may also include one or more auxiliary lumens 161 configured to deliver water through the elongate tube 104 to a second water distribution member, as described in further detail in an alternative embodiment below. It will be understood that a portion of the oscillation device 114 may be disposed underneath one or more of the distribution outlets 102 in the elongate tube 104 such that the elongate tube 104 can oscillate over a portion of the oscillation device 114, as illustrated in FIG. 10F.

FIGS. 10'A-E illustrate an alternate embodiment of the oscillation device with an off center paddlewheel that allows a reduction in unused space over a conventional oscillation device. A gearbox 114' is powered by a paddlewheel 147' located along the length of the gearbox 114'. Offsetting the paddlewheel 174' that drive the gearbox 114' within the housing 140' allows for the use of similar valving found in a conventional gearbox, while allowing for a reduction in the overall size of the gearbox. As water passes through the gearbox 114', some of it is forced through one of two direction holes 162' that control the direction the paddle wheel rotates and thereby what direction the oscillating bar moves. When water is forced through direction hole 162*a*', the paddlewheel 147' is spun clockwise. Conversely, when water is forced though the other direction hole 162*b*', the paddlewheel 147' is spun counter-clockwise. The determination as to which direction hole 162' the water flows through, and therefore what direction the oscillating bar rotates, is handled by a valve linkage 165' that toggles between blocking and unblocking the holes sequentially as the sprinkler oscillates. The sprinkler rotates until the oscillating bar reaches the end of its travel, as defined by end stops 164', at which point the stem 166' of the valve linkage 165' is struck and changes position. This change in position of the stem 166' causes the valve linkage 165' to shift and causes the valve linkage 165' to block the previously open direction hole 162*a*'/b', while at the same time opening the previously blocked direction hole 162*a*'/b'. This reverses the rotation of the paddlewheel 147', and thereby, the direction of movement of the oscillating bar. The valve linkage 165' itself is shaped liked a see-saw, whereby its default position is for it to have one side of it making contact with a housing 140' and the other not contacting the housing 140'. The rotational motion and direction of the paddlewheel 147' is transmitted from the paddlewheel 147' to rotation gear 160' and into the first gear stack 150'. Rotation is transferred from the first gear stack 150' to a second gear stack 154', which is also positioned within the housing 140. Rotation is transferred back from the second gear stack 154' to the first gear stack 150', and this transfer of rotation is repeated until the motions reach a termination gear 161' and the outlet gear 158, from which the motion is used to oscillate the sprinkler.

A gearbox with an off center paddlewheel, such as gearbox 114' with paddlewheel 147', allows a reduction in unused space over a conventional gearbox. This is achieved by moving the gear stacks 154' and 150' closer to the center of the gearbox 114', which is achieved by positioning the paddlewheel 147' off-center in the housing 140'. The off-center paddlewheel 147' allows for less wasted space in the area around the paddlewheel 147'. The rotational motion of the paddlewheel 147' is redirected by gear 160' so that the gear stacks 154' and 150' provide rotational motion that is more centrally located in the housing 140', in order to engage the termination gear 161' and the outlet gear 158' at a generally centered location. Consequently, a gearbox having a comparatively smaller diameter can be manufactured and used, thereby saving materials and providing for a more compact gearbox. Using such a gearbox allows the various devices disclosed herein, including devices 100, 2000, 2100, 2200, 2500, 2600, 2700, 2800 or the like, to have a gearbox of comparatively lesser overall diameter. With reference to the features shown in FIG. 1, a reduced diameter gearbox allows body portions 115 and 116 to also have a lesser overall diameter because their diameter is influenced by the diameter of the gearbox. Collectively, a reduction in the dimension of several components of the device 100 allows for a device 100 of reduced size, which may be desirable.

Figure 11:
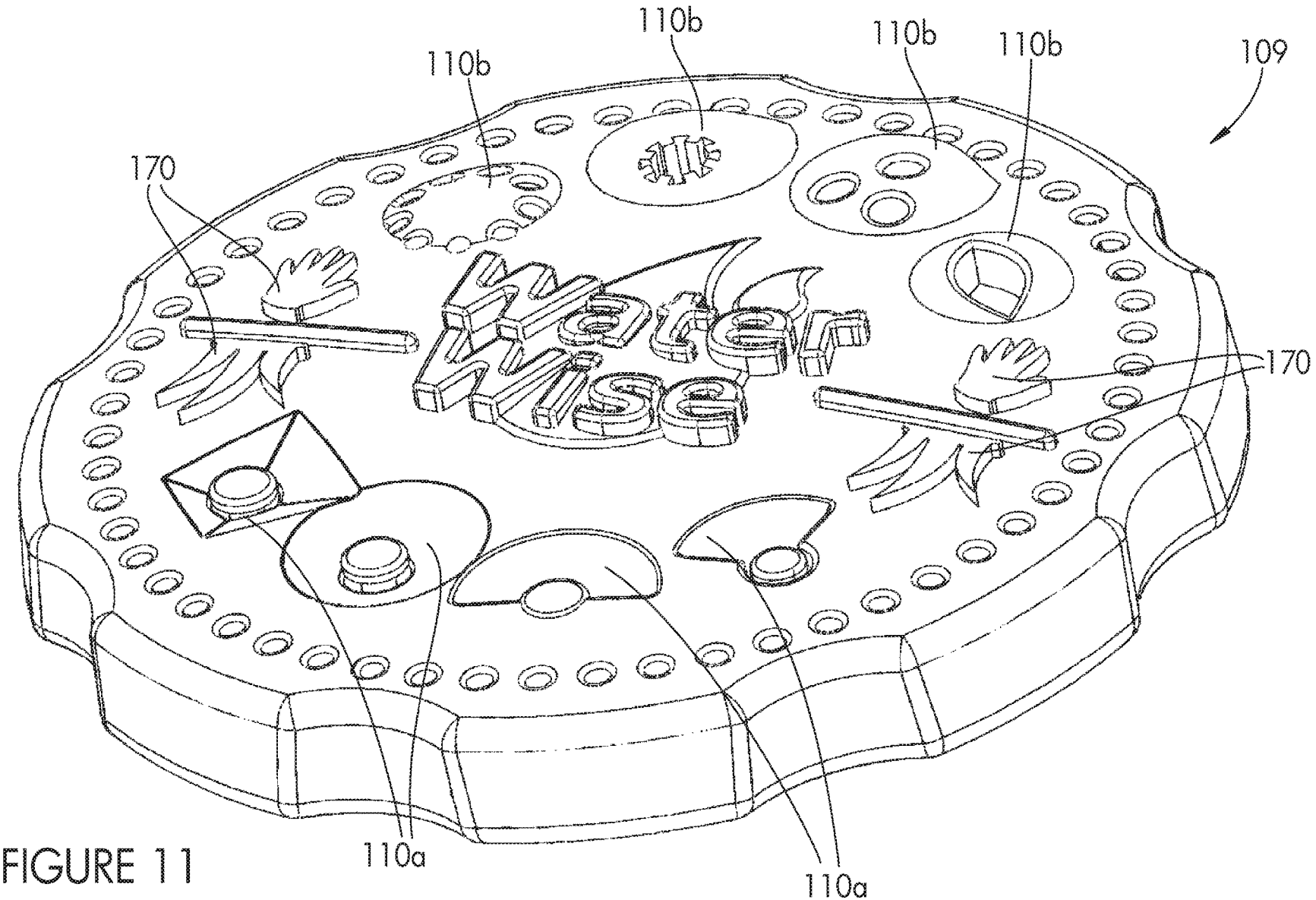
FIG. 11 is a perspective view of the dial of the multi-pattern head of the garden watering device of FIG. 1.

FIG. 11 shows further details of the multi-pattern head 101, and more specifically, one embodiment of the dial 109 and flow outlets 110 on the multi-pattern head 101. The dial 109 features a plurality of single outlet water distribution patterns, wherein there is at least one water distribution pattern (flow outlets 110*a*) principally configured to distribute water from a ground-based position and at least one water distribution pattern (flow outlets 110*b*) principally configured to distribute water from a handheld position. Through rotation of the dial 109 each water distribution pattern becomes available for selection by the user by rotating into communication with the lower channel 126 of the device body 115. The dial 109 is free to rotate indefinitely in either rotational direction without being limited.

The dial 109 may divide the plurality of flow outlets 110 into a first cluster of flow outlets 110*a* along one side of the dial 109 and configured for ground-based operation, and a second cluster of flow outlets 110*b* along the other side of the dial 109 and configured for handheld operation. The dial 109 may also include indicia 170 disposed on a visible surface between the first and second clusters of flow outlets 110*a*, 110*b*. It will be understood that the indicia 170 may be disposed along a face or a side of the dial 109. The indicia 170 clearly identify which flow outlets 110*a* are to be used in ground-based operation and which flow outlets 110*b* are to be used in handheld operation. The indicia 170 may be formed integrally with the dial 109 or may be added by a secondary manufacturing operation, such as heat-stamping or labeling. As shown in FIG. 11, each of the first cluster of flow outlets 110*a* defines a shaped outlet corresponding to the shape of the area to be covered by the flow of water. To this end, the flow outlet 110*a* with a half-moon shape would produce a semicircular arc of flow appropriate for when the multi-pattern head 101 is placed at the edge of a lawn to be watered. Similarly, each of the second cluster of flow outlets 110*b* has one or more contoured outlets for producing different types of showerhead-like flow patterns during handheld operation.

In operation, the user hooks a hose or other water supply to the water inlet 105 and selects an operational mode with the flow route selector 113. For example, the flow route selector 113 can route water through the upper channel 125 to the oscillating device 114 and the elongate tube 104. The elongate tube 104 is configured to spray a generally lineal pattern of water as it oscillates through an angle. Thus, the flow produced at the discharge outlets 102 is directed generally along the normal direction and forms generally a rectangular coverage area centered at the elongate tube 104 that may also extend forward and rearward from the elongate tube 104 along the longitudinal axis X. In another example, the flow route selector 113 can route water through the lower channel 126 to the multi-pattern head 101. When the multi-pattern head 101 is positioned for ground-based operation (FIG. 5B), the resulting flow produced depends on the shape of the flow outlet 110 and is generally directed to form a shaped coverage area forward of the elongate tube 104 along the axial direction. However, it will be understood that the elongate tube 104 and the multi-pattern head 101 can provide different coverage areas and flow patterns in alternative embodiments, some of which are described in further detail below.

It would be recognized that the above device 100 incorporates a variety of components in a hand-held form with smaller length and width dimensions than what could be accomplished in the prior art.

The device 100 incorporates the following components: a medium length spray wand (18 inches long), a ratcheting mechanism (1-1.2 inches long), a gearbox assembly (3.5-5 inches long and 2-3 inches in diameter), an oscillating tube (9 to 12 inches long and 2-2.5 inches wide), a hose connection (1 inch long), a medium area turret dial (4 inches in diameter) and a device handle (5 inches long). Unaltered, this results in a total length of between 24 and 27 inches as well as a total body diameter which is too thick to allow for convenient handling, especially near the tubular portions relating to the device body 115.

Through the novel arrangement of components detailed above, all of these elements can be incorporated into a device under 20 inches in length, and most preferably under 18 inches in length. A device with all of the features outlined above at the specified size provides both handheld functionality and store merchantability that exceeds the devices of the prior art.

Figure 12A:
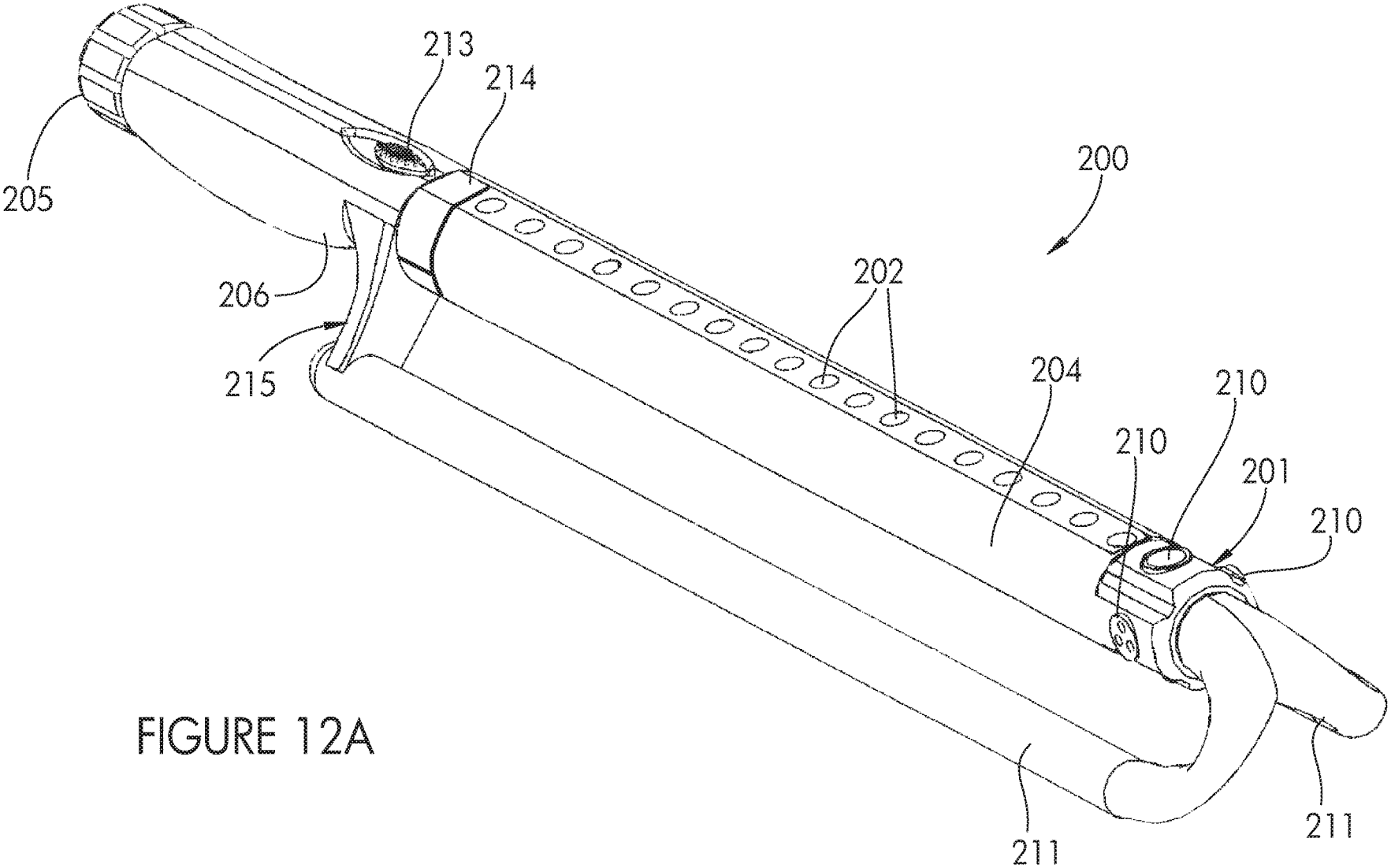
FIG. 12A is a perspective view of another embodiment of a garden watering device.
Figure 12B:
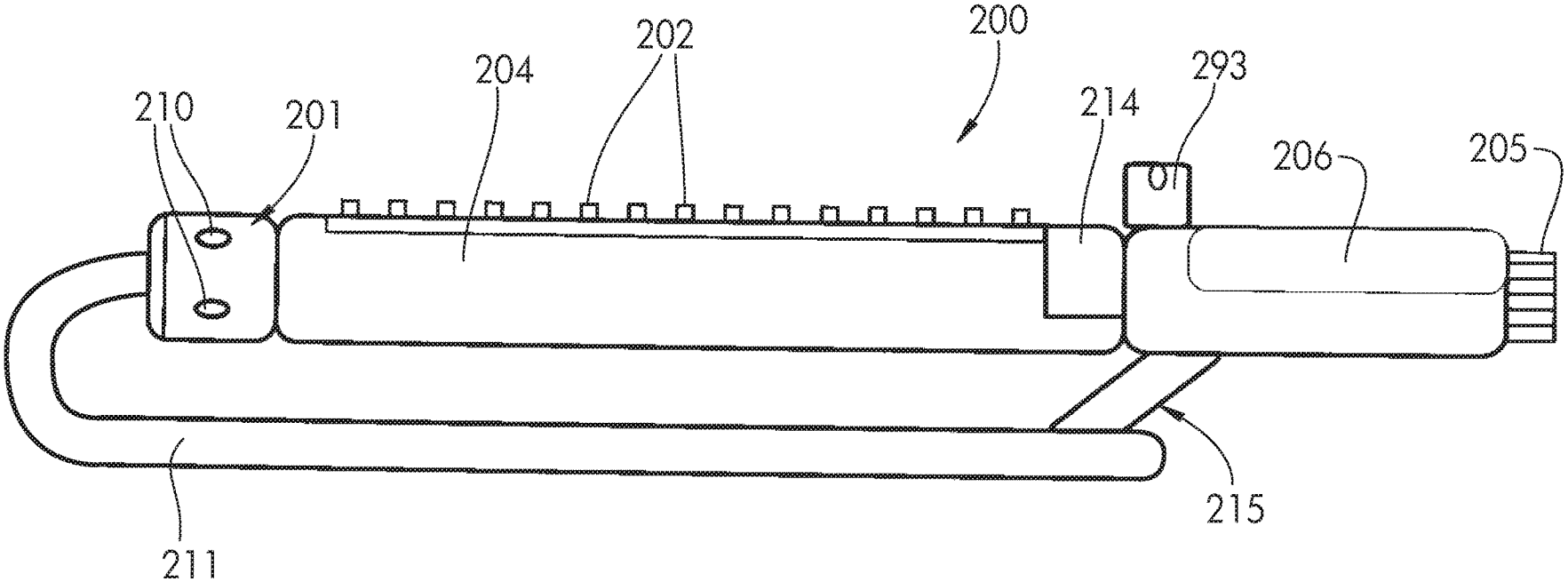
FIG. 12B is a side view of the garden watering device of FIG. 12A.
Figure 12C:
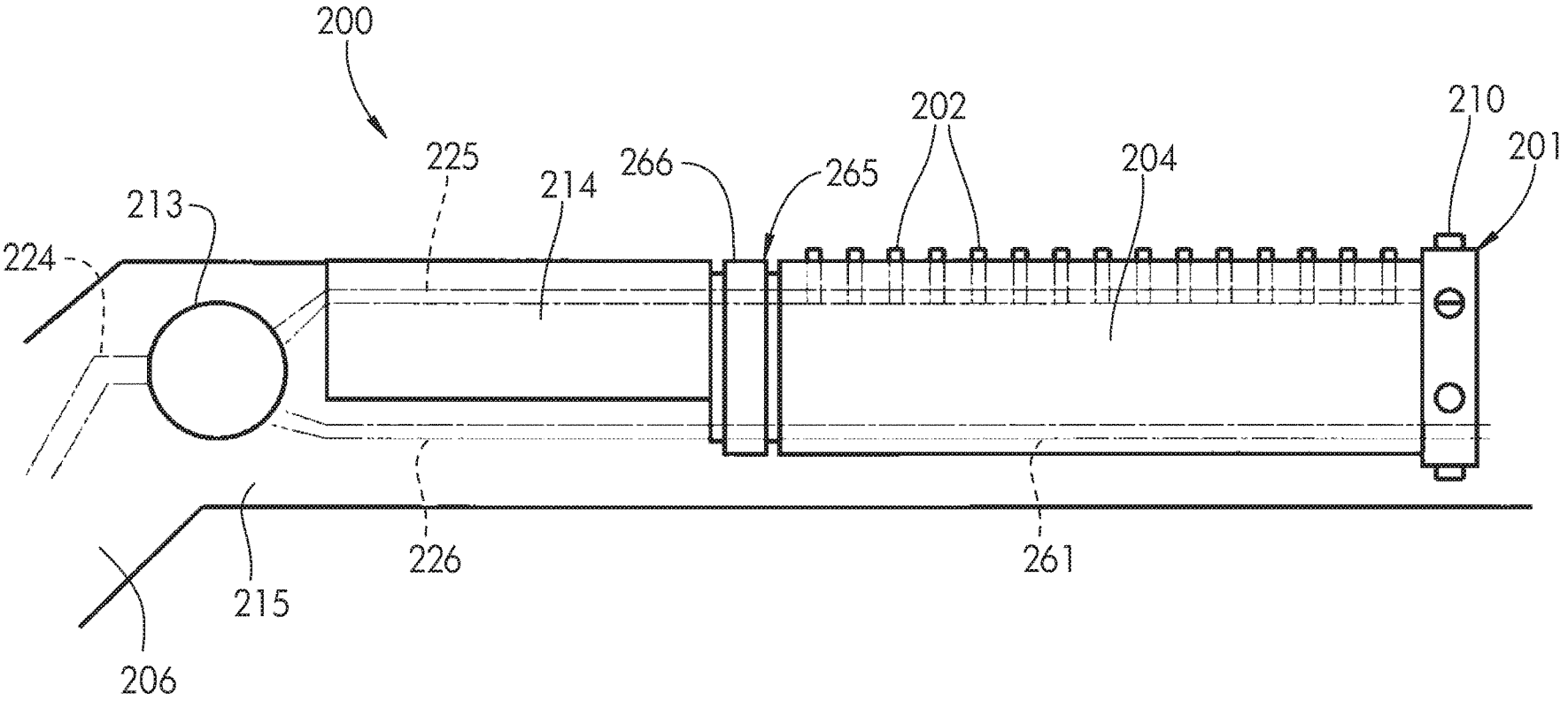
FIG. 12C is a side view of the garden watering device of FIG. 12A, illustrating internal passageways.

One alternative embodiment of a garden watering device 200 is illustrated in FIGS. 12A-12C. The garden watering device 200 includes many of the same elements as the garden watering device 100 of the first described embodiment, and these similar elements have been marked with the same reference numbers in the 200's (i.e., the device body 115 of the previous embodiment is now device body 215 in this embodiment). The device body 215 again includes a handle 206 integrated with a pair of elongate support structures, or legs 211. Either or both of support legs 211 could also have internal passageways and serve as water conduits, and could work in cooperation with the flow route selector 213 to direct water to either or both of the rotatable spray outlet 210 and the elongate tube 204. The handle 206 is coextensive with the elongate tube 204 along the longitudinal axis X of the elongate tube 204. At least one of the elongate support legs 211 extend along the full longitudinal length of the elongate tube 204 and support the second water distribution member 201, which is embodied as a rotatable spray nozzle located at the free end of the elongate tube 104 opposite the handle 206. As shown, the support legs 211 extend beyond the second water distribution member 201 and provide support for the elongate tube 204 at an end opposite the oscillating device 214. The garden watering device 200 also includes a flow route selector 213 and an oscillation device 214 similar to those previously described.

As shown in FIGS. 12A and 12B, the second water distribution member 201 of this embodiment shares a common axis of rotation with the elongate tube 204. The second water distribution member 201 is bifurcated from the elongate tube 204 such that the spray outlet 210 can rotate independently of the elongate tube 204. In this embodiment, it is necessary for the oscillating device 214 to have the option of user-selected disengagement as at least one of the patterns in the second water distribution member 201 is not oriented to distribute water via an oscillating motion. Alternatively, the second water distribution member 201 may be formed integrally with the elongate tube 204 in other embodiments. The second water distribution member 201 is configured for receiving water flow from the flow route selector 213 and directing that flow through whichever flow outlet 210 is pointed upwardly or in the normal direction. All other flow outlets 210 located radially around the circumference of the second water distribution member 201 are blocked from emitting water flow. The second water distribution member 201 may include flow outlets 210 configured for ground-based operation and other flow outlets 210 configured for handheld operation of the garden watering device 200. The flow outlets 210 have differing shapes and sizes to produce different spray patterns, each of which is distinguished from the generally linear spray pattern of the elongate tube 204. It will be understood the second water distribution member 201 may also be operatively connected to the oscillation device 214 for selective rotation during a spraying operation in an alternative embodiment further described with reference to FIGS. 19A-19C below. It will also be understood that the garden watering device 200 may include a third spray head 293 disposed adjacent to the handle 206 as shown in FIG. 12B in some embodiments, the third rotatable spray head 293 effective to provide yet another alternative flow pattern for ground-based or handheld operation. If a third rotatable spray head 293 is provided, the flow selector 213 may be modified as shown and described with reference to FIG. 9D.

FIG. 12C schematically shows the modified internal passageways of this embodiment of the garden watering device 200. The flow route selector 213 again diverts water flow from a primary channel 224 in the handle 206 to one of an upper channel 225 or a lower channel 226. Unlike the previous embodiment, each of the upper channel 225 and the lower channel 226 pass through the elongate tube 204. The upper channel 225 passes through the oscillating device 214, an oscillation selector 265, and the flow channel 203 of the elongate tube 204. The flow channel 203 is sealed from the second water distribution member 201 and only delivers flow to the discharge outlets 202. The lower channel 226 bypasses the oscillating device 214 but then communicates with at least one auxiliary lumen 261 similar to the auxiliary lumens 161 described previously with reference to FIG. 10E. The auxiliary lumen 261 delivers the water into the second water distribution member 201, where the water is directed through the flow outlet 210 currently selected by the user and pointed upwardly.

Alternatively, the flow route selector 213 may be modified as previously discussed with reference to FIG. 9D to direct flow into one of a plurality of wedge-shaped passages (not shown) extending along the length of the elongate tube 204 and into the second water distribution member 201. In this embodiment, each of the wedge-shaped passages leads to a specified flow outlet 210 in the second water distribution member 201. Furthermore, one of the wedge-shaped passages may be in communication with both a flow outlet 210 in the second water distribution member 201 and the discharge outlets 202 of the elongate tube 204. The flow route selector 213 of this embodiment may be used to direct water flow in any of a plurality of radial directions out of the flow outlets 210 in the second water distribution member 201. To this end, more watering and washing tasks may be achieved with this modified design.

The oscillation selector 265 connects the elongate tube 204 to the oscillation device 214 in this embodiment of the garden watering device 200. The oscillation selector 265 includes a selector collar 266 including detent stop members (not shown) which may be moved into engagement with corresponding detents (not shown) formed in the outer periphery of the elongate tube 204 adjacent the oscillation selector 265. The selector 265 effectively locks the elongate tube 204 in a specified angular orientation which may be changed by releasing the selector collar 266 from the elongate tube 204 and reorienting the elongate tube 204. Thus, the selector 265 may be used to produce a lineal non-oscillating spray pattern for ground-based operation directed in the normal direction or angled from the normal direction. The selector 265 may also be used to lock the elongate tube 204 in a downward orientation such that in a handheld operation, the elongate tube 204 produces a lineal pattern of spray flowing between the support legs 211*a* and 211*b*.

Figure 13:
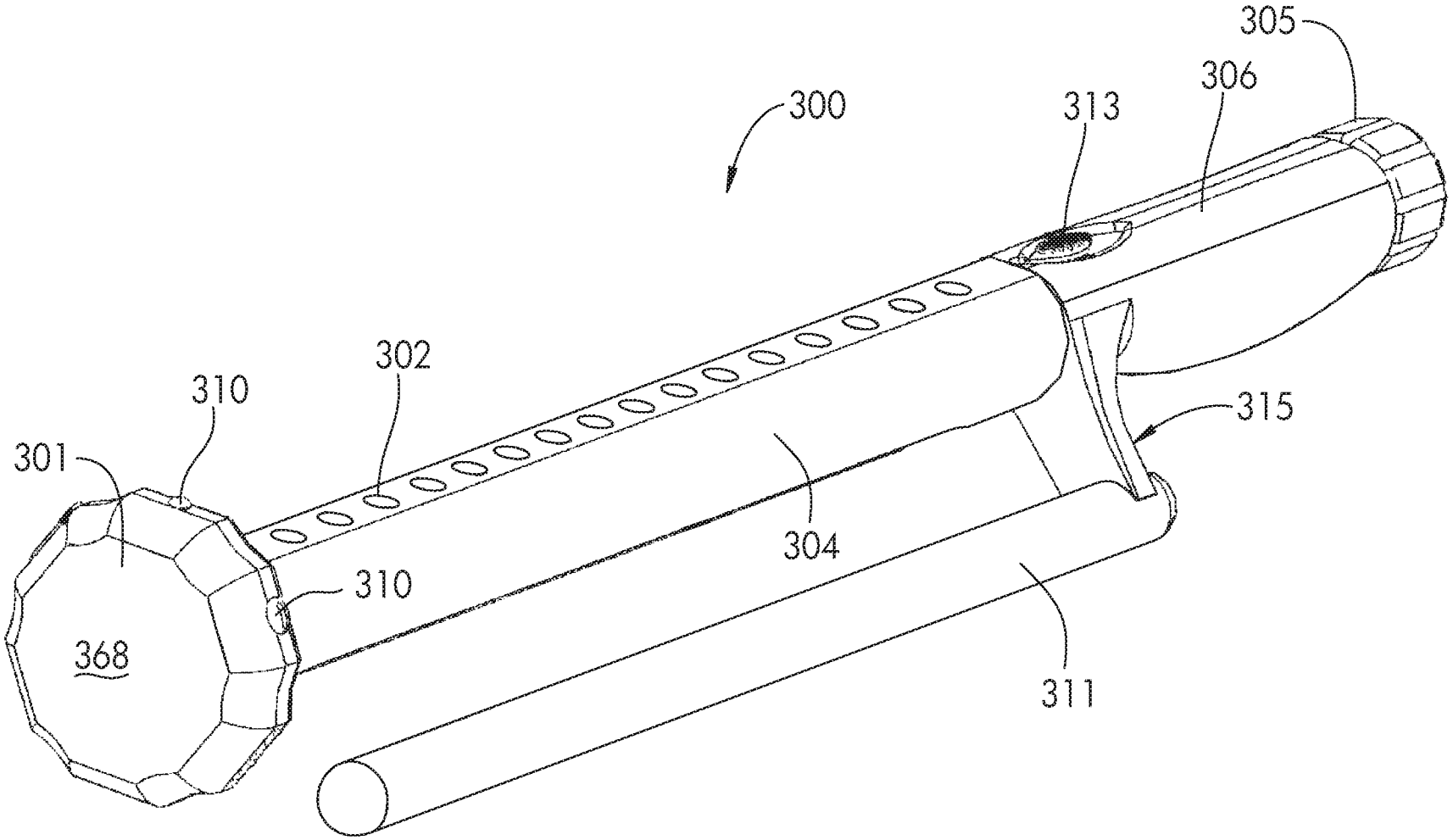
FIG. 13 is a perspective view of another embodiment of a garden watering device.

Although the second water distribution member 201 is shown having generally the same diameter as the elongate tube 204 in FIGS. 12A-12C, the rotatable spray nozzle 301 of the embodiment of the garden watering device 300 shown in FIG. 13 is larger in diameter than the elongate tube 304. The garden watering device 300 includes many of the same elements as the garden watering device 200 of the second described embodiment, and these similar elements have been marked with the same reference numbers in the 300's (i.e., the device body 215 of the previous embodiment is now device body 315 in this embodiment). In this embodiment, the support legs 311 do not extend around to the free side 368 of the rotatable spray nozzle 301 opposite the elongate tube 304. Moreover, the rotatable spray nozzle 301 may be readily rotated to various orientations such that one of the flow outlets 310 is directed in a normal direction for producing a shaped spray pattern in ground-based or handheld operation. The garden watering device 300 of this embodiment operates in the same manner as the garden watering device 200 previously described, and thus an explanation is not repeated here.

Figures 14A, 14B, 14C, 14D, 14E, 14F, 14G:
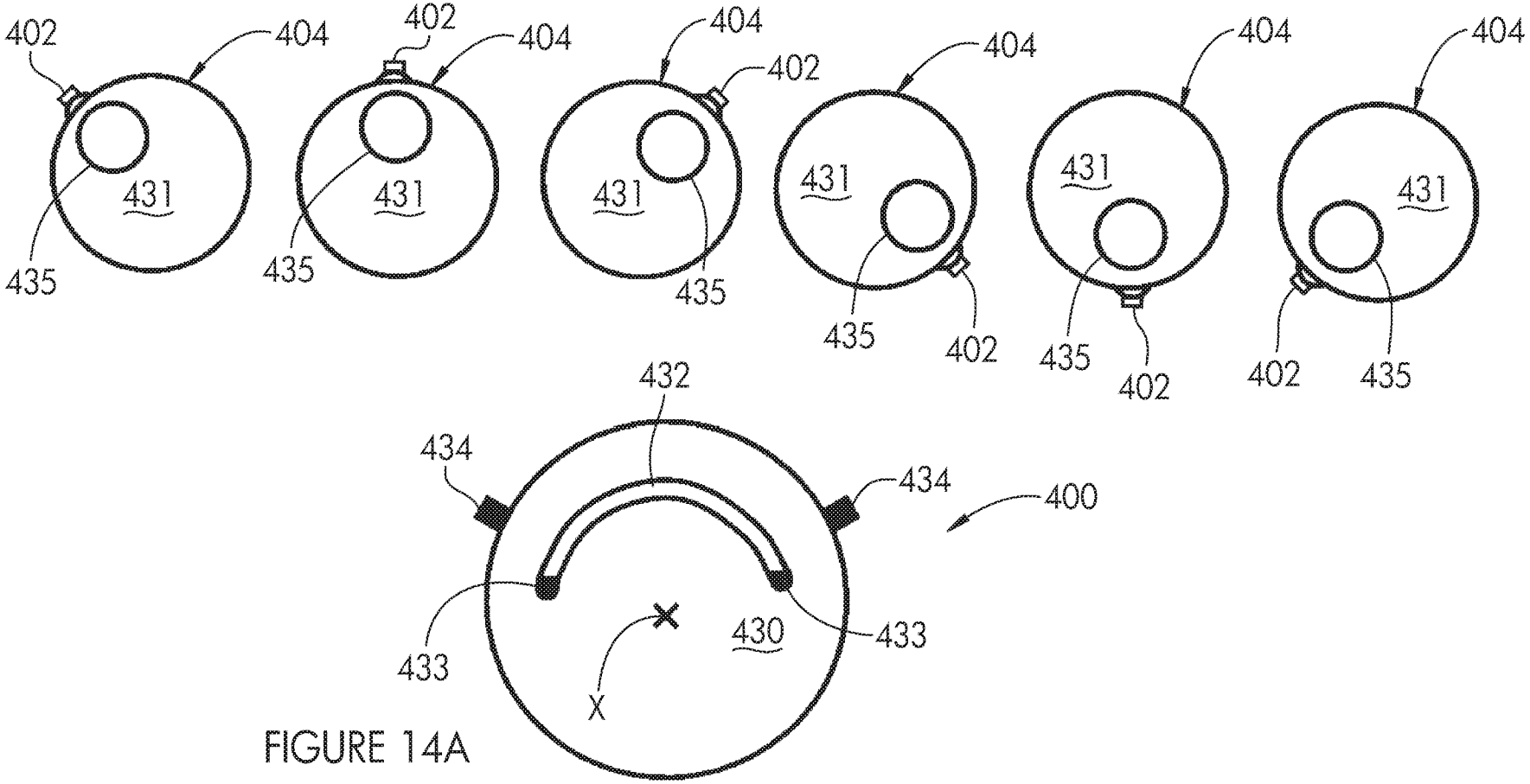
FIG. 14A is a front view of a flow control device of another embodiment of a garden watering device.
FIG. 14B is a front view of the elongate tube of the garden watering device of FIG. 14A, in a first rotational position.
FIG. 14C is a front view of the elongate tube of the garden watering device of FIG. 14A, in a second rotational position.
FIG. 14D is a front view of the elongate tube of the garden watering device of FIG. 14A, in a third rotational position.
FIG. 14E is a front view of the elongate tube of the garden watering device of FIG. 14A, in a fourth rotational position.
FIG. 14F is a front view of the elongate tube of the garden watering device of FIG. 14A, in a fifth rotational position.
FIG. 14G is a front view of the elongate tube of the garden watering device of FIG. 14A, in a sixth rotational position.

Another embodiment of the garden watering device 400 includes an elongate tube 404 as the previously-described embodiments and a flow angle control device 430 shown schematically in FIG. 14A. The flow angle control device 430 may be located in a similar location as the selector 265 shown in FIG. 12C, for example adjacent an inlet end 431 of the elongate tube 404. The flow angle control device 430 is configured to provide autonomous starts and stops of water flow at selected angular positions of the elongate tube 404. To this end, the flow angle control device 430 may include an arcuate flow orifice 432 centered at the longitudinal axis X of the elongate tube 404. The flow angle control device 430 also includes a pair of movable blocking members 433 on opposing ends of the arcuate flow orifice 432. The blocking members 433 are connected to respective handles 434 configured to rotate the blocking members 433 to block or open portions of the arcuate flow orifice 432 as desired.

The inlet end 431 of the elongate tube 404 includes a flow inlet 435 in fluid communication with the flow passage 403 leading to the dispensing orifices 402, as shown in various positions in FIGS. 14B-14G. The flow inlet 435 defines a diameter smaller than the elongate tube 404 and is centered so as to be offset from the longitudinal axis X of the elongate tube 404. In operation, the elongate tube 404 rotates 360 degrees as shown in the various sequential positions of FIGS. 14B-14G. The elongate tube 404 only provides spray from the dispensing outlets 402 when the flow inlet 435 is rotated into communication with the arcuate flow orifice 432 in the flow angle control device 430. In this regard, the elongate tube 404 would spray in the positions of FIGS. 14B-14D but not in the positions of FIGS. 14E-14G. As discussed above, the total angle through which the elongate tube 404 emits a spray of water is adjusted by moving the handles 434 coupled to the blocking members 433. The flow angle control device 430 therefore selectively turns the water supply to the elongate tube 404 off and on automatically, and pressure build-up or other negative consequences of conventional reversing oscillating watering devices are avoided.

Figure 15A:
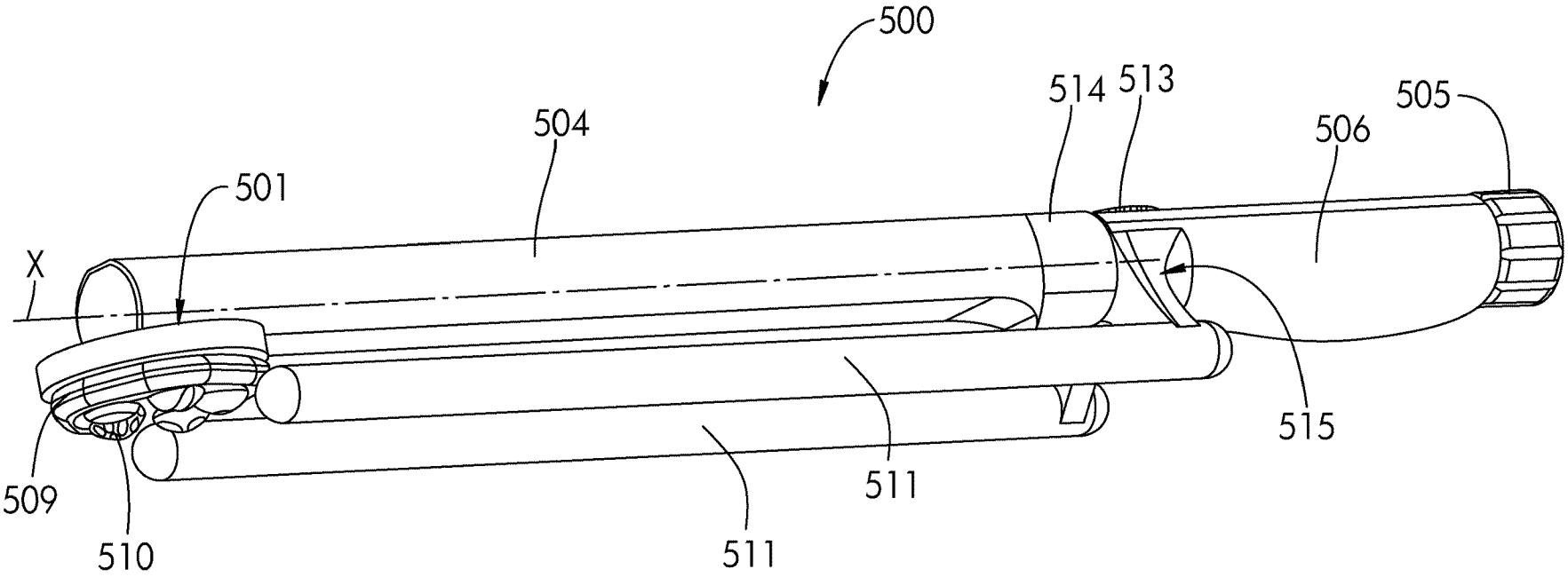
FIG. 15A is a perspective view of another embodiment of a garden watering device.
Figure 15B:
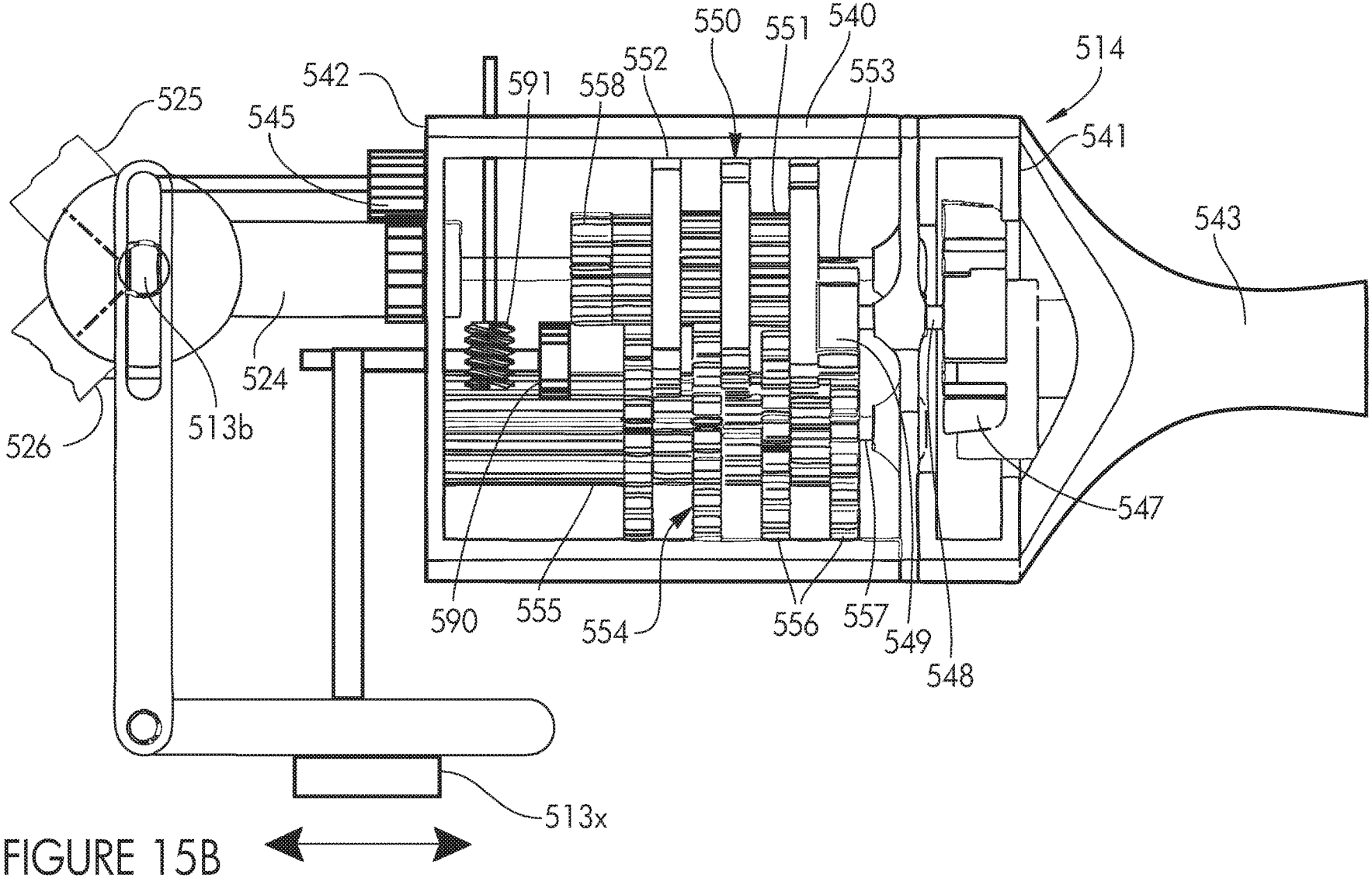
FIG. 15B is a side view of an oscillating device configured for use with the garden watering device of FIG. 15A.

Another embodiment of a garden watering device 500 is illustrated in FIGS. 15A and 15B. The garden watering device 500 includes many of the same elements as the garden watering device 200 of the second described embodiment, and these similar elements have been marked with the same reference numbers in the 500's (i.e., the device body 215 of the previous embodiment is now device body 515 in this embodiment). The garden watering device 500 of this embodiment again includes an elongate tube 504, but the second water distribution member 501 of this embodiment is a fixed multi-pattern turret head 501 generally oriented downwardly at a right angle to the longitudinal axis X of the elongate tube 504. The legs 511 extending from the device body 515 terminate just short of the multi-pattern turret head 501 such that the multi-pattern turret head 501 can freely spray past the legs 511 in a handheld operation of the garden watering device 500.

Just like previously described embodiments, the flow route selector 513 selectively places the elongate tube 504 and the multi-pattern turret head 501 in communication with the water supply. The elongate tube 504 may be operatively coupled to an oscillation device 514 similar to those previously described, for thereby oscillating the linear flow pattern of the elongate tube 504. When the flow route selector 513 directs water to the multi-pattern turret head 501, the oscillation device 514 is bypassed. The multi-pattern turret head 501 includes a rotatable dial 509 with a plurality of flow outlets 510 that may be rotated into active communication with the water supply. Consequently, the multi-pattern turret head 501 enables washing or watering with various spray patterns as desired in handheld operation.

FIG. 15B illustrates an alternative embodiment of the oscillation device 514 configured for use with the garden watering device 500 of the present embodiment or the garden watering devices 100, 200, 300 of previous embodiments. It will be understood that an additional flow route selector 513*x* is positioned in this illustration at a location downstream of the oscillation device 514, although the original flow route selector 513 upstream of the oscillation device 514 may also be provided in some embodiments. The oscillation device 514 includes many of the same elements as the oscillation device 114 of the first described embodiment, and these similar elements have been marked with the same reference numbers in the 500's (i.e., the fluid connector 143 of the previous embodiment is now fluid connector 543 in this embodiment). In this regard, the oscillation device 514 includes a paddlewheel 547 coupled to a propulsion gear 549, a first gear stack 550, a second gear stack 554, and an outlet gear 558 coupled to a final driver surface 545 disposed outside the housing 540 as shown in FIG. 15B. The first gear stack 550 and second gear stack 554 are engaged such that the second outer gears 556 are disposed between adjacent first outer gears 552, thereby enabling gear meshing between the elongate first inner gear 551 and the second outer gears 556, as well as gear meshing between the elongate second inner gear 555 and the first outer gears 552. The propulsion gear 549 is engaged with one of the first outer gears 552.

In this embodiment, the outlet gear 558 is not always in operative engagement with the elongate second inner gear 555. Instead, the flow route selector 513*x* further includes a connection gear 590 disposed within the housing 540 and connected to move with the lever 513*a*. Therefore, when the flow route selector 513*x* is moved to a position where the valve 513*b* communicates with the primary channel 524 exiting the oscillation device 514 and the upper channel 525 leading to the elongate tube 504, the connection gear 590 is slid into operative engagement with the outlet gear 558 to thereby provide rotation from the elongate second inner gear 555 to the outlet gear 558. In this arrangement, the elongate tube 504 is actuated to oscillate by the oscillation device 514. If the flow route selector 513*x* is then moved to a position where the valve 513*b* communicates with the primary channel 524 and the lower channel 526 leads to the multi-pattern turret head 501 (or a third rotatable spray head such as head 293 shown in the embodiment of FIG. 12B), the connection gear 590 decouples from the outlet gear 558 and rotation of the elongate tube 504 is disabled. In this regard, the flow route selector 513*x* determines whether water moving through the oscillation device 514 is used to actuate rotational movement of the elongate tube 504. It will also be understood that the water flow actuates the movement of the paddlewheel 547 and the gear stacks 550, 554 as previously described.

Additionally, the oscillation device 514 may further include a secondary gear 591 positioned off-center within the housing 540. When the flow route selector 513 disengages the connection gear 590 from the outlet gear 558, the connection gear 590 may be pulled into engagement with the secondary gear 591 when water is being directed through the valve 513*b* to the multi-pattern turret head 501. The secondary gear 591 may be operatively coupled to the multi-pattern turret head 501 (or a third rotatable spray head such as head 293 shown in the embodiment of FIG. 12B) such that rotation of the secondary gear 591 actuates rotation of the multi-pattern turret head 501. To this end, the oscillation device 514 selectively rotates either of the water distribution members depending upon the position of the flow route selector 513*x* and the connection gear 590. It will be understood that the connection gear 590 acts as an idler gear when not engaged with the outlet gear 558 or the secondary gear 591. Consequently, the oscillation device 514 of the garden watering device 500 enables the elongate tube 504 to spray a lineal sequence of water streams in a pivoting fashion and also enables the multi-pattern turret head 501 to deliver water in a circular pattern.

Figure 15C:
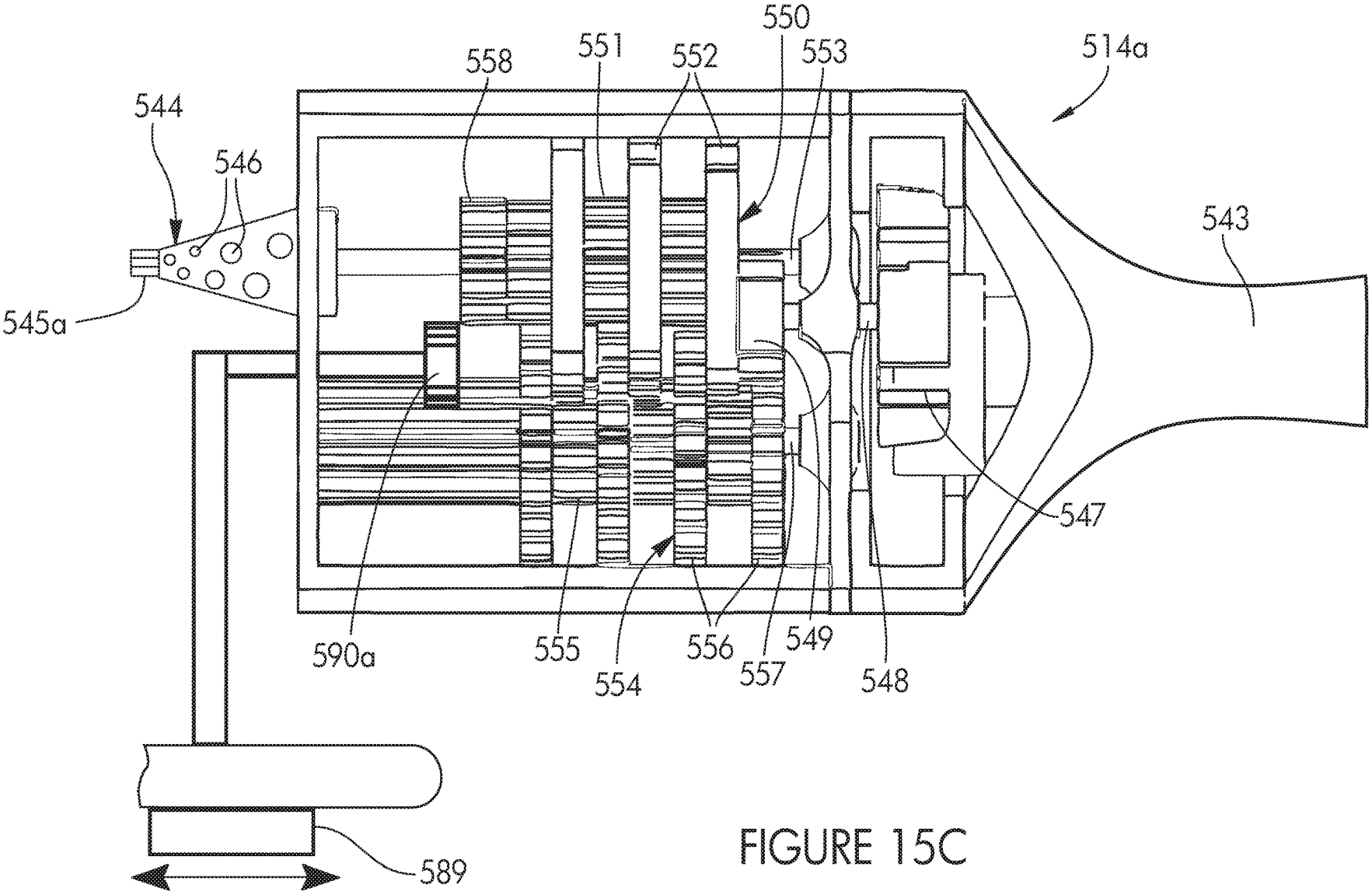
FIG. 15C is a side view of an alternative embodiment of an oscillating device configured for use with the garden watering device of FIG. 15A.

Yet another alternative embodiment of the oscillation device 514*a* is shown in FIG. 15C. The oscillation device 514*a* includes many of the same elements as the oscillation device 514 of the previous embodiment (FIG. 15B), and these similar elements have been marked with the same reference numbers. Again, the oscillation device 514*a* includes a paddlewheel 547 coupled to a propulsion gear 549, a first gear stack 550, a second gear stack 554, and an outlet gear 558 coupled to a final driver surface 545*a* disposed outside the housing 540 as shown in FIG. 15B. The final driver surface 545*a* is carried by a final gear drive adapter 544 also having a plurality of through apertures 546 for water exiting the housing 540. The first gear stack 550 and second gear stack 554 are engaged such that the second outer gears 556 are disposed between adjacent first outer gears 552, thereby enabling gear meshing between the elongate first inner gear 551 and the second outer gears 556, as well as gear meshing between the elongate second inner gear 555 and the first outer gears 552. The propulsion gear 549 is engaged with one of the first outer gears 552.

Just like the previous embodiment, the oscillation device 514*a* includes a connection gear 590*a* which is moveable by sliding movement of an oscillation selector lever 589 disposed outside the oscillation device 514*a*. The oscillation selector lever 589 is completely separate from the flow route selector 513, which is again typically placed upstream from the oscillation device 514*a* in this embodiment. Thus, the oscillation selector lever 589 may be moved such that the connection gear 590*a* transmits rotation from the elongate inner second gear 555 to the outlet gear 558 and the elongate tube 504 via the final driver surface 545*a*. Alternatively, the oscillation selector lever 589 may be moved to disengage the connection gear 590*a* and the outlet gear 558 as shown in FIG. 15C, which thereby stops any oscillation of the elongate tube 504. Consequently, the oscillation device 514*a* of this embodiment enables operative disengagement of the elongate tube 504 from the oscillation device 514*a* when the elongate tube 504 is in the desired position.

Figure 16A:
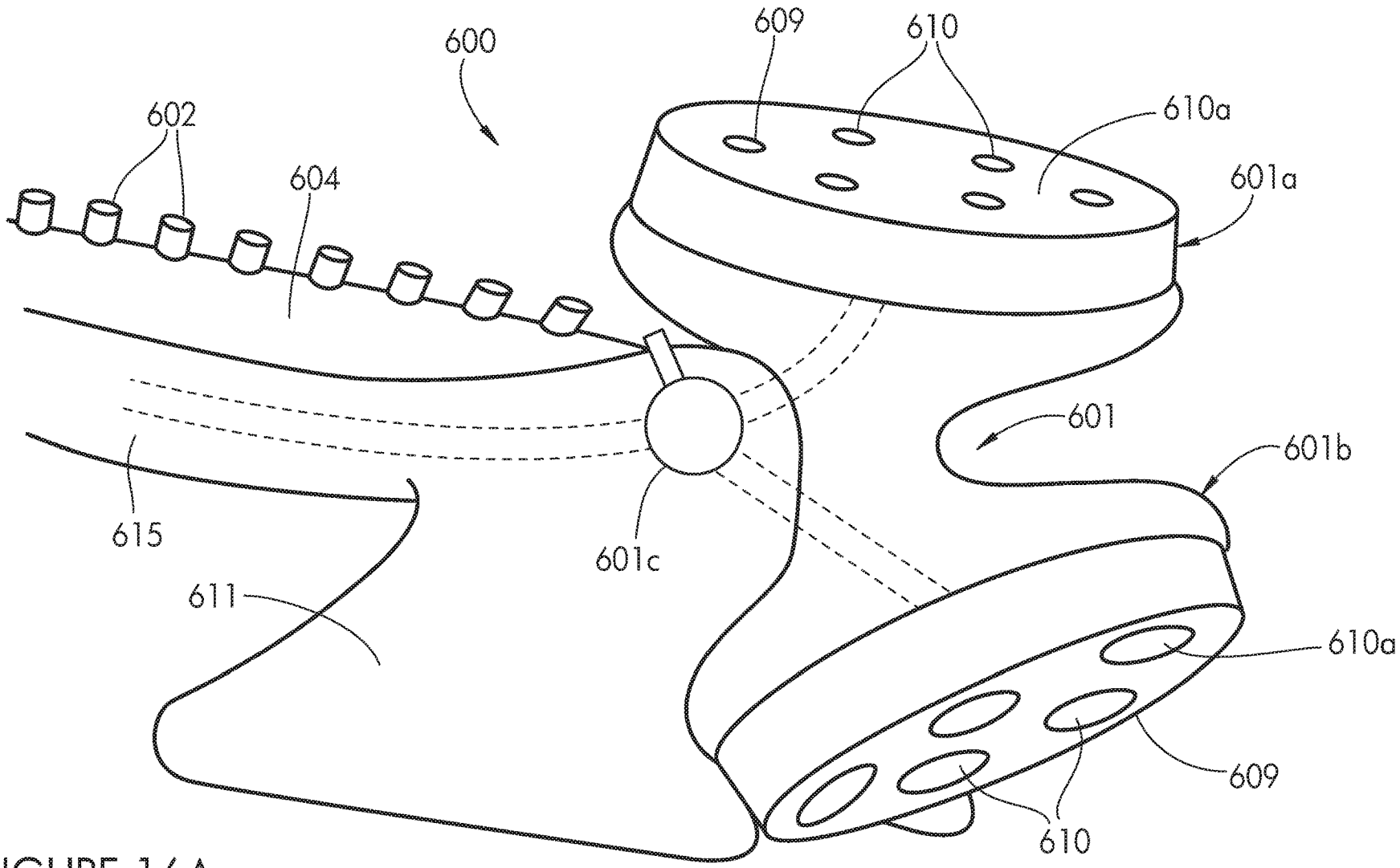
FIG. 16A is a perspective view of another embodiment of a garden watering device.

Yet another embodiment of a garden watering device 600 is illustrated in FIG. 16A. The garden watering device 600 includes many of the same elements as the garden watering device 100 of the first described embodiment, and these similar elements have been marked with the same reference numbers in the 600's (i.e., the device body 115 of the previous embodiment is now device body 615 in this embodiment). The garden watering device 600 of this embodiment includes a double fixed turret head 601 having an upper head 601*a* and a lower head 601*b*. The water passing through the garden watering device 600 may be directed to spray through the elongate tube 604 or the upper head 601*a* and the lower head 601*b*. Thus, the garden watering device 600 may be configured for ground-based or handheld operation.

More particularly, the double fixed turret head 601 further includes a flow divider 601*c* that supplies water to each of the upper head 601*a* and the lower head 601*b* simultaneously. The flow divider 601*c* may be modified to actively control flow to only one of the heads 601*a*, 601*b* in alternative embodiments, for example, like the internal mechanisms disclosed in U.S. Pat. No. 4,903,897 to Hays, which is incorporated by reference herein. In the illustrated embodiment, each of the upper head 601*a* and the lower head 601*b* include a rotatable dial 609 with a plurality of flow outlets 610 configured to provide varying spray patterns. Each of the rotatable dials 609 includes a blank outlet 610*a* which blocks outward flow of the water through that head 601*a*, 601*b*. Thus, in a ground-based operation, the lower head 601*b* would typically be rotated to block flow such that only flow through the upper head 601*a* occurs, while in a handheld operation, the upper head 601*a* would typically be rotated to block flow such that only flow through the lower head 601*b* occurs. Additionally, each of the upper head 601*a* and the lower head 601*b* may be rotated to simultaneously block flow, which would prevent any water flow from the double fixed turret head 601.

Figure 16B:
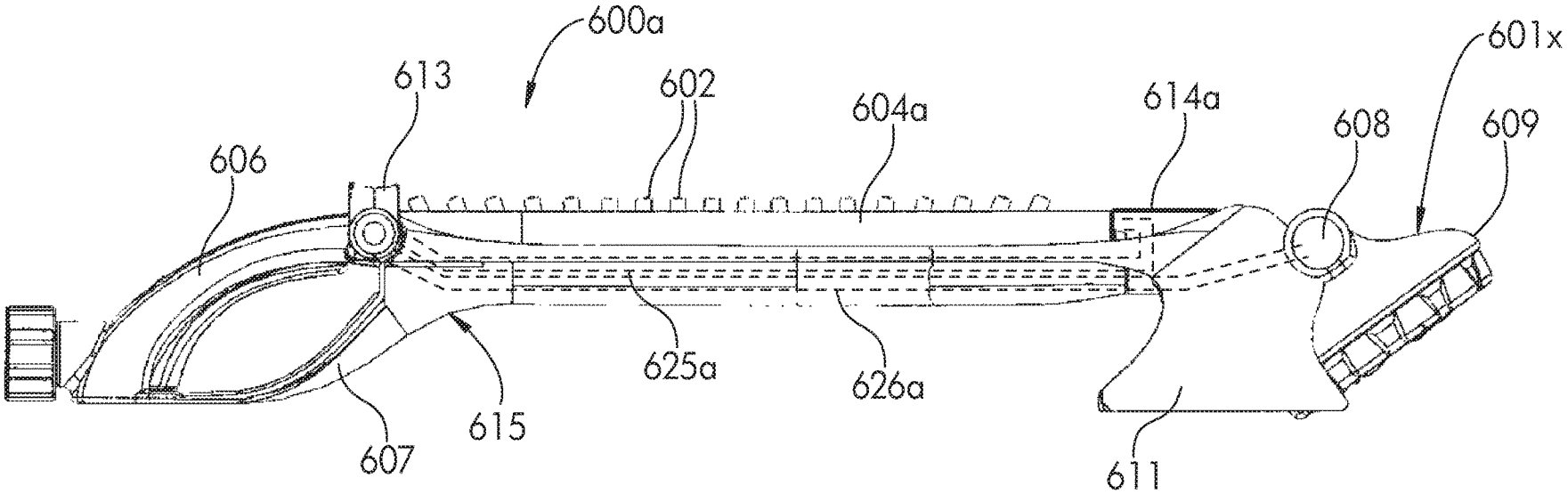
FIG. 16B is a perspective view of another embodiment of a garden watering device.

Yet another embodiment of a garden watering device 600*a* is illustrated in FIG. 16B. The garden watering device 600*a* includes many of the same elements as the garden watering device 100 of the first described embodiment, and these similar elements have been marked with the same reference numbers in the 600's (i.e., the device body 115 of the previous embodiment is now device body 615 in this embodiment). The garden watering device 600*a* of this embodiment is embodied as a reverse oscillation mechanism because the oscillation device 614*a* is positioned on the opposite end of the elongate tube 604*a* from the handle 606 and the flow route selector 613. Thus, each of the upper channel 625*a* and the lower channel 626*a* branching off from the flow route selector 613 extends along the device body 615 to the opposite end of the garden watering device 600*a* (i.e., adjacent the multi-pattern head 601*x*). The upper channel 625*a* then bends back on itself to enter the oscillation device 614*a*, which operates as any of the previously-described oscillation devices to oscillate the elongate tube 604*a*. The lower channel 626*a* delivers water to the articulating joint 608 and then to the multi-pattern head 601*x* as previously described.

It will be understood that the components of the various embodiments of the garden watering device described above and below may be combined in various combinations not illustrated herein, but within the scope of the invention. For example, another embodiment of a garden watering device may include three or more water distribution members. For example, the garden watering device may include the elongate tube (e.g., 104), the rotatable spray nozzle (e.g., 201) sharing the same axis of rotation as the elongate tube, and a multi-pattern turret-style head (e.g., 101) spaced from each of the elongate tube and rotatable spray nozzle. The flow route selector may be modified as previously described to route the water flow to one of three or more internal channels leading to the respective three water distribution members. In this regard, a single garden watering device may be reconfigured for a high number of watering and washing purposes.

Figure 17A:
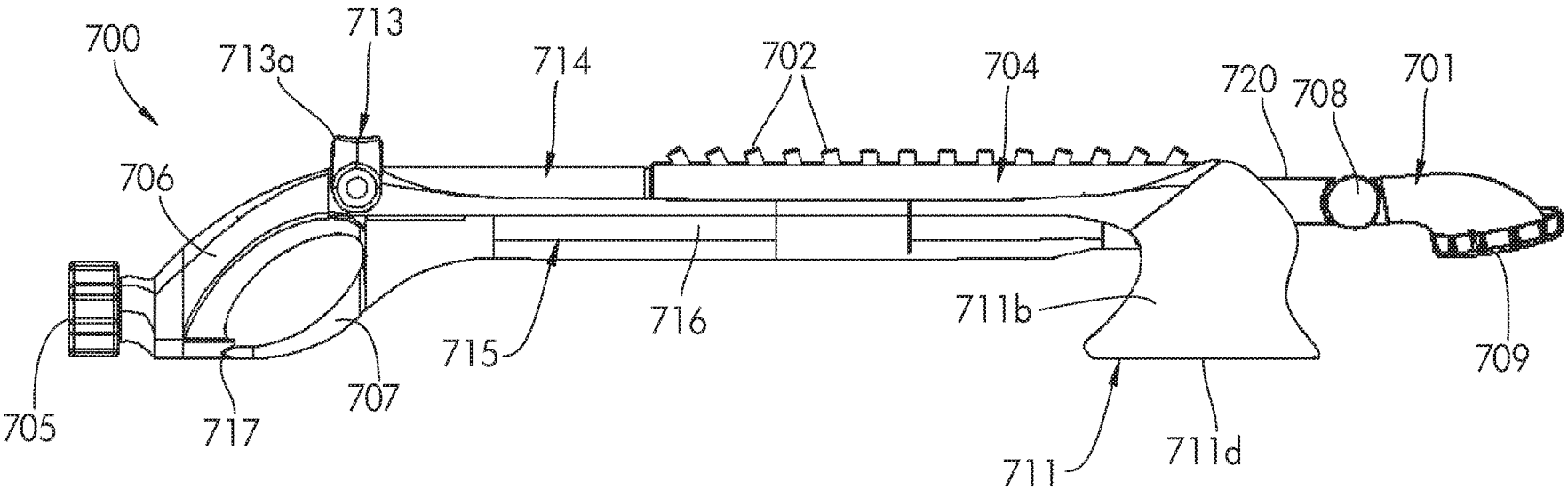
FIG. 17A is a side view of another embodiment of a garden watering device having a telescoping component in a retracted position.
Figure 17B:
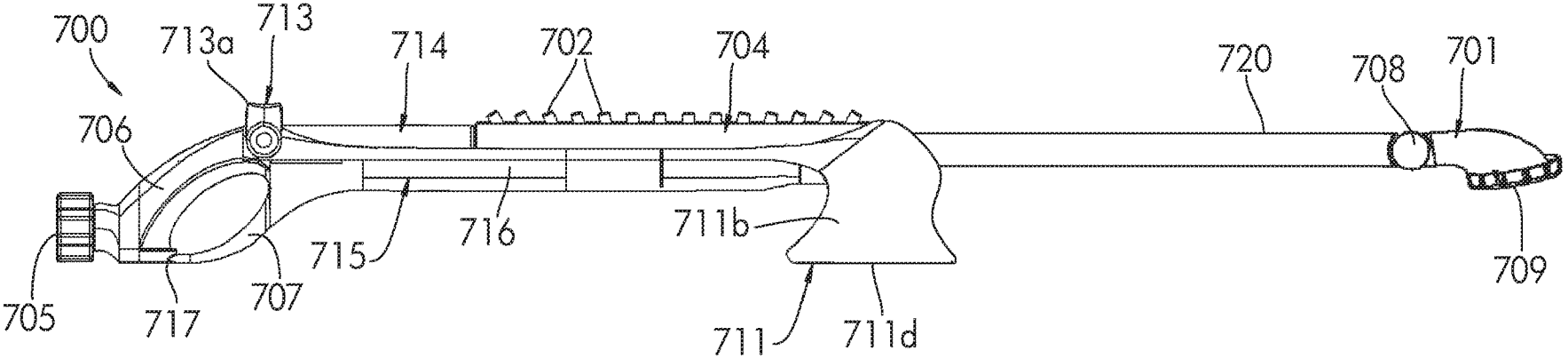
FIG. 17B is a side view of the garden watering device of FIG. 17A with the telescoping component in an extended position.
Figure 17C:
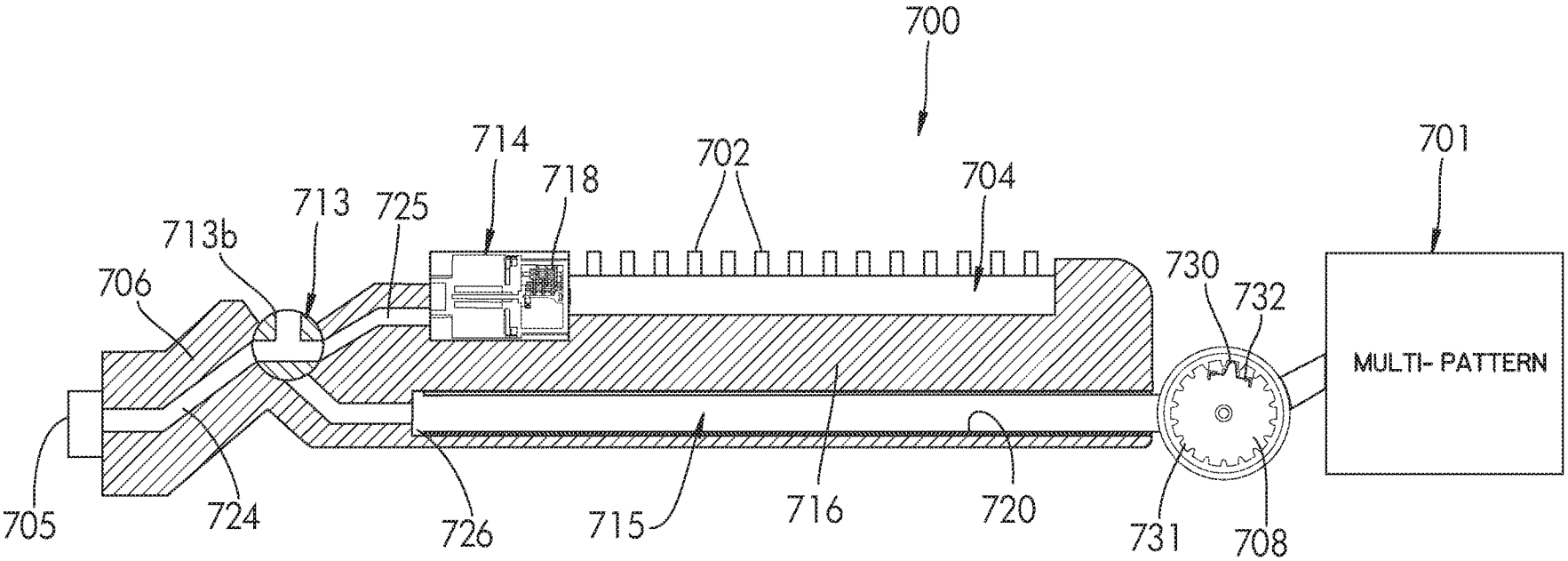
FIG. 17C is a partial cross sectional side view of the garden watering device of FIG. 17A.
Figure 17D:
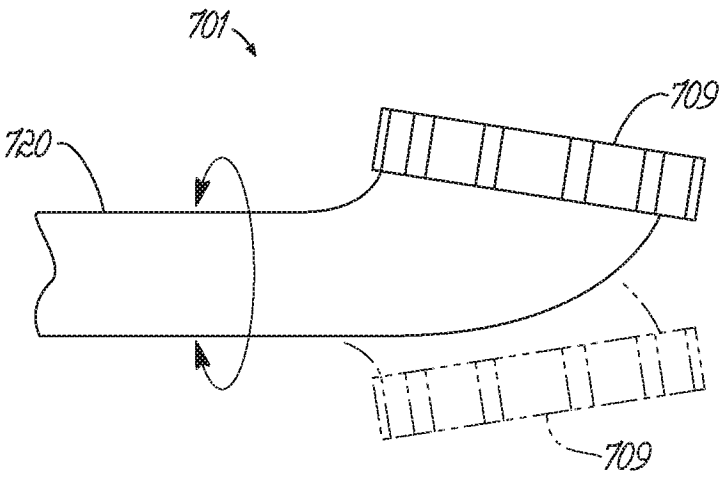
FIG. 17D is a partial side view of an alternate embodiment of a spray head for a garden watering device.
Figure 18A:
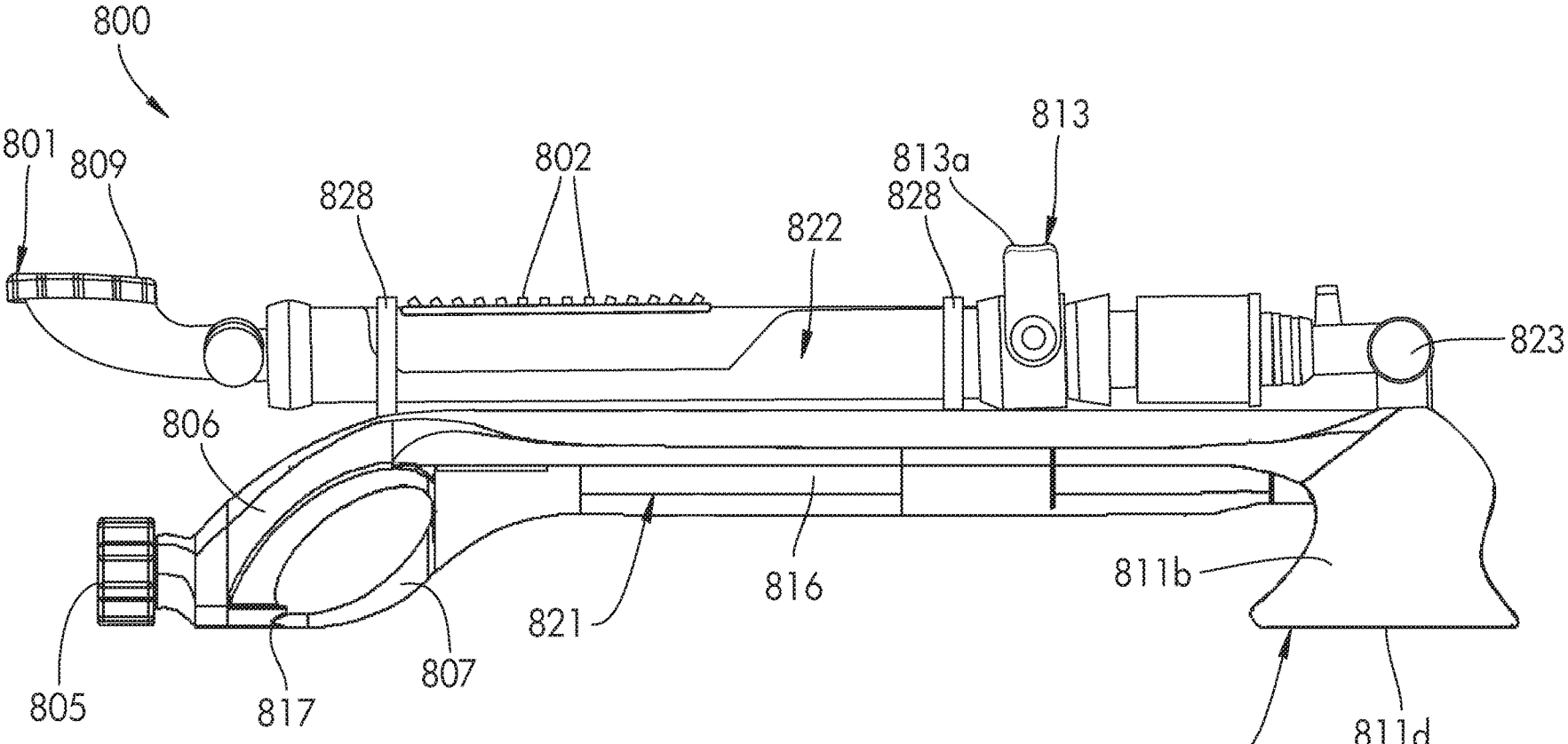
FIG. 18A is a side view of another embodiment of a garden watering device in a folded position.
Figure 18B:
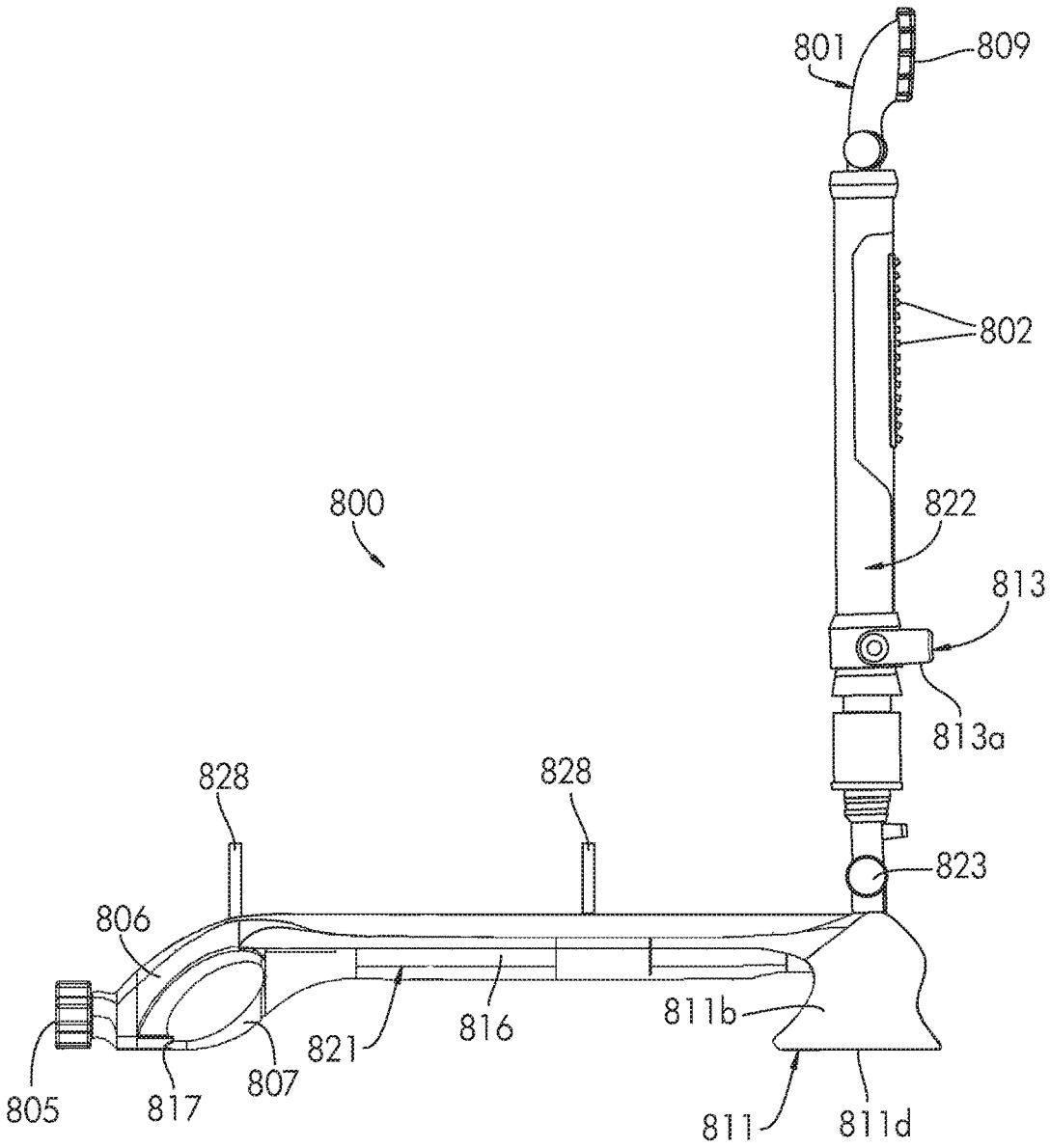
FIG. 18B is a side view of the garden watering device of FIG. 18A in a partially unfolded position.
Figure 18C:
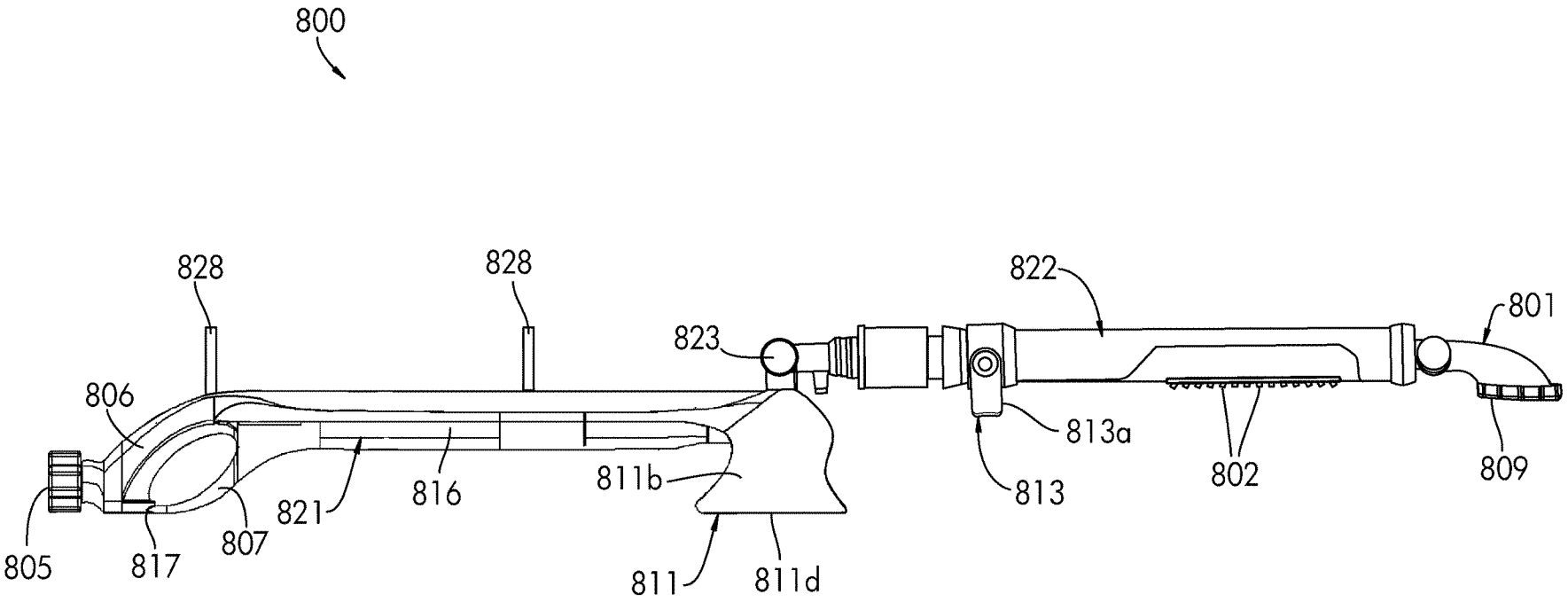
FIG. 18C is a side view of the garden watering device of FIG. 18A in a fully unfolded position.
Figure 18D:
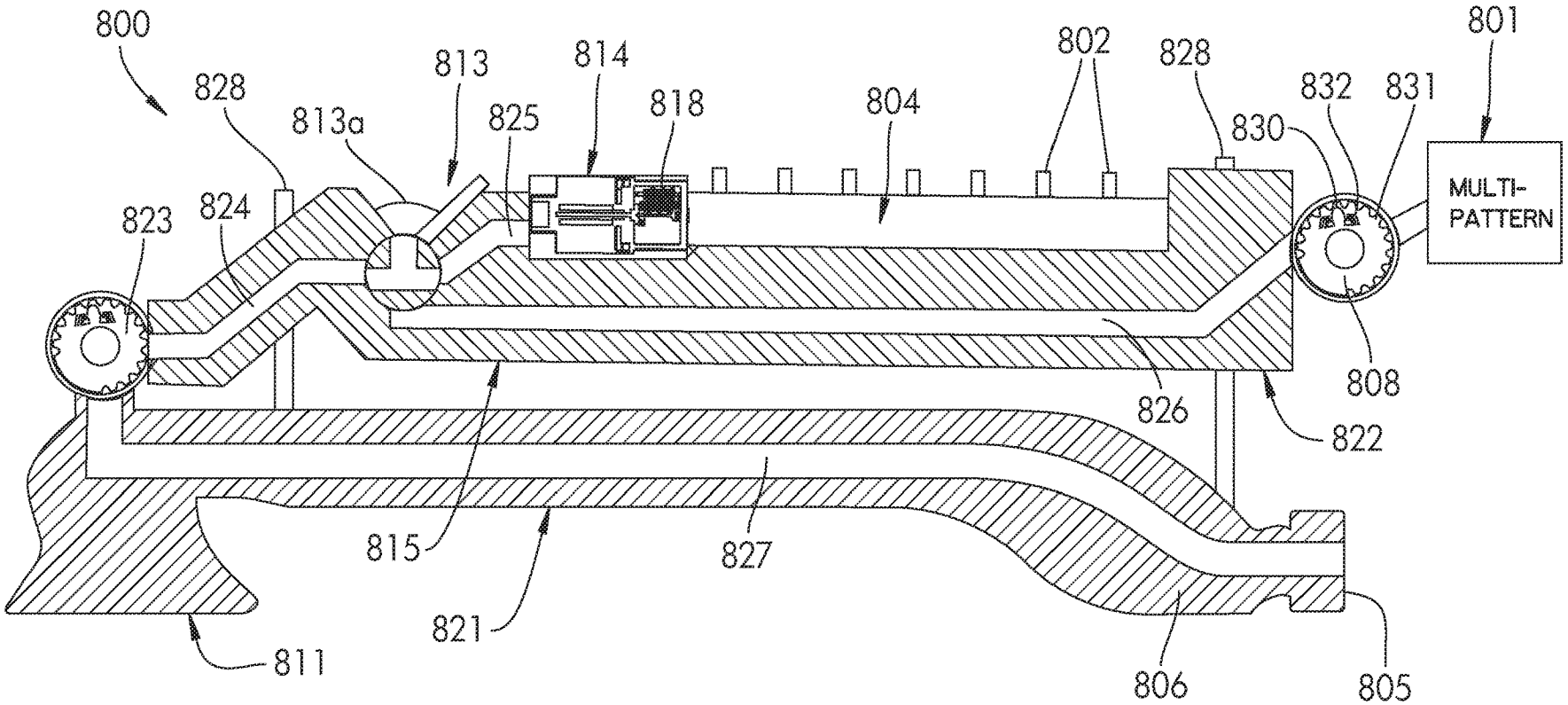
FIG. 18D is a partial cross sectional side view of the garden watering device of FIG. 18A.

Another alternative embodiment of a garden watering device 700 is illustrated in FIGS. 17A-17C. The garden watering device 700 includes many of the same elements as the garden watering device 100 of the first described embodiment, and these similar elements have been marked with the same reference numbers in the 700's (i.e., the device body 115 of the previous embodiment is now device body 715 in this embodiment). The garden watering device 700 of this embodiment includes a telescoping member 720 configured to be housed within the lower channel 726 as shown most clearly in FIG. 17C. The telescoping member 720 is defined by geometry that allows it to be housed within the lower channel 726. The multi-pattern head 701 and the articulating joint 708 are located at the distal end of the telescoping member 720 opposite to the handle 706.

The telescoping member 720 may be placed in the retracted position shown in FIG. 17A, and the garden watering device 700 will operate in the same manner as the first described embodiment. When the telescoping member 720 is extended to the extended position shown in FIG. 17B, the garden watering device 700 may sprinkle more area without moving the device 700 in the ground-based operation or may spray hard-to-reach locations in the handheld operation. The telescoping member 720 may be sized for a slight frictional fit with the lower channel 726 of the device body 715, which allows the telescoping member 720 to be locked in any position between the retracted position and the extended position. Thus, the garden watering device 700 is useful for a plurality of watering tasks.

Another alternative embodiment of a garden watering device 800 is illustrated in FIGS. 18A-18D. The garden watering device 800 includes many of the same elements as the garden watering device 100 of the first described embodiment, and these similar elements have been marked with the same reference numbers in the 800's (i.e., the oscillation device 114 of the previous embodiment is now oscillation device 814 in this embodiment). The garden watering device 800 of this embodiment includes a device body 815 having a lower body portion 821 and an upper body portion 822 coupled at an articulating hinge joint 823. The lower body portion 821 includes the water inlet coupling 805, the handle 806, the support leg 807, and the support structure 811 as shown in the previous embodiments, as well as a flow passage 827 in fluid communication with the water inlet coupling 805. The upper body portion 822 includes the primary channel 824, the upper channel 825 leading to the oscillation device 814 and elongate tube 804, and the lower channel 826 leading to the articulating joint 808 and multi-pattern head 801. The articulating hinge joint 823 operates in a similar manner as the articulating joint 808. As most clearly shown in FIG. 18D, water flows from the water inlet coupling 805 through the flow passageway 827 in the lower body portion 821 and the articulating hinge joint 823 into the primary channel 824 in the upper body portion 822. The water then encounters the flow route selector 813, which operates in a similar manner as previously described.

Like the garden watering device 700 of the previous embodiment, this garden watering device 800 may be extended to improve the coverage area or reach of the device 800. The lower body portion 821 may further include receptacle brackets 828 configured to hold the upper body portion 822 when the garden watering device 800 is in a folded position shown in FIG. 18A. The upper body portion 822 can then be rotated around the articulating hinge joint 823 to the partially unfolded position shown in FIG. 18B and then to the unfolded position shown in FIG. 18C. Thus, the garden watering device 800 is useful for a plurality of watering tasks.

Another alternative embodiment of a garden watering device 900 is illustrated in FIGS. 19A-19C. The garden watering device 900 includes many of the same elements as the garden watering devices 100, 800 of the previously described embodiments, and these similar elements have been marked with the same reference numbers in the 900's (i.e., the oscillation device 114 of the previous embodiment is now oscillation device 914 in this embodiment). The garden watering device 900 of this embodiment includes a device body 915 having a pair of support legs 911 (only one shown in the side views of FIGS. 19A and 19B) and an upper body portion including an oscillation device 914, an elongate tube 904, and a rotatable spray head 901 extending integrally from the elongate tube 904 as previously described with the embodiment shown in FIG. 12A. The support legs 911 and the upper body portion are coupled at an articulating hinge joint 523. Consequently, the garden watering device 900 may move between at least two positions for ground-based operation: parallel to the ground surface as shown in FIG. 19A, and a rotating tower as shown in FIG. 19B.

Rather than outputting rotation to a final driver surface as the previously-described oscillating devices, the oscillating device 914 of this embodiment outputs rotation to a drive shaft 995. The drive shaft 995 is hexagonal in FIG. 19C, but other shapes are possible within the scope of this invention. Each of the elongate tube 904 and the rotatable spray head 901 are selectively coupled with the drive shaft 995 to enable oscillation of one or both of the water distribution members. The elongate tube 904 includes a locking member 996 that may be rotated by an external handle 996*a* into and out of engagement with the elongate tube 904. When the locking member 996 is engaged with the elongate tube 904, the drive shaft 995 is tightly held within a hexagonal cavity defined between the elongate tube 904 and the locking member 996, thereby transmitting rotation from the oscillation device 914 to the elongate tube 904. In a similar manner, a structural member 997 integrally extending from the rotatable spray head 901 also includes a locking member 996 that may rotate into engagement with the structural member 997 to tightly capture the drive shaft 995 therein (see FIG. 19C). In the position shown in FIG. 19C, the drive shaft 995 transmits rotation from the oscillation device 914 to the rotatable spray head 901. Consequently, in the rotating tower position shown in FIG. 19B, the garden watering device 900 can emit a rotational spray of water generally parallel to the ground about an arc of any length, similar to conventional impulse sprinklers. However, the garden watering device 900 is also configured for use as a ground-based or handheld sprinkler like the other previously-described embodiments, unlike a conventional impulse sprinkler.

Figure 20:
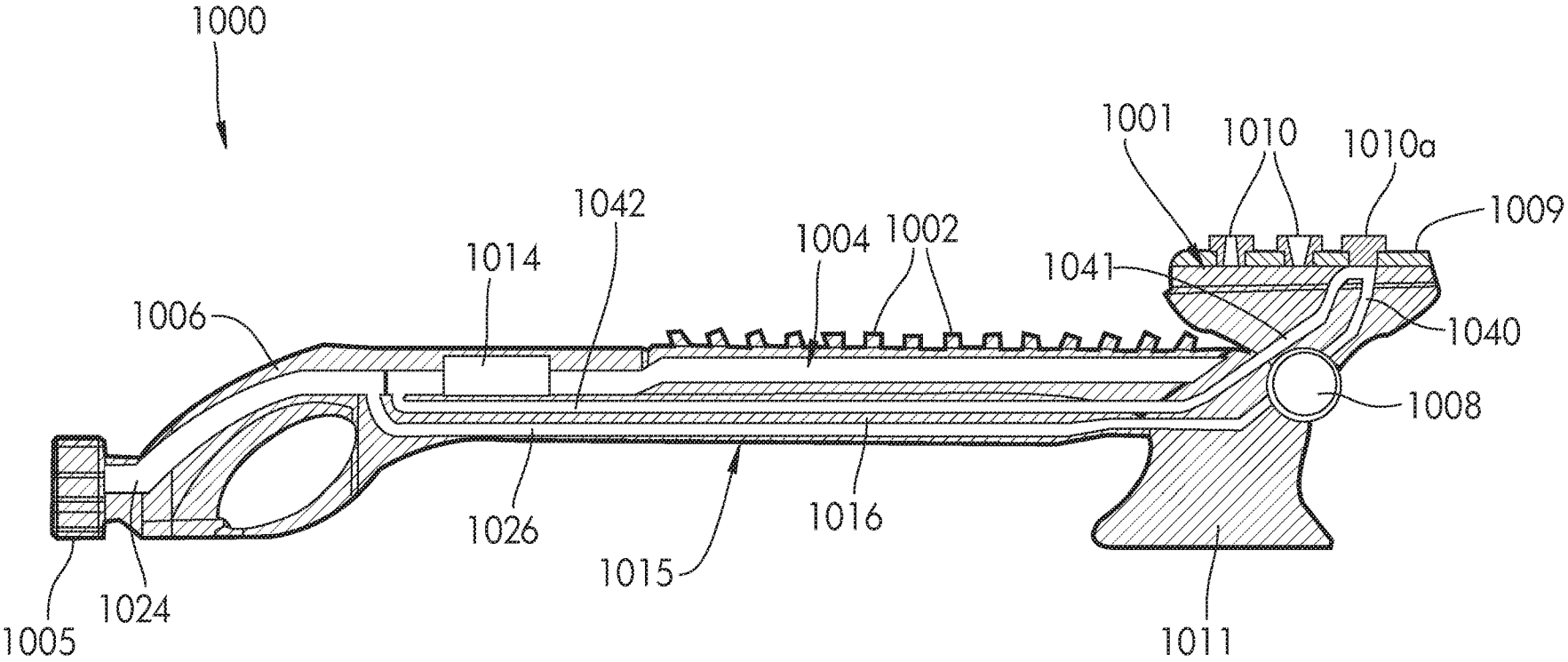
FIG. 20 is a partial cross sectional side view of another embodiment of a garden watering device, including a flow route selector integrated into an articulating joint.

Another alternative embodiment of a garden watering device 1000 is illustrated in FIG. 20. The garden watering device 1000 includes many of the same elements as the garden watering device 100 of the first described embodiment, and these similar elements have been marked with the same reference numbers in the 1000's (i.e., the oscillation device 114 of the first embodiment is now oscillation device 1014 in this embodiment). This garden watering device 1000 incorporates the flow route selector into the multi-pattern head 1001 at the rotatable dial 1009. The primary channel 1024 is directly in fluid communication with only the lower channel 1026 in this garden watering device 1000. As with previous embodiments, the dial 1009 includes a plurality of flow orifices 1010 which may be aligned with the water flow path through the multi-pattern head 1001.

In this garden watering device 1000, the multi-pattern head 1001 includes a first flow passage 1040 connecting the articulating joint 1008 with the flow orifices 1010. The multi-pattern head 1001 also includes a second flow passage 1041 leading from the flow orifices 1010 to a return channel 1042 provided in the central body portion 1016. When a blank or solid flow orifice 1010*a* is positioned over the water flow path, water is blocked from exiting the multi-pattern head 1001 and is forced into the return channel 1042, which leads to the elongate tube 1004 and oscillation device 1014 as previously described. The operator can select if the flow of water will be directed to the multi-pattern head 1001 or the elongate tube 1004 by rotating the dial 1009 to selectively position blank flow orifice 1010*a* over the multi-pattern head 1001 flow path.

Figure 21A:
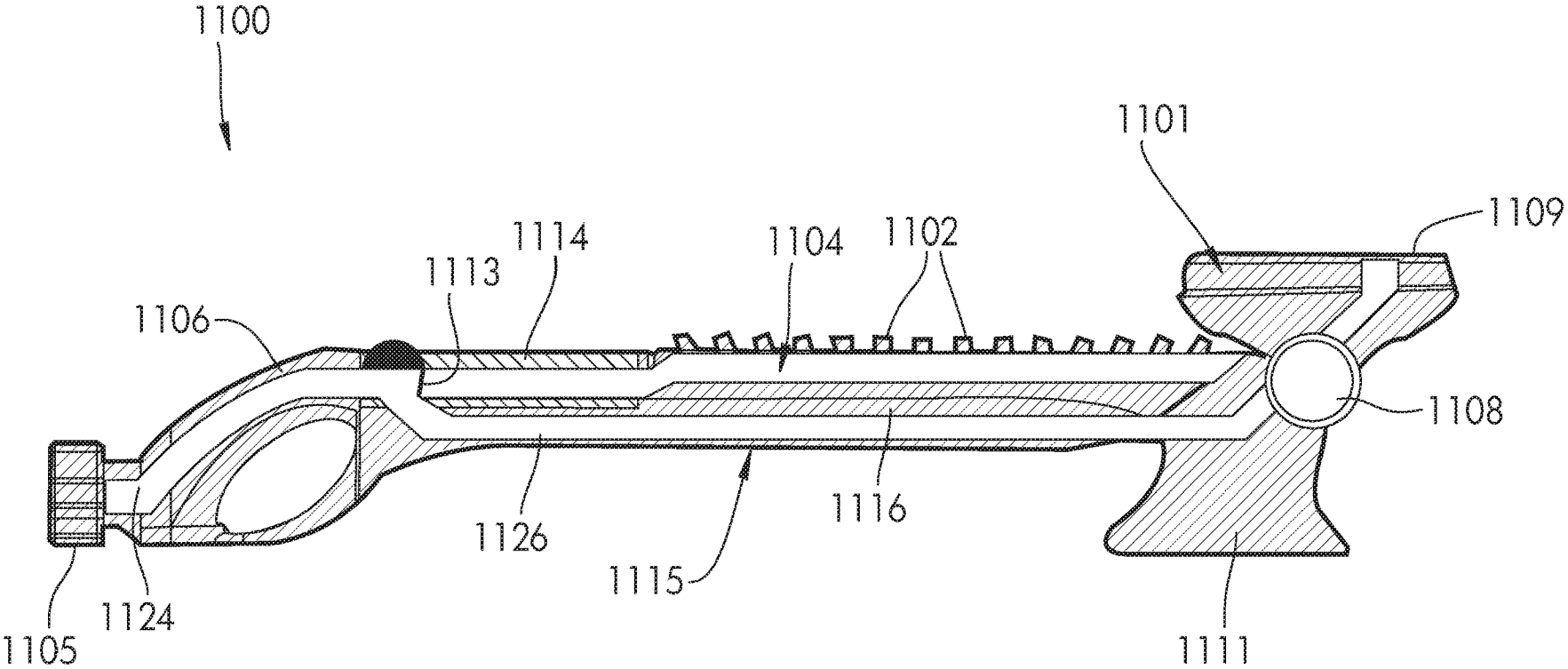
FIG. 21A is a partial cross-sectional side view of another embodiment of a garden watering device, including a flow route selector integrated into an oscillating device of an elongate tube.
Figure 21B:
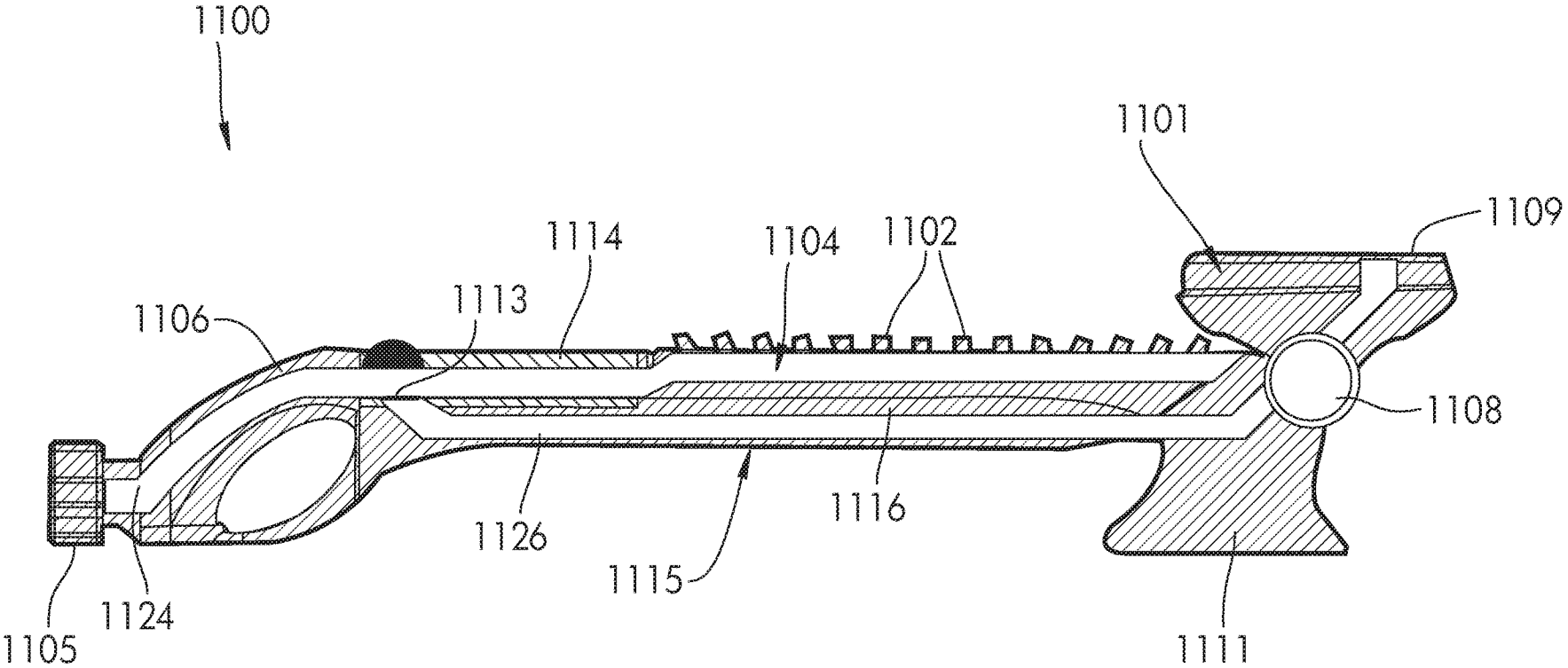
FIG. 21B is a partial cross-sectional side view of the garden watering device of FIG. 21A, showing the flow route selector in a different position.
Figure 22:
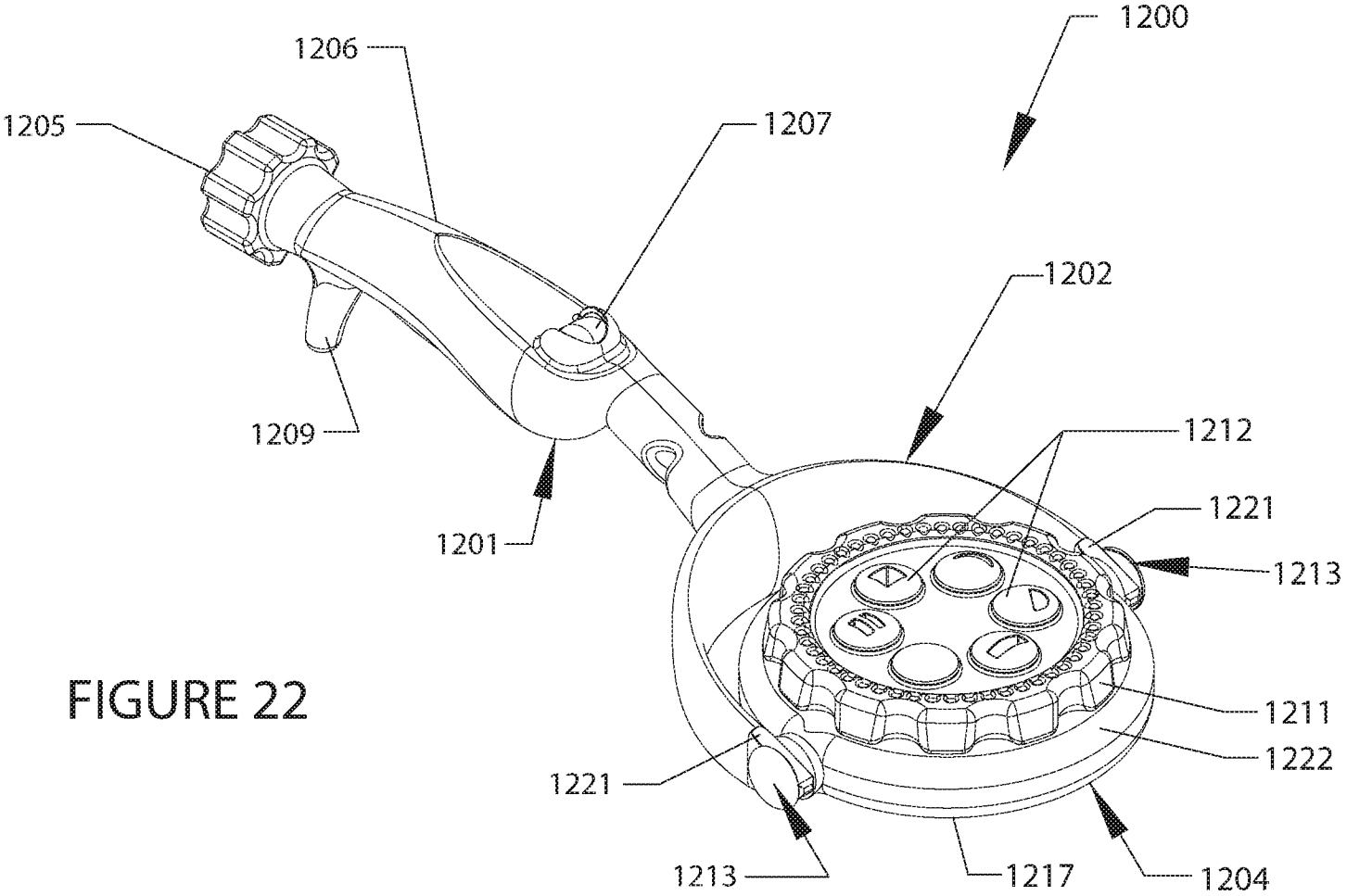
FIG. 22 is perspective view of the garden watering device in accordance with another embodiment.

Another alternative embodiment of a garden watering device 1100 is illustrated in FIGS. 21A and 21B. The garden watering device 1100 includes many of the same elements as the garden watering device 100 of the first described embodiment, and these similar elements have been marked with the same reference numbers in the 1100's (i.e., the oscillation device 114 of the first embodiment is now oscillation device 1114 in this embodiment). This garden watering device 1100 incorporates the flow route selector 1113 into the oscillation device 1114 that drives the elongate tube 1104. The oscillation device 1104 is mounted on the device body 1115 so that the oscillation device 1114 may rotate 360 degrees about an axis along the length of the elongate tube 1104. The flow route selector 1113 is shown schematically in FIG. 21A and operates as a three-way valve coupling a primary channel 1124 from the water inlet 1105 selectively with either the oscillation device 1114 or the lower channel 1126 leading to the multi-pattern head 1101. Thus, in a first position shown in FIG. 21A, the flow route selector 1113 blocks water from flowing into the oscillation device 1114 and allows flow of water into the lower channel 1126 and the multi-pattern head 1101. When the oscillation device 1114 is rotated approximately 180 degrees to a second position shown in FIG. 21B, the flow route selector 1113 blocks water flow into the lower channel 1126 and permits water to flow into the oscillation device 1114 and subsequently, the elongate tube 1104.

Another alternative embodiment of a garden watering device 1200 is shown in FIGS. 22-29. The garden watering device 1200 includes a multi-pattern head 1204 and a body member 1201. The body member 1201 includes a handle 1206 and a U-shaped arm 1202 extending to arm ends 1221 on opposite sides of the multi-pattern head 1204. The handle 1206 allows the operator to use the device for handheld operation. The U-shaped arm 1202 supports the multi-pattern head 1204 for rotation about axles 1213 at the end of the U-shaped arm 1202. The body member 1201 further includes a support structure 1209 to support the garden watering device 1200 and keep the handle 1206 off the ground when the garden watering device 1200 is being used as a ground based lawn sprinkler.

FIGS. 22-26 illustrate the garden watering device 1200 in a ground based operation. The garden watering device 1200 includes a water inlet 1205 connected to the handle 1206. The handle 1206 is hollow to accommodate the flow of water from the water inlet 1205. The support structure 1209 extends from the bottom of the handle 1206 to prop the handle 1206 off the ground. The garden watering device 1200 includes a valve control 1207 on the upper side of the handle 1206 for controlling the flow of water through the garden watering device 1200. The handle 1206 is in fluid communication with the U-shaped arm 1202, which is also hollow or otherwise configured to accommodate the flow of water. For example, in the described embodiment, the axles 1213 are hollow and in fluid communication with the U-shaped arm 1202 to allow water to flow from the handle 1206 and the U-shaped arm 1202 into the multi-pattern head 1204. The multi-pattern head 1204 includes a dial 1211 having a plurality of flow outlets 1212. The flow outlets 1212 allow the operator to select from a variety of water spray patterns.

Figure 23:
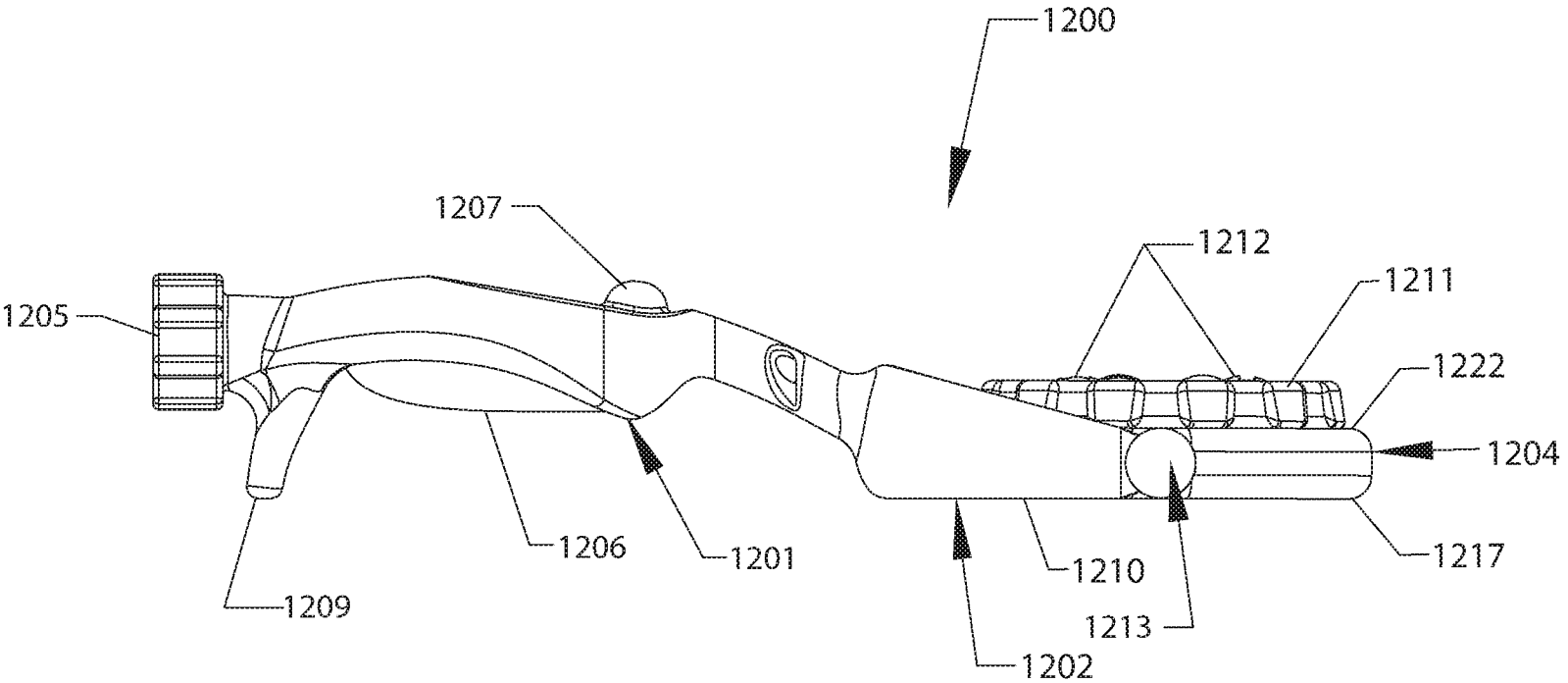
FIG. 23 is a side view of the garden watering device of FIG. 22, with the multi-pattern head rotated for ground-based operation.
Figure 24:
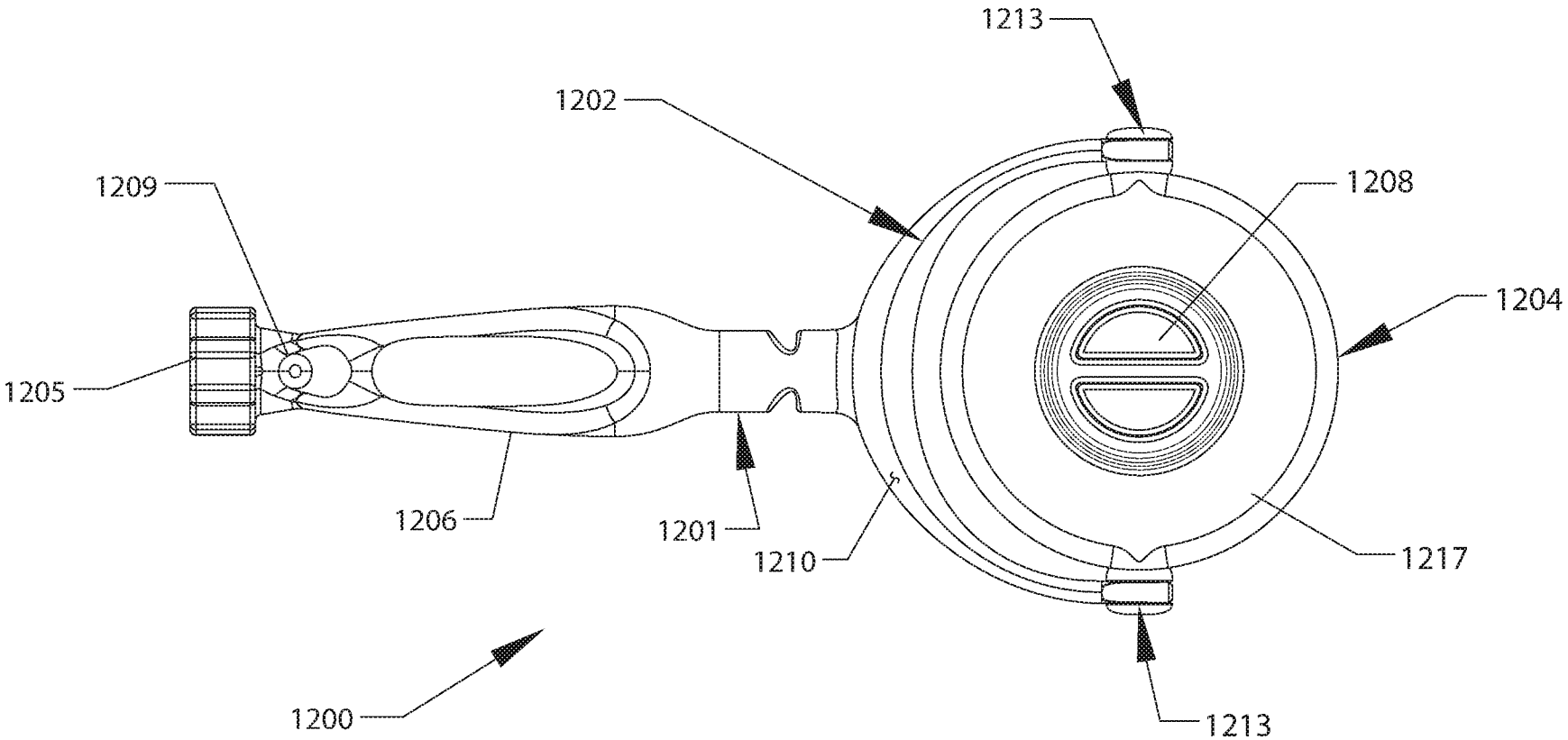
FIG. 24 is a bottom view of the garden watering device of FIG. 22.
Figure 25:
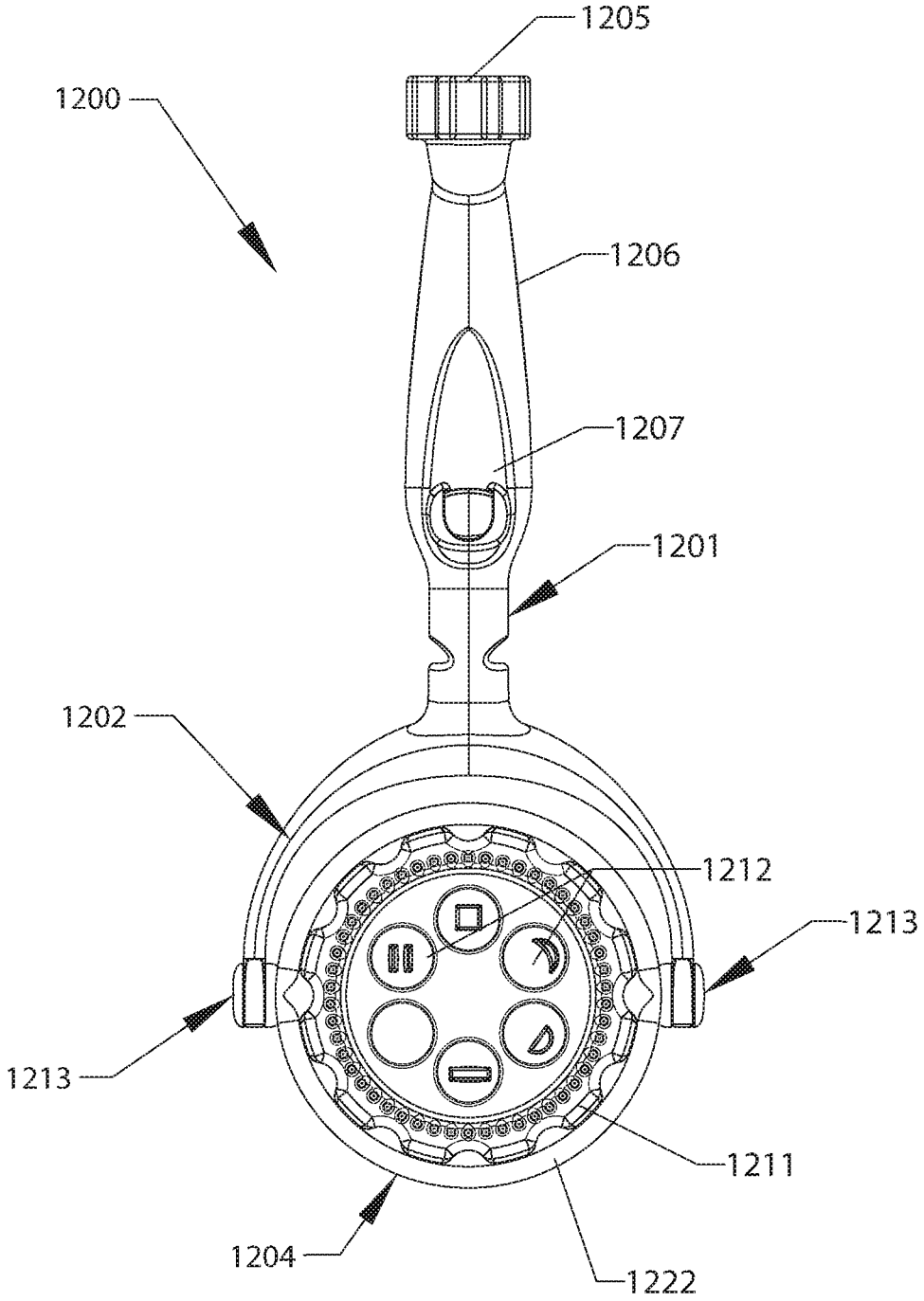
FIG. 25 is a top view of the garden watering device of FIG. 22.
Figure 26:
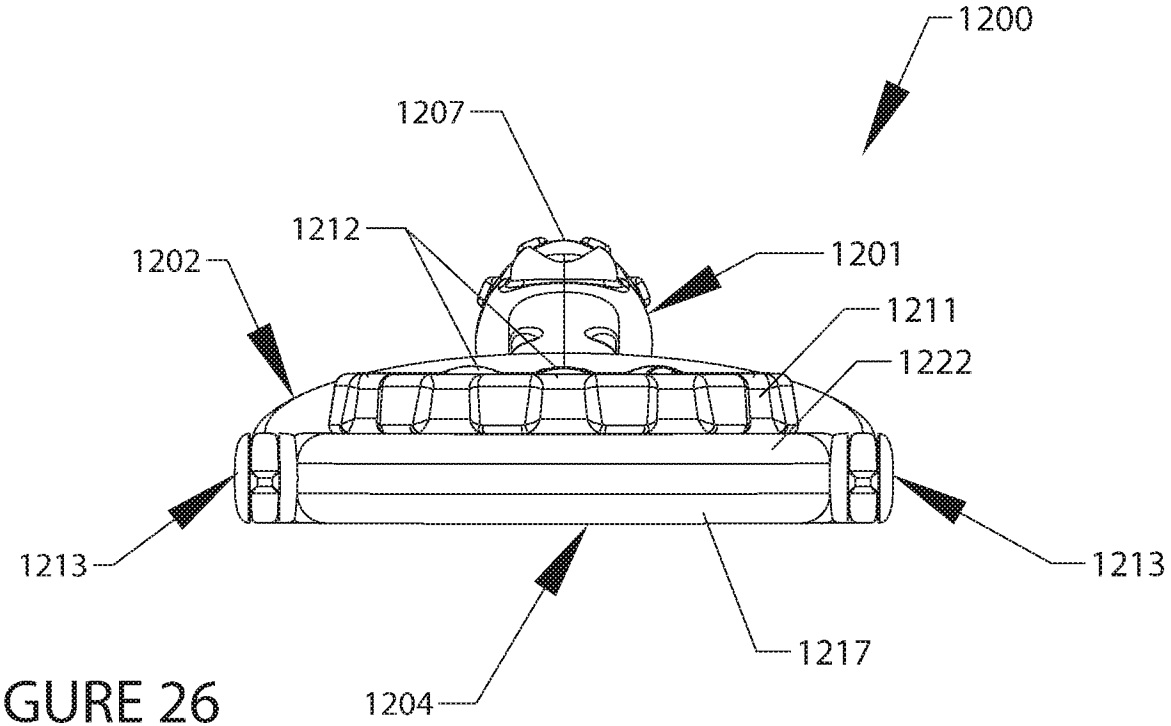
FIG. 26 is a front view of the garden watering device of FIG. 22.

As shown most clearly in FIG. 23, the U-shaped arm 1202 includes a generally planar lower surface 1210. This lower surface 1210 may be positioned in the same plane as the bottom of the support structure 1209. Thus, the support structure 1209 and the lower surface 1210 of the U-shaped arm 1202 support the garden watering device 1200 on any type of generally horizontal or flat surface without the need for a spike or other support means. The garden watering device 1200 further includes a knob 1208 located on the opposite side of the multi-pattern head 1204 from the dial 1211. The knob 1208 is operatively coupled to the dial 1211 and is configured to rotate the plurality of flow outlets 1212 to selectively have water directed to one or more flow outlets 1212 and to modify the spray pattern of the garden watering device 1200 as shown in FIG. 24. Consequently, the garden watering device 1200 is adapted to operate as a multi-pattern ground based lawn sprinkler.

Figure 27:
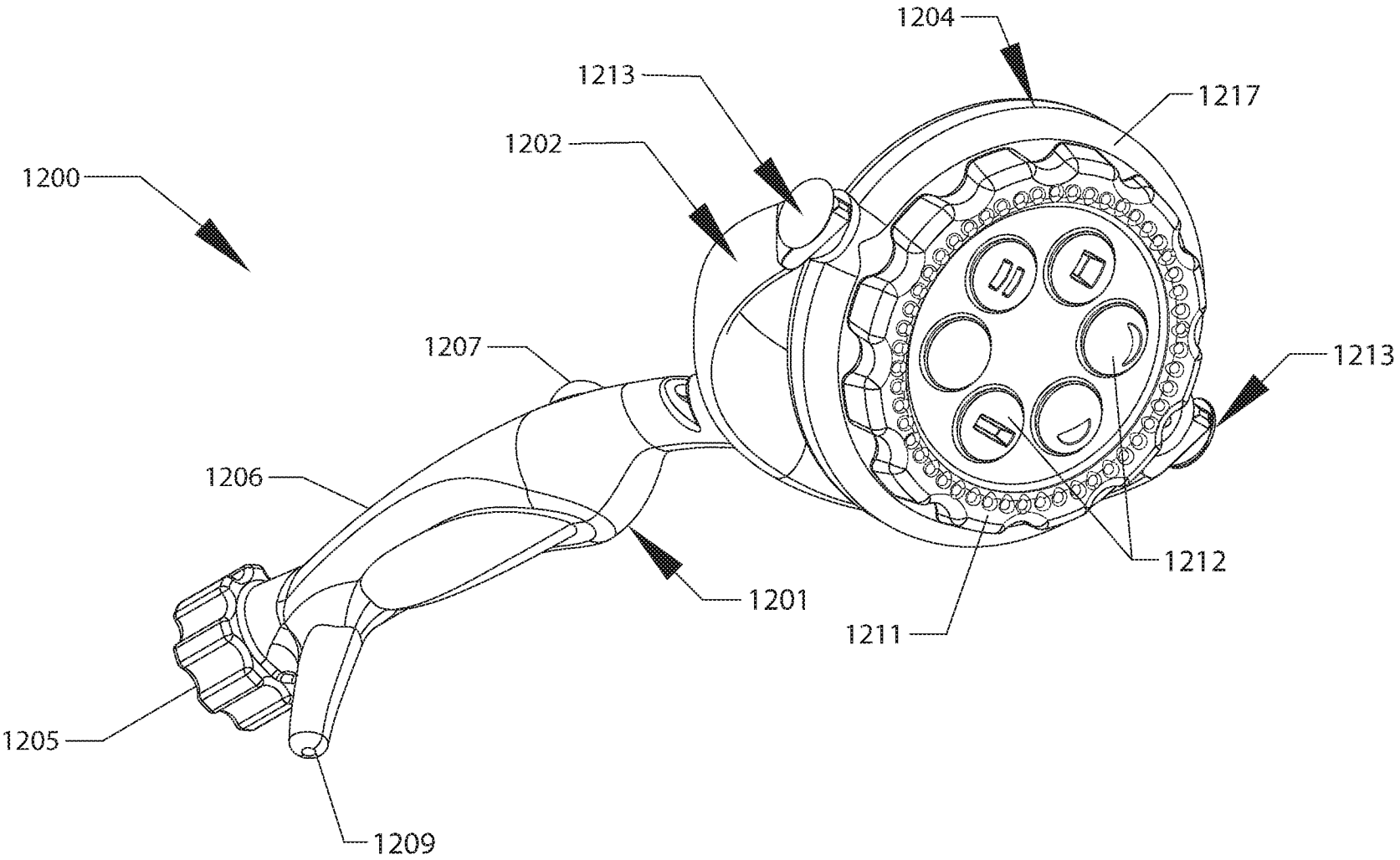
FIG. 27 is a perspective view of the garden watering device of FIG. 22, with the multi-pattern head rotated for handheld operation.

FIG. 27 depicts the garden watering device 1200 in a handheld operation. The axles 1213 permit the multi-pattern head 1204 to be rotated through an angle (e.g., at least 45 degrees) to be oriented downwardly and/or forwardly. In this orientation, the operator can grip the garden watering device 1200 by the handle 1206 and deliver a spray of water from the multi-pattern head 1204 away from the operator. The knob 1208 is advantageously facing the operator in the handheld operation. When the operator is using the garden watering device 1200 as a handheld sprinkler, rotating the easily accessible knob 1208 allows the operator to adjust the spray patterns of the dial 1211 without reaching in front of the flow outlets 1212 and getting wet or shutting off the flow of water. Thus, the garden watering device 1200 is configured to operate as a multi-pattern handheld sprinkler.

Figure 28:
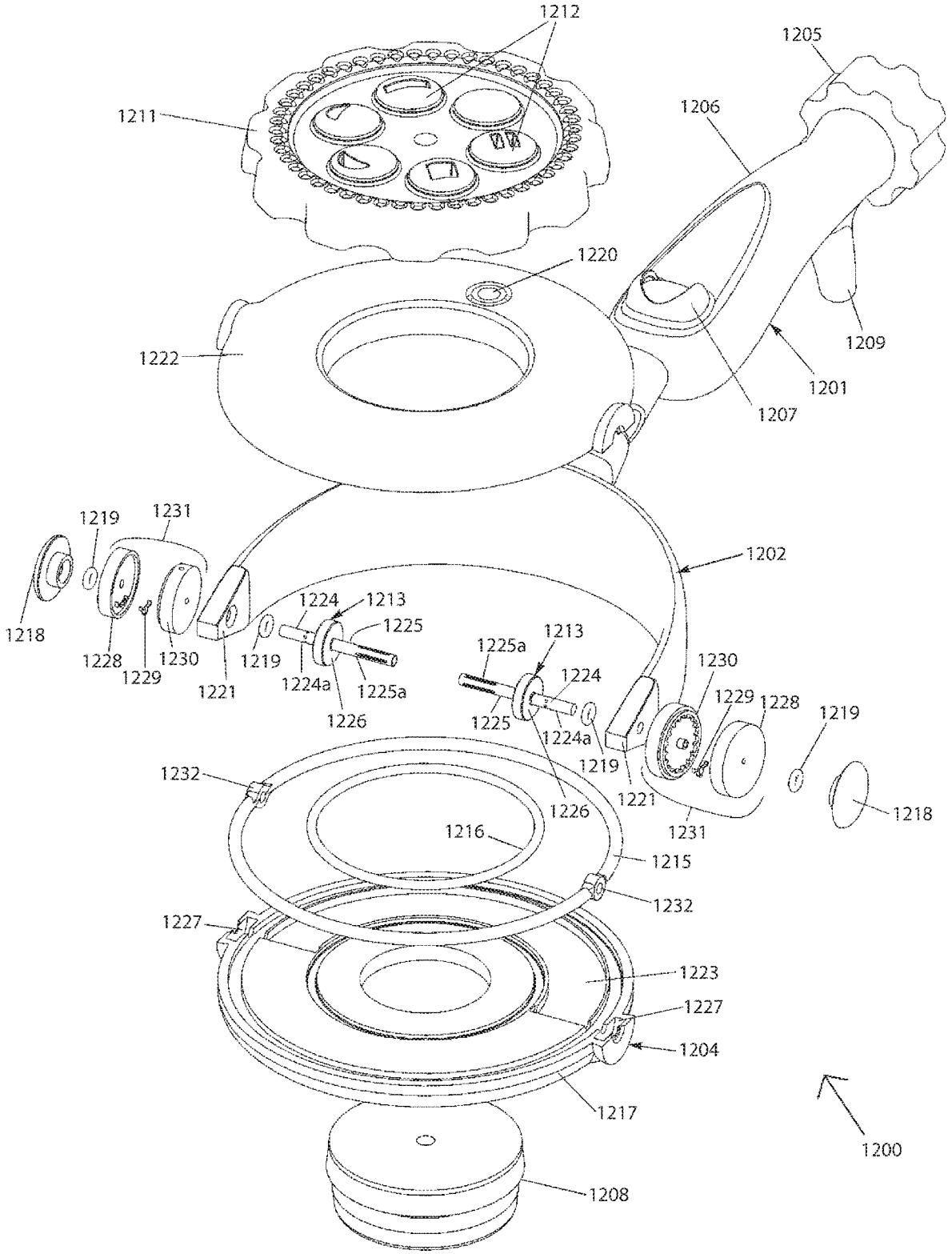
FIG. 28 is an exploded view of the garden watering device of FIG. 22.

FIG. 28 illustrates the internal components of the multi-pattern head 1204 and the axles 1213. The multi-pattern head 1204 includes a body 1217 and a faceplate 1222 coupled to the body 1217 to form a donut-shaped member. The knob 1208 extends through the aperture formed by the body 1217 and the faceplate 1212, and the knob 1208 is directly coupled to the dial 1211 adjacent to the faceplate 1212. The multi-pattern head 1204 further includes an inner circular seal 1216 and an outer circular seal 1215 disposed around the inner and outer periphery of the body 1217 and the faceplate 1222. A semi-annular flow chamber 1223 is formed between the body 1217 and the faceplate 1222, and the inner and outer circular seals 1216, 1215 prevent water flowing in the flow chamber 1223 from leaking out of the multi-pattern head 1204. The faceplate 1222 includes a discharge orifice 1220 in fluid communication with the flow chamber. Water flows out of the multi-pattern head 1204 at the discharge orifice 1220 to one of the flow outlets 1212 in the dial 1211.

The body 1217 and the faceplate 1222 cooperate to define a disc receptacle 1227 adjacent to each of the arm ends 1221. The outer circular seal 1215 may include side apertures 1232 adjacent to each of the arm ends 1221. The disc receptacle 1227 and side apertures 1232 of the outer circular seal 1215 are configured to engage the hollow axles 1213 as described below.

The hollow axles 1213 include an annular disc 1226 dividing the axle 1213 into a first axle portion 1224 and a second axle portion 1225. The annular disc 1226 of each axle 1213 is placed in a disc receptacle 1227 of the multi-pattern head 1204 such that the second axle portion 1225 extends into the multi-pattern head 1204 through the side apertures 1232 of the outer circular seal 1215. The second axle portion 1225 includes a plurality of axle outlet orifices 1225*a* in fluid communication with the flow chamber 1223.

The first axle portion 1224 of each axle 1213 extends from the annular disc 1226 through the end 1221 of the U-shaped arm 1202 and an articulating joint 1231 described below. An end cap 1218 is placed on the exterior-facing end of each first axle portion 1224. A pair of rubber seal rings 1219 is placed on each first axle portion 1224, one being between the interior side of the arm end 1221 and the annular disc 1226, the other being between the end cap 1218 and the articulating joint 1231. The rubber seal rings 1219 act as a seal to prevent water from leaking out of the connection between the axle 1213 and the U-shaped arm 1202. The first axle portions 1224 include a plurality of axle inlet orifices 1224*a* in fluid communication with the hollow U-shaped arm 1202 at arm ends 1221.

In the illustrated embodiment at FIG. 28, the articulating joint 1231 is comprised of a bracket 1228, a spring detent 1229, and a gear 1230. The spring detent 1229 is mounted on the bracket 1228 which is adapted to rotate in conjunction with the first axle portion 1224 of the axle 1213. The gear 1230 is coupled to the U-shaped arm 1202 and remains stationary with respect to the axle 1213. The gear 1230 includes a row of gear teeth facing the interior of the bracket 1228. The spring detent 1229 is biased to nestle in a gap between the teeth of the gear 1230, locking the multi-pattern head 1204 into a rotational position with respect to the U-shaped arm 1202. When the operator manually rotates the multi-pattern head 1204, the spring detent 1229 rotates with the bracket 1228 and axle 1213 to pop over the teeth of the gear 1230 and nestle into another gap. In this manner, the multi-pattern head 1204 can easily retain its position and be rotated through a full arc of rotation (e.g., 180 degrees) in both directions.

The axle inlet orifices 1224*a* on the axle 1213 allow water to flow from the U-shaped arm 1202 into the hollow axle 1213. The axle outlet orifices 1225*a* on the axle 1213 allow water to flow out of the axle 1213 and into the flow chamber 1223 within the multi-pattern head 1204. Thus, water from the body member 1201 and U-shaped arm 1202 is delivered to the flow chamber 1223 to be expelled through the discharge orifice 1220 and selected flow outlets 1212, depending upon the position of the knob 1208.

Figure 29:
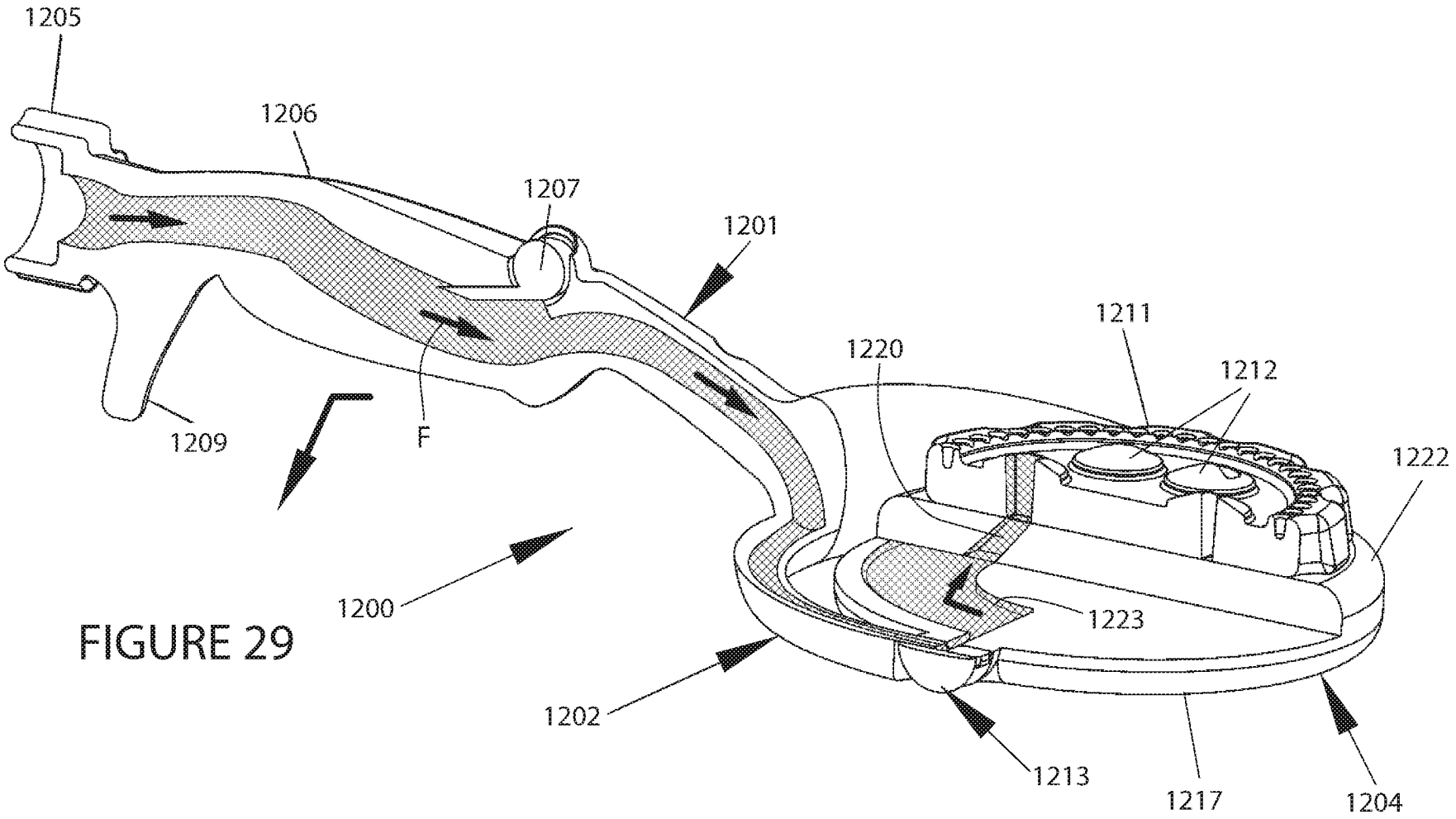
FIG. 29 is a partially cutaway perspective view of the garden watering device of FIG. 22 illustrating water flow through the device.

FIG. 29 demonstrates a flow path F of water flowing through the garden watering device 1200. Water enters through the primary water inlet 1205 and travels through the handle 1206 to the valve control 1207. If the valve control 1207 is closed, water will not flow past it. If the valve control 1207 is open (as illustrated in FIG. 29), water continues flowing through the device 1200. The valve control 1207 may be rotated by an operator's fingers between the open and closed positions. Water then flows into the U-shaped arm 1202, through the axle 1213, and into the flow chamber 1223. As the water pressure builds within the flow chamber 1223, water is forced out of the multi-pattern head 1204 through the discharge orifice 1220 and through one of the selected flow outlets 1212 in the dial 1211.

Figure 30:
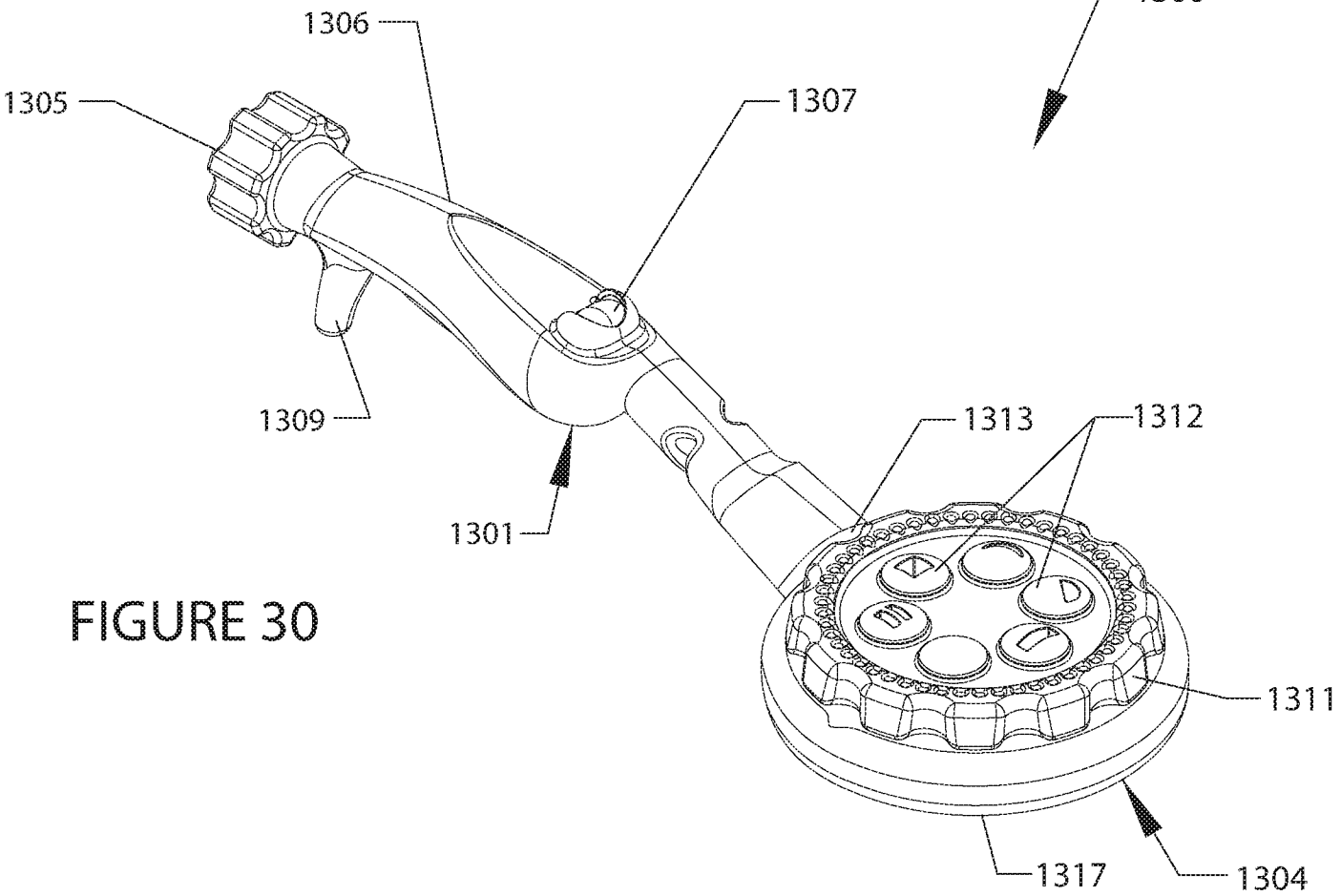
FIG. 30 is a perspective view of another embodiment of a garden watering device.

Another embodiment of a garden watering device 1300 is illustrated in FIG. 30. The garden watering device 1300 includes many of the same elements as the device 1200 of the previously described embodiment, and these similar elements have been marked with the same reference numbers in the 1300's (i.e., the handle 1206 of the previous embodiment is now handle 1306 in this embodiment). This garden watering device 1300 includes a water inlet 1305 connected to a handle 1306, which is integral with a body member 1301. The handle 1306 and body member 1301 are hollow to accommodate the flow of water from the water inlet 1305. The garden watering device 1300 also includes a multi-pattern head 1304 coupled to the body member 1301 opposite the handle 1306. A hollow axle 1313 connects the multi-pattern head 1304 and the body member 1301 to allow the multi-pattern head 1304 to rotate through an arc of at least 45 degrees with respect to the body member 1301. The hollow axle 1313 also permits a flow of water from the body member 1301 and water inlet 1305 into the multi-pattern head 1304, in a similar manner as the hollow axles 1213 of the first embodiment. The multi-pattern head 1304 includes a dial 1311 having a plurality of flow outlets 1312, which allow the operator to select from a variety of water spray patterns.

Figure 31A:
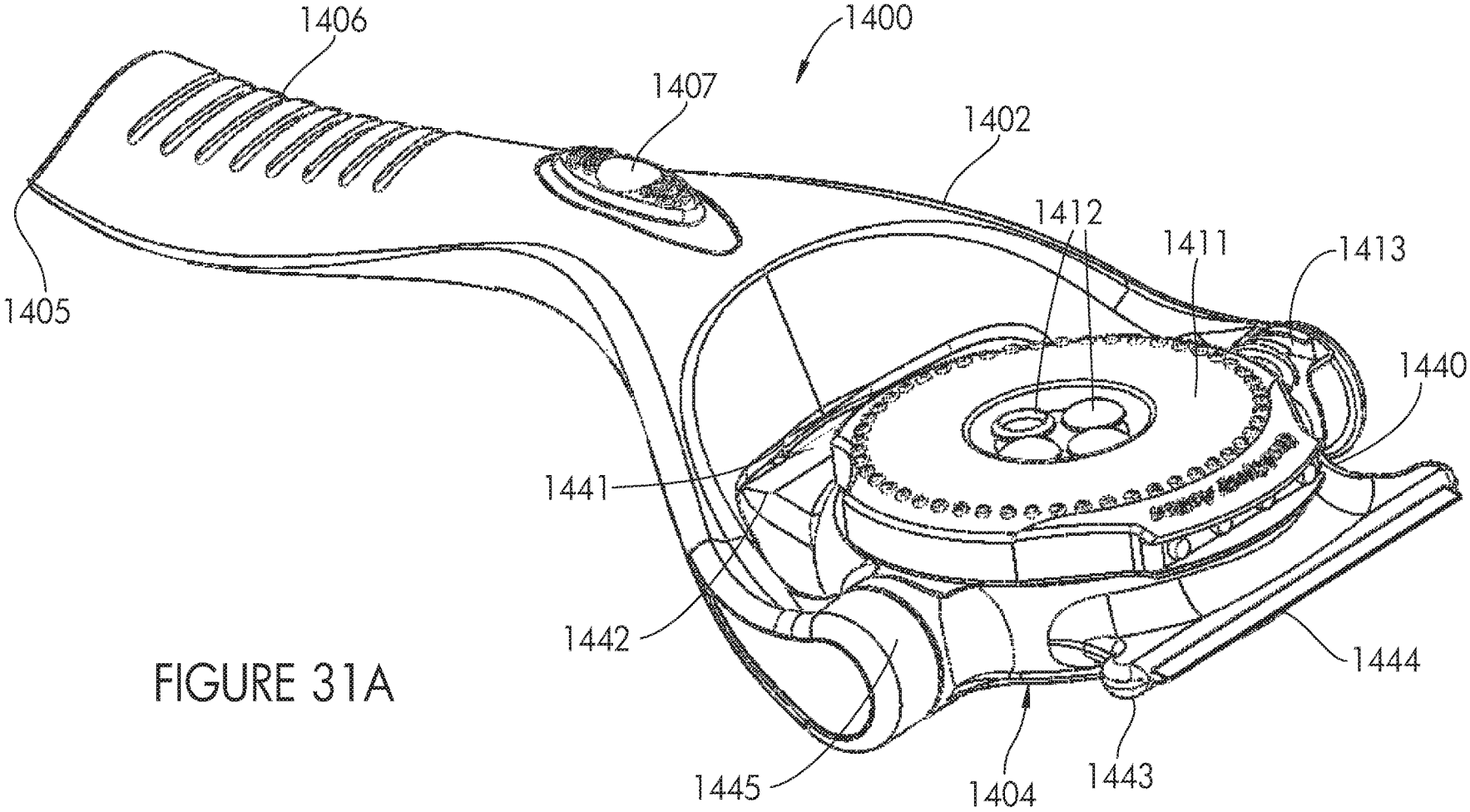
FIG. 31A is a perspective view of another embodiment of a garden watering device in a first position.
Figure 31B:
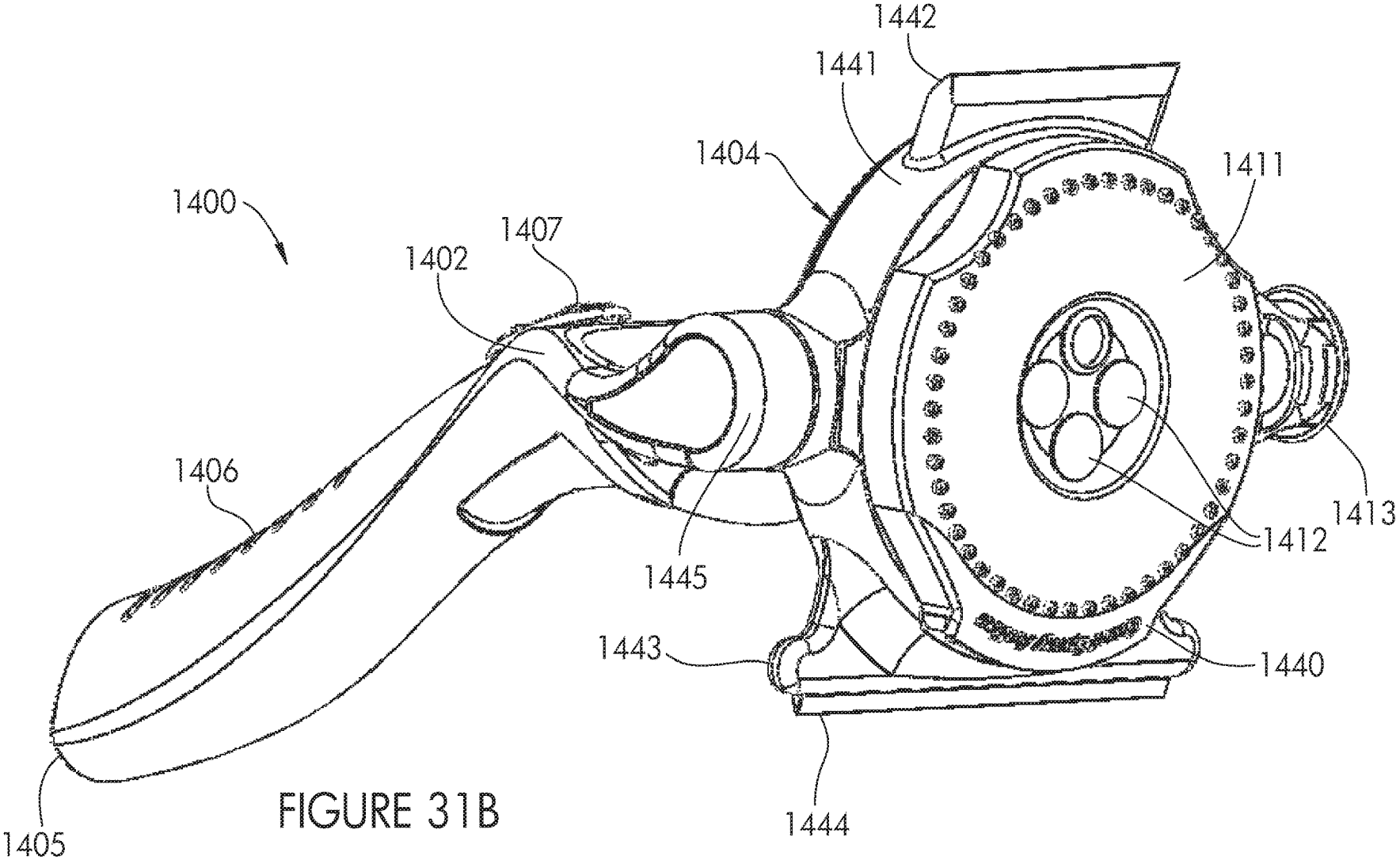
FIG. 31B is a perspective view of the garden watering device of FIG. 31A in a second position.

Another embodiment of a garden watering device 1400 is illustrated in FIGS. 31A and 31B. The garden watering device 1400 includes many of the same elements as the device 1200 of the previously described embodiment, and these similar elements have been marked with the same reference numbers in the 1400's (i.e., the handle 1206 of the previous embodiment is now handle 1406 in this embodiment). This garden watering device 1400 includes a modified multi-pattern head 1404. The multi-pattern head 1404 of this embodiment includes the rotatable dial 1411 and flow outlets 1412 of the previous embodiments, but now also includes an auxiliary spray outlet 1440 positioned along one side of the dial 1411. The internal passageways (not shown)

of the multi-pattern head 1404 may be modified such that water flows out of the auxiliary spray outlet 1440 when a blank flow outlet 1412 prevents flow from the center of the dial 1411, as previously described. The auxiliary spray outlet 1440 is shaped to produce an elongate flow of water, but alternative shapes of the auxiliary spray outlet 1440 are possible within the scope of this invention.

The multi-pattern head 1404 also includes an accessory housing 1441 positioned on an opposite side from the auxiliary spray outlet 1440. A scraper 1442 is held by the accessory housing 1441 and is configured for use in a handheld operation such as washing articles such as automobiles or pets. In a similar manner, a squeegee housing 1443 is formed adjacent the auxiliary spray outlet 1440 for holding a squeegee 1444. The squeegee 1444 may be used to wipe water off surfaces such as an automobile in a handheld operation of the garden watering device 1400. Thus, the multi-pattern head 1404 is more useful for many handheld watering and washing operations.

The multi-pattern head 1404 is again coupled to a U-shaped arm 1402 by at least one hollow axle 1413. However, the opposing side of the U-shaped arm 1402 may now carry a locking mechanism 1445 that selectively locks the multi-pattern head 1404 in a rotational position. When the locking mechanism 1445 is disengaged, the multi-pattern head 1404 of this embodiment is configured to free-float or freely rotate at the hollow axle 1413. In this regard, the multi-pattern head 1404 in a handheld operation may freely rotate to follow the undulating contours of an automobile, a pet, or another article during a washing operation. Consequently, the garden watering device 1400 is advantageously configured for many watering and washing tasks.

Figure 32B:
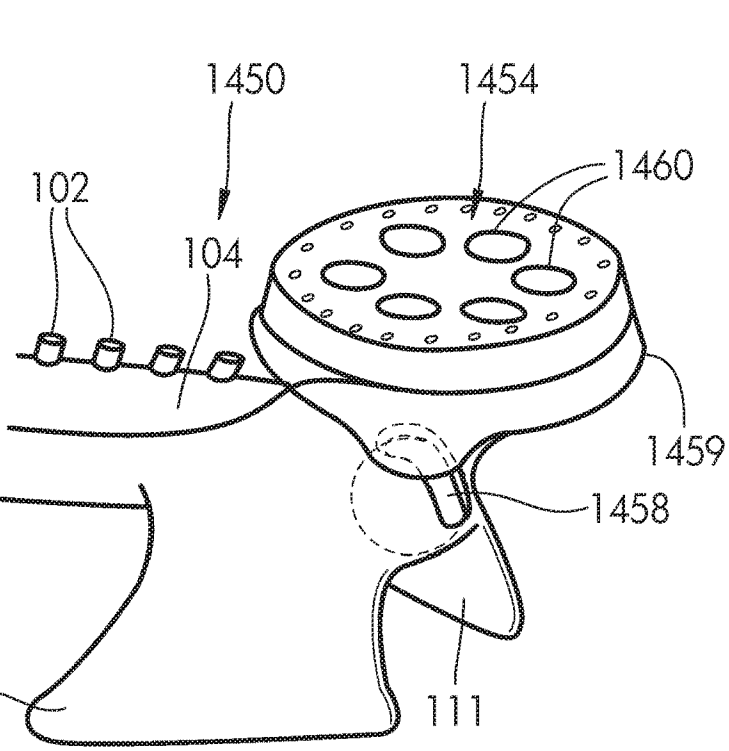
FIG. 32B is a perspective view of the garden watering device of FIG. 32A in a second position.
Figure 32A:
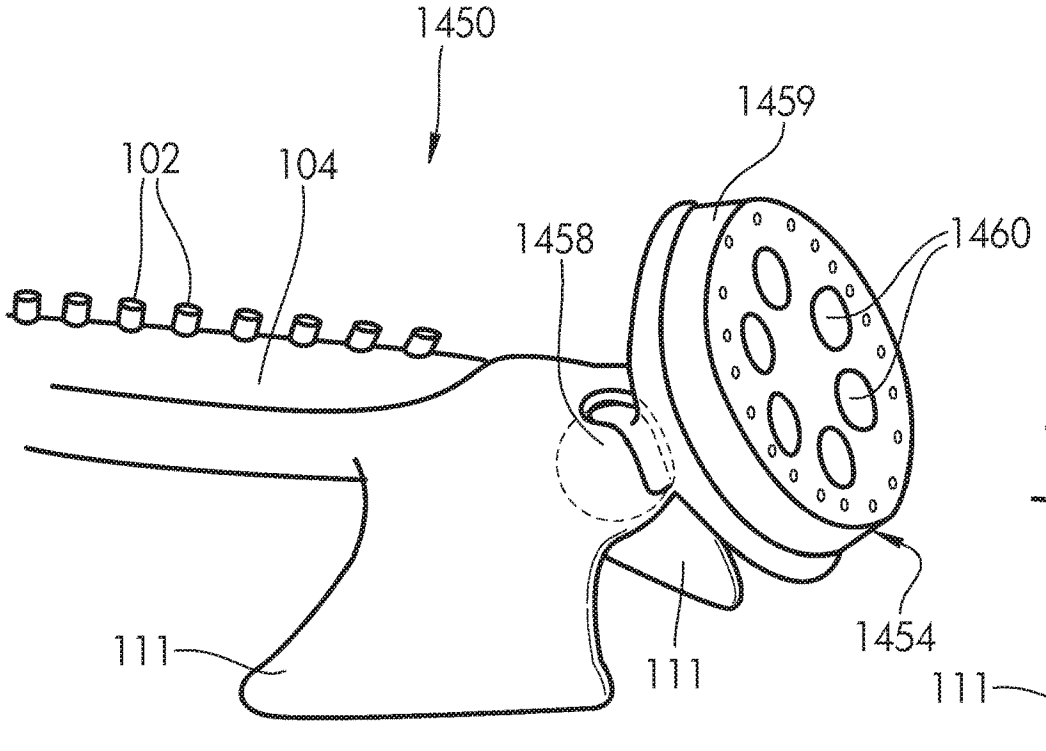
FIG. 32A is a perspective view of another embodiment of a garden watering device in a first position.

Another embodiment of a garden watering device 1450 is illustrated in FIGS. 32A and 32B. The garden watering device 1450 includes many of the same elements as the device 100 of the first described embodiment, and these similar elements have been marked with the same reference numbers in this embodiment. This garden watering device 1450 includes a modified multi-pattern head 1454. The multi-pattern head 1454 is coupled to the device body adjacent support structure 111 with an articulating ball joint 1458. The articulating ball joint 1458 passes water to the multi-pattern head 1454, and may also be referred to as a "ball swivel." The multi-pattern head 1454 includes a rotatable dial 1459 with a plurality of flow outlets 1460 similar to those previously described in other embodiments. However, the multi-pattern head 1454 is configured to be positioned at a plurality of different rotational positions by moving the articulating ball joint 1458, two positions of which are illustrated in FIGS. 32A and 32B. The articulating ball joint 1458 enables partially free-floating of the multi-pattern head 1454 in a handheld operation, similar to the previous embodiment of the garden watering device 1400. Therefore, the garden watering device 1450 enables a plurality of watering and washing operations with one device.

Another embodiment of a garden watering device 1500 is a water pistol with tripod support as shown in FIGS. 33-39. The pistol-style garden watering device 1500 is configured to be used for multiple sprinkling operations, including handheld and ground-based operations. The garden watering device 1500 includes a body member 1501, a discharge head or pistol barrel 1506, and a support structure 1502. The support structure 1502 is coupled to the body member 1501 at a hinge 1513 and rotates between a first position flush against the body member 1501 for handheld operation and a second position extended away from the body member 1501 for ground-based operation. In the first position, the support structure 1502 cooperates with the body member 1501 to form a handle 1514.

Figure 34:
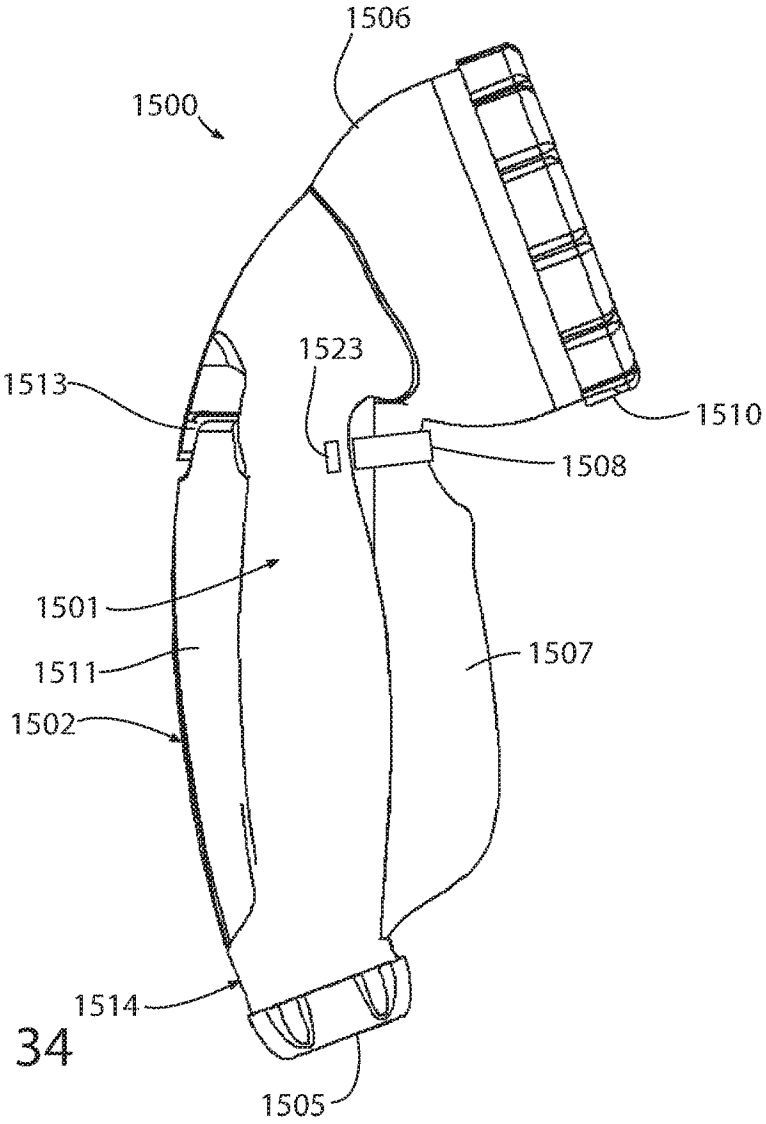
FIG. 34 is a side view of the garden watering device of FIG. 33.
Figure 33:
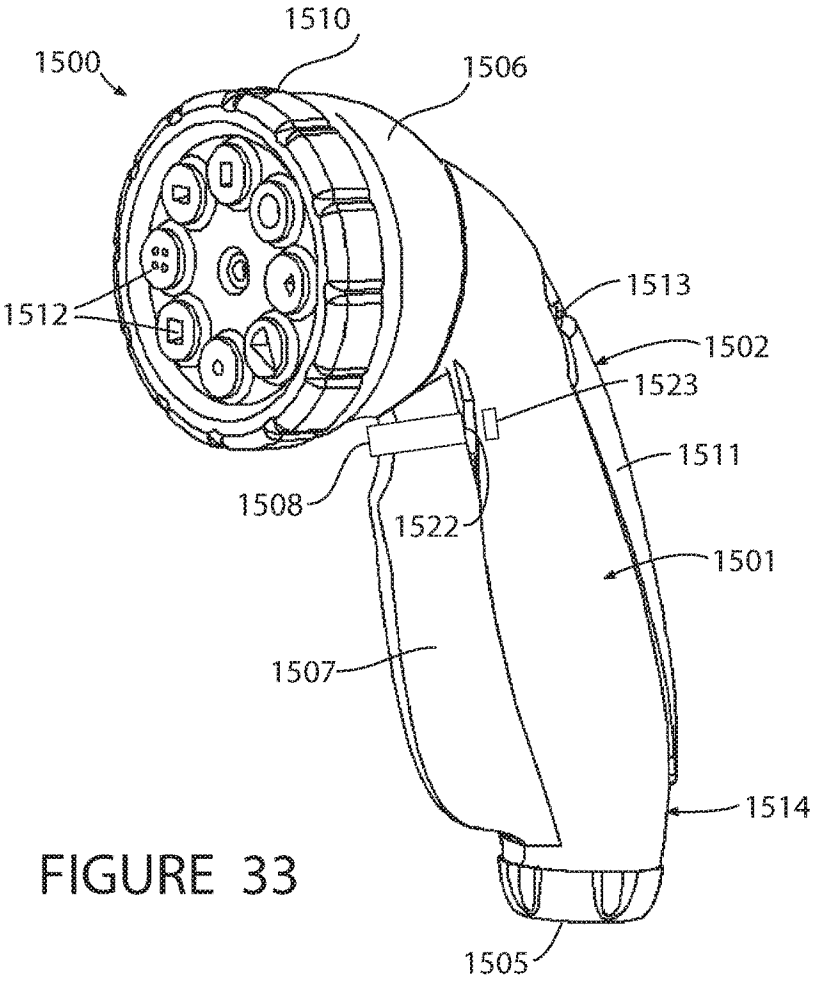
FIG. 33 is a perspective view of the garden watering device in accordance with one embodiment, illustrating the support legs folded into the handle.
Figure 35:
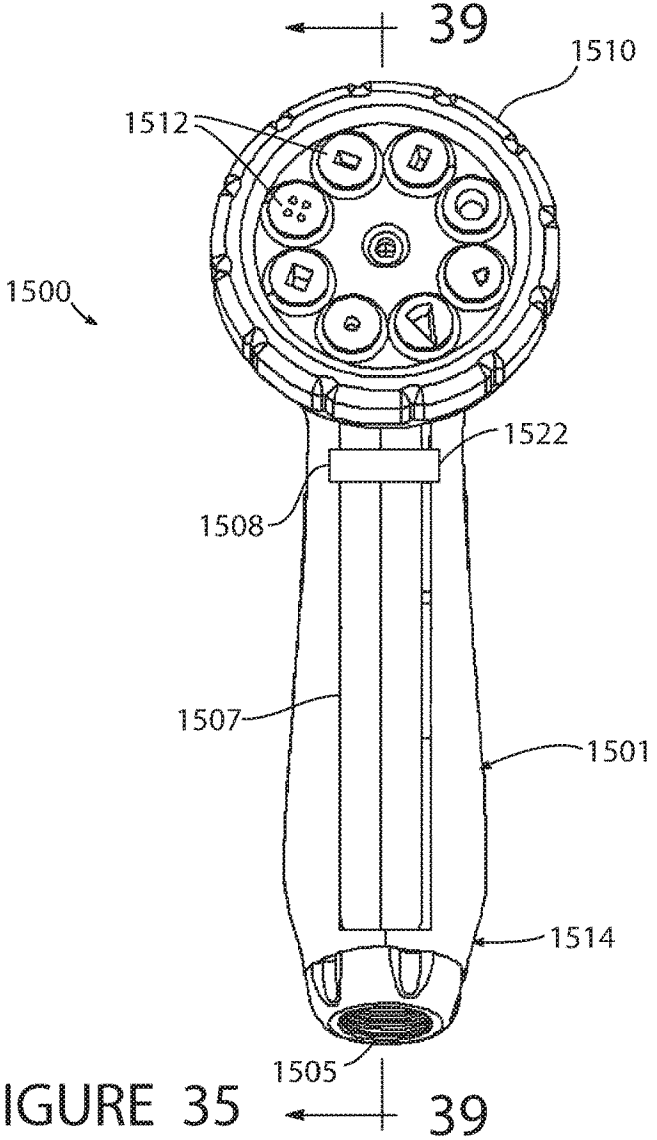
FIG. 35 is a front view of the garden watering device of FIG. 33.

As shown in FIGS. 33-35, the garden watering device 1500 may be used in a handheld pistol-style sprinkler operation. The body member 1501 of the garden watering device 1500 includes a water inlet 1505 attached to a handle 1514. The handle 1514 couples the water inlet 1505 to the discharge head 1506. Along a front side of the handle 1514 is a trigger 1507 for activating the flow of the water through the handle 1514. At the end of the discharge head 1506 is a discharge orifice 1509 (shown in FIG. 39) through which water from the handle 1514 travels out of the discharge head 1506. A dial 1510 containing a plurality of flow outlets 1512 is coupled to the discharge head 1506 over the discharge orifice 1509. The dial 1510 can be rotated to allow the operator to select from a variety of different outlets 1512 and water distribution patterns suited for different purposes.

The support structure 1502 includes a pair of support legs 1511 movably attached to the handle 1514 such as at hinges 1513. The support legs 1511 extend along the length of the handle 1514 on an opposite side from the trigger 1507. In the first position of the support structure 1502, shown in FIGS. 33-35, the support legs 1511 lie flush with the handle 1514 in corresponding receptacles 1515 to make a continuous body member 1501. Thus, the support legs 1511 do not interfere with the use of the garden watering device 1500 as a handheld pistol-style sprinkler.

Figure 36:
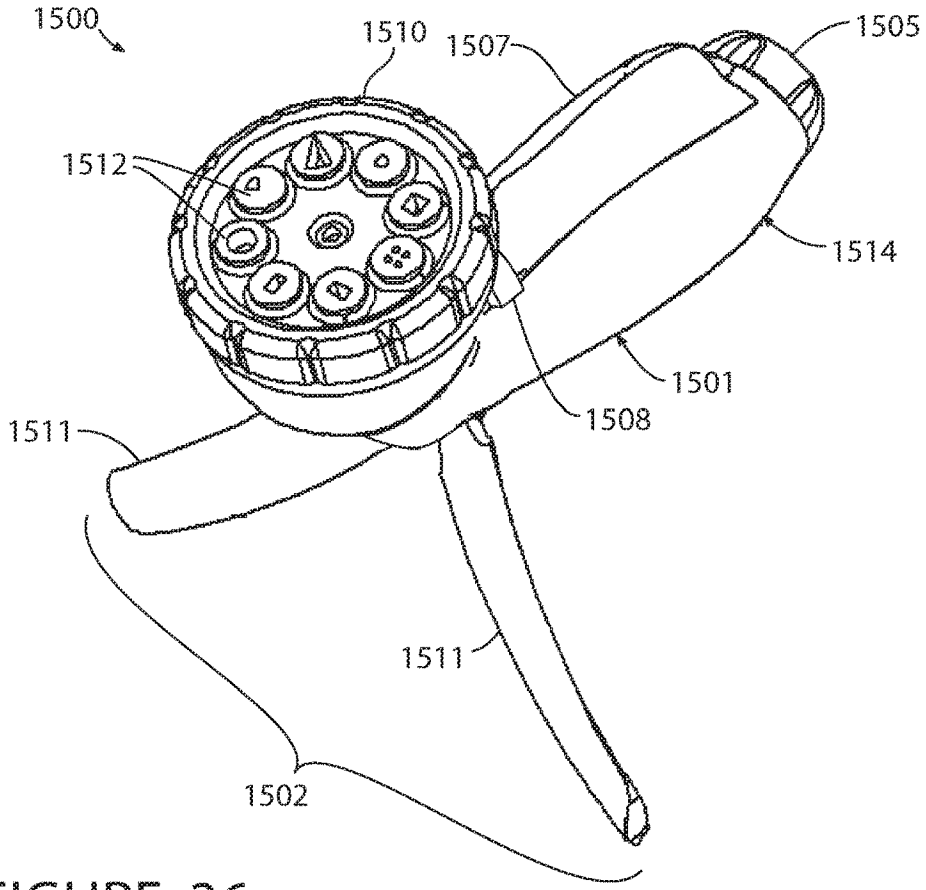
FIG. 36 is a perspective view of the garden watering device of FIG. 33 with the support legs folded outward.
Figure 37:
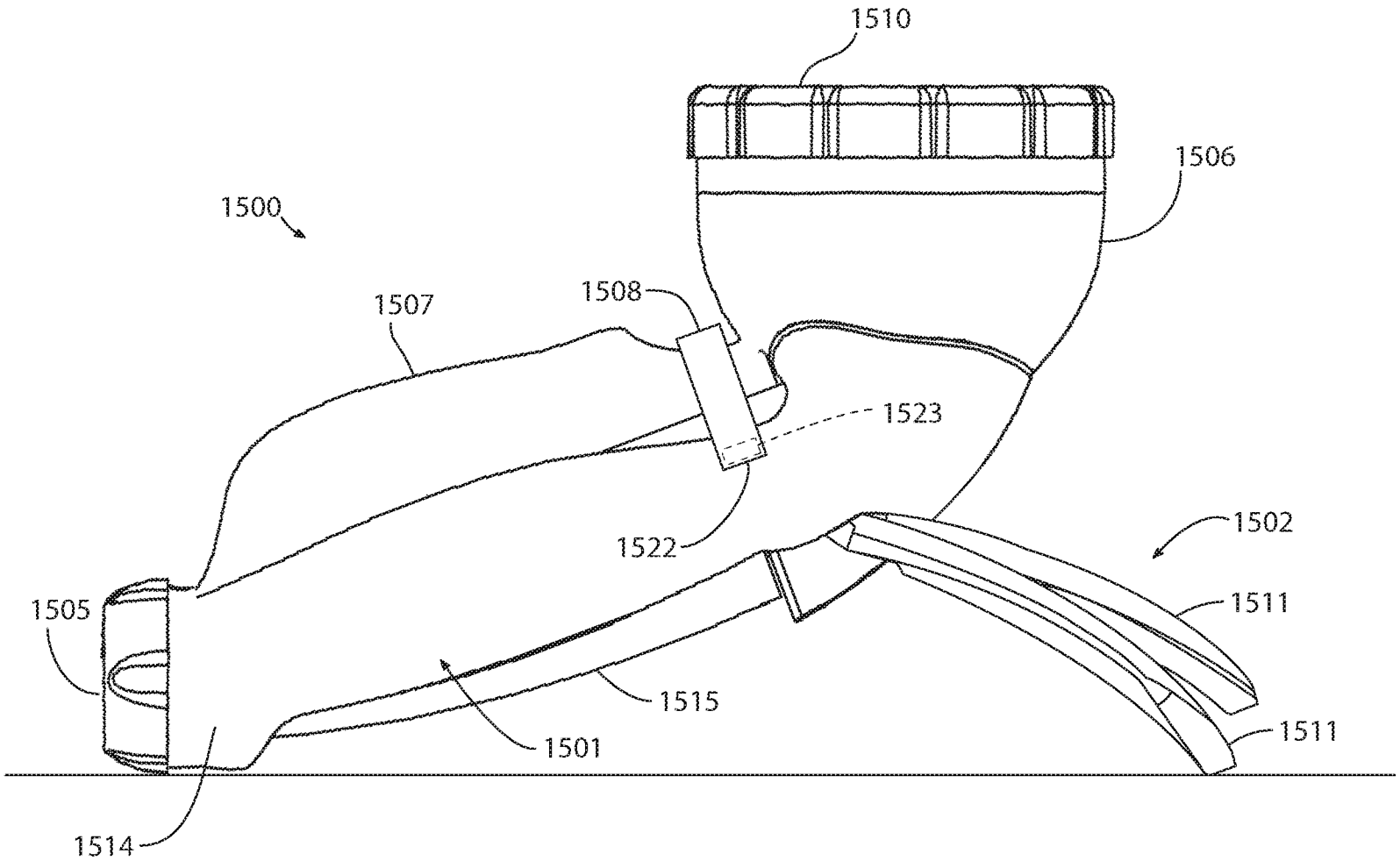
FIG. 37 is a side view of the garden watering device of FIG. 33.
Figure 38:
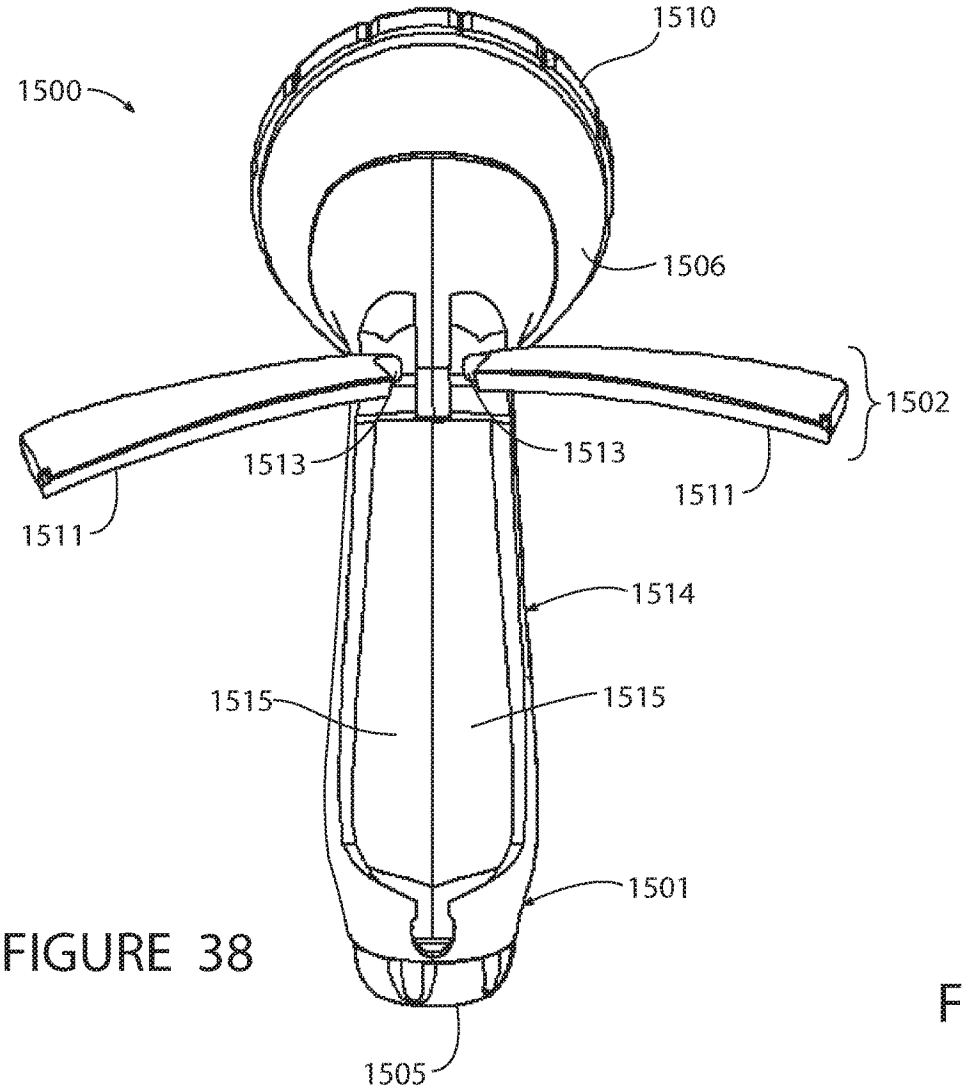
FIG. 38 is a rear view of the garden watering device of FIG. 33.

The pair of support legs 1511 may be rotated out away from the receptacles 1515 in the handle 1514 to the second position illustrated in FIGS. 36-38. The handle 1514 and each of the support legs 1511 together form a support structure such as in the form of a tripod for the garden watering device 1500 in a ground-based operation. As shown most clearly in FIG. 37, the support legs 1511 and handle 1514 are configured to support the discharge head 1506 on any appropriate horizontal surface, such as a ground surface without the use of a pivoting spike or other apparatus. The discharge head 1506 is also supported so as to be directed upwardly or generally perpendicular to the level surface. The pattern of sprinkler spray upward can be controlled by rotating the various flow outlets 1512 on the dial 1510 into fluid communication with the discharge orifice 1509 in the discharge head 1506. For example, a flow outlet 1512 which only sprays over half the discharge head 1506 may be selected when the garden watering device 1500 is positioned at the edge of a lawn. Consequently, the support legs 1511 allow the garden watering device 1500 to function as a ground-based sprinkler on any type of ground surface, including rocky terrain or uneven surfaces. To further allow the adaptability of the ground-based operation of the device 1500 on uneven ground, each of the two support legs 1511 may be adjusted independently of the other to achieve an interface between the support structure 1502 and an uneven surface.

The garden watering device 1500 also includes a locking collar 1508 configured to keep the trigger 1507 depressed during ground-based operation. The locking collar is pivotally coupled to the handle 1514 at one side of the trigger 1507 and extends generally around the trigger 1507 to the other side of the handle 1514. On the other side of the handle 1514 from the pivotal connection, the handle 1514 includes a locking projection 1523. The locking collar 1508 includes a collar end 1522 which engages the locking projection 1523 in a snap fit to place the locking collar 1508 in a locked position. In the locked position, the snap fit engagement of the collar end 1522 and the locking projection 1523 holds the trigger 1507 in a depressed state and allows for continuous flow of water through the handle 1514 to the discharge head 1506. The locking collar 1508 may be moved to an unlocked position by disengaging the collar end 1522 from the locking projection 1523, which then allows the trigger 1507 to function normally with manual manipulation for handheld operation. It will be appreciated that the trigger 1507 could also be replaced with several other types of flow control devices, non-limiting examples of which include a ball valve, a poppet valve, a barrel valve, and the like.

Figure 39:
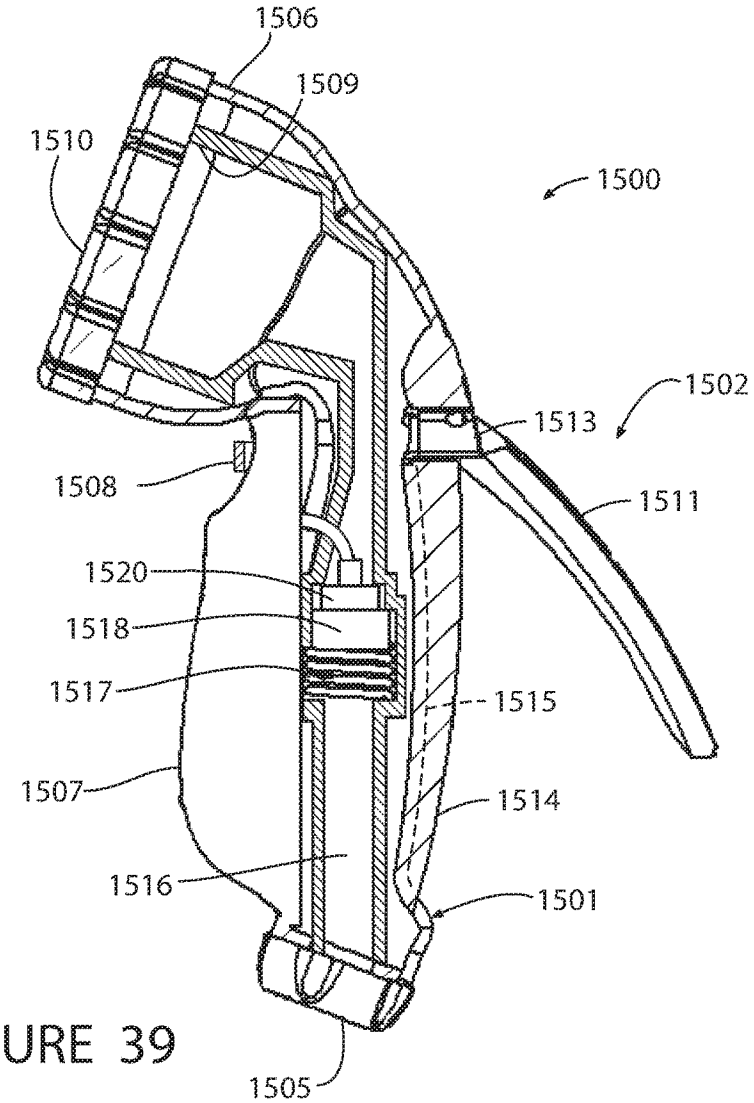
FIG. 39 is a cross-sectional side view of the garden watering device of FIG. 33 along line 39-39.

FIG. 39 is a cross sectional side view of the garden watering device 1500 taken along line 39-39 in FIG. 35, illustrating the interior components of the garden watering device 1500. The handle 1514 includes an interior channel 1516 through which water flows from the water inlet 1505 to the discharge head 1506. Within the interior channel 1516, an interior valve 1520 controls the flow of water through the handle 1514 and the garden watering device 1500. A spring 1517 located in the interior channel 1516 biases a piston 1518 into engagement with the interior valve 1520 to close water flow though the handle 1514. When the trigger 1507 is pressed down, the trigger 1507 pushes the piston 1518 against the bias of the spring 1517 to open the interior valve 1520 and let water flow pass through the handle 1514. Also illustrated in FIG. 39 is the discharge orifice 1509 in the discharge head 1506, which allows flow of water from the handle 1514 to one of the plurality of flow outlets 1512 in the dial 1510.

Figure 41:
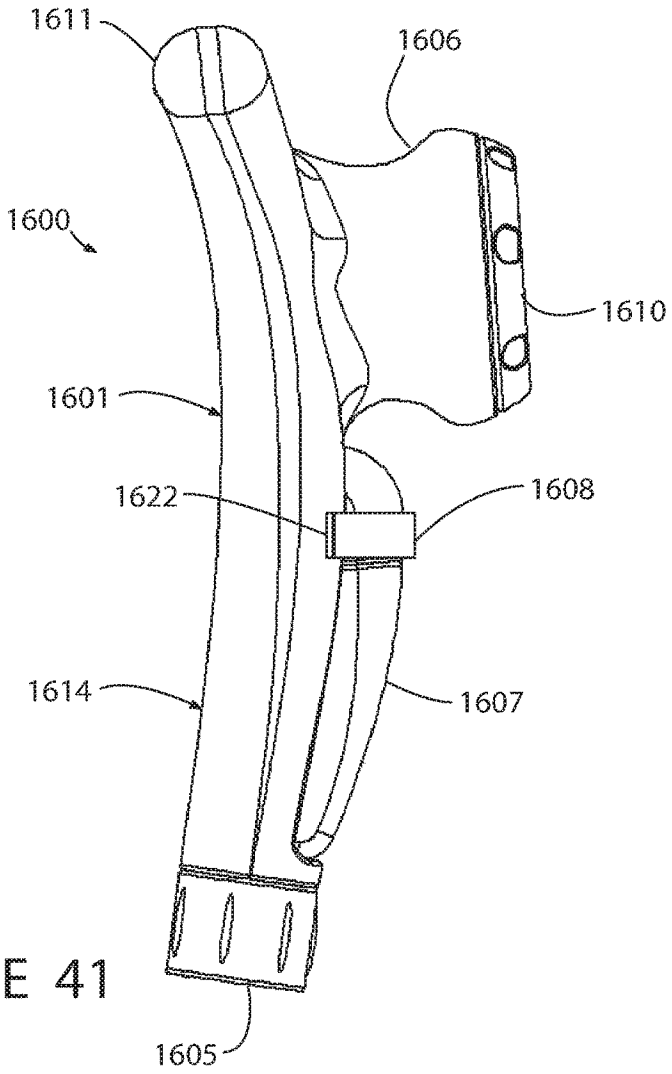
FIG. 41 is a side view of the garden watering device of FIG. 40.
Figure 40:
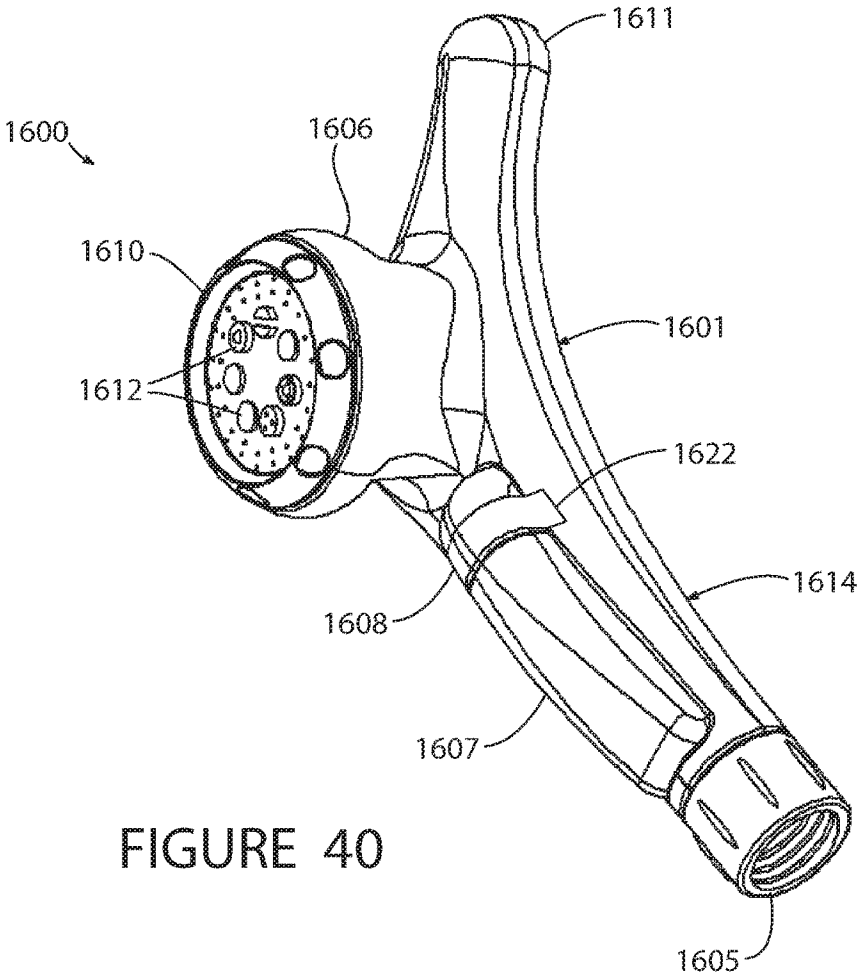
FIG. 40 is a perspective view of an alternative embodiment of the garden watering device.
Figure 42:
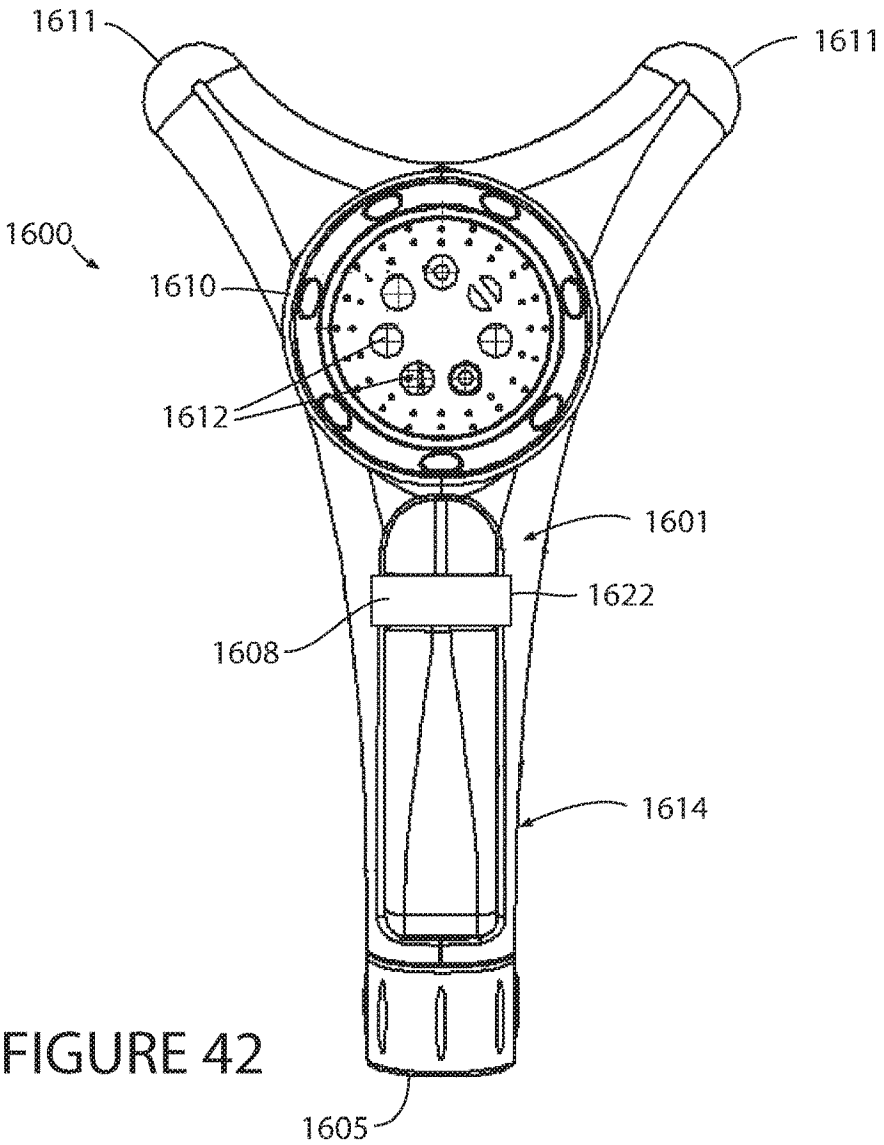
FIG. 42 is a front view of the garden watering device of FIG. 40.

Another alternative embodiment of a garden watering device 1600 is illustrated in FIGS. 40-42. The garden watering device 1600 includes many of the same elements as the garden watering device 1500 of the previously described embodiment, and these similar elements have been marked with similar reference numbers in the 1600's (i.e., the body member 1501 of the previous embodiment is now body member 1601 in this embodiment). Rather than including a support structure 1502 that may be folded into the handle 1514 as in the previous embodiment, the body member 1601 of the garden watering device 1600 includes a handle 1614 and a pair of fixed support legs 1611 extending away from the handle 1614 to define a tripod support arrangement. As shown in FIG. 41, the tripod support arrangement supports the garden watering device 1600 in a ground-based operation in a similar manner as the previous embodiment. More specifically, the discharge head 1606 is pointed directly upward and generally perpendicular to the level surface the garden watering device 1600 is placed upon. The garden watering device 1600 may be used on any appropriate horizontal surface, and the pair of support legs 1611 also does not interfere with the handheld pistol-style operation of the garden watering device 1600.

Figure 43:
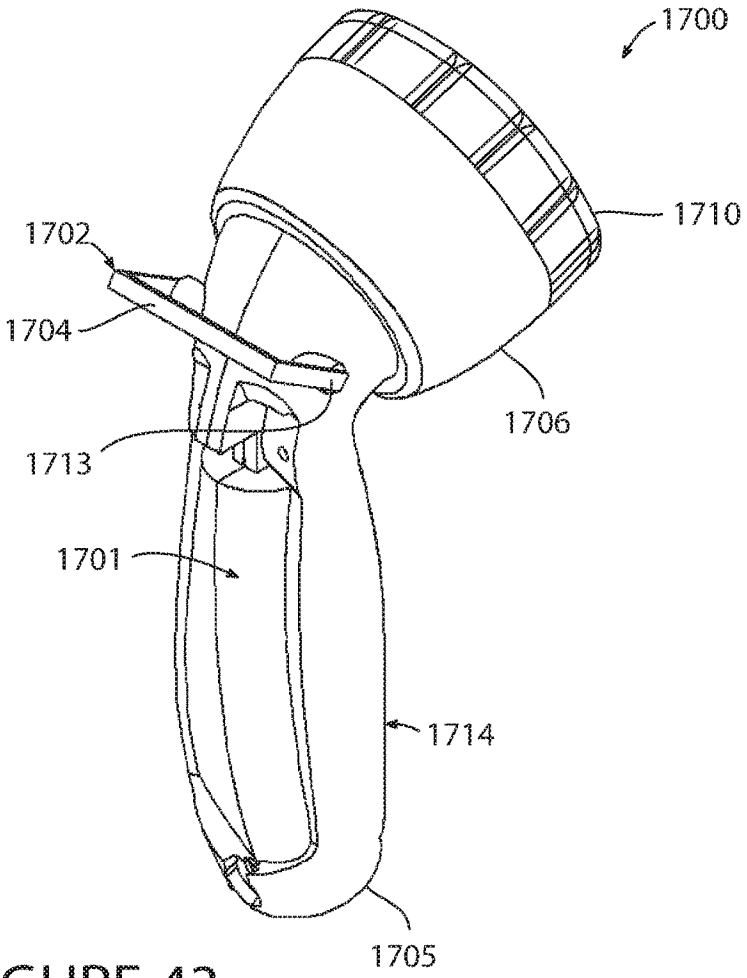
FIG. 43 is a perspective view of another embodiment of the garden watering device.
Figure 45:
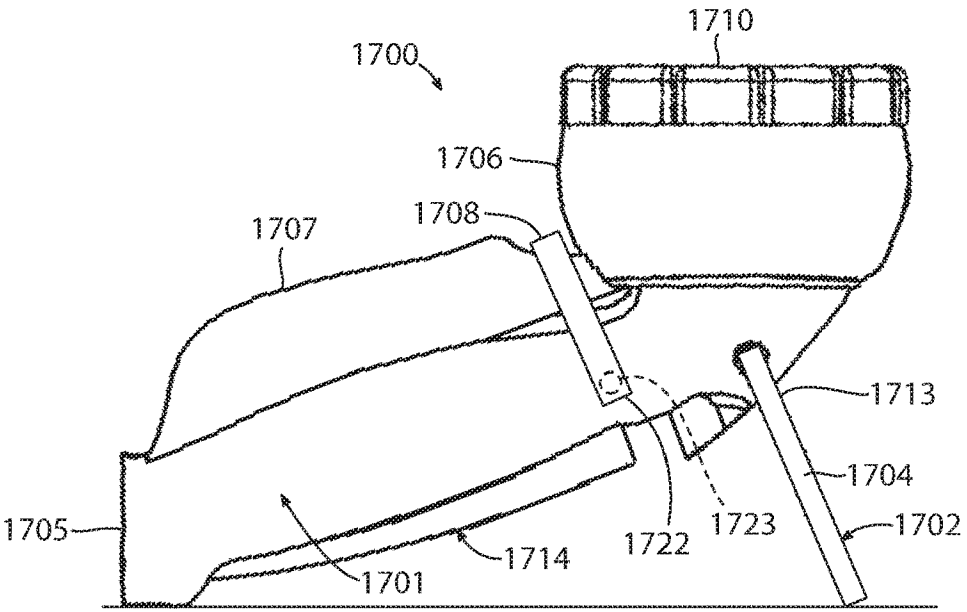
FIG. 45 is a side view of the garden watering device of FIG. 43, illustrating the stabilization bar folded outward.
Figure 44:
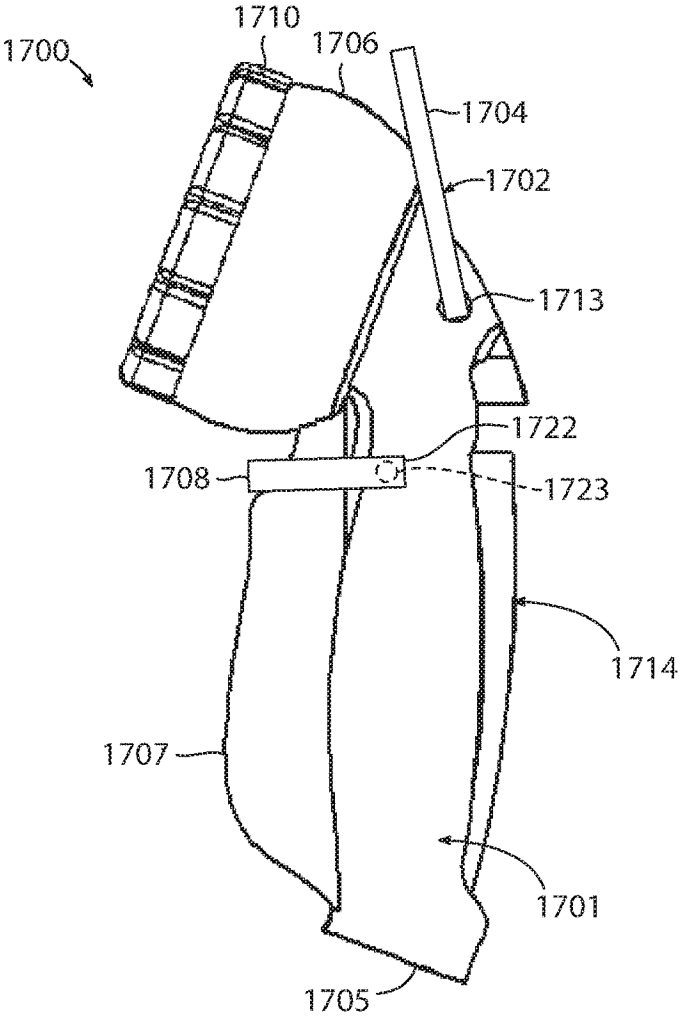
FIG. 44 is a side view of the garden watering device of FIG. 43, illustrating the stabilization bar folded against the device body.

Another embodiment of a garden watering device 1700 is illustrated in FIGS. 43-45. The garden watering device 1700 includes many of the same elements as the garden watering device 1500 of the previously described embodiment shown in FIG. 33, and these similar elements have been marked with similar reference numbers in the 1700's (i.e., the body member 1501 of the previous embodiment is now body member 1701 in this embodiment). In this garden watering device 1700, the support structure 1702 includes a stabilization bar 1704 pivotally coupled to the body member 1701 proximate to the discharge head 1706. The stabilization bar 1704 rotates from a first position shown in FIG. 12 to a second position shown in FIG. 13. In the first position, the stabilization bar 1704 is generally up against or flush against the discharge head 1706 and does not interfere with an operator's grip of the handle 1714 in a handheld pistol-style operation. In the second position, the stabilization bar 1704 is rotated away from the body member 1701 so that the garden watering device 1700 can be supported on any level surface by the handle 1714 and the stabilization bar 1704. The stabilization bar 1704 is configured to support the discharge head 1706 in a ground-based operation so that the discharge head 1706 points directly upward and generally perpendicular to the surface on which the garden watering device 1700 sits. The stabilization bar 1704 can take the form of a wire support, a unitary support leg, or other structure for supporting the discharge head 1706 for ground-based operation. In addition, the stabilization bar 1704 might not be associated with the valve components of the watering device 1700 and could be moved between its first and second positions without affecting the flow of water through the watering device 1700.

Figure 46B:
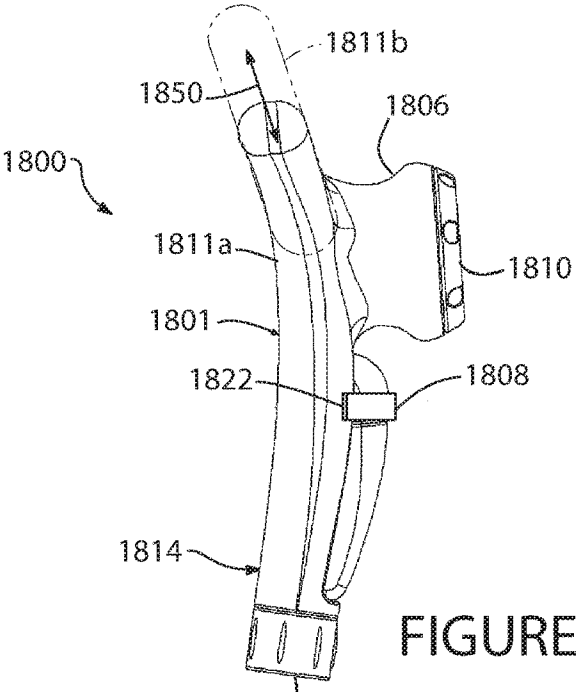
FIG. 46B is a side view of the garden watering device of FIG. 46A.
Figure 46A:
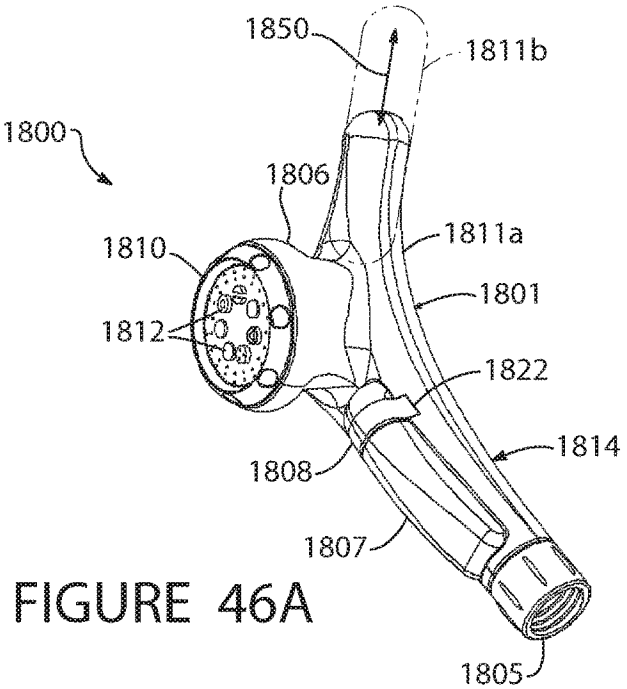
FIG. 46A is a perspective view of another embodiment of the garden watering device.

Another embodiment of a garden watering device 1800 is illustrated in FIGS. 46A and 46B. The garden watering device 1800 includes many of the same elements as the garden watering device 1600 of the previously described embodiment shown in FIG. 40, and these similar elements have been marked with similar reference numbers in the 1800's (i.e., the body member 1601 of the previous embodiment is now body member 1801 in this embodiment). In this garden watering device 1800, the fixed support legs opposing the handle 1814 have been replaced with a pair of leg receptacles 1811*a* and a corresponding pair of telescoping support legs 1811*b* slidably received in the leg receptacles 1811*a*. As shown in FIGS. 46A and 46B, the telescoping support legs 1811*b* may be retracted substantially into the leg receptacles 1811*a* as shown in solid, or may be extended into the position shown in phantom in the figures. To this end, the telescoping support legs 1811*b* may be stored during a handheld operation and deployed outboard of the main body member 1801 to provide a stable tripod-like support with the handle 1814 in a ground-based operation.

Figure 47C:
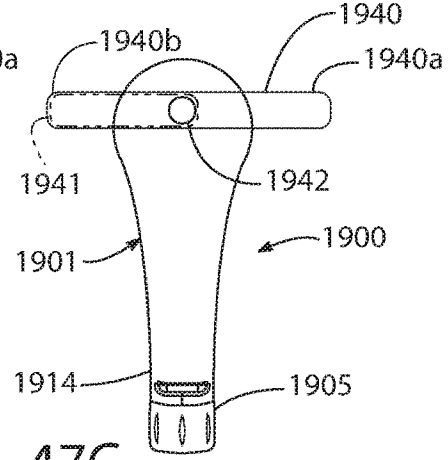
FIG. 47C is a bottom view of the garden watering device of FIG. 47A, with a support member fully deployed.
Figure 47B:
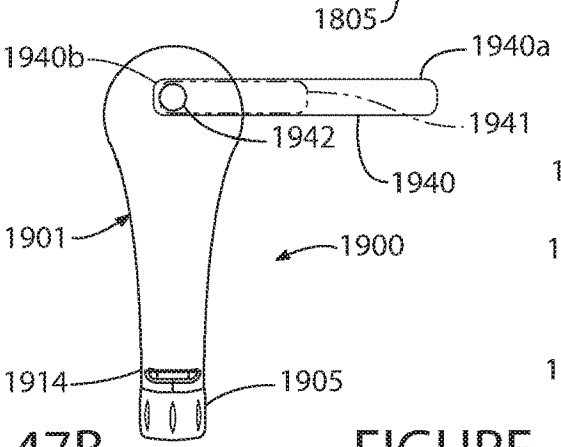
FIG. 47B is a bottom view of the garden watering device of FIG. 47A, with a support member partially deployed.
Figure 47A:
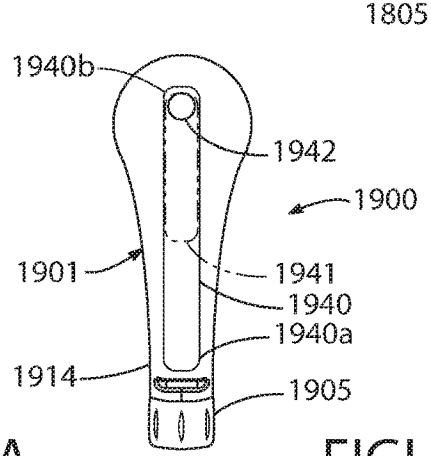
FIG. 47A is a bottom view of another embodiment of the garden watering device, with a support member stowed.

Yet another embodiment of a garden watering device 1900 is illustrated in FIGS. 47A-47C. The garden watering device 1900 includes many of the same elements as the garden watering device 1800 of the previously described embodiment shown in FIG. 46A, and these similar elements have been marked with similar reference numbers in the 1900's (i.e., the body member 1801 of the previous embodiment is now body member 1901 in this embodiment). In this garden watering device 1900, a support member 1940 is pivotally coupled to the body member 1901 along a bottom side with a fastener 1942, such as a screw or a pivot pin. The support member 1940 includes a first end 1940*a*, a second end 1940*b*, and an elongate channel 1941 formed between the second end 1940*b* and a central portion of the support member 1940. It is to be understood that the placement of the elongate channel 1941 could be reversed such that the elongate channel 1941 is formed in the body member 1901 and the fastener 1942 is coupled to the support member 1940. The head of the fastener 1942 is slidably received in the elongate channel 1941. When in a handheld operation as shown in FIG. 47A, the fastener 1942 is disposed adjacent the second end 1940*b* and the support member 1940 stows itself underneath the body member 1901 such that the first end 1940*a* is underneath the handle 1914. To deploy the support member 1940, the support member 1940 is rotated about the fastener 1942 to the partially deployed position in FIG. 47B, and then the fastener 1942 is slid along the elongate channel 1941 toward the central portion of the support member 1940 as shown in FIG. 47C. In this position, the first and second ends 1940*a*, 1940*b* of the support member 1940 cooperate with the handle 1914 to provide a tripod-like support for the garden watering device 1900 in a ground-based operation. Therefore, the garden watering device 1900 is configured to move between handheld and ground-based configurations easily.

Figure 48:
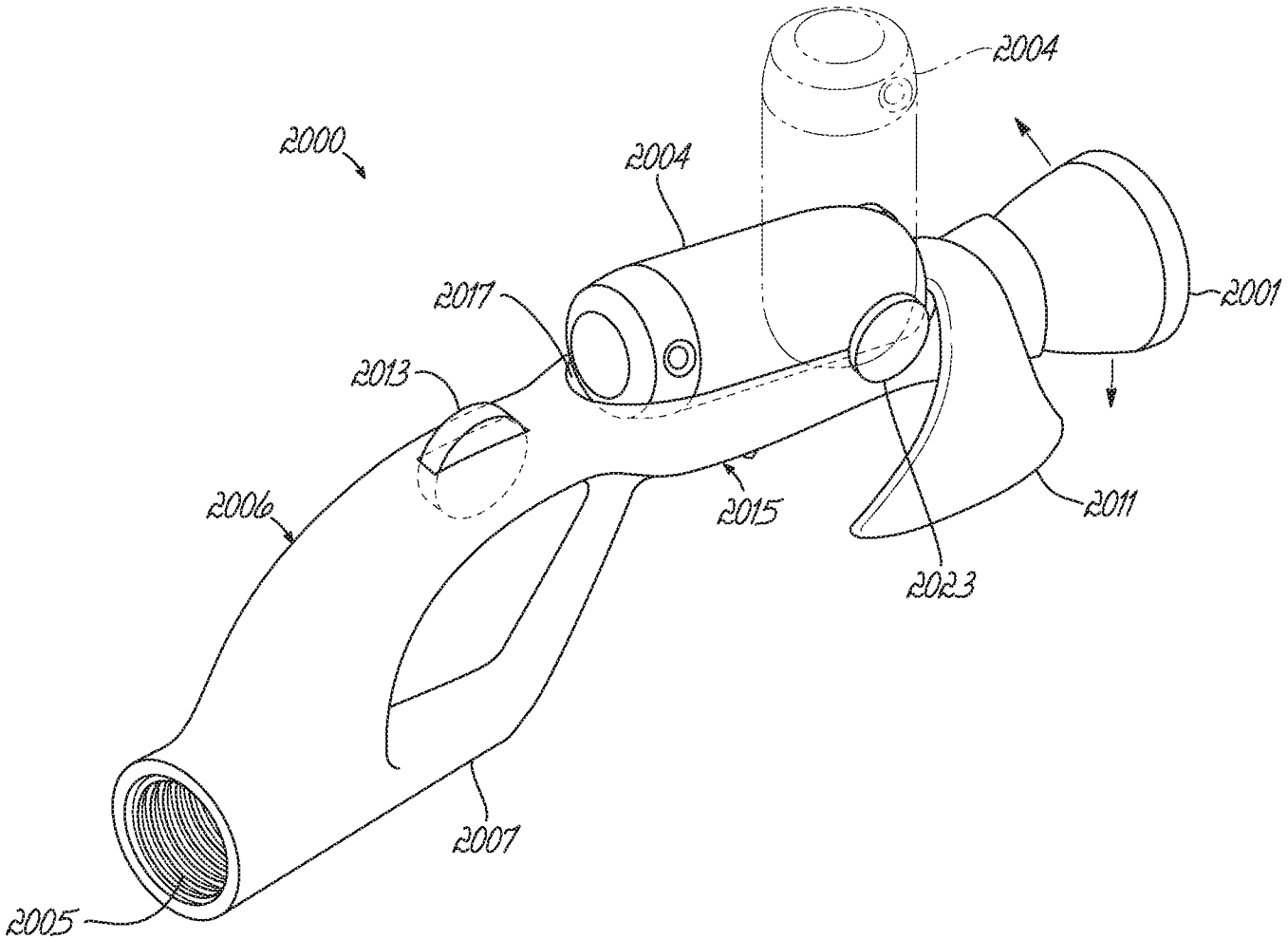
FIG. 48 is a perspective view of another embodiment of a garden watering device.

Another embodiment of a garden watering device 2000 is illustrated in FIG. 48. The garden watering device 2000 includes many of the same elements as the garden watering device 100 of the previously described embodiment shown in FIG. 1, and these similar elements have been marked with similar reference numbers in the 2000's (i.e., the device body 115 of the previous embodiment is now body member 2015 in this embodiment). As with the watering device 100, the garden watering device 2000 has a first water distribution member 2004 and a second water distribution member 2001. The second distribution member 2001 is again a turret-style multi-pattern head as previously detailed, but the first distribution member 2004 is a rotary gearbox sprinkler rather than an elongate tube. The gearbox sprinkler member 2004 is connected to the body 2015 by means of a hinge member 2023 which allows the gearbox sprinkler head 2004 to move between a first position flush with the device body 2015 when the head 2004 is not in use and a second position extended away from the body member 2015 when the head 2004 is to be used. When in the first position, shown by solid lines in FIG. 48, the gearbox member 2004 sits in a storage area such as a recess 2017 which reduces the profile of the device 2000 and is appropriate for handheld or ground-based use of the device 2000 with the multi-pattern head 2001 as previously described. When in the second position, shown by broken lines in FIG. 48, the gearbox member 2004 sits perpendicular to the body 2015 and, when the device is placed on the ground for ground-based operation, the gearbox member 2004 is generally perpendicular to the ground as well.

When the gearbox sprinkler head 2004 is selected by means of the flow route selector 2013, water moving through the water inlet 2005 into the gearbox sprinkler head 2004 causes the head 2004 to rotate and dispense water as known for gearbox sprinkler heads. While placed on the ground for ground-based operation, the support leg 2007 of the handle 2006 and the support legs 2011 rest on the ground, as with the device 100 of FIG. 1.

Figure 49:
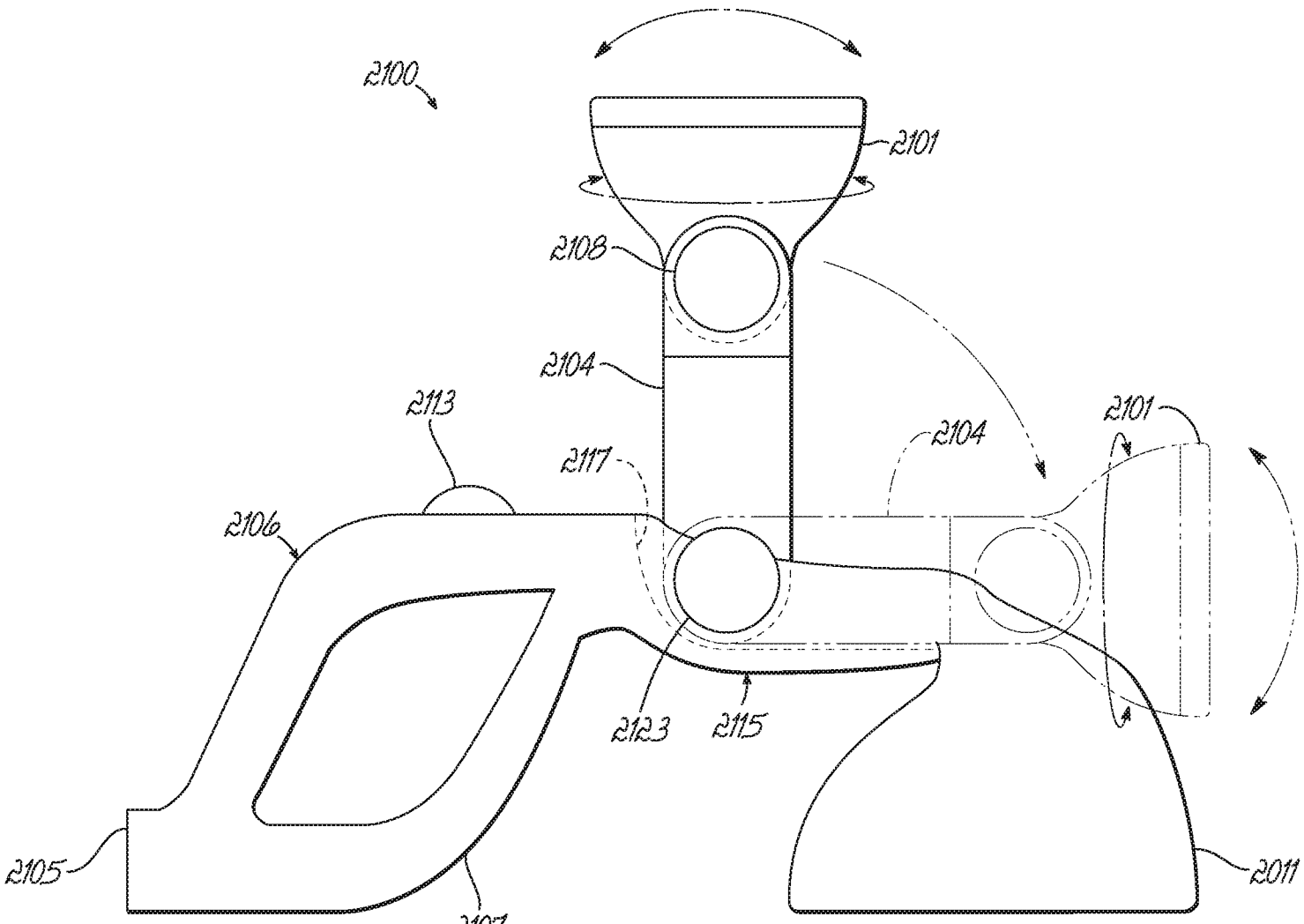
FIG. 49 is a perspective view of another embodiment of a garden watering device.

Yet another embodiment of a garden watering device 2100 is illustrated in FIG. 49. The garden watering device 2100 includes many of the same elements found in the garden watering device 2000 shown in FIG. 48. In this embodiment, the gearbox sprinkler head is combined with the multi-pattern turret style head to form a single head 2101 that performs both functions. The head 2101 includes the turret-style outlet with multiple spray patterns available by dial as detailed above. A gearbox 2104 is disposed between two articulated joints 2108, 2123. The distal joint 2108 rotates with the head 2101. The joint 2123 proximate the device body 2115 acts as the hinge member 2023 described above with respect to the previous embodiment 2023, moving the dispensing member 2101 between a generally horizontal position flush with the body 2115 within a storage area such as a recess 2117, shown in outline, and a generally vertical position appropriate for ground-based operation, shown in solid lines.

Figure 50:
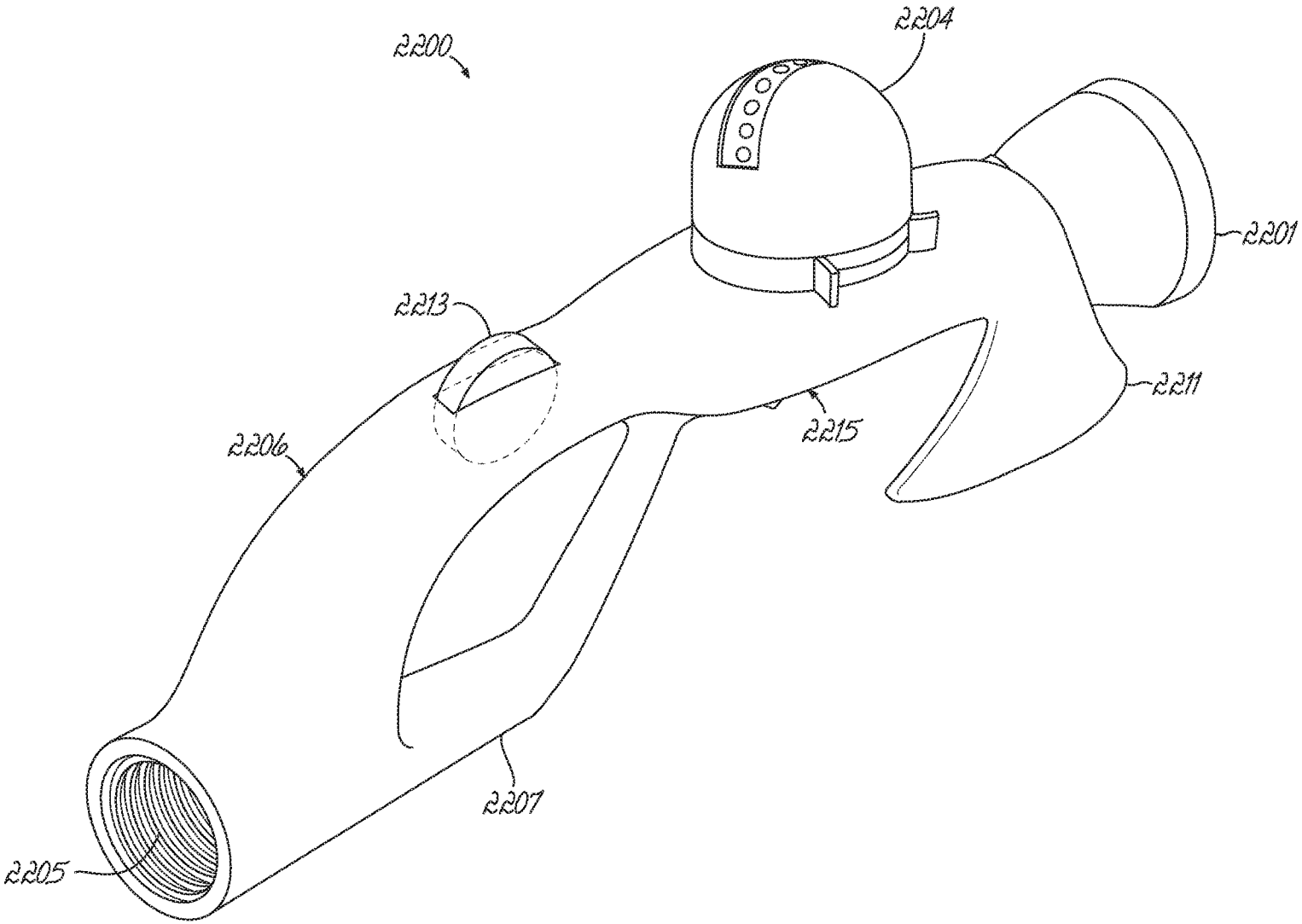
FIG. 50 is a perspective view of another embodiment of a garden watering device.

Illustrated as FIG. 50, another embodiment of a garden watering device 2200 is again similar to the garden watering device 2000 shown in FIG. 48, with similar numbers, except that the gearbox sprinkler head 2204 is in a generally fixed position within the body 2215 and is not designed to fold or unfold relative to the body 2215. Again the gearbox sprinkler head 2204, when water is routed to it by use of the flow route selector 2213, rotates and distributes water in a ground-based operation mode as known in the art for a gearbox sprinkler head. The construction of this head 2204 may allow much of the gearbox that enables rotation of the head to be recessed within the body 2215 itself, allowing the head 2204 to retain a relatively low profile and the device 2200 to be manageable in a handheld operation. The handle 2206, support structures, 2211, and multi-pattern turret-style sprinkler 2201 are all as above.

A variety of alternating embodiments center on a device with a second water dispensing member that is different than the turret-style multi-spray head shown as head 101 in FIG. 1 and in many subsequent embodiments. Each of FIGS. 51 to 54 show an embodiment of a garden watering device with a distal end including a different embodiment of a spray head. It should be understood that each of these embodiments could be used in conjunction with the elongate tube 104 of FIG. 1, with the gearbox sprinkler head 2004 of FIG. 48, or with any other appropriate first water dispensing member as disclosed in this application or known in the art.

Figure 51:
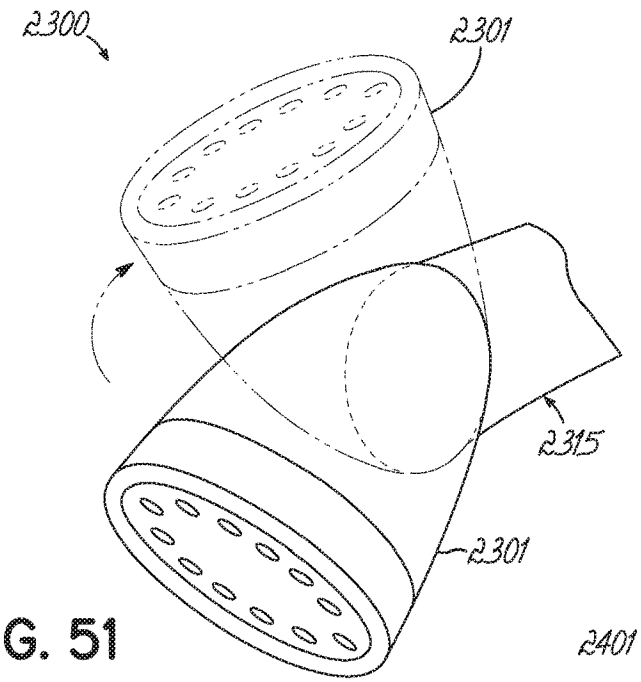
FIG. 51 is a partial perspective view of an embodiment of a multi-pattern turret-style sprinkler head of a garden watering device.
Figure 53:
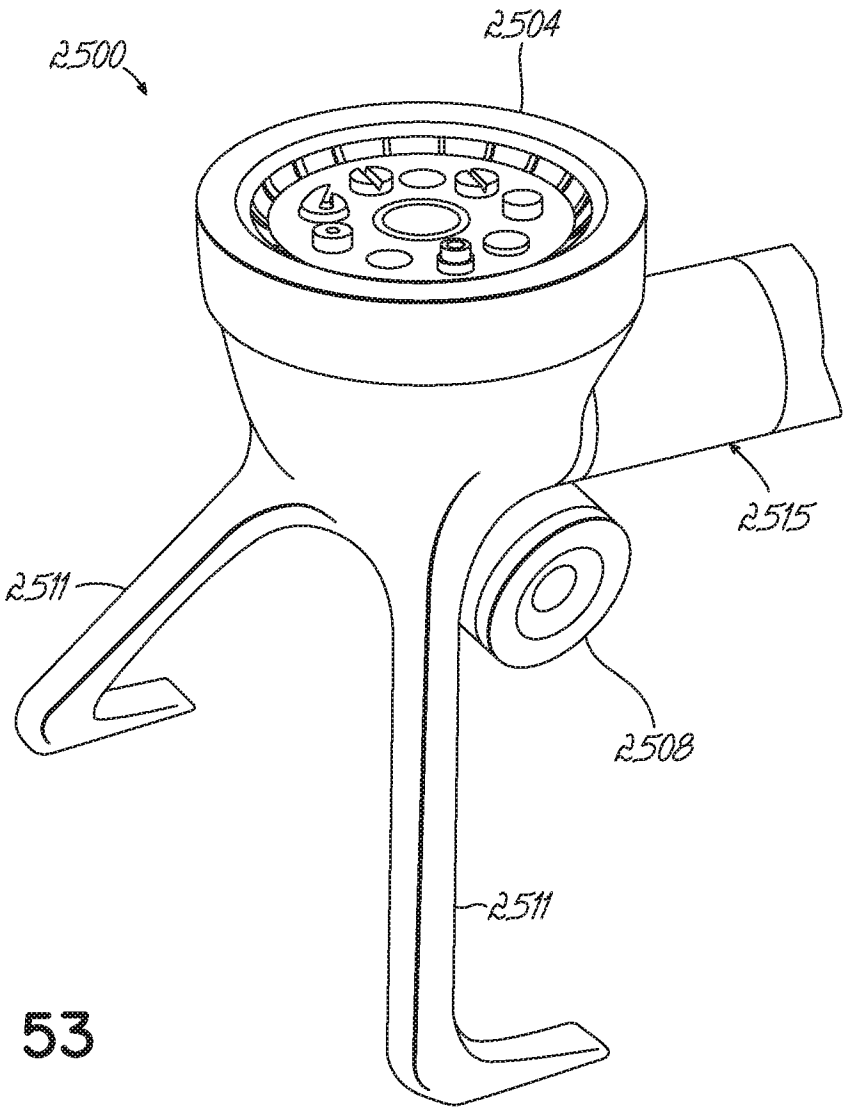
FIG. 53 is a partial perspective view of another embodiment of a multi-pattern turret-style sprinkler head of a garden watering device.

FIG. 51 illustrates an embodiment of a garden watering device 2300, which lacks an independent support structure on the end near the multi-pattern head 2301. Instead, the multi-pattern head 2301, when in a lowered position as shown by solid lines in FIG. 51, rests against the ground for ground based operation of the device 2300. Rather than a ratchet interface, the head 2301 is angled relative to the longitudinal axis X, and swivels to rotate relative to the longitudinal axis X, thus allowing the head 2301 to point in any direction.

Figure 52A:
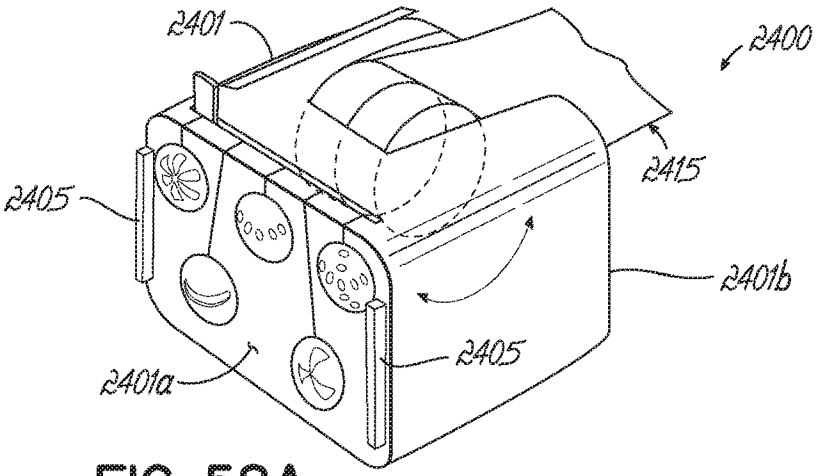
FIG. 52A is a partial perspective view of another embodiment of a multi-pattern turret-style sprinkler head of a garden watering device.
Figure 52C:
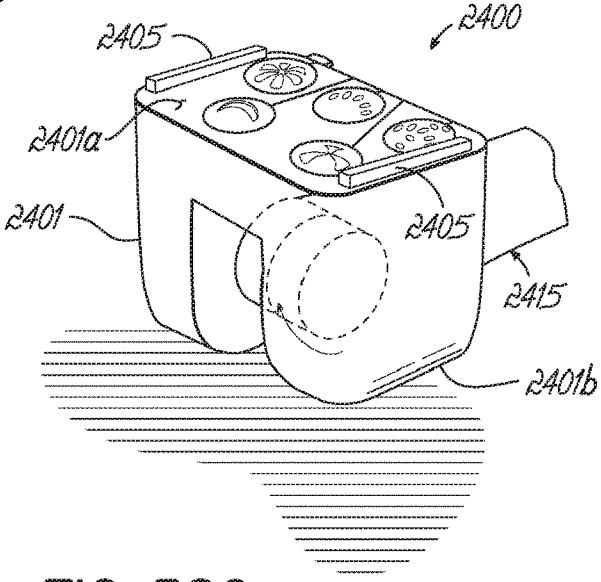
FIG. 52C is a partial perspective view of the head of FIG. 52A pointing upwards.
Figure 52B:
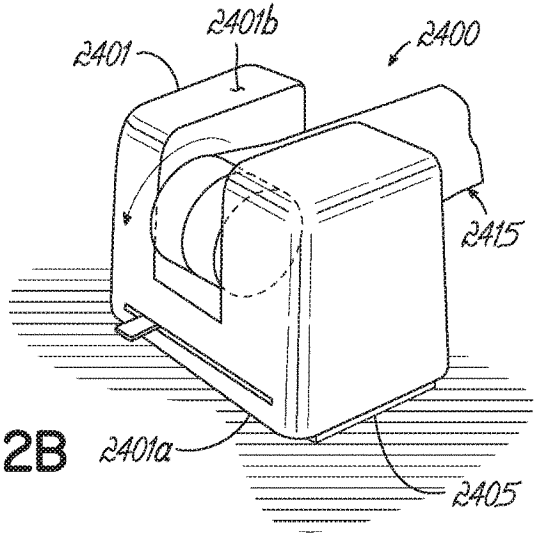
FIG. 52B is a partial perspective view of the head of FIG. 52A pointing downward.

Like the device 2300 of FIG. 51, FIGS. 52A-C illustrate a garden watering device 2400 where the secondary distribution member 2301 acts as a structural support when the device 2400 is used in ground-based operation. As in previous embodiments, the turret-style multi-pattern sprinkler head 2401 may be joined to the device body 2415 by means of a basic bidirectional hinge 2408, or by any other means herein disclosed. When in the face-down position, as shown in FIG. 52B, the flat front surface 2401*a* of the multi-pattern head 2401 acts to rest the distal end of the device 2400 on the ground during ground-based operation. While in the face-up position, as shown in FIG. 52C, the flat rear surface 2401*b* of the multi-pattern head 2401 similarly acts to support its end of the device 2400.

A user selects from among different flow patterns for the turret head 2401 by means of a linear actuator 2420, which uses the position of a lever 2421 along the width of the sprinkler 2401 to determine the pattern of water distribution. As with the dials on multi-pattern spray heads disclosed above, the linear actuator includes both spray patterns appropriate for hand-held operation of the device 2400 with the head 2401 pointed generally forward or down and forward as appropriate for hand-held use, and spray patterns appropriate for ground-based operation of the device 2400 with the head 2401 pointed upward as shown in FIG. 52C.

In another embodiment shown in FIGS. 53A and 53B, a garden watering device 2500 may include a multi-pattern turret head 2501 with the support legs 2511 integral therewith. When the head 2501 is turned upward for ground-based use as shown in FIG. 53A, the support legs 2511 are oriented to contact that ground and support the device 2500. When the head is turned forward as shown in FIG. 53B, the legs 2511 lay parallel to and flush with the device body 2515 and do not encumber the user for hand-held operation.

Figure 54:
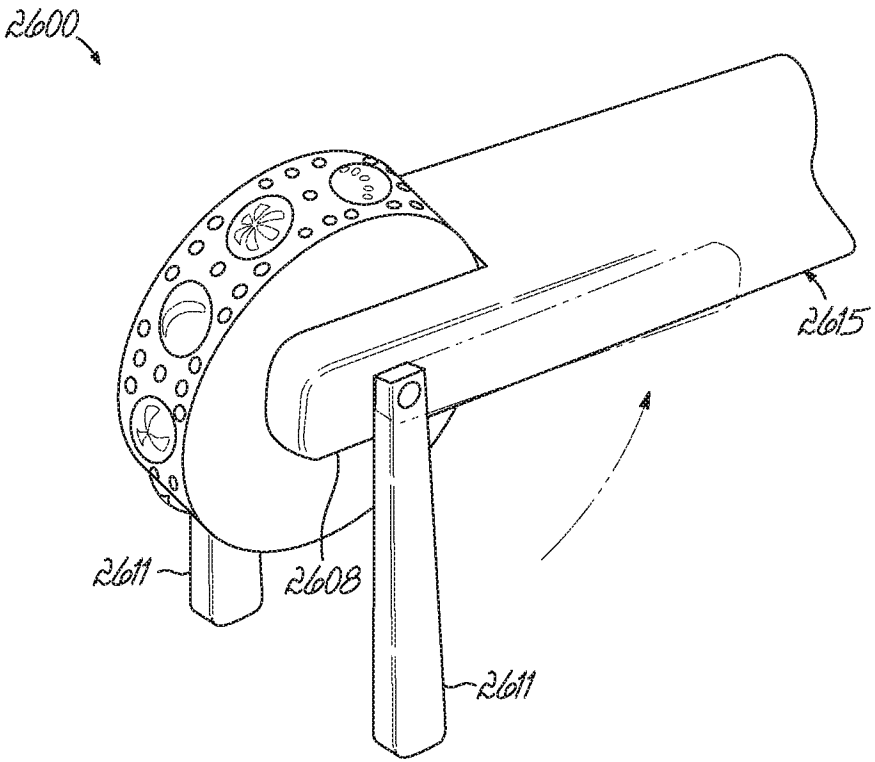
FIG. 54 is a partial perspective view of another embodiment of a multi-pattern turret-style sprinkler head of a garden watering device.

FIG. 54 shows a device 2600 with yet another embodiment of a multi-pattern head 2601 for hand-held operation. In this embodiment, the head 2601 represents a wheel with a set of nozzles 2622 projecting from the rim of the wheel. The head 2601 interfaces with the device body 2615 by means of a hub joint 2608 about which the head 2601 can be rotated into a variety of orientations. Different rotational orientations of the head 2601 relative to the device body 2615 correspond to different spray patterns, which may include both spray patterns appropriate for the use of the device 2600 for hand-held operation and other spray patterns appropriate for ground-based operation of the device 2600.

The device 2600 includes a pair of fold-out legs 2611 to support the spray head end of the device 2600 when in ground-based operation. Other support structures, such as the stationary support structures shown as legs 111 in FIG. 1 or other integral or moveable structures, may also be used to support the device 2600 against the ground.

Figure 55:
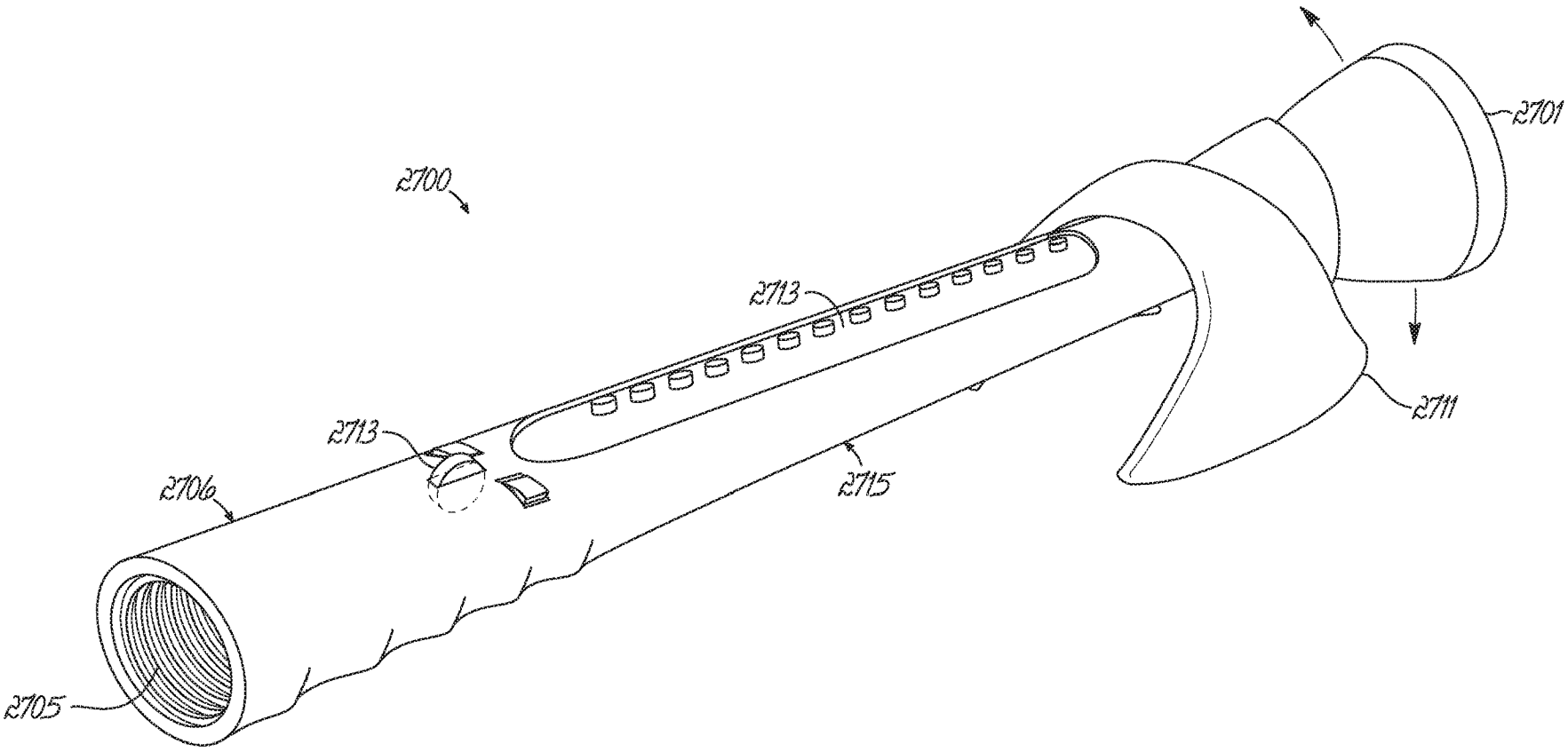
FIG. 55 is a perspective view of an embodiment of a garden watering device.
Figure 56:
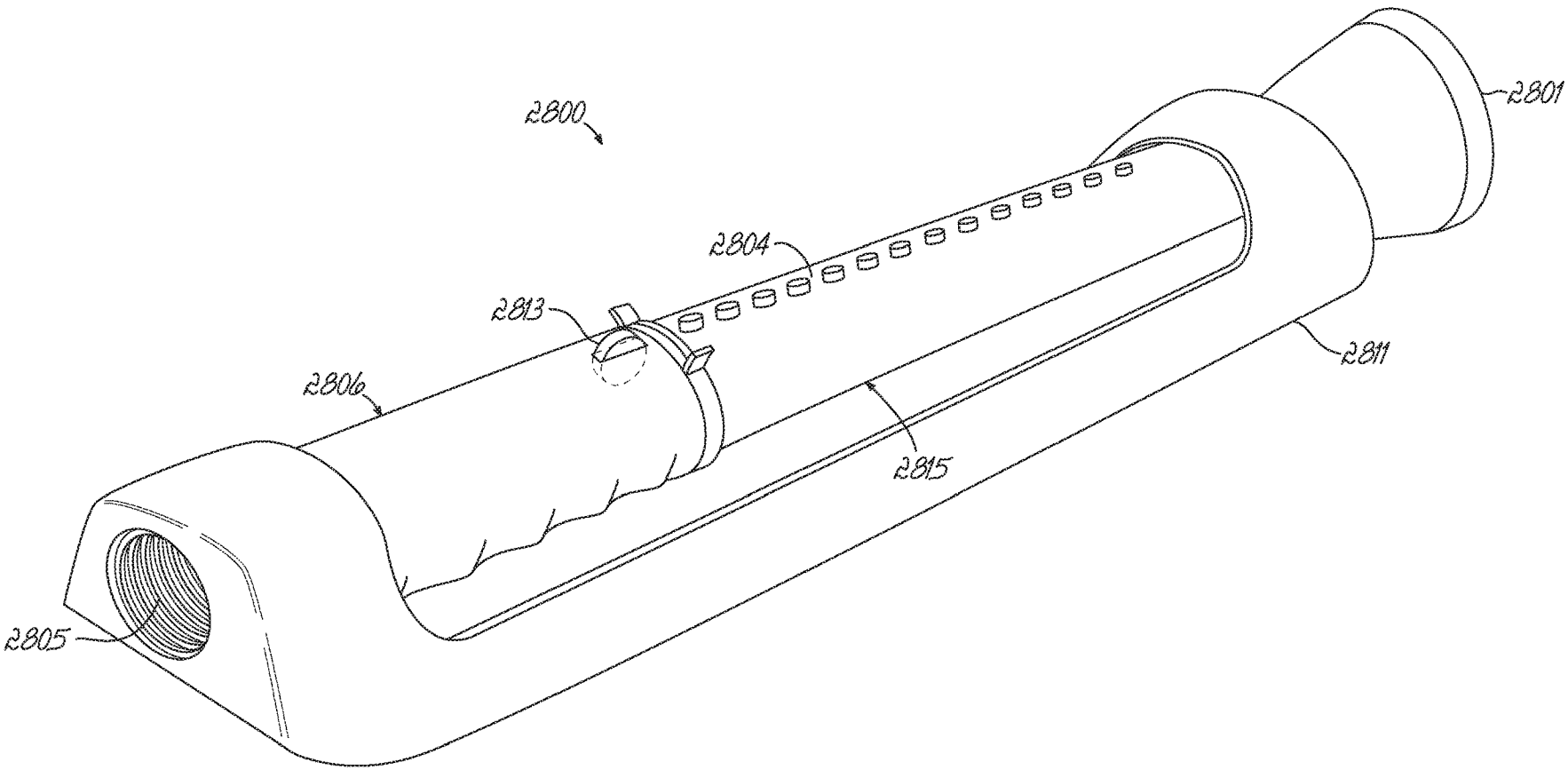
FIG. 56 is a perspective view of another embodiment of a garden watering device.

Additional embodiments of a garden watering device are shown in FIGS. 55 and 56. These devices 2700, 2800 are similar to the device 100 shown in FIG. 1, but with modified handles 2706, 2806 that do not include a support leg. The device 2700 shown in FIG. 55 uses a support structure 2711 coupled to the device body 2715 and similar to the support structure 111 in FIG. 1. The device 2800 shown in FIG. 26 uses legs 2811 running most of the length of the device body 2815, similar to the support structures ending in "11" shown in FIGS. 12A, 13, and 15A.

These devices are shown with the elongated tube dispensing members 2704, 2804 immediately following the handle. In these embodiments, the oscillating mechanism 2714, 2814 that allows the elongated tube dispensing member 2704, 2804 to oscillate resides within the handle 2706, 2806, therefore further reducing the length of the devices 2700, 2800. Although shown with the same elongated tube dispensing member 2704, 2804, and multi-spray turret head 2701, 2801 shown as 104 and 101 in FIG. 1, it will be recognized that other embodiments of first and second dispensing members, such as the gearbox sprinkler head 2004 and the alternate turret heads 2301, 2401, 2501, or 2601, may be used with a handle 2706 or 2806 as shown.

It will be understood by one of ordinary skill in the art that other embodiments disclosed herein can also benefit by placing the oscillating mechanisms partially or fully within the handle members disclosed as part of those embodiments, or modifying the handle members to allow the oscillating mechanisms to reside fully or partially therein. This novel placement of the oscillating mechanism contributes to the invention's reduced size and length compared to the prior art, among other benefits that will be understood by a person of ordinary skill.

Figure 57:
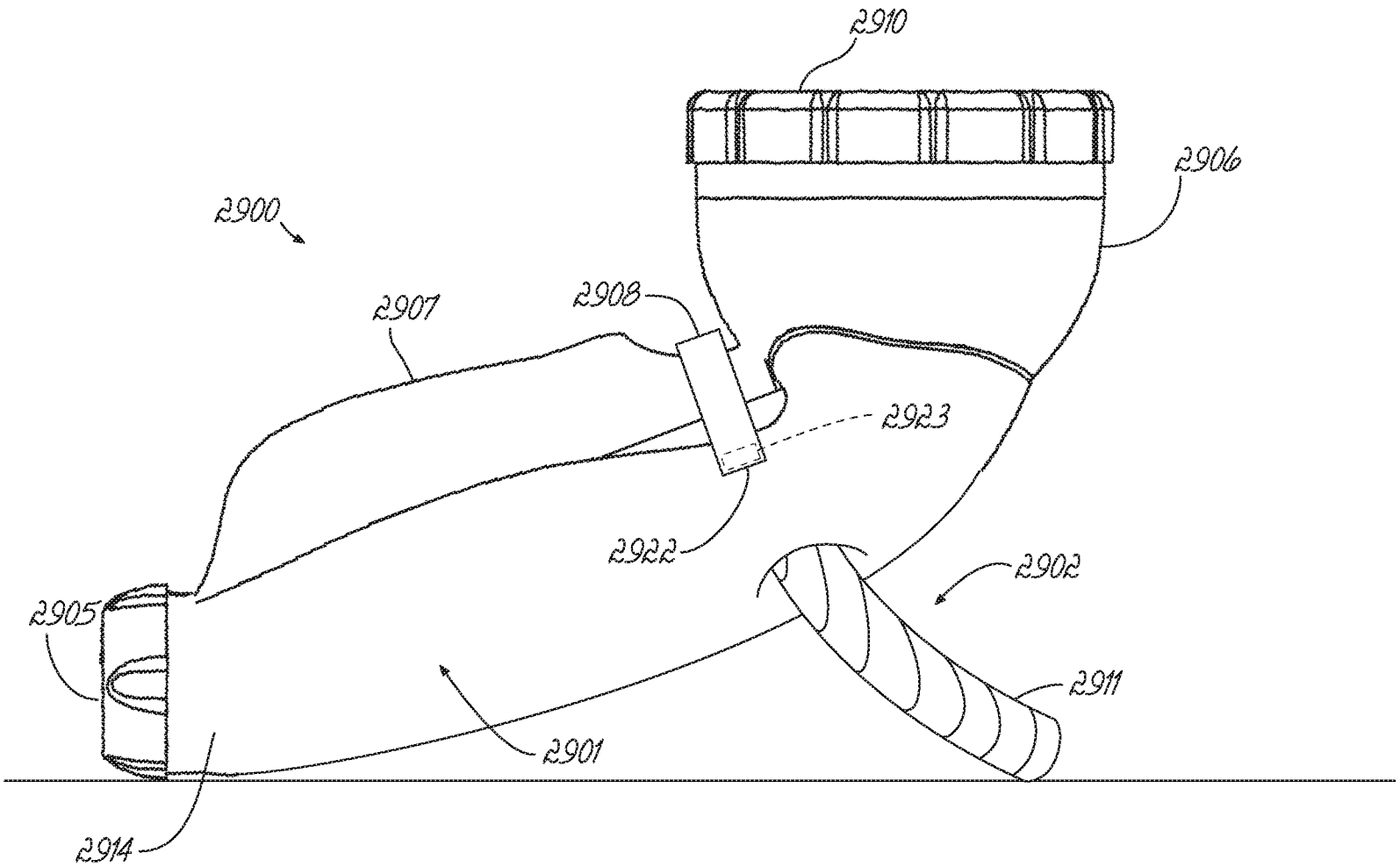
FIG. 57 is a perspective view of another embodiment of a garden watering device.

FIG. 57 illustrates a pistol-style garden watering device 2900 which is generally similar to the device 1500 shown in FIG. 33 and uses similar numbers in the 2900's, but which replaces the hinged legs 1511 with flexible support legs 2911. These legs 2911 may be rope, wire, rubber, or any other material which can support the pistol-style device 2900 in ground-based operation as earlier described. When the device 2900 is being operated as a hand-held device, these flexible legs 2911 may be designed to retract partially or wholly into the device body 2915, to sit in storage areas such as small recesses on either side of the body 2915, or to otherwise lie within or flush with the contours of the device body 2915 while not in use.

Figure 58B:
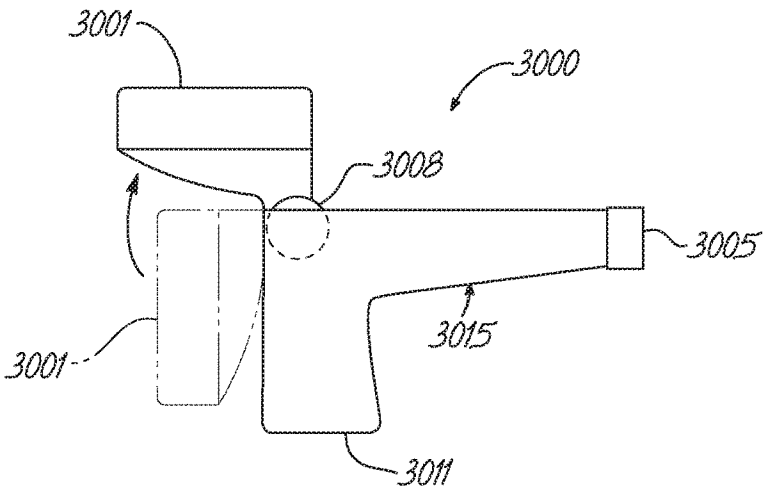
FIG. 58B is a side view of the device of FIG. 58A.
Figure 58A:
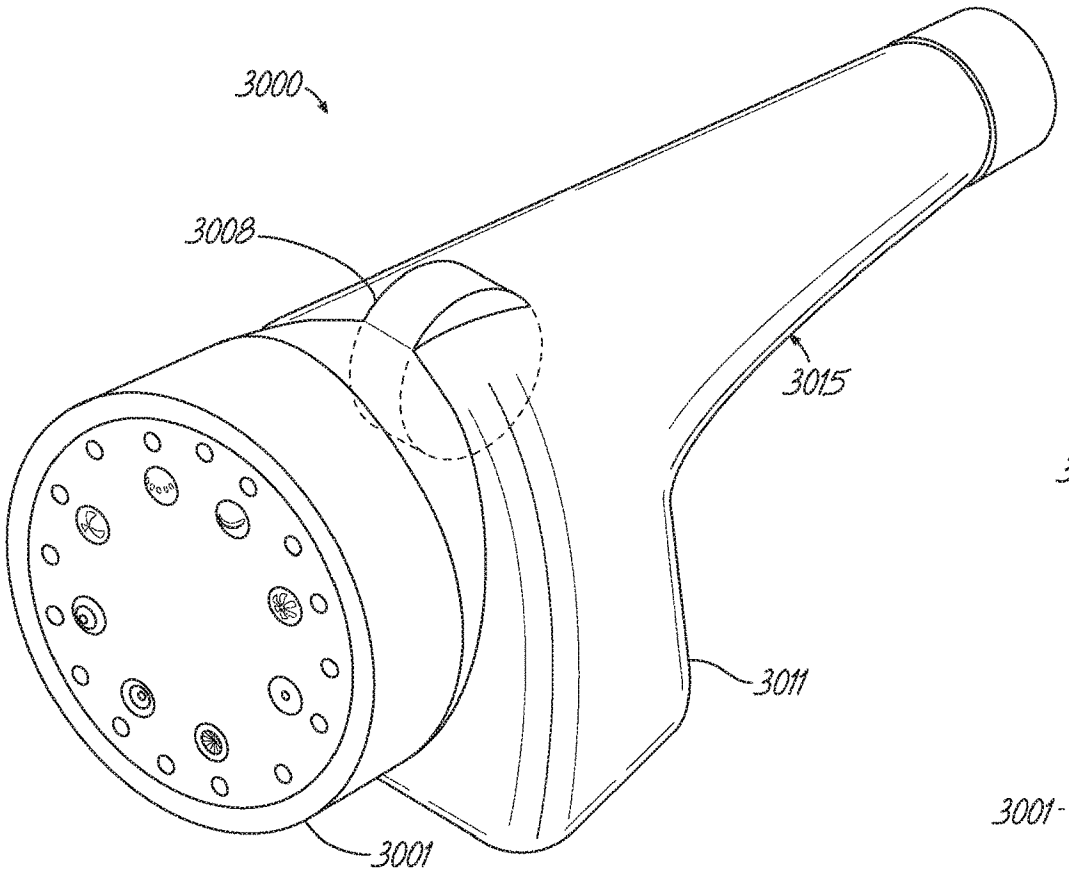
FIG. 58A is a perspective view of another embodiment of a garden watering device.

FIGS. 58A-B illustrate a further embodiment of a garden watering device 3000 that includes a turret-style multi-spray head 3001 having dial settings for both hand-held and ground-based use as previously described. As in the pistol-style devices disclosed above, the multi-spray head 3001 is not paired with another water dispensing member, and so no flow route selector between the head 3001 and another member is needed. As shown, the spray head 3001 is connected to the device body 3015 by means of an articulated joint 3008 similar to those previously described. When the spray head 3001 faces generally forward, as shown in FIG. 58A, the device 3000 can be used with any of the hand-held spray patterns for use as a hand-held watering device. By moving the spray head 3001 to face generally upward, as shown in FIG. 58B, the device 3000 can be used with a ground-based spray pattern of the spray head 3001 for ground-based use. In ground-based use, the device rests on the support structure 3011 which is an integral part of the device body 3015.

Figures 59A, 59B:
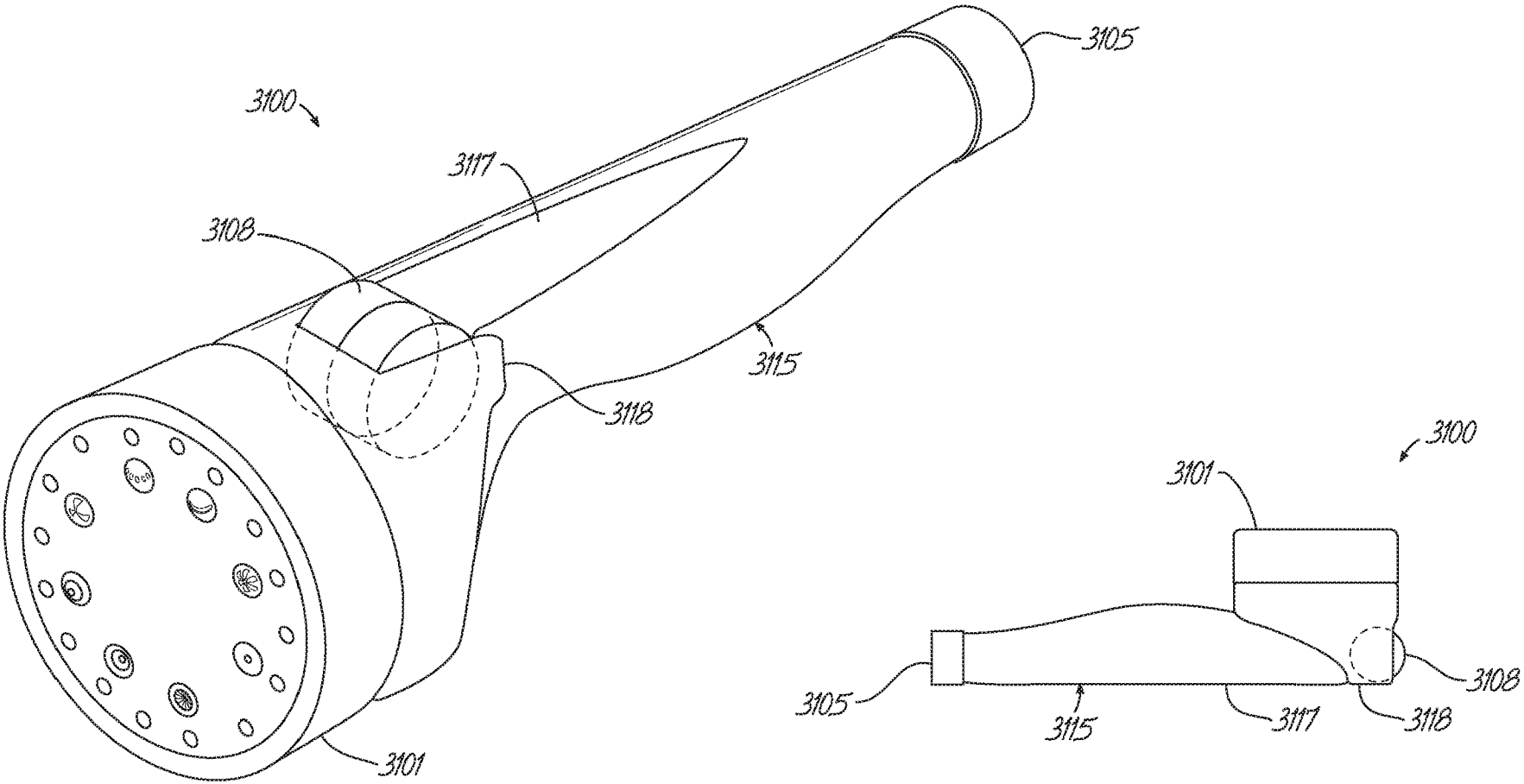
FIG. 59A is a perspective view of another embodiment of a garden watering device.
FIG. 59B is a side view of the device of FIG. 59A.

FIGS. 59A-B illustrate yet another embodiment of a garden watering device 3100 that also includes a turret-style multi-spray head 3101 as earlier disclosed, and is generally similar to the device 3000 of FIG. 58A discussed immediately above. However, rather than a projecting support member, this device 3100 includes a flat surface 3117 on the device body 3115 as shown. The device body 3115 may be contoured to allow convenient gripping while in hand-held use, with the flat surface 3117 facing generally upwards while in hand-held operation as shown in FIG. 59A. However, in ground-based operation as shown in FIG. 59B, the head 3101 is rotated to face away from the flat surface 3117. The flat surface 3117 can then contact the ground, allowing the device 3100 to be used as a ground-based sprinkler as previously described. As shown, the rear portion of the head 3101 may itself include a generally flat projection 3118 that is parallel to, and may be generally flush with, the flat surface 3117 when the head 3101 is moved into this position as shown, thus providing further contact with the ground and further support for the device 3100 in ground-based operation.

Figure 60A:
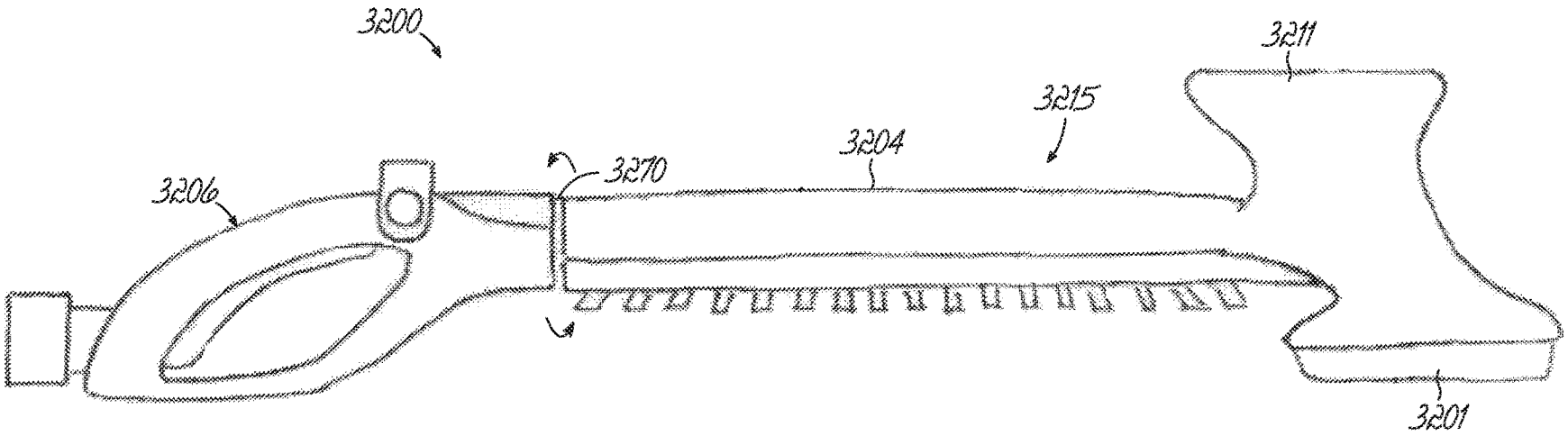
FIG. 60A is a side view of another embodiment of a garden watering device.
Figure 60B:
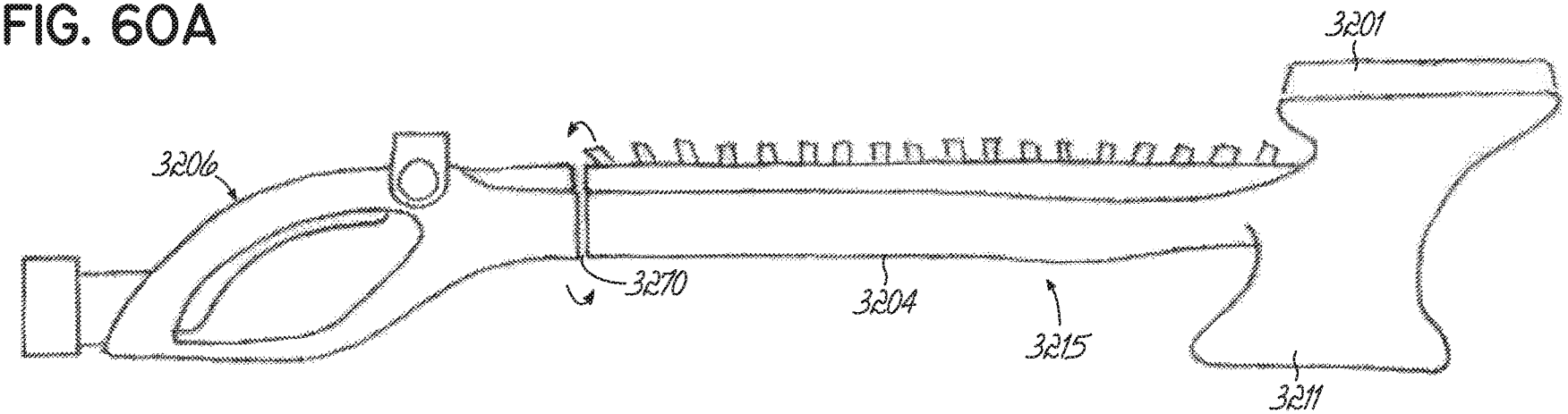
FIG. 60B is another side view of the device of FIG. 60A.

FIGS. 60A and 60B illustrate another embodiment of a garden watering device 3200 wherein the multi-spray turret-style sprinkler head 3201, which is otherwise similar to that shown in previously-described embodiments, may be generally fixed to the device body 3215. However, as shown, the device body 3215, which includes the elongated tube 3204 and the support legs 3211 as well as the fixed turret head 3201, is configured to rotate relative to the handle 3206, such as at 3207. The device body 3215 may be oriented such that the head 3201 faces generally downward as shown in FIG. 60A to facilitate hand-held operation, and may then be rotated to orient the head 3201 generally upward as shown in FIG. 60B to facilitate ground-based operation.

Figure 61B:
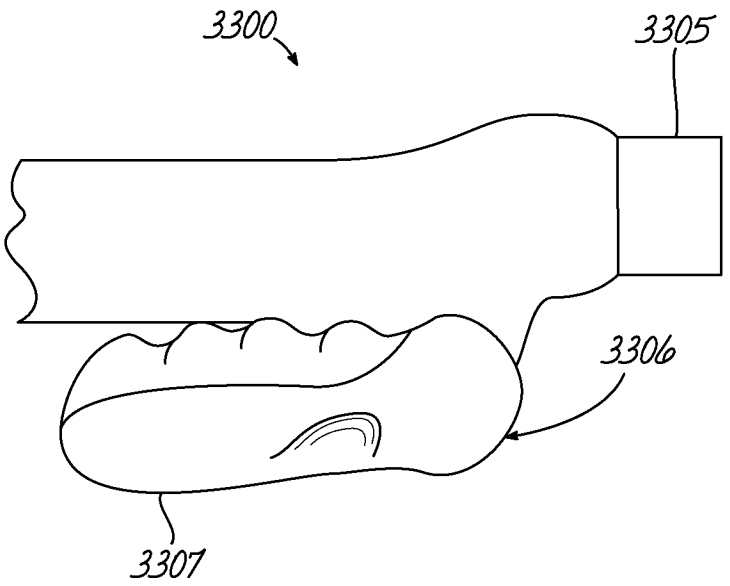
FIGS. 61A and 61B are partial perspective views of an embodiment of a movable handle of a garden watering device.
Figure 61A:
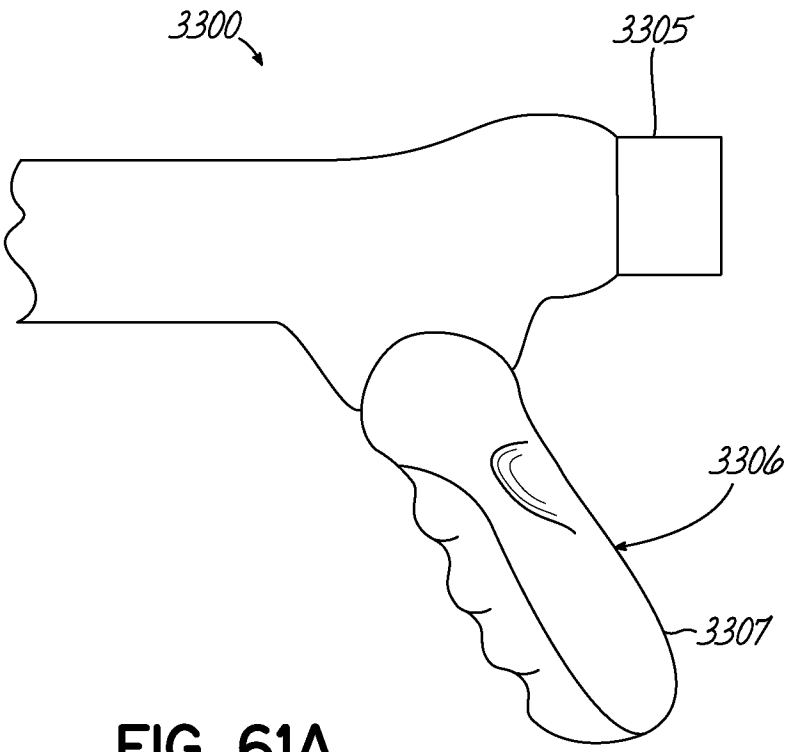

FIGS. 61A and 61B illustrate a garden watering device 3300 with a handle 3307 that, by means of an articulating joint 3306, folds flush with the device body 3305 when the handle 3307 is not needed. The handle 3307 may be included where appropriate with any of the earlier garden watering devices 3300 and is intended to provide additional flexibility in use, as well as further facilitating compactness in storage and sales.

It will be recognized that a variety of movable or stowable handles may be used, and the handle may slide or otherwise retract into the device body rather than folding flush to the device as shown. In some embodiments, a hose may become part of a movable handle when positioned for use. For example, a handle may partially or completely sheath the portion of the house nearest the water inlet in order to use the hose structure as part of the stability and shape of the handle. In light of the disclosure herein, one of ordinary skill in the art will recognize a variety of configurations for and advantages to a movable handle.

Figure 62:
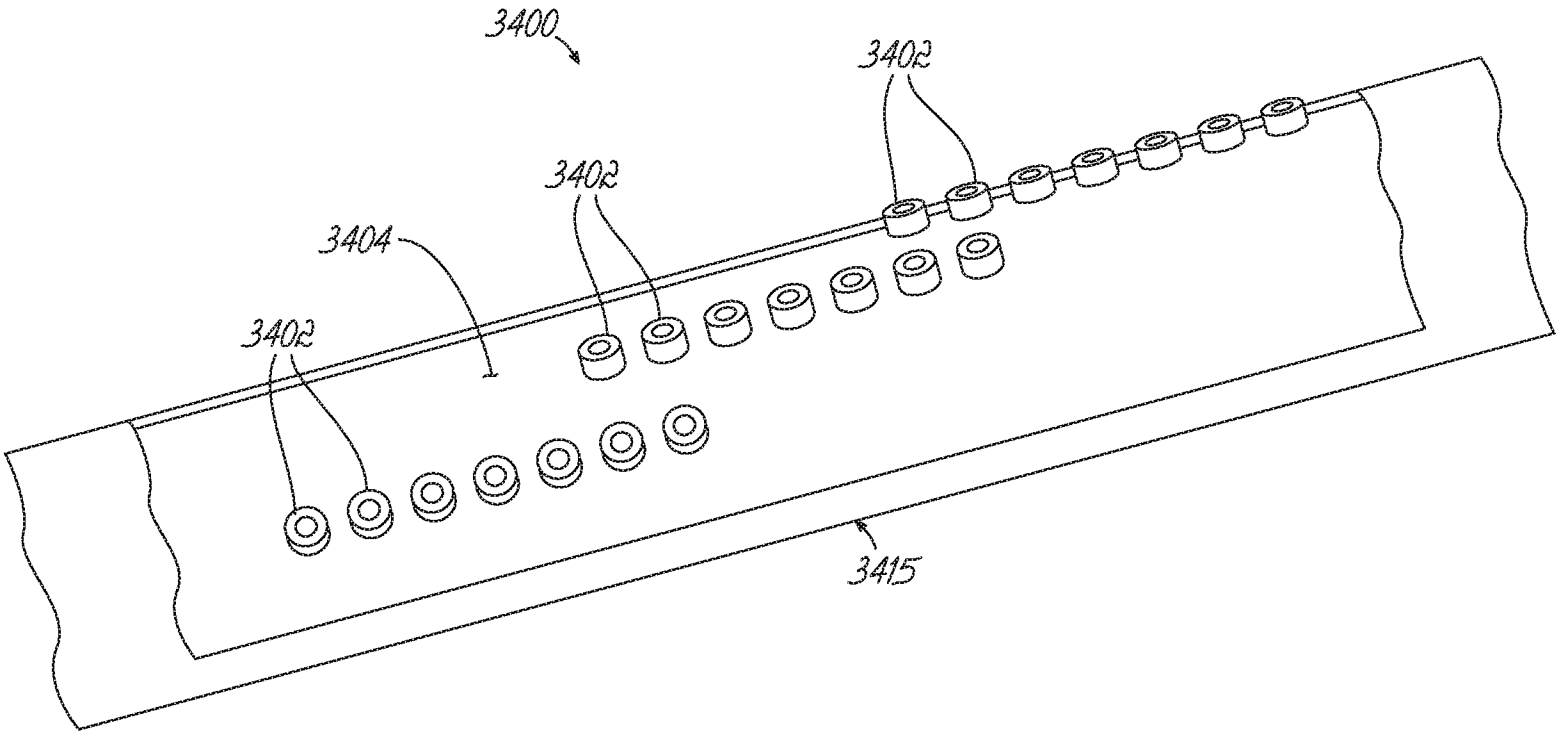
FIG. 62 is a partial perspective view of an embodiment of an elongate tube water dispenser of a garden watering device.

FIG. 62 illustrates the device body 3415 of a garden watering device 3400 wherein the elongate tube 3404 is not limited to a single row of outlets 3202, but instead includes a plurality of rows which overlap linearly along the X axis as shown. These staggered rows of outlets 3202 are an additional feature which reduced the needed length of the device 3400 for a given number of outlets 3202 for the first dispensing member 3204. The elongated tube 3204 functions as described in previous embodiments, and may be used with any previously-described second dispensing member, handle, and flow route selector as above.

Figure 63:
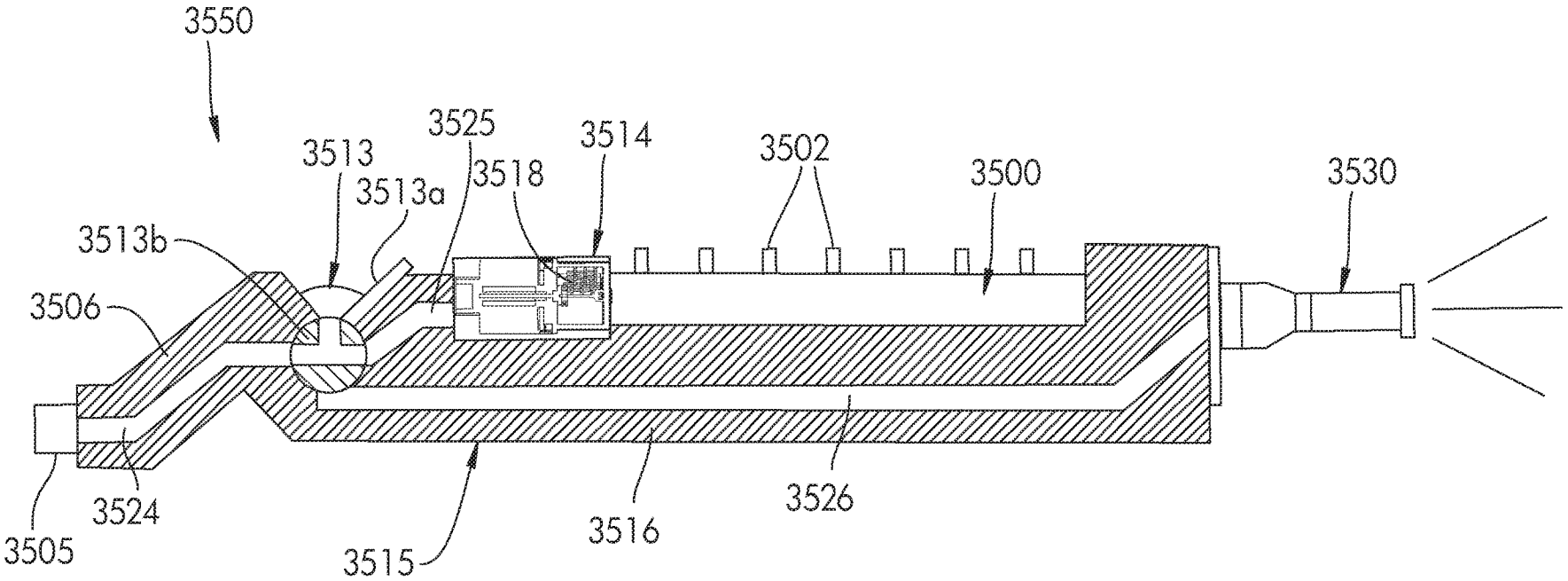
FIG. 63 is a partial cross sectional side view of an embodiment of a garden watering device.
Figure 64:
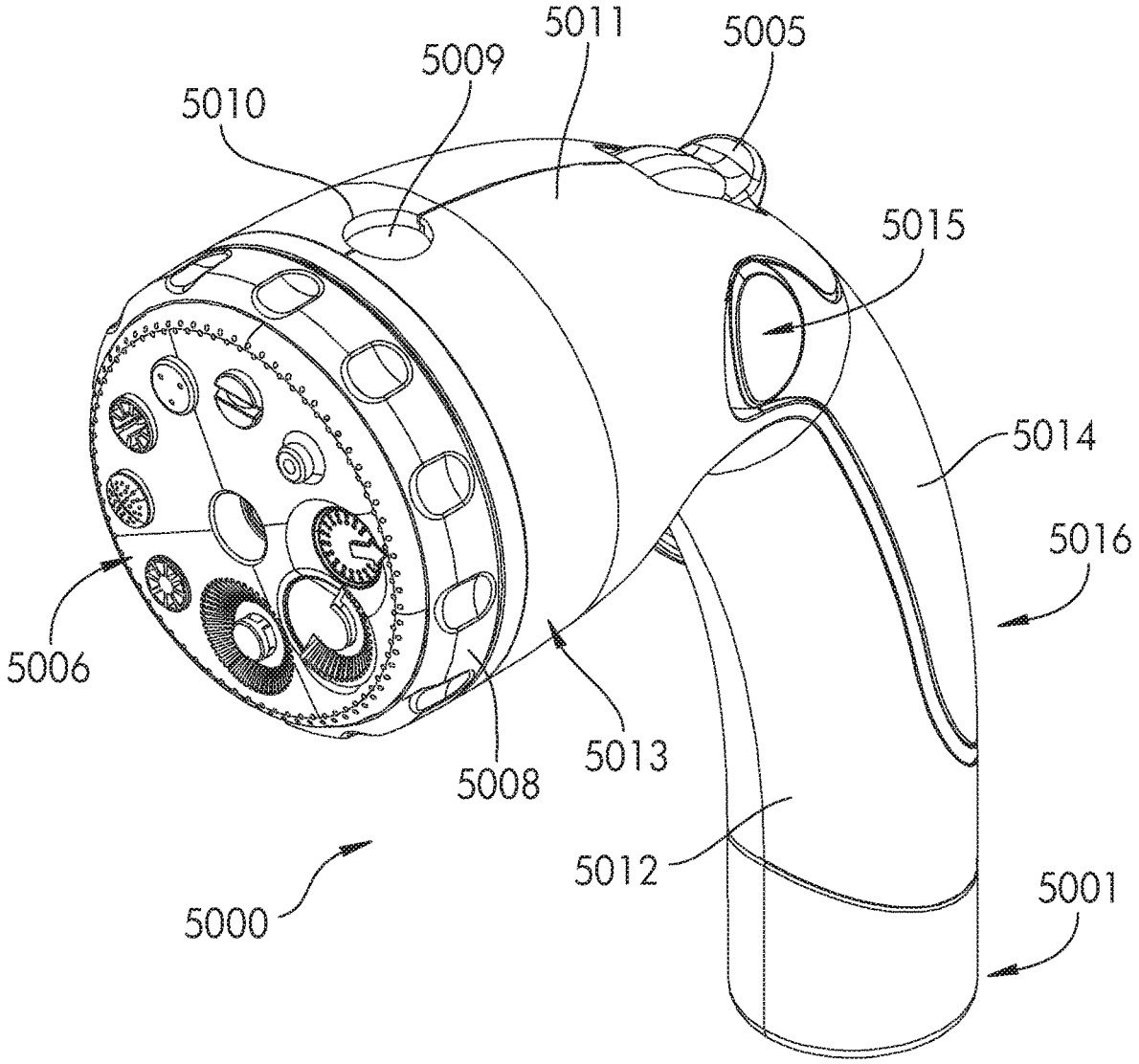
FIG. 64 is a perspective view of another embodiment of a garden watering device.

FIG. 63 illustrates another embodiment of a garden watering device 3500. It is generally identical to the device 700 as illustrated in FIG. 17C, except for the replacement of the turret head 701 and articulating joint 708. Instead, the garden watering device 3500 includes an adjustable spray nozzle 3501. Water is directed to either the oscillating elongate tube 3504 or the adjustable spray nozzle 3501 by means of the flow selector 3513, as previously described. The adjustable spray nozzle 3501 can be rotated about its axis to adjust the water discharge pattern. Of course, the articulating joint 708 could also be used in an alternative variant of the configuration shown in FIG. 63.

Figure 65:
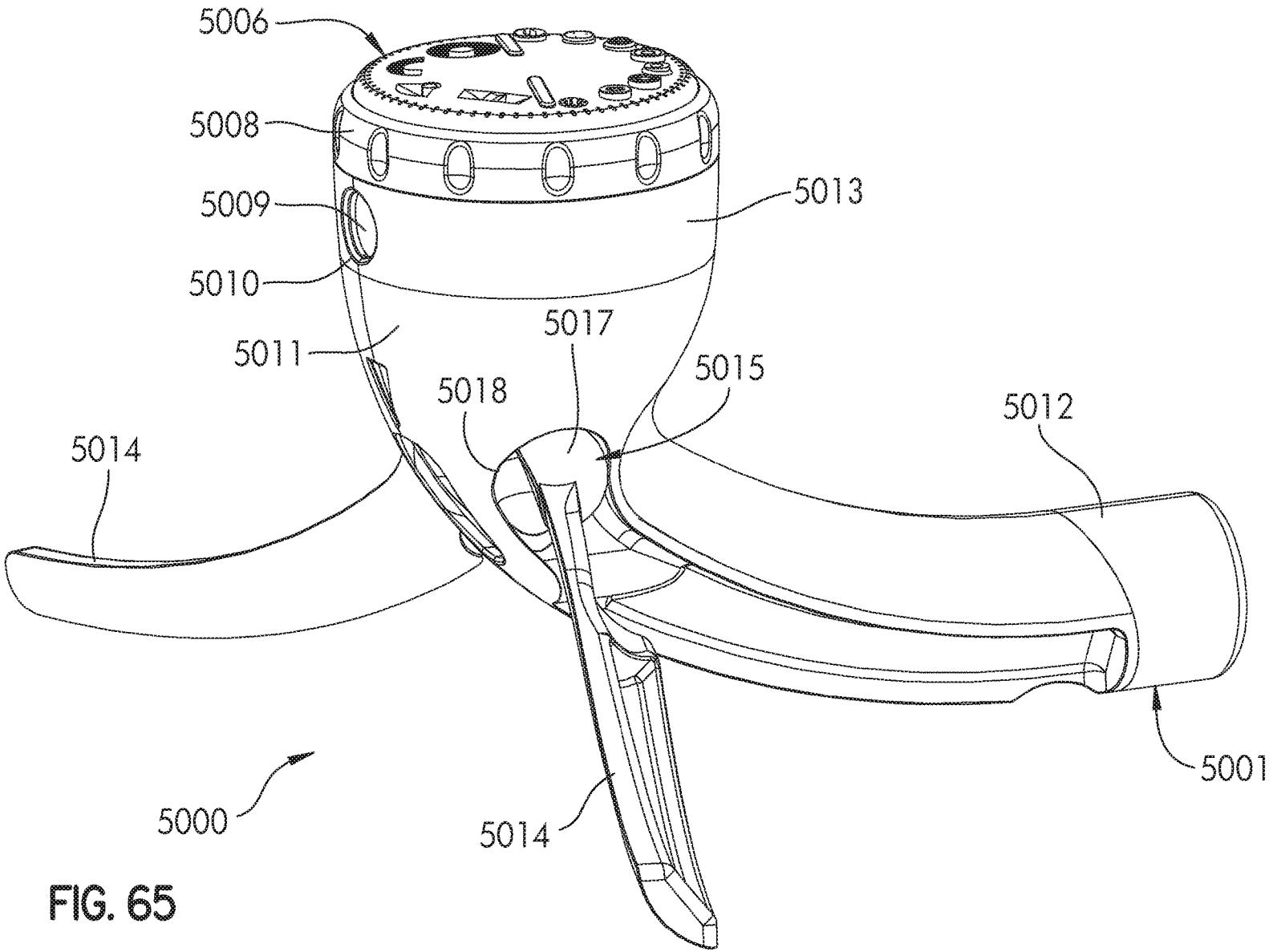
FIG. 65 is a perspective view of the garden watering device of FIG. 64, with the support structure rotated away from the main body for ground-based watering applications.
Figure 66:
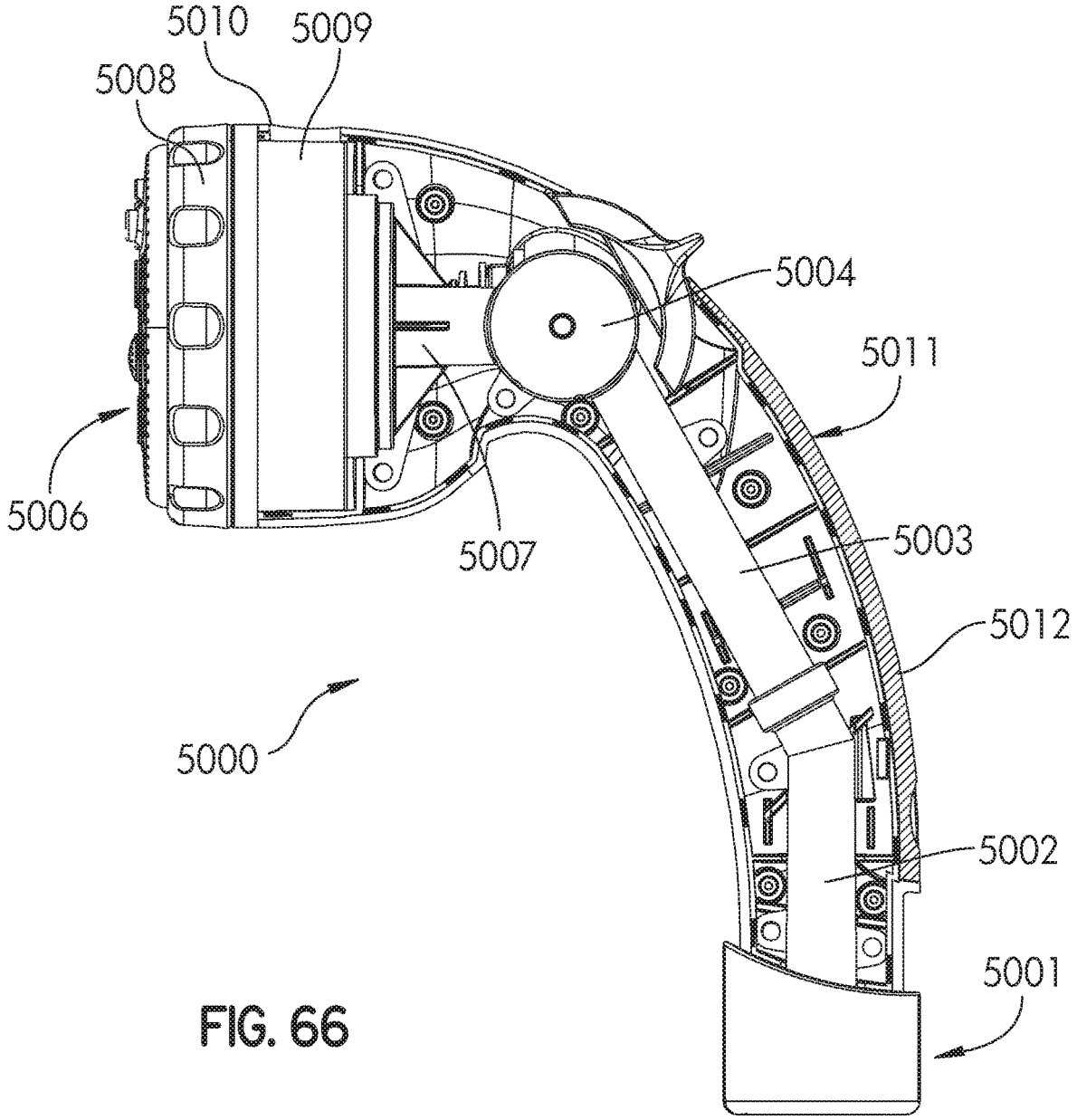
FIG. 66 is a partial cross-sectional view of the garden watering device of FIG. 64.
Figure 67:
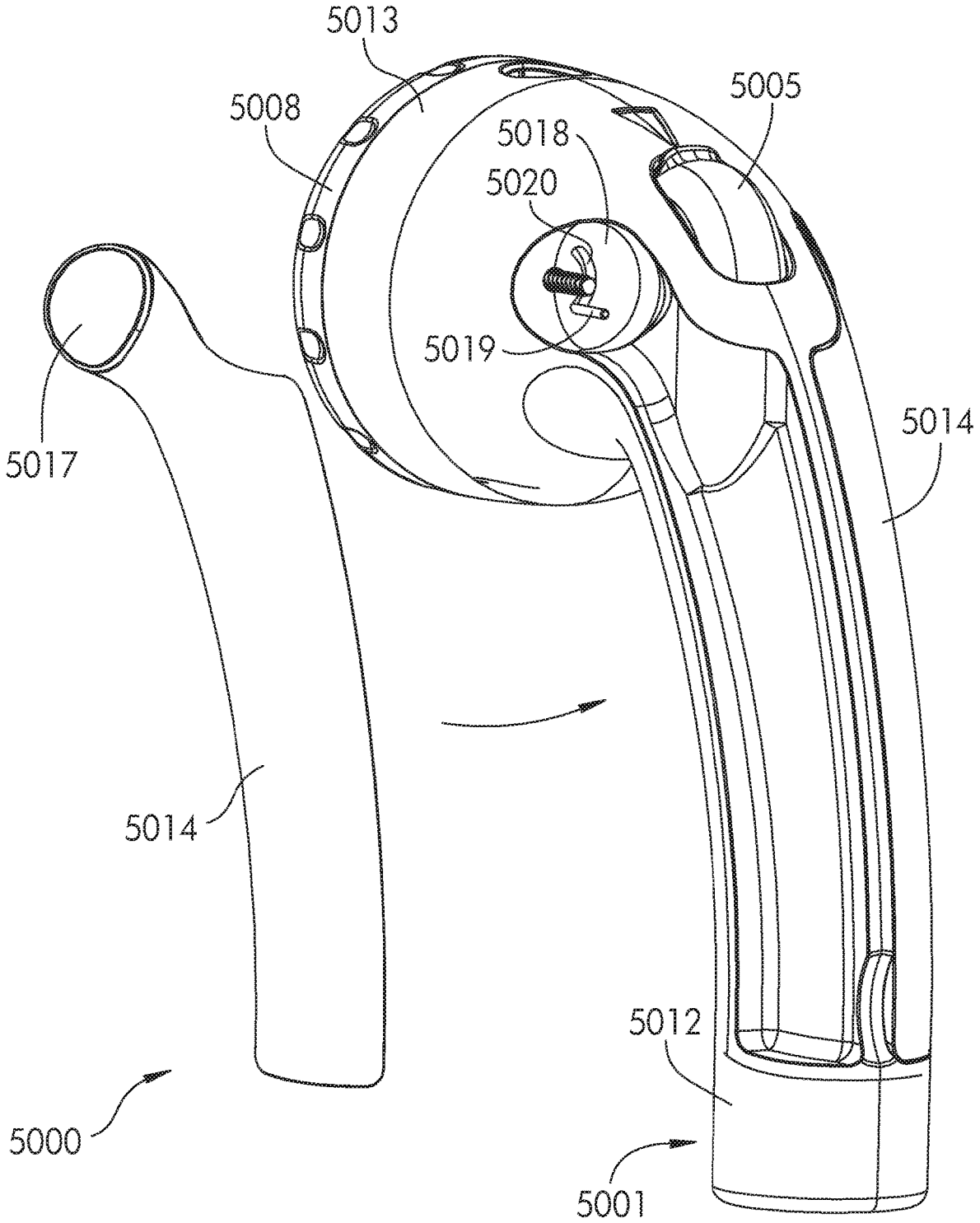
FIG. 67 is a partial disassembled perspective view of the garden watering device of FIG. 64, showing the support structure separated from the main body.

FIGS. 64-67 illustrate another embodiment of a garden watering device 5000. The garden watering device 5000 includes a body member 5012, a discharge head or pistol barrel 5013, and a support structure 5014. The support structure 5014 is coupled to the body member 5012 at a ball and socket-type joint 5015 that allows the support structure 5014 to rotate between a first position flush against the body member 5012 (for handheld operation) and a second position rotated and extending generally away from the body member 5012 (for ground-based operation). Advantageously, the support structure 5014 includes the ball portion of the ball and socket-type joint 5015, and the body member 5012 includes the socket portion, but the opposite is also possible. In the first position (shown in FIG. 64), the support structure 5014 is flush against and cooperates with the body member 5012 to form a generally monolithic handle 5016. Ribs or other surface details (such as a chamfered edge) on support structure 5014, or similar or corresponding surface structure on body member 5012, or combinations thereof, allow for a generally smooth handle 5016. As illustrated in FIGS. 65 and 67, the flush fitting of the support structure 5014 with the body member 5012 is the result of a recess within the body member 5012. In the second position (shown in FIG. 65), the support structure 5014 is rotated away from the body member 5012 and allows the garden watering device 5000 to function as a ground-based sprinkler on any type of ground surface, in a manner similar to what is described above and shown with respect to FIG. 37.

With reference to FIG. 67, the support structure 5014 includes a ball portion 5017 at a distal end thereof for mating with a socket portion 5018 formed in the body member 5012 to form the ball and socket-type joint 5015. The ball portion 5017 engages a pin 5019 that rides in a track 5020. Thereby, rotational movement of the support structure 5014 is defined and limited by the interaction between the pin 5019 and the track 5020. As the 5014 moves from the first position to the second position, the ball and socket-type joint 5015 provides for movement of the support structure 5014 along a generally arcuate path.

As shown in FIG. 66, the garden watering device 5000 includes a hose end 5001 that is in fluid communication with a lower flow path 5002, which in turn, is in fluid communication with an upper flow path 5003. Connected to the upper flow path 5003 is a control valve 5004 which is actuated by a trigger 5005. The control valve 5004 allows a user to selectively control the flow of water to a spray dial 5006, which is a multi-pattern spray head. The control valve 5004 is in turn in communication with an internal spray bowl 5007 which collects and conveys water to the spray dial 5006. An accent ring 5008 is located around the spray dial 5006 and offers an attractive and dedicated area by which the user can change the position and setting of the spray dial 5006. The dial setting is presented to the user by an indicia ring 5009, which provides indicia corresponding to a selected setting through an indicia window 5010. The indicia ring 5009 allows the user the ability to view and change the setting of the spray dial 5006 without being required to look at the face of the dial and to do so from a convenient operational position of the garden watering device 5000. The garden watering device 5000 generally includes a device housing 5011, for containing various components of the garden watering device 5000.

Figure 68:
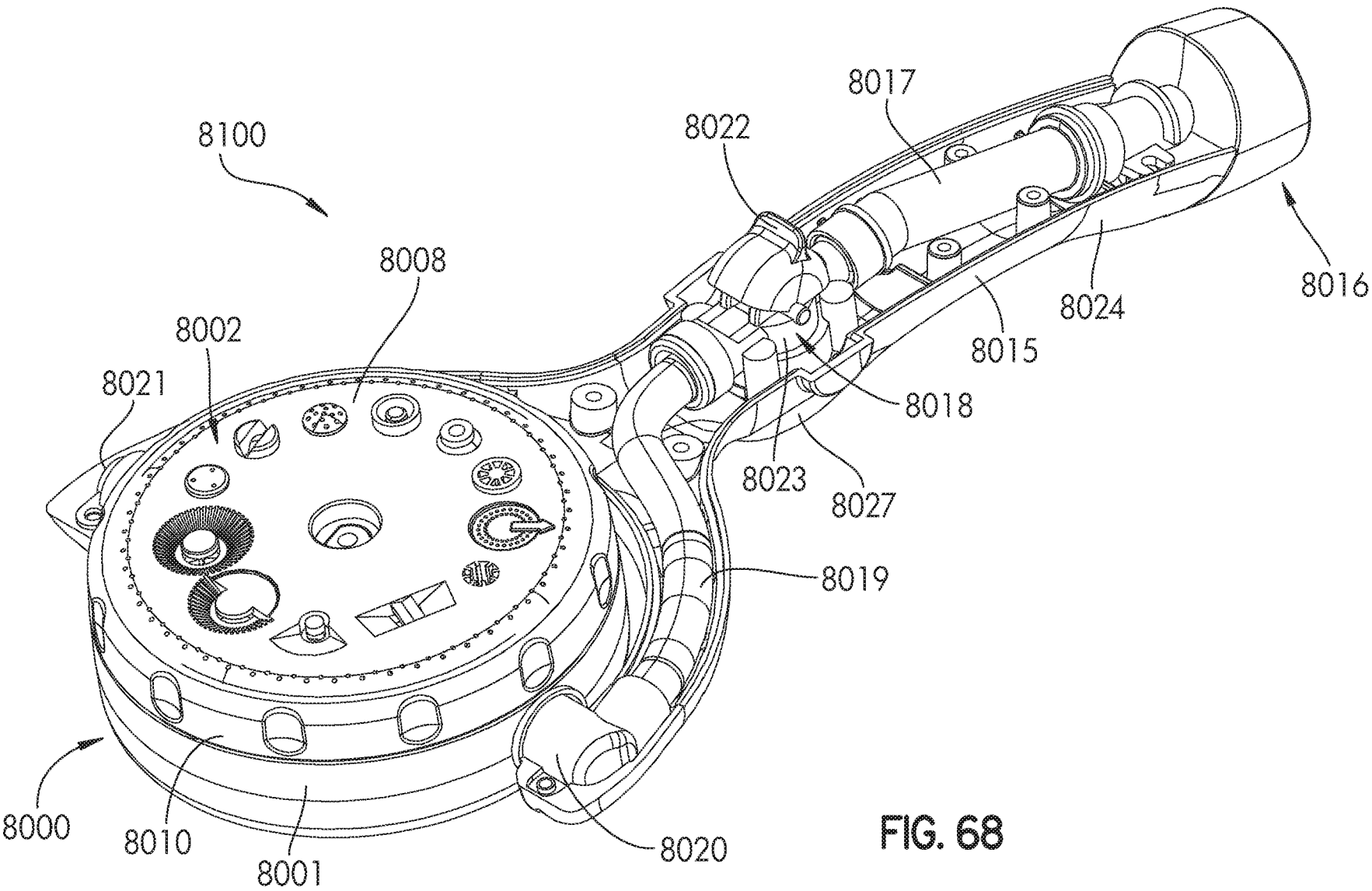
FIG. 68 is a partially disassembled perspective view of another embodiment of a garden watering device.
Figure 69:
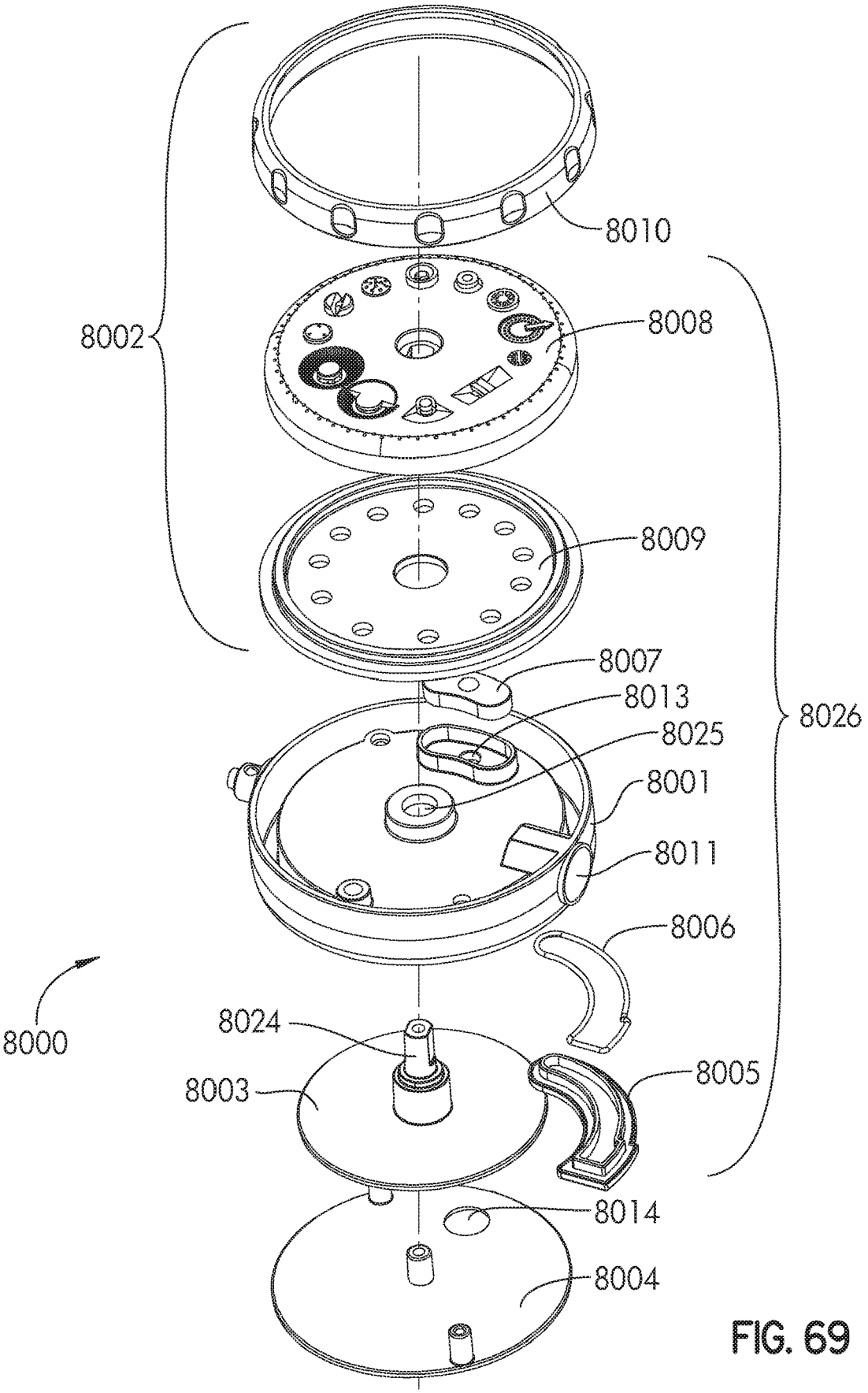
FIG. 69 is an exploded view showing spray head components of the garden watering device of FIG. 68.
Figure 70:
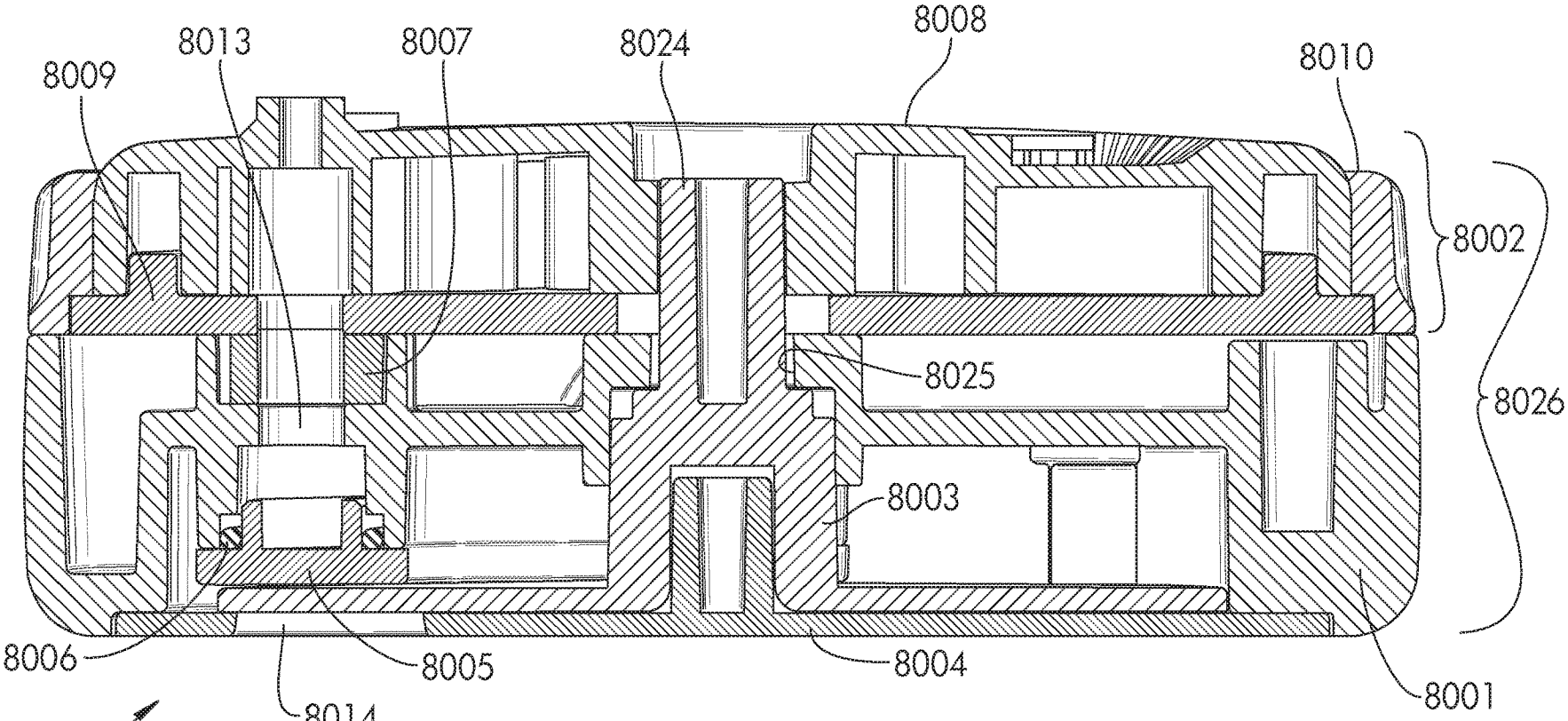
FIG. 70 is a cross sectional view of the spray head of the garden watering device of FIG. 68.
Figure 71:
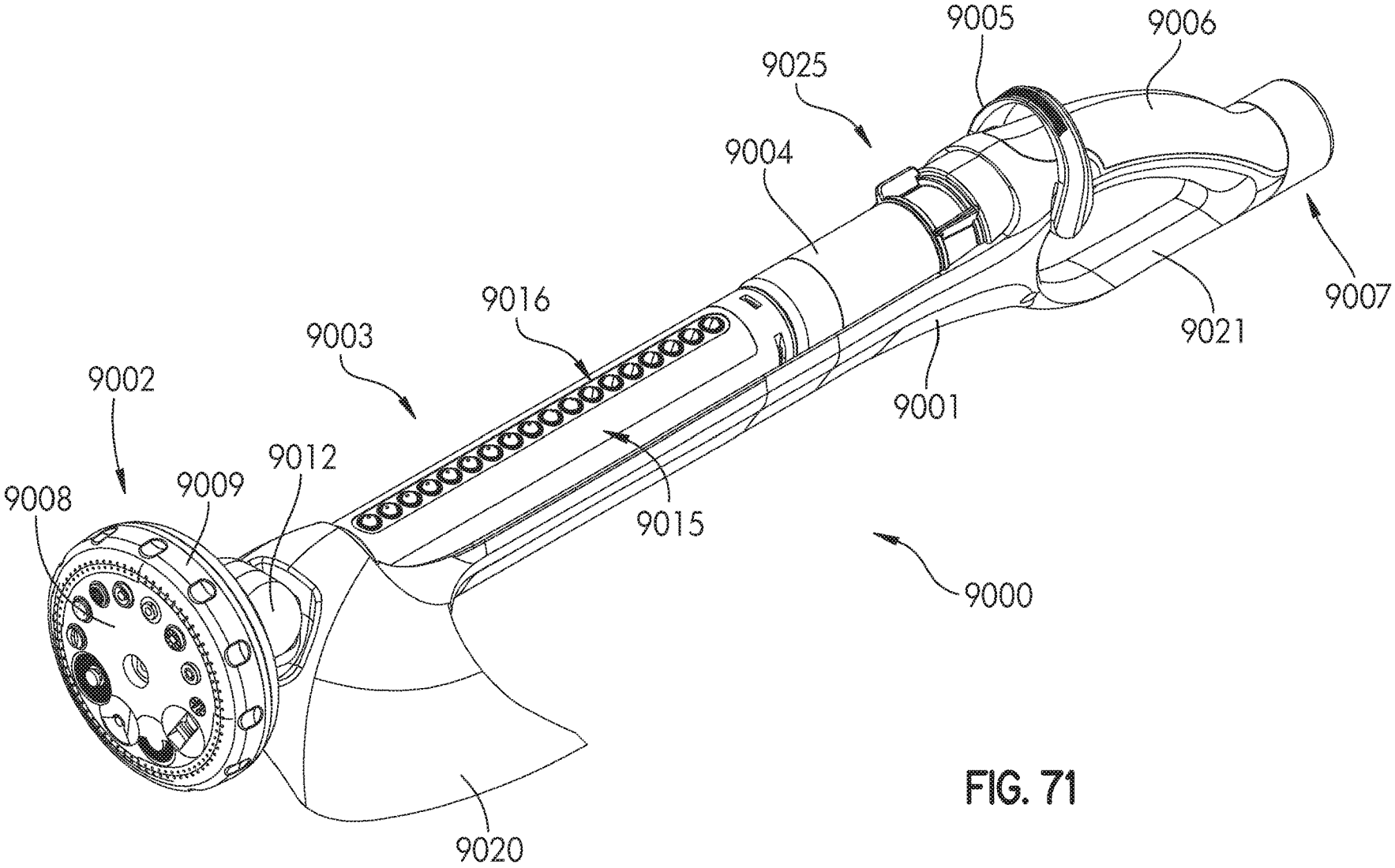
FIG. 71 is a perspective view of another embodiment of a garden watering device.
Figure 72:
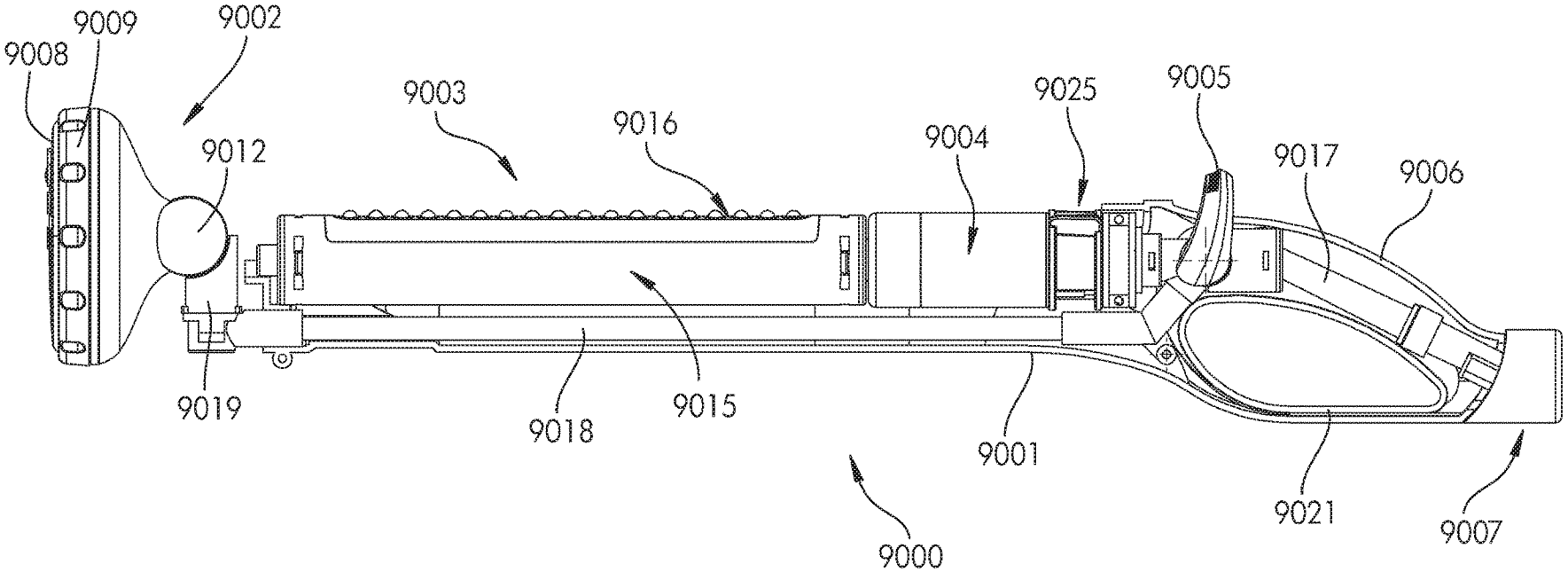
FIG. 72 is a partially disassembled side elevation view of the garden watering device of FIG. 71, with the support legs removed to show additional features.
Figure 73:
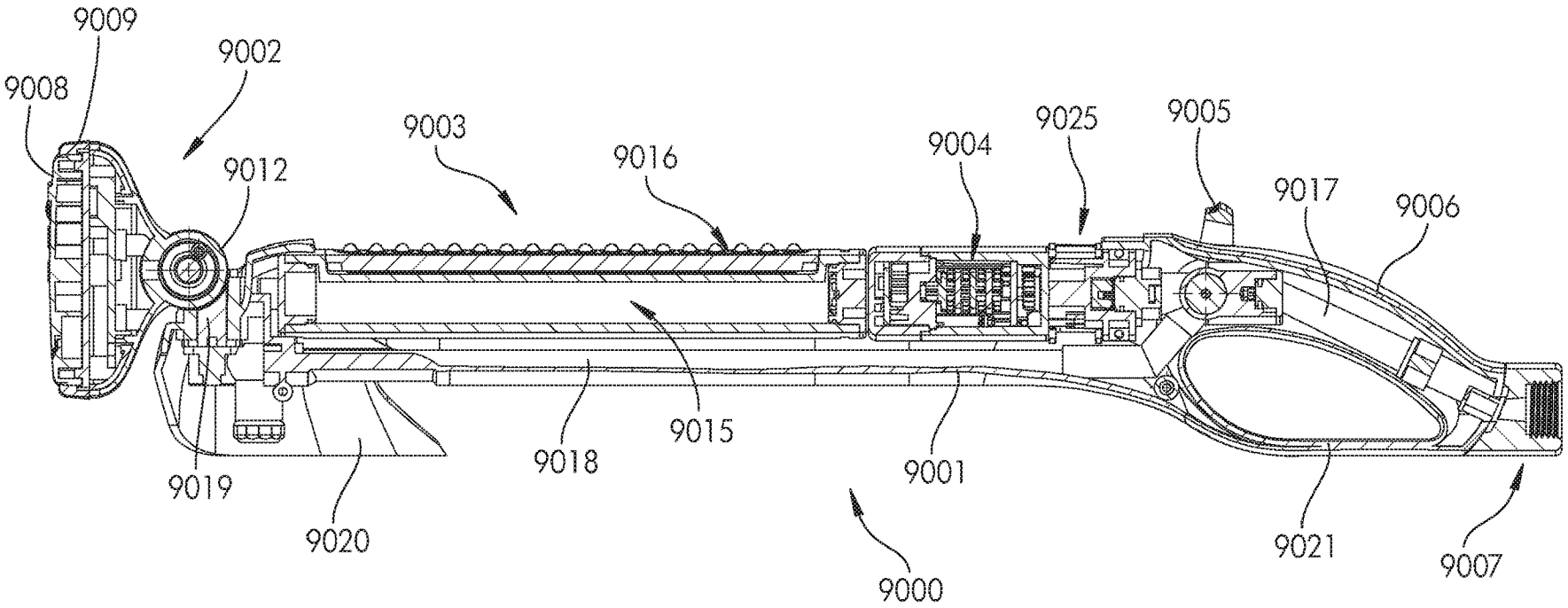
FIG. 73 is a longitudinal cross sectional view of the garden watering device of FIG. 71.
Figure 74:
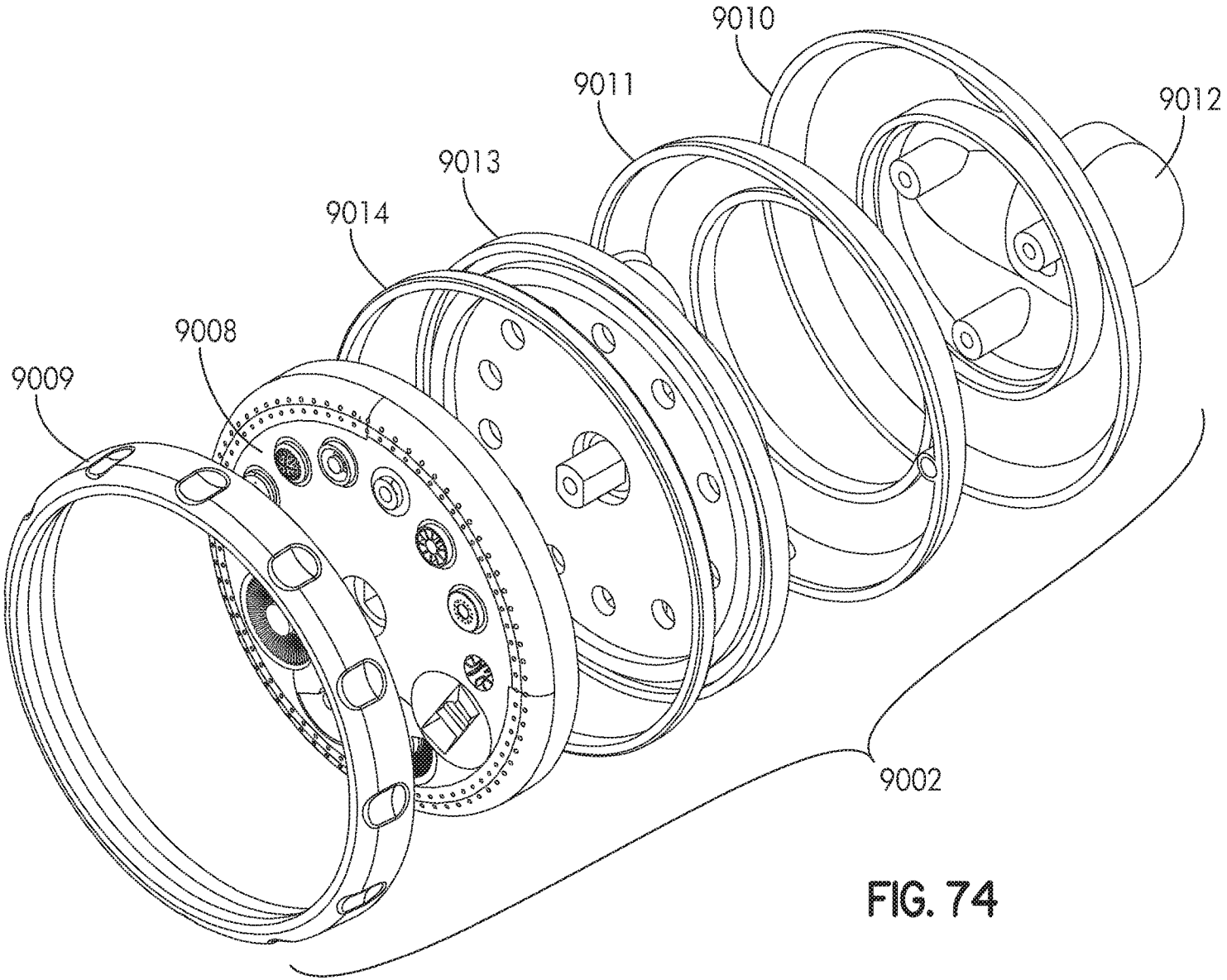
FIG. 74 is an exploded view showing spray head components of the garden watering device of FIG. 71.

FIGS. 68-70 illustrate another embodiment of a garden watering device 8100. The garden watering device 8100 contains a main housing 8015, a spray head 8000, a hose end 8016, a lower flow path 8017, a valve assembly 8018, an upper flow path 8019, a rotatable coupling 8020, a ratcheting mechanism 8021, and a handle portion 8024. The rotatable coupling provides a rotatable coupling for the spray head 8000 and a passageway therethrough for the water to flow to the spray head 8000. Water flows into the garden watering device 8100 through the hose end 8016 into the lower flow path 8017 up to the valve assembly 8018 and then, selectively, into the upper flow path 8019. The water then flows past the rotatable coupling 8020 and into a dial assembly 8002 and out a spray dial 8008. The valve assembly 8018 includes a trigger 8022 that allows a user to selectively control the flow of water to the spray head 8000 and a valve body 8023. The spray head 8000 is rotatably coupled to the main housing 8015 by the rotatable coupling 8020 such that it can be rotated relative to the main housing 8015 while maintaining fluid communication with the upper flow path 8019. The angle of the spray head 8000 relative to the main housing 8015 is maintained by the ratcheting mechanism 8021, and is configured such that the user can adjust the angle manually, with the ratcheting mechanism 8021 generally preventing unintentional adjustment of the spray head 8000. Advantageously, the spray head 8000 is capable of spraying water over a wide range of angles with respect to the main housing 8015. Additionally, in the embodiment shown the main housing 8015 does not encircle the spray head 8000 so as to not interfere with water spraying therefrom.

The spray head 8000 includes a main body 8001, a dial assembly 8002, an indicia dial 8003, a housing cover 8004, a flow channel cover 8005, a flow channel gasket 8006, and a dial gasket 8007. The dial assembly 8002 includes spray dial 8008, a dial backer plate 8009, and an accent ring 8010. The spray dial 8008 and dial backer plate 8009 are connected in such a way as to form a water tight union between the two. The water flows in to the spray head 8000 via an inlet hole 8011, through an internal flow channel 8012, up to a main body outlet hole 8013, through the dial gasket 8007, to the dial assembly 8002, through the dial backer plate 8009, into, and then out of, the spray dial 8008. The dial gasket 8007 ensures a substantially watertight connection between the main body outlet hole 8013 and the dial backer plate 8009. The internal flow channel 8012 is enclosed by a flow channel cover 8005, with the flow channel gasket 8006 being positioned between the two parts to help ensure a water tight fit. A tang 8024 of the indicia dial 8003 is inserted through the main body 8001 and into the dial assembly 8002, such that the dial assembly 8002 and the indicia dial 8003 turn in unison. The indicia dial 8003 includes graphics or other indicia that present to the user the selected outlet on the spray dial 8008 in a position that is more easily viewed by the user when the sprinkler is in use. The housing cover 8004 encloses the indicia dial 8003 and the bottom of the spray head 8000 to protect and selectively obscure the user's view of the indicia on the dial 8003 that do not correspond with the dial's selected setting. The unobscured portion of the indicia dial 8003 (corresponding with the dial's selected setting) is viewable through the housing cover 8004 through an indicia window 8014.

As shown in FIGS. 69 and 70, a dial-indicia assembly 8026 includes the spray dial 8008, the indicia dial 8003, the main body 8001, and the dial backer plate 8009. The spray dial 8008 is connected to the indicia dial 8003 through the tang 8024 that extends from the indicia dial 8003 through a hole 8025 formed within the main body 8001 through the backer plate 8009 and into the spray dial 8008. The tang 8024 is indexed with the dial 8003 to allow both the spray dial 8008 and the indicia dial 8003 to turn in unison. The hole 8025 allows for free rotation of both the spray dial 8008 and the indicia dial 8003. The internal flow channel 8012 extends along a curved path within the main body 8001, which main body 8001 is configured so that the flow path 8012 is not compromised or interrupted by the dial-indicia assembly 8026. Since the flow path 8012 is not compromised by the tang 8024, little to no additional sealing structures are needed around the tang 8024 to form a water tight union between the tang 8024 and the hole 8025.

Advantageously, the main housing 8015 includes a bulge 8027 generally in the vicinity of the valve assembly 8018, and generally near a region of the handle portion 8024 away from the hose end 8016. The bulge 8027 is generally opposite the valve assembly trigger 8022, and serves as a finger-locating structure so that a user can solidly grip the handle portion 8024 and engage the trigger 8022. As used herein, the term "bulge" generally refers to the rounded swelling portion that extends outward from the otherwise generally consistent shape of the handle portion 8024, as indicated at 8027. The bulge 8027 may generally correspond with the increased space requirements of the valve assembly 8018.

During ground-based operation, a tripedal support is provided for the watering device 8100 generally by the handle portion 8024, the bulge 8027, and the spray head 8000 or components of the main housing 8015 that support the spray head 8000. Thus, the size and shape of the bulge 8027 should be taken with the ground-based operation of the watering device 8100 in mind, and the size and shape should be chosen to provide an appropriate support of the watering device 8100.

FIGS. 71-74 illustrate another embodiment of a garden watering device 9000. The garden watering device 9000 includes a main housing 9001, a spray head assembly 9002, an oscillating bar assembly 9003, a water motor 9004, a control valve 9005, a handle portion 9006, and a hose end 9007. The spray head assembly 9002 includes a spray dial 9008, an accent ring 9009, a spray bowl 9010, an indicia ring 9011, a ratcheting mechanism 9012, a dial backer plate 9013, and a decoration ring 9014. The oscillating bar assembly 9003 includes an oscillating bar 9015 and a spray strip 9016. In a first mode of operation, water is routed from the hose end 9007 into a lower flow path 9017, through the control valve 9005 and water motor 9004, and into the oscillating bar 9015 and out the spray strip 9016. In a second mode of operation, water is routed from the hose end 9007 into the lower flow path 9017, through the control valve 9005, and into the bypass flow path 9018. The water is then ducted up to the ratcheting mechanism 9012 through a passageway 9019, into the spray head assembly 9002, and out the spray dial 9008. A stop tab assembly 9025 is incorporated into the garden watering device 9000 and allows a user to control the angle of rotation of the oscillating bar assembly 9003.

The garden watering device 9000 is configured to operate in both handheld and ground based operation modes. In handheld operation, the user holds the garden watering device 9000 primarily by the handle portion 9006. In ground based operation the garden watering device 9000 rests on the ground by means of a generally tripedal support structure composed of support legs 9020 and the rear support surface 9021. Advantageously, the spray head assembly 9002 can be rotated with respect to the main housing 9001 so as to nest between the support legs 9020. Such nesting reduces the overall dimensions of the watering device 9000 and protects the spray head assembly 9002, which are advantages for packaging, shipping, and for storage. While the present invention has been illustrated by a description of various preferred embodiments and while these embodiments have been described in some detail, it is not the intention of the Applicant to restrict or in any way limit the scope of the appended claims to such detail. Additional advantages and modifications will readily appear to those skilled in the art. The various features of the invention may be used alone or in numerous combinations depending on the needs and preferences of the user.

What is claimed is:

1. A garden watering device for use in handheld or ground-based operation, comprising:

a device body including a water inlet and forming a support structure for ground-based operation, the device body including a plurality of water flow channels formed therein;

a water inlet communicating with the flow channels for directing water from a source to at least one of the flow channels;

a flow route selector configured to selectively route water from the water inlet to at least one of the flow channels;

a first water distribution member coupled with at least one of the flow channels and including an elongate tube with a series of discharge outlets;

at least one a second water distribution member coupled with at least one of the flow channels and positioned at an end of the device body, the second water distribution member including a multi-pattern head adapted to spray water in multiple patterns;

the multi-pattern head being pivotally coupled with the device body for being pivoted downwardly for handheld operation and pivoted upwardly for ground-based operation; and a handle at least partially integrated with the support structure coupled at an end of the device body opposite to the multi-pattern head for being gripped in handheld operation.

2. The garden watering device of claim 1, wherein the handle is integral with the support structure of the body.

3. The garden watering device of claim 1, wherein a portion of the handle contacts the ground to support the device body and at least one water distribution members in ground-based operation.

4. The garden watering device of claim 1, wherein the flow selector includes a three-way valve within the device body.

5. The garden watering device of claim 1, wherein the flow route selector is movable to a position wherein water is not delivered to the first water distribution member or the second water distribution member.

6. The garden watering device of claim 1, wherein the series of discharge outlets are generally linear.

7. The garden watering device of claim 1, further comprising:

an oscillation device configured to rotate the elongate tube.

8. The garden watering device of claim 7, wherein the oscillation device includes a paddlewheel configured to be driven by water passing through the oscillation device to thereby rotate an output shaft.

9. The garden watering device of claim 8, wherein the output shaft is selectively coupled to the elongate tube to rotate the elongate tube.

10. The garden watering device of claim 7, wherein the oscillation device is disposed between the elongate tube and the handle.

11. The garden watering device of claim 1 wherein the device body includes at least one leg positioned proximate an end of the device body opposite the handle for forming part of the support structure.

12. The garden watering device of claim 1 wherein the water inlet is positioned on the device body proximate to handle.

* * * * *